US005099740A

United States Patent [19]

Minamitaka

[11] Patent Number: 5,099,740

[45] Date of Patent: * Mar. 31, 1992

[54] AUTOMATIC COMPOSER FOR FORMING RHYTHM PATTERNS AND ENTIRE MUSICAL PIECES

[75] Inventor: Junichi Minamitaka, Tokyo, Japan

[73] Assignee: Casio Computer Co., Ltd., Tokyo, Japan

[ * ] Notice: The portion of the term of this patent subsequent to May 22, 2007 has been disclaimed.

[21] Appl. No.: 447,581

[22] Filed: Dec. 7, 1989

Related U.S. Application Data

[62] Division of Ser. No. 177,592, Apr. 4, 1988, Pat. No. 4,926,737.

[30] Foreign Application Priority Data

| | | | |
|---|---|---|---|
| Apr. 8, 1987 | [JP] | Japan | 62-86571 |
| May 20, 1987 | [JP] | Japan | 62-121037 |
| Jun. 12, 1987 | [JP] | Japan | 62-145405 |
| Jun. 15, 1987 | [JP] | Japan | 62-146963 |

[51] Int. Cl.[5] ..... G10H 1/38; G10H 1/40

[52] U.S. Cl. ..... 84/651; 84/DIG. 12; 84/DIG. 24

[58] Field of Search ..... 84/609–614, 84/634–638, 650–652, 666–669, DIG. 12, DIG. 22

[56] References Cited

U.S. PATENT DOCUMENTS

| | | |
|---|---|---|
| 3,889,568 | 6/1975 | Amaya . |
| 3,972,258 | 8/1976 | Adachi . |
| 4,181,059 | 1/1980 | Weber . |
| 4,305,319 | 12/1981 | Linn . |
| 4,399,731 | 8/1983 | Aoki . |
| 4,539,882 | 9/1985 | Yuzama . |
| 4,587,878 | 5/1986 | Nakada et al. . |
| 4,633,748 | 1/1987 | Takashima et al. . |
| 4,633,751 | 1/1987 | Fukaya et al. . |
| 4,664,010 | 5/1987 | Sestero . |
| 4,704,933 | 11/1987 | Kurakake . |
| 4,771,671 | 9/1988 | Hoff, Sr. . |

FOREIGN PATENT DOCUMENTS

| | | |
|---|---|---|
| 58-87593 | 5/1983 | Japan . |
| 62-187876 | 8/1987 | Japan . |
| WO86/05616 | 9/1986 | World Int. Prop. O. . |

*Primary Examiner*—Stanley J. Witkowski

*Attorney, Agent, or Firm*—Frishauf, Holtz, Goodman & Woodward

[57] ABSTRACT

A automatic composer automatically forms a rhythm pattern. Reference rhythm patterns representing a sequence of a plurality of tone durations are generated, and a pulse scale source provides a pulse scale of pulse points having weights for joining or disjoining tone durations, depending on their positions. The reference rhythm pattern is modified by executing one of joining or disjoining tone durations in accordance with the pulse scale. Also disclosed is an automatic composer for composing an entire musical piece, wherein featuring parameters are extracted from an inputted portion of a musical piece, and an entire musical piece is composed in accordance with at least the extracted featuring parameters. According to a preferred arrangement, the featuring parameters are extracted in accordance with at least one of a sequence of tone pitches and a sequence of tone durations, the sequences defining the inputted portion of the musical piece.

7 Claims, 112 Drawing Sheets

OVERALL ARRANGEMENT

AUTOMATIC COMPOSING FUNCTION

INTEGERS FOR WHITE KEYS ONLY

SUCCESSIVE INTEGERS (1) MOTIF DATA: MDi: $MD_1=1$, $MD_2=5$, $MD_3=6$, $MD_4=8$, $MD_5=13$

Rhyli: $Rhyl_1=4$, $Rhyl_2=2$, $Rhyl_3=2$, $Rhyl_4=4$, $Rhyl_5=4$

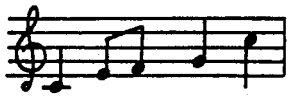

(2) CHORD MEMBER MEMORY:

| ADDRESS | DATA |
|---|---|
| 1 | 1, 5, 8, 13 (do, mi, sol, do: Cmaj) |
| 25 | 1, 6, 10, 13 (do, fa, la, do: Fmaj) |
| 29 | 3, 6, 8, 12 (re, fa, sol, ti: G7) |

(3) CHORD PROGRESSION MEMORY: CNi: $CN_1=1$, $CN_2=7$, $CN_3=8$, $CN_4=1$
(Cmaj) (Fmaj) (G7) (Cmaj)

(4) PARAMETER FORMULAE: (INCLUDING PARAMETERS B)

PC1i: WHETHER TO CORRECT LLi (i IS MEASURE NUMBER)

$PC1i = [+\cos\{(i+2) \times 2\pi/2\}] \times 1 + 0$

PC2i: NUMBER $PC2i = [+\cos\{(i+2) \times 2\pi/4\}] \times 2 + PA_2$

PC3i: WEIGHT OF APPOGGIATURA $PC3i = [-\cos\{(i+2) \times 2\pi/2\}] \times 1 + PA_3$ PC4i: LOCATION OF APPOGGIATURA $PC4i = 1$ PC5i: UPWARD/DOWNWARD MOTION $PC5i = [-\cos\{(i+2) \times 2\pi/4\}] \times 2$ PC6i: WEIGHT OF PASSING $PC6i = [+\cos\{(i+2) \times 2\pi/4\}] \times 2 + PA_4$ PC7i: INVERSION PARAMETER $PC7i = [+\cos\{(i+2) \times 2\pi/4\}] \times 1 + 1$

FIG. 4

EXAMPLES OF INPUT DATA (INPUT) Fmaj G7 Cmaj (BEFORE CORRECTION)

(CORRECTED)

< MELODY >

MDi (i = 1 ~ No 1): MOTIF PITCH DATA

MEDi (i = 1 ~ No): MELODY PITCH DATA (TEMPORARI LLY STORED WHEN GENERATED FOR EACH MEASURE)

MELDi (i = 1 ~ MNo): MELODY PITCH DATA (FINALLY STORED IN MELODY DATA MEMORY)

LLi: ARPEGGIO PATTERN DATA

Rhyli (i = 1 ~ No 1): MOTIF TONE DURATION DATA

Rhyi (i = 1 ~ No): MELODY TONE DURATION DATA

HDi (i = 1 ~ No 1): DATA FOR NONHARMONIC TONE DETERMINATION

< CHORD >

CNi (i = 1 ~ CNo): CHORD NUMBER DATA

KDi (i = 1 ~ 4): CHORD MEMBER DATA

< PARAMETER >

PAi, PBi, PCi: PARAMETERS FOR MELODY GENERATION

EDA, EDB, EDC: CORRECTED DATA

< MISCELLANEOUS >

ONPU: NUMBER OF PITCHS IN SYSTEM (e.g. ONPU = 61 FOR $C_2$ ~ $C_7$)

ri: VARIABLE FOR RANDOMIZATION $RND_{(x)}$: RANDOM FUNTION GENERATING AT RANDOM INTEGERS WITH UPPER LIMIT OF X

FIG. 6

EXTRACT NONHARMONIC TONES

EXTRACT ANTICIPATION
(DETAILS OF 7-4 IN FIG. 7)

EXTRACT APPOGGIATURA
(DETAILS OF 7-5 IN FIG. 7)

EXTRACT NEIGHBOR
(DETAILS OF 7-6 IN FIG. 7)

EXTRACT PASSING
(DETAILS OF 7-7 IN FIG. 7)

EXTRACT AUXILIARY
(DETAILS OF 7-8 IN FIG. 7)

EXTRACT AND COMPUTE PARAMETERS

LOAD HDi WITH RESPECTIVE TYPES OF NONHARMONIC TONES (DETAILS OF 13-1 IN FIG. 13)

NUMBERS OF RESPECTIVE TYPES OF NONHARMONIC TONES
(DETAILS OF 13-2 IN FIG. 13)

NUMBER OF NONHARMONIC AND HARMONIC TONES PA7~9
(DETAILS OF 13-3 IN FIG. 13)

SMOOTHNESS PARAMETER PA10
(DETAILS OF 13-5 IN FIG. 13)

EXAMPLE OF PARAMETER MAPPING

VALUE

SINE TYPE 1
DIRECTION OF
MELODY PROGRESSION
(MEASURE NUMBER)

SINE TYPE 2

MODULUS
(CYCLIC PEAKS)

DC
DEVELOPMENT

SEGMENT
DEPENDENT

CYCLIC RAMPS
1
RETURN TO 1

NONCOMPUTATIO-
NAL

EXAMPLE OF PC CHARACTERISTIC (NOT RANDOMIZED)

EXAMPLE 1 OF RANDOM CHARACTERISTIC

RANDOMIZED

EXAMPLE 2 OF RAMDOM CHARACTERISTIC

RANDOMIZED

1. $PC_2$: NUMBER OF ARPEGGIO TONES TO BE GENERATED $$PC_{2i} = [+\cos\ (i+2) \times 2 \times \pi / \underline{PBf_2}\ ] \times \underline{PBa_2} + \underline{PBd_2} + PA_8$$

2. $PC_8$: SMOOTHNESS PARAMETER $$PC_{8i} = [-\cos\ (i+2) \times 2 \times \pi / \underline{PBf_8}\ ] \times \underline{PBa_8} + \underline{PBd_8} + PA_{10}$$

FIG. 22A

EXAMPLES OF PARAMETER COMPUTATION

| No | $PA_8$ | $PBf_2$ | $PBa_2$ | $PBd_2$ \ i | 1 | 2 | 3 | 4 | 5 |
|---|---|---|---|---|---|---|---|---|---|
| 1 | 0 | 4 | 1 | 0 | 0 | 1 | 0 | −1 | 0 |
| 2 | 0 | 4 | 1 | 1 | 1 | 2 | 1 | 0 | 1 |
| 3 | 1 | 4 | 1 | 0 | 1 | 2 | 1 | 0 | 1 |
| 4 | 0 | 4 | 2 | 0 | 0 | 2 | 0 | −2 | 0 |
| 5 | 0 | 2 | 1 | 0 | −1 | 1 | −1 | 1 | −1 |
| 6 | 0 | * | 0 | 0 | 0 | 0 | 0 | 0 | 0 |

FIG. 22B

EXAMPLE OF PC2

GENERATE MELODY

READ OUT CHORD MEMBERS
(DETAIL OF 24-1 IN FIG. 24)

2 CHORD MEMBER MEMORY

| ADDRESS | DATA | |
|---|---|---|
| 1 | 1 | |
| 2 | 5 | (Cmaj) |
| 3 | 8 | |
| 4 | 13 | |
| 5 | 1 | |
| ⋮ | 5 | (C7) |
| | 8 | |
| | 11 | |
| 9 | 3 | |
| ⋮ | 6 | (Dm) |
| | 10 | |
| | 15 | |
| | ⋮ | |

FIG. 26 (a)

3 CHORD PROGRESSION MEMORY

| ADDRESS | DATA | |
|---|---|---|
| 1 | 1 | (Cmaj) |
| 2 | 7 | (Fmaj) |
| 3 | 8 | (G7) |
| 4 | 1 | (Cmaj) |
| 5 | EOF | |

FIG. 26 (b)

INVERSION OF CHORD MEMBERS
(DETAILS OF 24-2 IN FIG. 24)

DETERMINE MEDj FROM PRECEDING TONE
(DETAILS OF 24-12 IN FIG. 24)

IMPART APPOGGIATURA

IMPART PASSING

IMPART NEIGHBOR

IMPART AUXILIARY

CORRECT TONE DURATIONS

| DATA | ADDRESS |
|---|---|
| EDA | 0 |
| EDB | 1 |
| EDC | 2 |
| EDA | 3 |
| EDB | 4 |
| EDC | 5 ← P |

9 LEARNED DATA MEMORY

CORRECT PARAMETER BY LEARNING

OVERALL ARRANGEMENT

AUTOMATIC COMPOSING FUNCTION

GENERAL FLOWCHART

< MELODY >

| | |
|---|---|
| MDi | MOTIF PITCH DATA |
| MRi | MOTIF TONE DURATION DATA |
| MEDi | MELODY PITCH DATA (TEMPORARILY STORED WHEN GENERATED) |
| MERi | MELODY TONE DURATION DATA (TEMPORARILY STORED WHEN GENERATED) |
| MDi | RESPECTIVE TYPES OF NONHARMONIC TONES ID DATA AT MOTIF EVALUATION |
| MRi | RESPECTIVE TYPES OF FEATURING PHYTHMS ID DATA AT MOTIF EVALUATION |
| MELDi | MELODY PITCH DATA |
| MELRi | MELODY TONE DURATION DATA |
| LLi | ARPEGGIO PATTERN |
| RHi | PATTERN OF DURATIONS OF HARMONIC TONES OF MOTIF |

< CHORD >

| | |
|---|---|
| CNi | CHORD NUMBER DATA |
| KDi | CHORD MEMBER DATA |
| R | PITCH DATA OF CHORD ROOT |
| SBi | MUSIC FORM ID DATA |

< PARAMETER >

| | |
|---|---|
| PC | MELODY FEATURING PARAMETER |
| PB | PC MODIFYING PARAMETER (CONTROL COSISTENCY AND VARIETY) |
| PA | MOTIF FEATURING PARAMETER |

< MISCELLANEOUS >

| | |
|---|---|
| EDA | MEASURE FOR CORRECTION |
| EDB | TYPE OF PARAMETER FOR CORRECTION |
| EDC | CORRECTED DATA |
| ONPU | NUMBER OF PITCHS IN SYSTEM (e.g. ONPU=61 FOR $C_2 \sim C_7$) |
| RND | RANDOM FUNCTION |

< LOCAL PARAMETER >

$a_1, a_2, a_3 \cdots$, SUM, SUMB, $f\ell$, ----

FIG. 40

LIST OF MAIN VARIABLES

PC NUMBER OF TONES WITHIN MEASURE IN PROCESS OF GENERATION

< ARPEGGIO >

$PC_{1,1}$ CONTROL WEIGHT OF SCALE TONE $PC_{1,2}$ SMOOTHNESS $PC_{1,3}$ MAXIMUM LENGTH OF REPEATED ARPEGGIO PATTERN, ALSO CORRESPONDING TO THE NUMBER OF HARMONIC TONES OF MOTIF $PC_{1,4}$ MINIMUM LENGTH OF REPEATED ARPEGGIO PATTERN $PC_{1,5}$ WHETHER TO DETERMINE TONE FROM THE LAST TONE OF THE PRECEDING MEASURE $PC_{1,6}$ ALLOW OR INHIBIT SAME PITCH MOTION (USING $PC_{1,2}$ AS UPPER LIMIT AND $PC_{1,6}$ AS LOWER LIMIT)

$PC_{1,7}$ NUMBER OF INVERSIONS $PC_{1,9}$ CONTROL SKIP MOTION, 0: INHIBIT, 1: ALLOW ONLY ONCE, 2: INHIBIT SUCCESSION, 3: NO RESTRICTION $PC_{1,10}$ ADJUST OPTIMAL NUMBER OF INVERSIONS $PC_{1,11}$ UPPER LIMIT FOR CALCULATION OF OPTIMAL NUMBER OF INVERSIONS $PC_{1,12}$ CHOOSE EITHER CALCULATED OPTIMAL NUMBER OF INVERSIONS OR VALUE OF $PC_{1,7}$ $PC_{1,13}$ WHETHER TO PRODUCE COMPLEMENTARY ARPEGGIO PATTERN $PC_{1,14}$ WHETHER TO SHIFT ROOT

<APPOGGIATURA>

$PC_{2,1}$ CONTROL WEIGHT OF SCALE TONE $PC_{2,2}$ WEIGHT OF APPOGGIATURA $PC_{2,3}$ LOCATION OF APPOGGIATURA $PC_{2,4}$ UPWARD/DOWNWARD ( ↗ , ↘ )

$PC_{2,7}$ LIMIT MINIMUM TONE DURATION

< PASSING >

$PC_{3,4}$ DEGREE OF SKIP MAKING IT EASIER FOR PASSING TO FOLLOW $PC_{3,2}$ WEIGHT OF PASSING $PC_{3,3}$ LIMIT MINIMUM TONE DURATION $PC_{3,1}$ WEIGHT OF SCALE TONE

< NEIGHBOR >

$PC_{4,1}$ WEIGHT OF SCALE TONE $PC_{4,2}$ UPWARD/DOWNWARD ( ∨ , ∧ )

$PC_{4,4}$ CONTROL NEIBOR IMPARTION, 0: INHIBIT,
1: ALLOW ONLY ONCE,
2: INHIBIT SUCCESSION,
3: NO RESTRICTION

< ESCAPE >

$PC_{5,1}$ WEIGHT OF SCALE TONE $PC_{5,2}$ WHETHER TO IMPART $PC_{5,3}$ UPWARD/DOWNWARD FOR NEIGHBOR TYPE ESCAPE (↗↖, ↘↙)

< FEATURING RHYTHM >

$PC_{6,1}$ 0: INHIBIT, 1: ALLOW ONLY ONCE
2: INHIBIT SUCCESSION, 3: NO RESTRICTION

< REST (BREATH) >

$PC_{9,1}$ WEIGHTER TO IMPART

FIG. 41

LIST OF PARAMETERS C

MOTIF DATA $MD_1=1$, $MD_2=5$, $MD_3=6$, $MD_4=8$, $MD_5=13$
$MR_1=4$, $MR_2=2$, $MR_3=2$, $MR_4=4$, $MR_5=4$

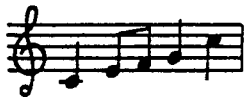

CHORD MEMBER DATA

| ADDRESS | | | |
|---|---|---|---|
| 1 | 1, 5, 8, 13 | (do, mi, sol, do | Cmaj) |
| 25 | 1, 6, 10, 13 | (do, fa, la, do | Fmaj) |
| 29 | 3, 6, 8, 12 | (re, fa, sol, ti | $G_7$) |

CHORD PROGRESSION DATA

| | | |
|---|---|---|
| $CN_1=1$ (C) | $CN_5=7$ (F) | |
| $CN_2=7$ (F) | $CN_6=7$ (F) | |
| $CN_3=8$ ($G_7$) | $CN_7=8$ ($G_7$) | |
| $CN_4=1$ (C) | $CN_8=1$ (C) | CNO = 8 |

MUSIC FORM ID DATA

SBN = 2 $SB_1=10$
$SB_2=51$ --- (BINARY FORM OF AB)

WEIGHTED SCALE DATA

WESTERN MAJOR SCALE IS ASSUMED
SCL = 75 FOR WHITE KEYS,
SCL = 25 FOR BLACK KEYS

FIG. 42

EXAMPLE OF DATA (1)

| PC \ MEASURE NUMBER | | 1 | 2 | 3 | 4 | 5 | 6 | 7 | 8 |
|---|---|---|---|---|---|---|---|---|---|
| <NUMBER> | PC | | 4 | 4 | 2 | 5 | 6 | 4 | 1 |
| <ARPEGGIO> | 1.1 | | 60 | → | | | | | |
| | 1.2 | | 1 | → | | | | | |
| | 1.3 | | 4 | 4 | 2 | 0 | 5 | 4 | 0 |
| | 1.4 | | 0 | 0 | 0 | 0 | 0 | 0 | 0 |
| | 1.5 | | 0 | 0 | 0 | 0 | 0 | 0 | 1 |
| | 1.6 | | 0 | 0 | 0 | 0 | 0 | 0 | 0 |
| | 1.7 | | * | * | * | 2 | 3 | 2 | 2 |
| | 1.9 | | 1 | → | | | | | |
| | 1.10 | | 0 | 1 | 0 | * | * | * | * |
| | 1.11 | | 2 | 2 | 2 | * | * | * | * |
| | 1.12 | | 1 | 1 | 1 | 0 | 0 | 0 | 0 |
| | 1.13 | | 1 | 1 | 1 | 0 | 0 | 0 | 0 |
| | 1.14 | | 0 | → | | | | | |
| <APPOGGIATURA> | 2.1 | | 60 | → | | 20 | → | | |
| | 2.2 | | 0 | 0 | 0 | 5 | 5 | 0 | 0 |
| | 2.3 | | 0 | 0 | 0 | 1 | 1 | 0 | 0 |
| | 2.4 | | 0 | 0 | 0 | 1 | 0 | 0 | 0 |
| | 2.7 | | * | * | * | 2 | 2 | * | * |
| <PASSING> | 3.1 | | 60 | → | | | | | |
| | 3.2 | | 3 | 2 | 1 | 0 | 0 | 0 | 0 |
| | 3.3 | | 2 | 2 | 2 | 2 | 1 | 2 | 2 |
| | 3.4 | | 5 | 5 | 5 | 5 | 5 | 5 | 5 |
| | r1 | | 2 | 1 | 0 | 0 | 0 | 0 | 0 |
| | RND (1) | | 0.8 | 0.3 | 0.5 | | | | |
| <NEIGHBOR> | 4.1 | | 60 | → | | | | | |
| | 4.2 | | 0 | 0 | 0 | 0 | 0 | 1 | 0 |
| | 4.4 | | 0 | 0 | 0 | 0 | 0 | 2 | 0 |
| <ESCAPE> | 5.1 | | 60 | → | | | | | |
| | 5.2 | | 1 | → | | | | | |
| | 5.3 | | 1 | → | | 0 | → | | |
| <FEATURING RHYTHM> | 6.1 | | 0 | 0 | 0 | 0 | 0 | 0 | 0 |
| <REST> | 9.1 | | 0 | 0 | 1 | 0 | 0 | 0 | 1 |

FIG. 43

EXAMPLE OF DATA (2)

ARPEGGIO

APPOGGIATURA

PASSING

ESCAPE

REST
(FINAL)

EVALUATE MOTIF

EVALUATE RHYTHM

EXTRACT NONHARMONIC TONES

EXTRACT NONHARMONIC TONES

EXTRACT NONHARMONIC TONES

EXTRACT PARAMETER

EXTRACT DURATION PATTERN OF ARPEGGIO TONES (DETAILS OF 13-2 IN FIG. 13)

PULSE SCALE BUILT IN ALGORITHM IN FIG. 50

NUMBERS OF RESPECTIVE NONHARMONIC TONES AND HARMONIC TONES (DETAILS OF 48-3,4 IN FIG. 48)

SMOOTHNESS AND SAME PITCH MOTION PARAMETERS
(DETAILS OF 48-5, 6 IN FIG.48)

FEATURING RHYTHM PARAMETER
(DETAILS OF 48-8 IN FIG. 48)

EXTRACT MINIMUM TONE DURATION
(DETAILS OF 48-7 IN FIG. 48)

CALCULATE PARAMETERS

DATA FORMAT $A_1$ $A_2$

UPPER DIGIT LOWER DIGIT $A_1$ MEASURE NUMBER $A_2$ REPEAT OR DEVELOPMENT (EXAMPLE) FOR $SB_1 = 10$
$SB_2 = 91$
$SB_3 = 130$

⇩

MUSIC FORM OF A --- (MEASURES 1 ~ 8)
↓
B --- (MEASURES 9 ~ 12)
↓
A --- (MEASURES 13 ~ )

FIG. 57

MUSIC FORM ID DATA

READ AND DECODE MUSIC FORM DATA
(DETAILS OF 56-4 IN FIG. 56)

< EXAMPLE > $SB_1=10$, $SB_2=91$, $SB_3=130$, (FOR ABA)

DECODED EXAMPLE

GENERATE MELODY

GENERATE ARPEGGIO

GENERATE ARPEGGIO

READ CHORD MEMBERS
(DETAILS OF 61-1 IN FIG. 61)

| SCL NUMBER | 1 | 2 | 3 | 4 | 5 | 6 | 7 | 8 | 9 | 10 | 11 | 12 |
|---|---|---|---|---|---|---|---|---|---|---|---|---|
| (1) YONA NUKI MINOR SCALE (ADDRESSES 0 ~ 11) | 75 | 25 | 50 | 25 | 75 | 75 | 25 | 50 | 25 | 75 | 25 | 75 |
| (2) YONA NUKI MAJOR SCALE (ADDRESSES 12 ~ 23) | 75 | 25 | 75 | 25 | 75 | 50 | 25 | 75 | 25 | 75 | 25 | 50 |
| (3) OKINAWA SCALE (ADDRESSES 24 ~ 35) | 75 | 25 | 50 | 25 | 75 | 75 | 25 | 75 | 25 | 50 | 25 | 75 |
| (4) WESTERN MAJOR SCALE (ADDRESSES 36 ~ 47) | 75 | 25 | 75 | 25 | 75 | 75 | 25 | 75 | 25 | 75 | 25 | 75 |

EXAMPLES OF WEIGHTED SCALE DATA

READ WEIGHTED SCALE DATA
(DETAILS OF 65A-1 IN FIG. 65A)

MODIFY WEIGHTED SCALE DATA
(PART OF 61-2 IN FIG. 61)

MODIFY WEIGHTED SCALE DATA
(PART OF 61-2 IN FIG. 61)

CALCULATE OPTIMAL NUMBER OF INVERSIONS
(DETAILS OF 61-4 IN FIG. 61)

INVERT CHORD MEMBERS
(DETAILS OF 61-5 IN FIG. 61)

DETERMINE MED1 FROM PRECEDING TONE
(DETAILS OF 61-15 IN FIG. 61)

SIMPLIFIED FLOWCHART OF GENERATING PITCH LINE OF ARPEGGIO

DETERMINE TONE DURATION PATTERN (DETAILS OF 61-44 IN FIG. 66)

OPTIMALLY JOIN NOTES WHERE NUMBER OF NOTES (HARMONIC TONES) IS LESS THAN THAT OF MOTIF HARMONIC TONES

OPTIMALLY DISJOIN NOTES WHERE NUMBER OF NOTES IS GREATER THAN THAT OF MOTIF

CHECK
(DETAILS OF 73-3 AND 73-6)

SHIFT
(DETAILS OF 73-7)

EXECUTE
(DETAILS OF 73-8)

IMPART APPOGGIATURA

IMPART PASSING

IMPART PASSING

IMPART PASSING

IMPART NEIGHBOR

IMPART NEIGHBOR

IMPART NEIGHBOR

IMPART ESCAPE

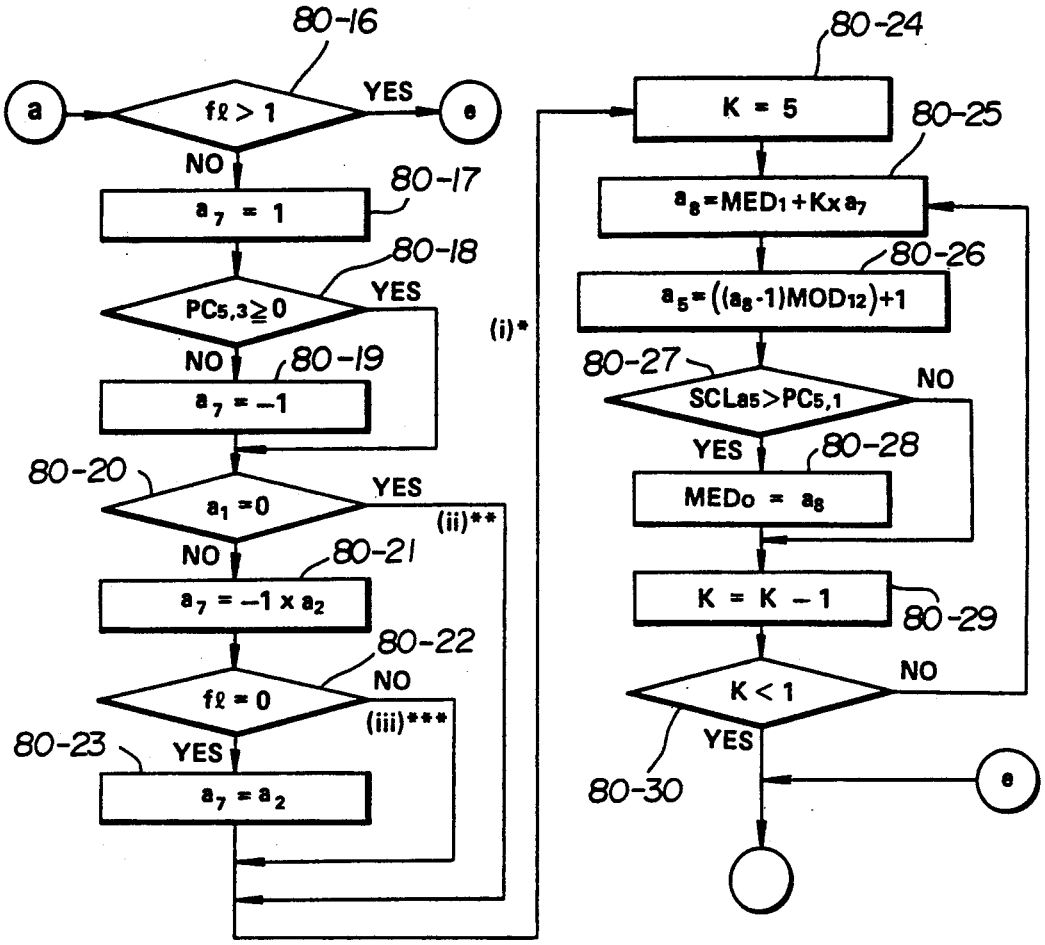
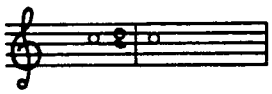
*((i) NEIGHBOR TYPE)
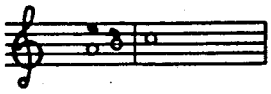
**((ii) PASSING TYPE)
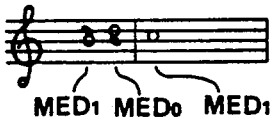
***((iii) APPOGGIATURA TYPE)
FIG. 80B
IMPART ESCAPE

GENERATE FEATURING RHYTHM

IMPART REST (BREATH)

FIG. 83 A (a)

MEMORY 1
EXAMPLE OF CHORD PROGRESSION

| i | 1 | 2 | 3 | 4 | 5 | 6 | 7 | 8 | 9 | 10 | 11 | 12 |
|---|---|---|---|---|---|---|---|---|---|---|---|---|
| CNi | 2 | 6 | 2 | 2 | 6 | 6 | 2 | 2 | 7 | 6 | 2 | 8 |
| | $I_7$ | $IV_7$ | $I_7$ | $I_7$ | $IV_7$ | $IV_7$ | $I_7$ | $I_7$ | $V_7$ | $IV_7$ | $I_7$ | $V_{aug}$ |

FIG. 83 A (b)

CHORD NUMBER/CHORD TYPE

| CNi | CHORD |
|---|---|
| 1 | I |
| 2 | $I_7$ |
| 3 | IIm |
| 4 | $III_7$ |
| 5 | IV |
| 6 | $IV_7$ |
| 7 | $V_7$ |
| 8 | $V_{aug}$ |
| 9 | VIm |

FIG. 83 A (c)

MEMORY 2
NUMBER OF AVAILABLE NOTE SCALES

| ADD-RESS | CNi | NO. OF ANS |
|---|---|---|
| 0 | 1 | 1 |
| 1 | 2 | 3 |
| 2 | 3 | 1 |
| 3 | 4 | 1 |
| 4 | 5 | 1 |
| 5 | 6 | 3 |
| 6 | 7 | 3 |
| 7 | 8 | 2 |
| 8 | 9 | 1 |

FIG. 83 A (d)

MEMORY 3
AVAILABLE NOTE SCALES

| ADD-RESS | CNi | ANS |
|---|---|---|
| 0 | 1 | 0 |
| 1 | 2 | 0 |
| 2 | | 1 |
| 3 | | 2 |
| 4 | 3 | 0 |
| 5 | 4 | 0 |
| 6 | 5 | 0 |
| 7 | 6 | 0 |
| 8 | | 1 |
| 9 | | 2 |
| 10 | 7 | 0 |
| 11 | | 1 |
| 12 | | 2 |
| 13 | 8 | 3 |
| 14 | | 4 |
| 15 | 9 | 0 |

FIG 83 A (e)

MEMORY 4
SCALE DATA

| ADDRESS | do | | re | | mi | fa | | sol | | la | | ti | |
|---|---|---|---|---|---|---|---|---|---|---|---|---|---|
| 0 ~ 11 | 1 | 0 | 1 | 0 | 1 | 1 | 0 | 1 | 0 | 1 | 0 | 1 | NATURAL MODE (WESTERN MAJOR SCALE) |
| 12 ~ 23 | 1 | 0 | 1 | 0 | 1 | 0 | 0 | 1 | 0 | 1 | 0 | 0 | (PENTATONIC SCALE) |
| 24 ~ 35 | 1 | 0 | 1 | 1 | 0 | 1 | 1 | 0 | 0 | 1 | 1 | 0 | (BLUE NOTE SCALE) |
| 36 ~ 47 | 1 | 0 | 1 | 0 | 1 | 0 | 1 | 0 | 1 | 0 | 1 | 0 | (WHOLE TONE SCALE) |
| 48 ~ 59 | 1 | 1 | 0 | 1 | 1 | 0 | 1 | 0 | 1 | 0 | 1 | 0 | (ALTERED SCALE) |

READ WEIGHTED SCALE DATA

EXTRACT TONE DURATION PATTERN OF ARPEGGIO REFERENCING TABLE (MODIFICATION OF FIG. 50)

OPTIMALLY JOIN NOTES REFERENCING TABLE (MODIFICATION OF FIG. 72)

CHECK USING TABLE
(DETAIL OF 88-2 IN FIG. 88)

OPTIMALLY DISJOIN NOTES REFERENCING TABLE (MODIFICATION OF FIG. 73)

EXAMPLE OF JOINING AND DISJOINING

EXAMPLE OF JOINING AND DISJOINING

FIG. 91 (A) SAMBA
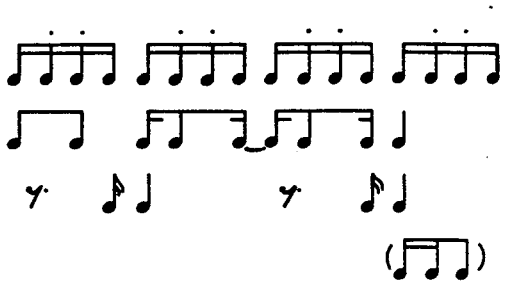
FIG. 91 (B) 16 BEATS
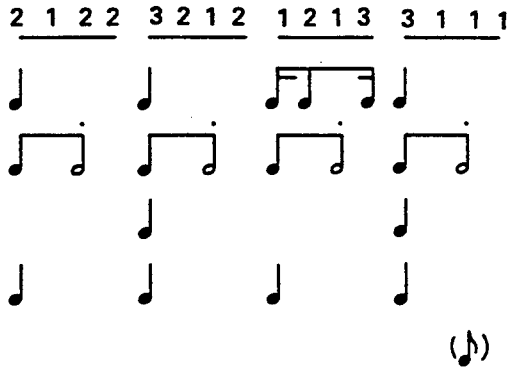
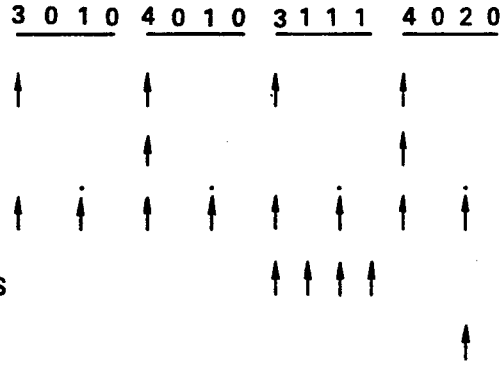
FIG. 91 (C) FOUR-FOUR TIME
FIG. 91 (D) ESSENCE OF ROCK
FIG. 91 (E) ESSENCE OF 8 BEATS (AFTERBEAT)
FIG. 91 (F) ESSENCE OF 16 BEATS
FIG. 91 (G) LEADING TO NEXT MEASURE

WEIGHTED DATA

| $T_0$ | $T_1$ | $T_2$ | $T_3$ | $T_4$ | $T_5$ | $T_6$ | $T_7$ | $T_8$ | $T_9$ | $T_{10}$ | $T_{11}$ | $T_{12}$ | $T_{13}$ | $T_{14}$ | $T_{15}$ |
|---|---|---|---|---|---|---|---|---|---|---|---|---|---|---|---|
| 5 | 1 | 2 | 1 | 3 | 1 | 2 | 1 | 4 | 1 | 2 | 1 | 3 | 1 | 2 | 1 |

EVALUATE DEGREE OF SYNCOPATION

EXAMPLES OF EVALUATED DEGREE OF SYNCOPATION

GENERATE CONTROLLED TONE DURATION PATTERN

GENERATE RANDOM NUMBERS
(DETAILS OF 94-1 IN FIG. 94)

EVALUATE
(DETAILS OF 61-2 IN FIG. 62)

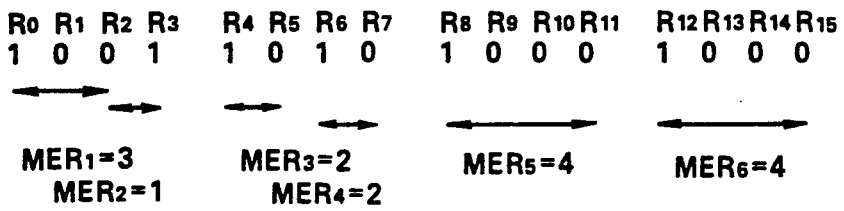
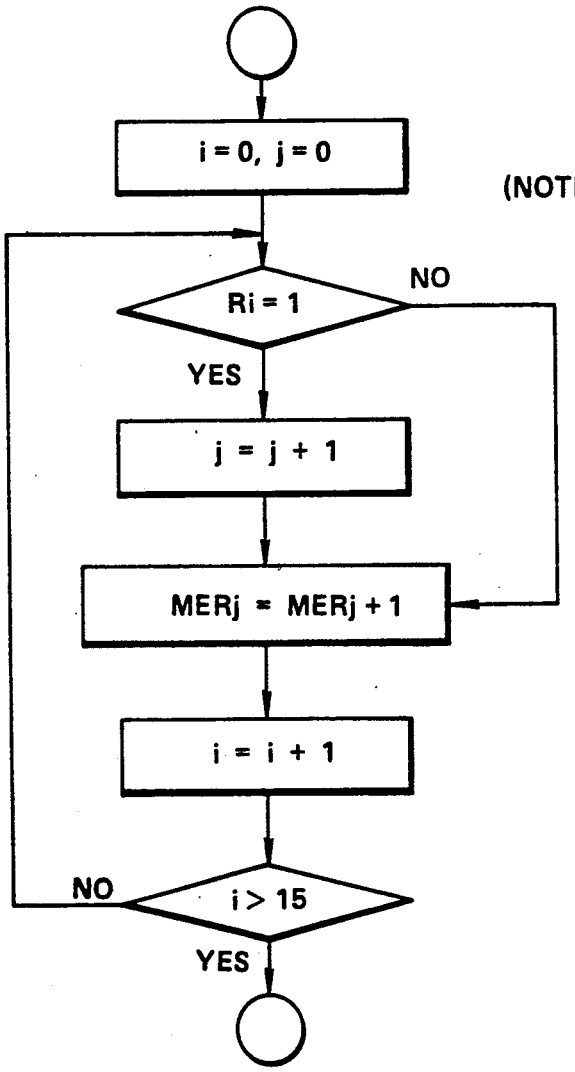
(NOTE) INITIALIZE MERjS (j = 1~N) WITH ZEROS
FIG. 97
DATA CONVERSION
(DETAIL OF 94-4 IN FIG. 94)

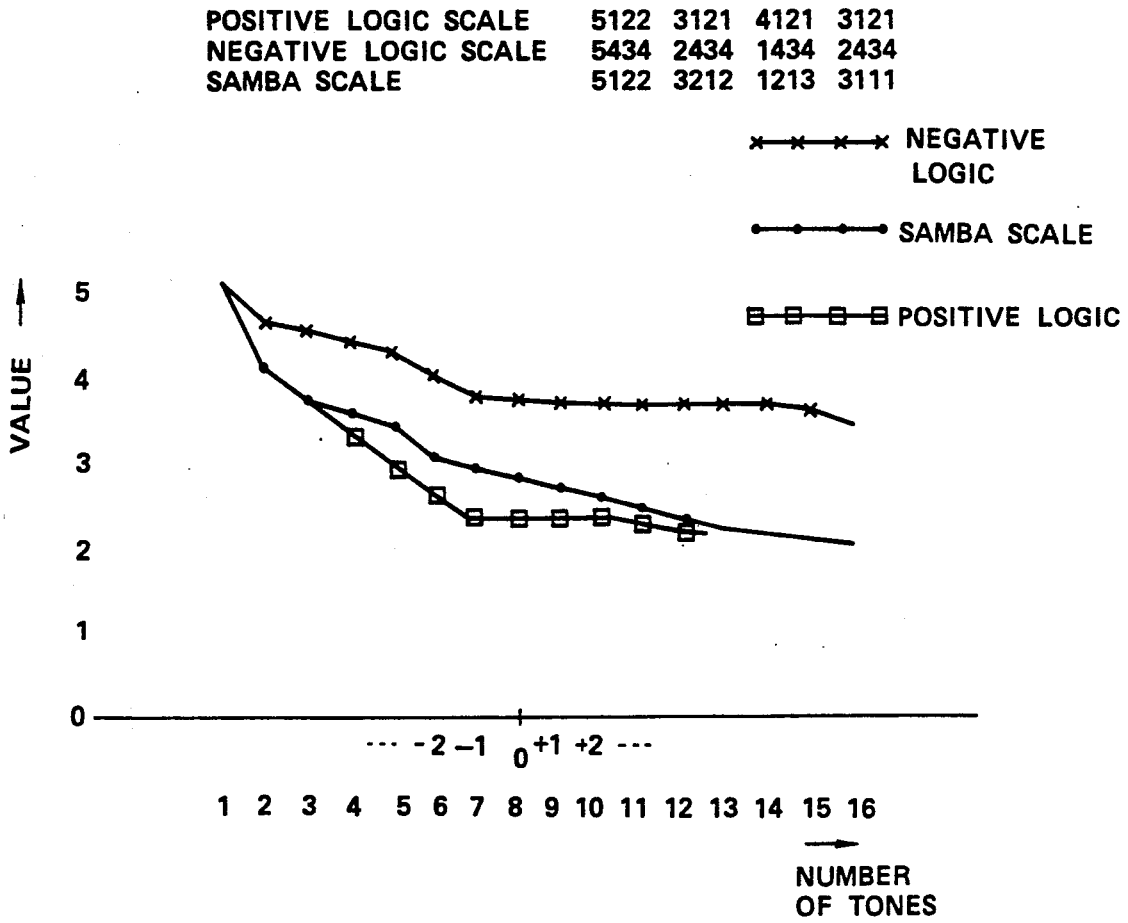
FIG.98
EXAMPLE OF EVALUATION FOR 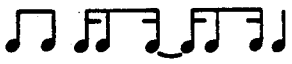

EXAMPLE OF NORMALIZED EVALUATION

MOTIF TONE DURATION PATTERN Ri

| | | | | | | | | | | | | | | | | |
|---|---|---|---|---|---|---|---|---|---|---|---|---|---|---|---|---|
| SAMBA: | 1 | 0 | 1 | 0 | 1 | 1 | 0 | 1 | 0 | 1 | 0 | 1 | 1 | 0 | 0 | 0 |
| ENKA: | 1 | 0 | 1 | 1 | 1 | 0 | 1 | 0 | 1 | 0 | 1 | 0 | 1 | 0 | 1 | 0 |
| NOW: | 1 | 1 | 0 | 1 | 0 | 1 | 0 | 1 | 0 | 1 | 1 | 0 | 1 | 0 | 0 | 0 |
| 4 : | 1 | 0 | 0 | 0 | 1 | 0 | 0 | 0 | 1 | 0 | 0 | 0 | 1 | 0 | 0 | 0 |
| 2 : | 1 | 0 | 0 | 0 | 0 | 0 | 0 | 0 | 1 | 0 | 0 | 0 | 0 | 0 | 0 | 0 |

PULSE SCALE Ti (tij)

POSITIVE LOGIC

| | | | | | | | | | | | | | | | | |
|---|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 0 | 1 | 0 | 1 | 0 | 1 | 0 | 1 | 0 | 1 | 0 | 1 | 0 | 1 | 0 |
| 1 | 0 | 0 | 0 | 1 | 0 | 0 | 0 | 1 | 0 | 0 | 0 | 1 | 0 | 0 | 0 |
| 1 | 0 | 0 | 0 | 0 | 0 | 0 | 0 | 1 | 0 | 0 | 0 | 0 | 0 | 0 | 0 |
| 1 | 0 | 0 | 0 | 0 | 0 | 0 | 0 | 0 | 0 | 0 | 0 | 0 | 0 | 0 | 0 |

NEGATIVE LOGIC

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 0 | 1 | 0 | 1 | 0 | 1 | 0 | 1 | 0 | 1 | 0 | 1 | 0 | 1 | 0 | 1 |
| 0 | 1 | 1 | 1 | 0 | 1 | 1 | 1 | 0 | 1 | 1 | 1 | 0 | 1 | 1 | 1 |
| 0 | 1 | 1 | 1 | 1 | 1 | 1 | 1 | 0 | 1 | 1 | 1 | 1 | 1 | 1 | 1 |
| 0 | 1 | 1 | 1 | 1 | 1 | 1 | 1 | 1 | 1 | 1 | 1 | 1 | 1 | 1 | 1 |

SAMBA

| | | | | | | | | | | | | | | | |
|---|---|---|---|---|---|---|---|---|---|---|---|---|---|---|---|
| 1 | 1 | 1 | 1 | 1 | 1 | 1 | 1 | 1 | 1 | 1 | 1 | 1 | 1 | 1 | 1 |
| 1 | 0 | 1 | 0 | 1 | 1 | 0 | 1 | 0 | 1 | 0 | 1 | 1 | 0 | 0 | 0 |
| 0 | 0 | 0 | 1 | 1 | 0 | 0 | 0 | 0 | 0 | 0 | 1 | 1 | 0 | 0 | 0 |
| 1 | 0 | 0 | 0 | 0 | 0 | 0 | 0 | 1 | 0 | 0 | 0 | 0 | 0 | 0 | 0 |

16 BEATS

| | | | | | | | | | | | | | | | |
|---|---|---|---|---|---|---|---|---|---|---|---|---|---|---|---|
| 1 | 0 | 1 | 0 | 1 | 0 | 1 | 0 | 1 | 0 | 1 | 0 | 1 | 0 | 1 | 0 |
| 1 | 0 | 0 | 0 | 1 | 0 | 0 | 0 | 1 | 1 | 0 | 1 | 1 | 0 | 0 | 0 |
| 1 | 0 | 0 | 0 | 1 | 0 | 0 | 0 | 1 | 0 | 0 | 0 | 1 | 0 | 0 | 0 |
| 0 | 0 | 0 | 0 | 1 | 0 | 0 | 0 | 0 | 0 | 0 | 0 | 1 | 0 | 0 | 0 |
| 0 | 0 | 0 | 0 | 0 | 0 | 0 | 0 | 0 | 0 | 0 | 0 | 0 | 0 | 1 | 0 |

FIG.100

| MOTIF | PULSE SCALE | MEAN | MAXIMUM |
|---|---|---|---|
| SAMBA | POSITIVE | .2 4 3 7 5 | .5 |
| | NEGATIVE | .3 7 1 2 5 | .5 |
| | SAMBA | .4 6 0 9 3 8 | 1 |
| | 16 BEATS | .2 6 0 4 1 7 | .5 2 0 8 3 3 |
| ENKA | POSITIVE | .4 4 5 8 3 3 | .8 8 8 8 8 9 |
| | NEGATIVE | .3 3 4 1 6 7 | .5 6 2 5 |
| | SAMBA | .3 1 4 2 3 6 | .5 6 2 5 |
| | 16 BEATS | .3 9 2 5 9 3 | .8 8 8 8 8 9 |
| NOW | POSITIVE | .1 9 0 6 2 5 | .5 |
| | NEGATIVE | .4 2 2 2 9 2 | .5 |
| | SAMBA | .2 6 9 5 3 1 | .5 |
| | 16 BEATS | .1 0 3 1 2 5 | .1 8 7 5 |
| 4 | POSITIVE | .5 | 1 |
| | NEGATIVE | 9 .4 2 8 5 7 E–0 2 | .2 5 |
| | SAMBA | .3 2 0 3 1 3 | .5 |
| | 16 BEATS | .5 3 3 3 3 3 | 1 |
| 2 | POSITIVE | .4 7 5 | 1 |
| | NEGATIVE | 3 .1 6 6 6 7 E–0 2 | .1 2 5 |
| | SAMBA | .2 9 6 8 7 5 | 1 |
| | 16 BEATS | .2 1 6 6 6 7 | .5 |

FIG.101

EXTRACT NONHARMONIC TONES

CLASSIFY NONHARMONIC TONES

CLASSIFY NONHARMONIC TONES (2)

CLASSIFY NONHARMONIC TONES (3)

DETAILS OF 106-2

AUTOMATIC COMPOSER FOR FORMING RHYTHM PATTERNS AND ENTIRE MUSICAL PIECES

This is a division of application Ser. No. 07/177,592, filed Apr. 4, 1988 now U.S. Pat. No. 4,926,737, issued May 22, 1990.

BACKGROUND OF THE INVENTION

1. Field of the Invention

The present invention relates to an apparatus for automatically composing a musical piece.

2. Description of the Related Art

One of the most important considerations to be taken into account when designing an automatic composer is that the device in question should be capable of composing a musical piece which is familiar to people in general, i.e. one which is not mechanical in sound, but is full of musicality.

For example, U.S. Pat. No. 4,399,731 issued to E. Aoki on Aug. 23, 1983 discloses an automatic composer comprising means for randomly sampling individual pitch data from a set of pitch data, such as a twelve-note scale data, and means for checking whether the sampled data satisfies limited musical conditions. When the sample satisfies these conditions, it will be accepted as a melody note. If not, the sample is rejected as unsuitable for a melody note, and a new sample is taken from the set of pitch data and checked in turn. Thus, the basic process performed by this automatic composer is essentially one of trial and error. When pitch data are being randomly sampled, they constitute, at that point, a totally disordered sequence of pitches which is far-removed from anything resembling good quality music; thus, the chances of obtaining a melodic piece as a result, are negligible. In essence, therefore,, the above apparatus provides a means for checking sampled data as to their musical conditions, or for selecting data by means of a condition filter. The selection standard is, consequently, a key factor in determining the quality of the music composed. If the selection of pitch data were too restrictive, the melodies generated would be lacking in variety. If, on the other hand, the selection process were too wide in scope, the original disordered sequence of pitches would be the predominent element in the melodies generated.

The above-mentioned automatic composer is thus more suitable for generating a melody which does not conform any existing style of music familiar to most people, and is primarily useful for music dictation i.e. solfeggio and/or performance exercise, since novel or unfamiliar music is, initially at least, difficult to read or play. The above automatic composer therefore clearly fails to satisfy the musical criteria outlined earlier.

The present invention contemplates the very function.

Other techniques of automatic composition are disclosed in U.S. Pat. No. 4,664,010 to A. Sestero, May 12, 1987 and WO 86/05619 by G. B. Mazzola et. al. Sept. 25, 1986. The former patent relates to a technique of converting a given melody into a different melody by performing a mirror or symmetry transformation of the given melody with respect to particular pitches. According to the latter patent application, a given melody is represented graphically by a set of locations in a two-dimensional space having a pitch axis (Y axis) and a time axis (X axis). A suitable transformation of the given melody is carried out with respect to the two axes, thereby developing a new melody formed by a sequence of pitches and a sequence of tone durations.

Each of the above techniques employs simply mathematical transformations such as symmetry conversion, and cannot be said to contemplate musical properties of melody; thus, the chances of achieving musical compositions of satisfactory quality are relatively low, when compared to the present invention.

Another automatic composer is disclosed, by the present inventor, in Japanese Patent laid open (Kokai) 62-187876, dated Aug. 17, 1987. This apparatus comprises a table representing frequencies of pitch transitions and a random number generator. In operation, tone pitches are successively developed from the outputs of the frequency table and the random number generator, to form a melody. The frequency table makes it possible to compose music which accords with the musical style designated by a user. Even this arrangement cannot be said, however, to carry out analysis and evaluation of musical properties of melody for musical composition.

Other relevant techniques are disclosed in U.S. Pat. No. 3,889,568 issued on June 17, 1975 concerning a system of chord progression programs, Japanese patent laid open (Kokai) 58-87593, May 25, 1983 and U.S. Pat. No. 4,539,882, Sept. 10, 1985 concerning an apparatus for automatically assigning chords to a melodic line.

The present invention aims to provide a novel and useful automatic composer and various apparatus associated therewith, far apart from the prior art.

SUMMARY OF THE INVENTION

An object of the present invention is to provide a novel and unique automatic composer.

Another object of the present invention is to provide an automatic composer capable of composing a melody which varies in a great number of ways as music proceeds which maintaining the concept or essence of music.

A further object of the present invention is to provide an automatic composer which is capable of composing music based on a given motif.

Still another object of the present invention is to provide an automatic composer which is capable of composing music in accordance with a given chord progression.

A further object of the present invention is to provide an automatic composer capable of composing music with a controlled stream of melody.

Another object of the present invention is to provide an automatic composer which is capable of controlling the rhythm of melody in various ways.

Yet another object of the present invention is to provide an automatic composer which is capable of producing a controlled sequence of tone pitches.

A further object of the present invention it to provide a melody analyzer which automatically provides a harmony evaluation of melody.

A further object of the present invention it to provide an improved automatic composer which facilitates analysis of motif.

Another object of the present invention is to provide a rhythm machine which is capable of automatically producing a controlled rhythm pattern.

A further object of the present invention is to provide an automatic composer which facilitates eddition or correction of a music piece.

In accordance with an aspect of the present invention, a rhythm machine for automatically forming a rhythm pattern comprises reference rhythm source means for providing a reference rhythm pattern representing a sequence of a plurality of tone durations; pulse scale source means for providing a pulse scale of pulse points having weights for joining or disjoining tone durations depending on their positions; and means for modifying said reference rhythm pattern by executing one of joining or disjoining tone durations in accordance with the pulse scale. With this arrangement a rhythm pattern is generated automatically.

According to another aspect of the invention, an automatic composer comprises an input means for inputting a portion of a musical piece for composing an entire musical piece; parameter extraction means for extracting, from the inputted portion of a musical piece, featuring parameters characterizing the inputted portion; and music composing means for forming the entire musical piece in accordance with at least the featuring parameters extracted by the parameter extraction means. According to a preferred feature, further provided is a progression-providing means for providing a progression of music, and wherein the music composing means includes means for receiving the progression of music from the progression-providing means and for composing the entire musical piece in accordance with the featuring parameters and the progression of music. Means may also be provided for extracting said featuring parameters in accordance with at least one of a sequence of tone pitches and a sequence of tone durations, the sequences defining the inputted portion of a musical piece. According to yet another aspect of the invention, an automatic composer comprises parameter generating means for generating featuring parameters characterizing a portion of a musical piece for composing an entire musical piece, in accordance with a user's command; progression-providing means for providing a progression of music; and music forming means for forming the entire musical piece in accordance with the featuring parameters provided by the parameter generating means and the progression of music provided by the progression-providing means. The progression-providing means preferably includes means for providing a chord progression as the progression of music. According to another preferred feature of this aspect of the invention, the music forming means includes arpeggio generating means for generating arpeggios in accordance with the chord progression; and nonharmonic tone imparting means for imparting at least one nonharmonic tone before, after an arpeggio and/or between arpeggios, whereby a generated melody is formed by said arpeggios and said nonharmonic tones.

BRIEF DESCRIPTION OF THE DRAWINGS

The above and other objects, features and advantages of the present invention will become apparent from the following description taken in conjunction with the drawing in which:

FIG. 4 shows an example of input data;

FIG. 6 shows a list of variables;

FIG. 17(*a*) shows an example of the operation of the flow of FIG. 17;

FIG. 22A shows examples of parameter C computation;

FIG. 22B shows an example of an particular parameter for different set of constituent parameters and measure number;

FIGS. 26*a* and 26*b* illustrate contents of a chord member memory and a chord progression memory;

FIGS. 29(*a*) and (*b*) illustrate graphic representation of an example of the process;

FIG. 35(*a*) illustrates contents of a learned data memory;

FIG. 40 is a list of variables used in the automatic composer;

FIG. 41 is a list of parameters C used in the automatic composer;

FIG. 42 shows an example of input data;

FIG. 43 shows an example of the values of parameters C;

FIG. 49(*a*) shows an example of the operation of the flow of FIG. 49;

FIG. 57 shows an example of musical form ID data;

FIGS. 80A, and 80B show, in combination, a flowchart of addition of except;

FIGS. 83(A)(*a*)–(*e*) show data structures of note scale and associated memories (part 1) in accordance with a further embodiment of the present invention;

FIGS. 83A(*c*) and 83A(*d*) also show data structures of note scale and associated memories;

FIGS. 91(*a*)–(*g*) illustrate several rhythms and rhythm essentials;

FIG. 97 shows the details of data conversion in FIG. 94, also illustrating converted data;

FIG. 98 shows characteristics of curves evaluated by several pulse scales;

FIG. 100 shows examples of motif tone duration patterns together with pulse scales and their constituent subpulse scales;

FIG. 101 illustrates evaluation values of respective patterns of motif tone durations in FIG. 100, using respective pulse scales;

DETAILED DESCRIPTION OF THE PREFERRED EMBODIMENTS

Figure 1:
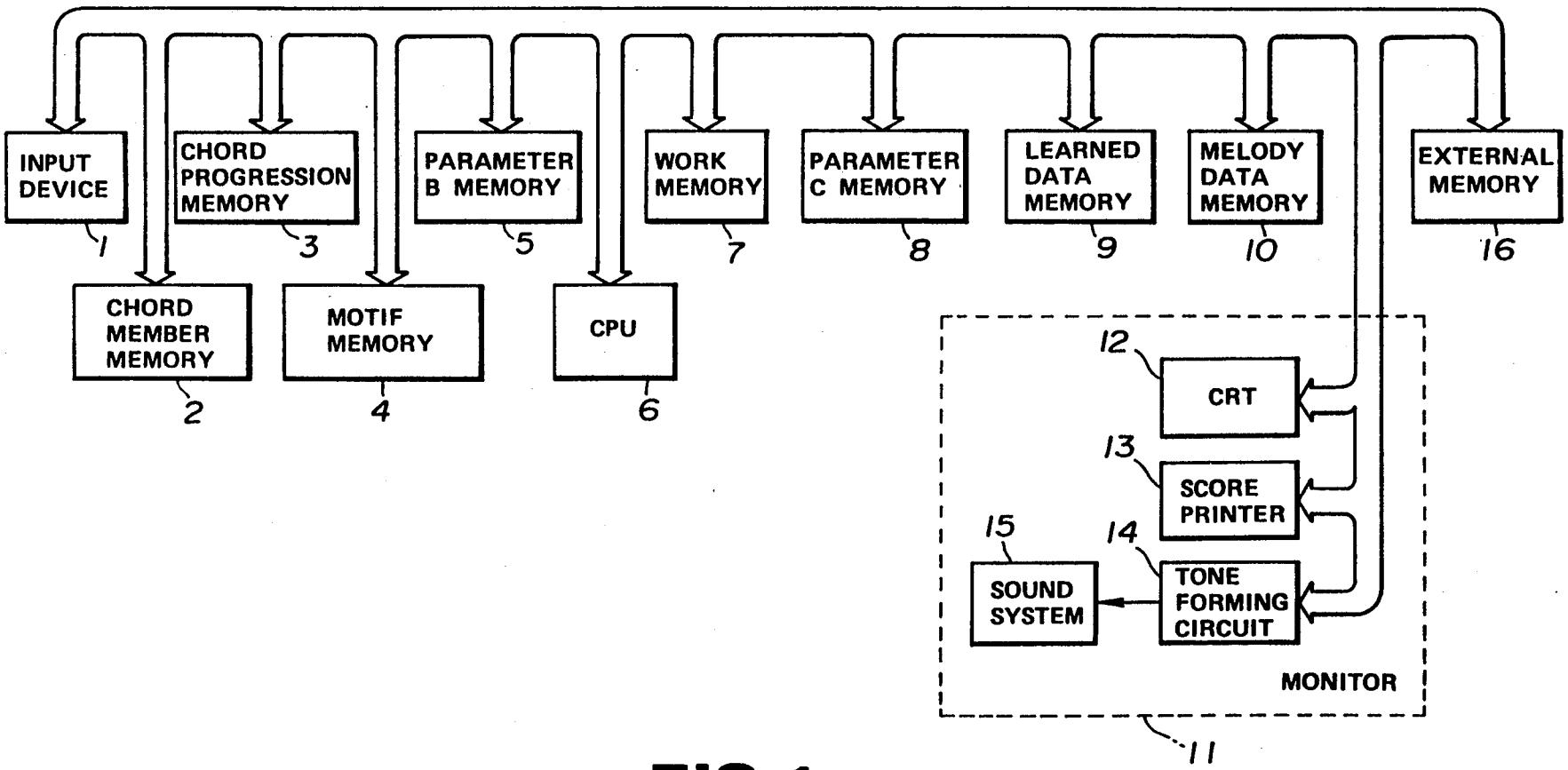
FIG. 1 shows an overall arrangement of an automatic composer in accordance with an embodiment of the present invention.

Referring first to FIG. 1, there is shown an overall arrangement of an automatic composer in accordance with a first embodiment of the present invention. The present automatic composer comprises an input device 1, a chord number memory 2, a chord progression memory 3, a motif memory 4, a parameter B memory 5, a CPU 6, a work memory 7, a parameter C memory 8, a learned data memory 9, a melody data memory 10, a monitor including a CRT 12, a score printer 13, a tone forming circuit 14 and a second system 15, and an external memory 16.

The above motif memory 4 stores a motif (given melody) information provided by means of the input device 1. The motif information is expressed by a series of data of pitch and duration (time value). In operation of composition, CPU6 derives, from the stored motif information, parameters characterizing the motif i.e. motif featuring parameters.

The above chord progression memory 3 stores a chord progression information in the form of a series of chord names. The chord progression information may be provided either by designating respective chords in a successive manner by means of the input device operated by the user or being automatically generated by CPU6 in response to a macro-instruction such as one specifying the form of music. The automatic generation of chord progression is possible by, for example, connecting basic or frequently used chord patterns or linking acceptable chord pairs or combinations. As a logic for chord connection, a Markov process model could be utilized. However, it is not pertinent to the present invention whether chord progression is directly specified by the user or automatically generated by the machine.

The chord member memory 2 stores members of chords (pitch data of members) for respective chords. In the present example, the content of each address of the chord progression memory 3 representing a chord name specifies the address locations where member data for that particular chord are stored. In the process of composition, CPU6 advances the address of the chord progression memory 3 at every time of chord change, for example, each measure, and from the content of the advanced address, i.e., chord name, calculates a corresponding addresses of the chord member memory 2 to read out pitch data of chord members at those addresses.

On the other hand, the parameter B memory stores parameters B for controlling the style of music. In composition mode, CPU generates, on segment by segment basis, parameters C which are dependent upon the parameters B, the above motif featuring parameters and an segment variable such as measure number. The parameters C have a character of controlling o characterizing a melody to be generated. The generation of parameters C will be described later. The generated parameters C are stored in the parameter C memory.

The work memory 7 is used to store intermediate data such as in-process melody data in the course of composition.

The melody data memory 10 stores melody data forming a complete music piece.

A complete music piece may be outputted by means of the monitor 11 as required. For example, one may listen to music via the tone forming circuit 14 and the sound system 15, or obtain a copy of the music score from the score printer 13.

From the monitor 11, the user may wish to correct some part of the music piece. In such case, the present embodiment allows the user to request correction by means of CRT12 and the input device 1. The correction is made in an interactive manner between the user and the machine. The corrected data is, then, stored in the learned data memory 9 as knowledge. For subsequent composition, CPU6 utilizes the knowledge to generate a melody.

The external memory 16 is utilized for providing a back up copy of complete music pieces, acquired knowledge or as a resource for substitutable programs of automatic composition.

FUNCTION OF AUTOMATIC COMPOSITION

Figure 2:
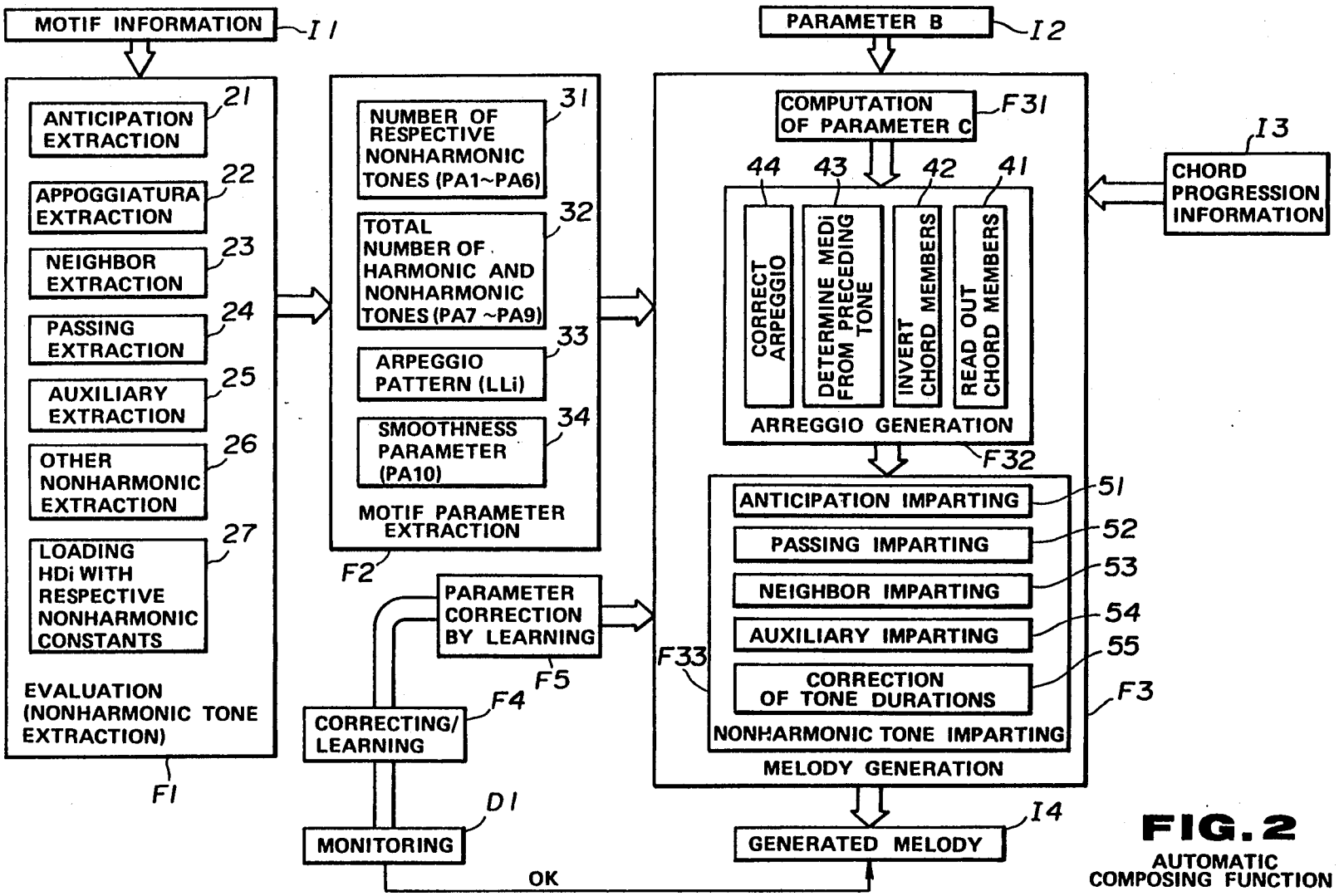
FIG. 2 is a block diagram illustrating functions of the automatic composer.

The overall function of the automatic composer of the embodiment will no be described with respect to FIG. 2 wherein blocks denoted by symbols beginning with a letter I represent information or a source thereof. For example, I1 is a motif information which may be stored in the motif memory 4 in FIG. 1. I2 indicates parameters B stored in the parameter B memory in FIG. 1. I3 is a chord progression information provided by the chord progression memory 3 in FIG. 1. I4 indicates a generated melody which may be stored in the melody data memory 10 in FIG. 1. On the other hand, those blocks denoted by symbols beginning with a letter F indicates various functions of the automatic composition. As illustrated, main functions comprise a motif evaluation function F1 for evaluating motif information, motif parameter extraction function F2 for extracting motif parameters from the result of the evaluation, a melody generating function F3 for generating a melody in accordance with the motif featuring parameters from the motif parameter extraction function F2 and chord progression information. The composer system further comprises correcting and learning function F4 for correcting the necessary parts of the generated melody by means of monitoring D1 by a user and learning the corrected information and parameter correcting function F5 for correcting associated parameters.

More specifically, the above evaluation function F1 comprises, in the present example, nonharmonic tone extraction function for extracting nonharmonic tones for their respective types from the motif. Here, an anticipation extraction element 21, an appoggiatura extraction element 22, a neighbor tone extraction element 23, a passing tone extraction element 24 and an auxiliary tone extraction element 25 are shown to extract respective kind of nonharmonic tones. As types of nonharmonic tones extracted by extraction elements 21 through 26, "anticipation", "appoggiatura" etc. are enumerated. However, those terms such as "anticipation", "appoggiatura" are not necessarily the same as those used in any specific theory of harmony. In other words, the usage of terms for respective type of nonharmonic tones is somewhat different among individual musicologists and the definitions thereof vary with category or genre of music compositions and music history. This vagueness, though not so much as that of natural languages, fails to satisfy the definitions required by computer systems. Thus, accurately, the anticipation extraction element 21 serves to extract a first kind of nonharmonic tones which might be regarded as anticipation while the appoggiatura extraction elements 22 serves to extract a second class of nonharmonic tones and similarly, other elements functions to extract third, fourth kind of nonharmonic tones and so on. As the last element of the evaluation function F1, there is shown a function 27 which loads HDi (motif data) with constants or nonharmonic identifiers corresponding to respective kinds of nonharmonic tones. This function 27, could, instead, be incorporated into respective nonharmonic tone extraction elements 21 through 26.

Since the above evaluation function F1 performs preliminary functions for extraction of parameters characterizing the motif from the source I1, it might, therefore, be regarded as parts of the motif parameter extraction function F2.

In the arrangement in FIG. 2, the motif parameter extraction function F2 extracts parameters characterizing the motif from the evaluation results from the motif evaluation function F1, here, motif data with the information of nonharmonic tone identifiers indicative of the locations and types of nonharmonic tones in the motif. In FIG. 2, the motif parameter extraction function F2 comprises a function 31 for extracting the number of respective types of nonharmonic tones, a function 32 for extracting the total numbers of harmonic tones and nonharmonic tones contained in the motif, a function 33 for extracting a parameter indicative of the pattern of the arpeggio of the motif, and a function 34 for extracting a parameter indicative of the smoothness of the motif.

It is convenient here to make a brief description of a unit of segment performed by the motif evaluation function F1 and the motif parameter extraction function F2. This segment unit may be a predetermined interval of the motif or input melody. For example, if it is assumed that the motif forms a phrase in accordance with a chord progression the chord of which changes measure by measure, (this is true in many cases) one measure may be used as a unit of the extraction segment. In such case, for the motif having a length of N measures, evaluation and extraction by the functions F1 and F2 are performed on a measure by measure basis starting with the first measure and ending with the last or Nth measure. For the sake of clarity, it is assumed hereinafter that the length of the motif is a melody for a single and opening measure of the composition, and the function F2 extracts parameters characterizing the motif at the first measure and referred to as parameters PAj later, unless otherwise stated.

On the other hand, the melody generating function F3 also involves a concept of segment for which a melody is controlled. For example, if a chord progression information I3 represents a series of chords each having a duration of a single measure with chord C for i-th measure, for example, chord C for (i+1)th measure, chord F for (i+2)th measure and chord G for (i+3)th measure the length of one measure may be used as the control segment for melody generation.

It is a parameter C computation function F31 within the melody generating function F3 which generates parameters C on the above described segment basis. The nature of the parameters C is that they depend upon motif featuring parameters provided by the motif parameter extraction function F2 as well as the location of segment such as the measure number. Mathematically, if parameters C are expressed by PC, motif featuring parameters by PA and the segment number of the music composition by i, then parameters C may be expressed by:

$$PC=f(PA,i)$$

The relationship of PC=f(PA) indicates that the essence of the motif characterized by the motif parameters PA reflects on the overall music piece. Further, the relationship of PC=f(i) indicates that parameters C are determined for or assigned to respective segments of the music composition. The parameters C generated by the parameter C computation function F31 are supplied to the remaining portions of the melody generating function F3, i.e. an arpeggio generating function F32 and a nonharmonic tone imparting function F33 both of which utilize the supplied parameters to control the generation of a melody. In other words, the parameters C serves to control or characterize a melody to be generated.

In FIG. 2, the parameter C computation function F31 not only uses the above motif featuring parameters and the segment number but also utilizes parameters B stored in the parameter B memory 5 in FIG. 1 for the computation of the parameters C. The parameter B memory 5 serves to compress data in connection with the forming of the parameters C. Although means for forming the parameters C i.e. melody control parameters may be configured by another arrangement wherein selection of parameters C is made from data base {f(i)} of possible parameters C in accordance with the motif featuring parameters, such arrangement will require a vast amount of storage because data are to be provided for respective segments i. In essence, the parameter B memory 5 of the present embodiment is an element of the melody featuring parameter generating means.

An arpeggio component of the complete melody is generated by the arpeggio generating function F32. Another element of the function F32 is a chord member reading function 41 which reads out respective members of the chord from the chord member memory 2 (FIG. 1) in accordance with the chord progression information I3. Another element of the function F32 is a chord inversion function 42 which selectively performs chord inversions with respect to the chord members read out by the function F41 in accordance with parameters C such as chord inversion designating parameters determined for respective segments such as measures. This function 42 serves mainly to control the range of the melody for respective segments. The arpeggio generating function F32 further comprises a function 43 for determining a harmonic tone MEDi from the immediately preceding tone, and a function for correcting the pattern or shape of the arpeggio. The arpeggios generated by the arpeggio generating function F32 adheres or conforms to the chord progression while their patterns are controlled by parameters C for respective segments.

The nonharmonic tone imparting function F33 serves to allocate or impart nonharmonic tones between arpeggio tones provided by the above arpeggio generating function F32. In the illustrated example, there are shown an appoggiatura imparting function 51, a passing tone imparting function 52, a neighbor tone imparting function 53 and an auxiliary tone imparting function 54. Again, the terms of "appoggiatura", "passing", "neighbor" and "auxiliary" are merely for the purpose of description. Actually, they are first, second, third and fourth kind of nonharmonic tones for the generation of a melody.

One of what is important is that respective functions 51 through 54 apply rules of nonharmonic tone imparting defined therein in accordance with parameters C which are determined on segment by segment basis. For example, if a parameter C inhibits the imparting of appoggiatura, the appoggiatura imparting function 51 will not impart any appoggiatura. The number of appoggiatura may also be controlled by an associate parameter C. In short, respective functions 51 through 54 perform imparting of nonharmonic tones under the control of parameters C. It is, however, possible and desirable to introduce randomized components in order to avoid the uniqueness. Such random or variation introducing function may be incorporated into either nonharmonic tone imparting functions 51 through 54 or parameter C computation function F31, or the combination thereof with appropriate trade-off therebetween.

Within the block F33 in FIG. 2, there is further shown a block for a tone duration correcting function 55 which corrects respective durations or time values of the melody for respective segments or measures so that the segmented melody has a predetermined length.

The melody generated segment by segment by the above melody generating function F3 is stored into the melody data memory 10 (FIG. 1). The motif is, in the present example, an opening melody for the first measure of the composition while the melody generated by the melody generating function F3 follows the motif. Accordingly, the melody data in the melody data memory 10 are arrayed with the motif data as the leading data for the purpose of facilitating further data processing.

The melody automatically generated by the above described functions is shown by a symbol I4 in FIG. 2. A user may listen to a complete music piece by means of monitoring D1. If the monitored music is satisfactory, no correction will be made to the data of that music. On the other hand, if there is a portion undesirable to the user, he or she may tell the automatic composer that portion by means of the input device 1 (FIG. 1). Correspondingly, the automatic composer learns that portion and inquires the user as to which type of parameters should be corrected and how it should be converted for that portion by means of CRT12. It is preferred that the expression of such queries be made in a comprehensible manner to the user. To this end, the present embodiment includes conversion means for performing conversions between subjective and objective parameters as will be described in more detail. In response to the queries from the automatic composer, the user designates a desired type of a parameter which is, in turn, learned by the automatic composer. Such learning is carried out by the correcting and learning function F4 in FIG. 2. The result of learning i.e. the information of corrected portion and type and value of the parameter is stored into the learned data memory 9 (FIG. 1) as knowledge for composition.

For the motifs subsequently supplied, the automatic composer will put the parameter correcting function F5 into operation so that the generated melody will conform to the user's request. For the portion or segment where the user wishes to correct the melody, the parameter provided by the parameter correction function F5 takes preference over the parameter computed by the parameter C computation function F31. As a result, the user's inclination or preference will reflect on the melody generated. In case quite a different type of music is to be composed, the above learning function should be disabled. To this end, when a style or genre of music is designated by the user via the input device 1 (FIG. 1), only that portion of the learning function associated with the designated musical style may be active. The above learning function on a partial and field dependent basis might be superficially analogous to the technique of learning Chinese compound words for word processing. Of course, they are different in substance.

PRELIMINARY ITEMS

Before the detailed description of the operation of the embodiment, preliminary items will be described.

Figure 3:
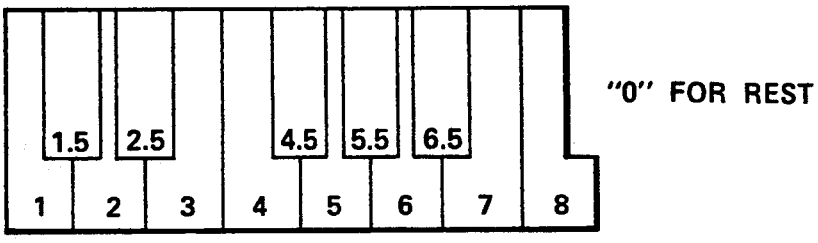
FIGS. 3*a* and *b* show examples of pitch data.
Figure 3:
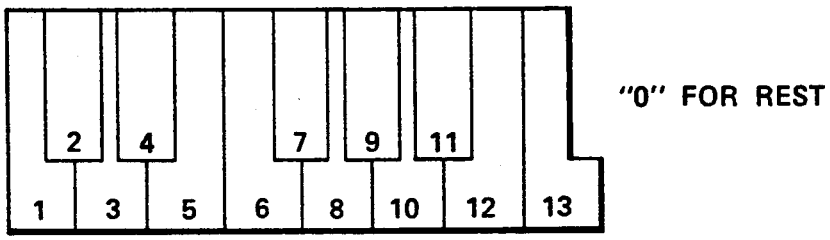

In the description hereinafter, it is assumed, unless otherwise stated, that the automatic composer uses pitch data allocation as shown in FIG. 3(*b*). That is, successive integral numbers with one increment for a half tone up are assigned to respective pitches of notes on scale. Rest is represented by the value of zero. Several other pitch data allocations may be employed and an example is shown in FIG. 3(*a*).

The minimum duration or time value of notes is assumed to be a sixteenth note. Namely, the data for sixteenth has a value of one while the data for eighth which is twice sixteenth has a value of two.

The unit of extraction segment and generation segment is assumed to be one measure. In this connection, chord progression information is also assumed to have one chord a measure.

Further, it is assumed, unless otherwise specified that the length of the motif or input melody is a single measure.

The length of each measure is assumed to be the same irrespective of the measure number.

For the sake of the description, it is assumed that each chord consists of four pitches. One type of chords consists of four independent voices such as C major seventh chord of do, mi, sol, and ti, while the other type of chords is triad with two voices having an octave relation each other. Thus, the triad of do, mi and sol is expressed here by four data for do, mi, so and do (octave up from do). In this connection, address locations for each chord in the chord member memory 2 are made up of four addresses with respective addresses storing values corresponding to the respective pitches of members. For the chord of do, mi, sol and do, for instance, the corresponding data are 1, 5, 8 and 13 respectively.

The above assumptions are merely for the purpose of the description.

FIG. 4 shows an example of input data for the description of the operation. The melody shown at (1) in FIG. 4 is a motif used in conjunction with the description of the operation hereinafter. Since the remaining portions in FIG. 4 are obvious per se, descriptions thereof are omitted here.

Figure 5:
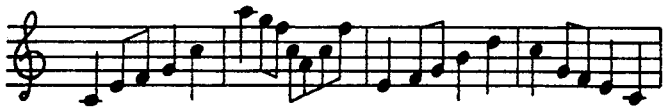
FIGS. 5*a* and *b* show examples of generated melody.
Figure 5:
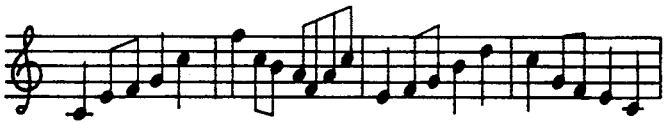

FIG. 5(*a*) and 5(*b*) shows examples of a generated melody. In the melody on the upper staff, the segment for the first measure is an input melody or motif while the other segments for the second, third and fourth measures are generated by the automatic composer.

The notations Fmaj, G7, Cmaj below the second, third, fourth measures indicates chords for these measures contained in the chord progression (see (3) in FIG. 4). The melody on the staff in FIG. 5(*b*) is a melody by the second generation by the automatic composer using the same motif after the procedure of learning. As is seen from FIG. 5(*b*) the melody segment for the second measure is corrected.

FIG. 6 shows a list of main variables used in the following flowcharts. Since FIG. 6 is selfexplanatory, descriptions thereof are omitted here.

Preparatory matters have been described and the operation will no be described in detail.

NONHARMONIC TONE EXTRACTION

Figure 7:
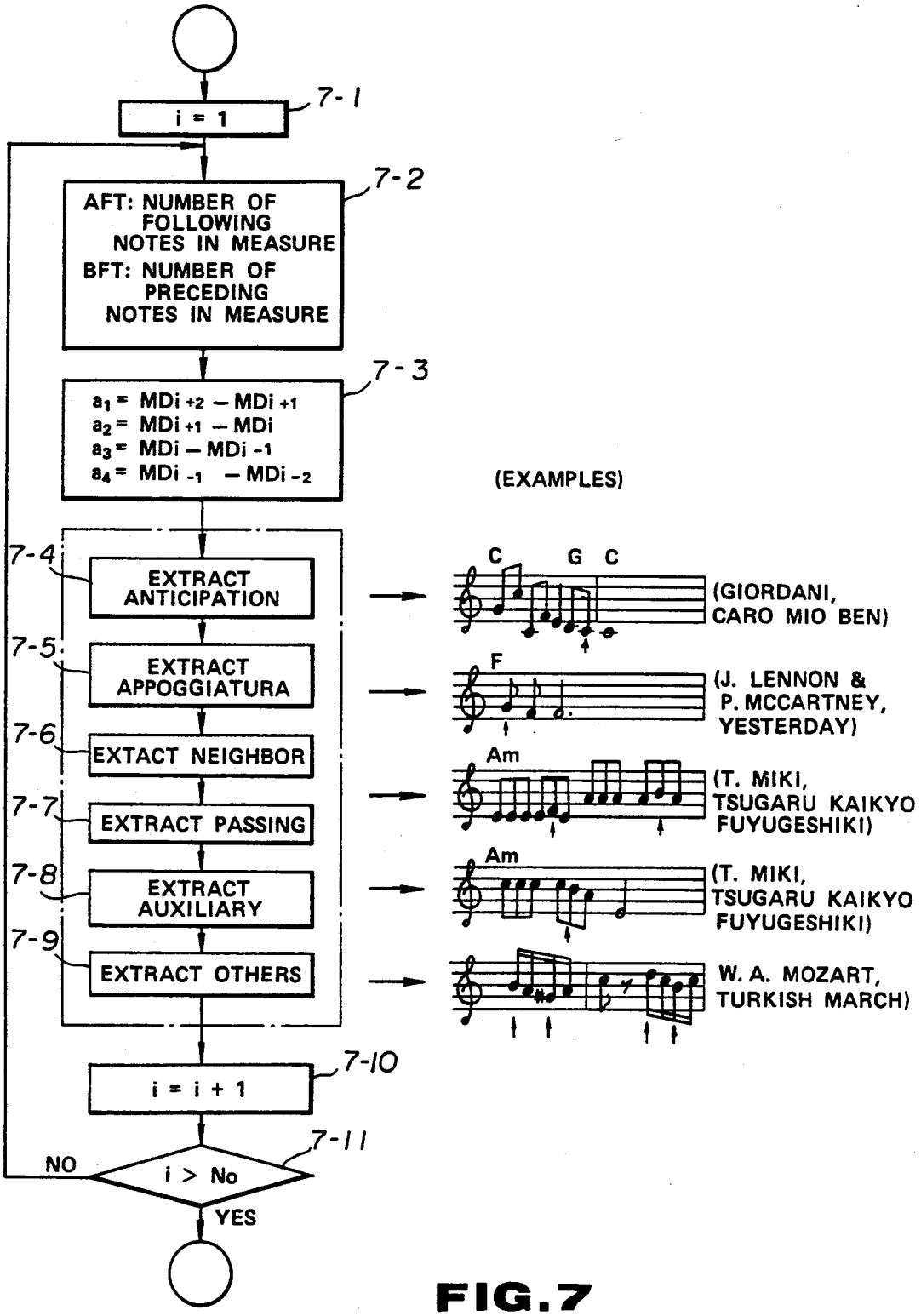
FIG. 7 is a flowchart of extraction of nonharmonic tone, also illustrating excerpts of famous music pieces used to explain nonharmonic tones.

FIG. 7 is a flowchart showing a nonharmonic tone extraction. In FIG. 7, i denotes a variable for motif data number. At 7-2, with respect to i-th tone, accurately, the i-th tone within the motif measure, computation is carried out of the number of tones following the i-h tone for the same measure with the result set in a variable AFT. Similarly, the number of tone preceding the i-th tone in the measure is computed and the result is set into a variable BEF. At 7-3, the pitch differences or the intervals formed between adjacent pairs of tones surrounding the i-th tone are obtained. For example, al is set at the pitch difference between the pitch MDi+2 of the tone which is the second tone after the i-th tone and the pitch MDi+1 of the tone which is the first tone after the i-th tone. However, when one of the MD's or motif pitches has a value of zero indicative of a rest or silence, the variable a is set at a unique value so that any nonharmonic tone will not be extracted for the tone before or after the rest in the process of 7-4 to 7-9. 7-4 through 7-9 is a process of extracting respective types of nonharmonic tones. The order of the operations is not restricted to that as illustrated. In principle, any order may be used. At 7-4 to 7-9, it is examined as to whether the i-th note (or a note before or after the i-th note) is a nonharmonic tone, and if the i-th tone satisfies the respective conditions for extraction, it will be identified as a corresponding type of a nonharmonic tone. As an aid to understanding, righthand part in FIG. 7 shows examples of respective types of nonharmonic tones by arrows on staffs. That is, a note denoted by an arrow is a corresponding type of a nonharmonic tone.

The note number i in the motif measure is incremented at 7-10, and the process storting from 7-2 is repeated until the note number exceeds the total number of the notes in the motif measure. Thus, when the operations 7-1 to 7-11 are completed, respective types of nonharmonic tones contained in the motif for one measure have been extracted.

Figure 8:
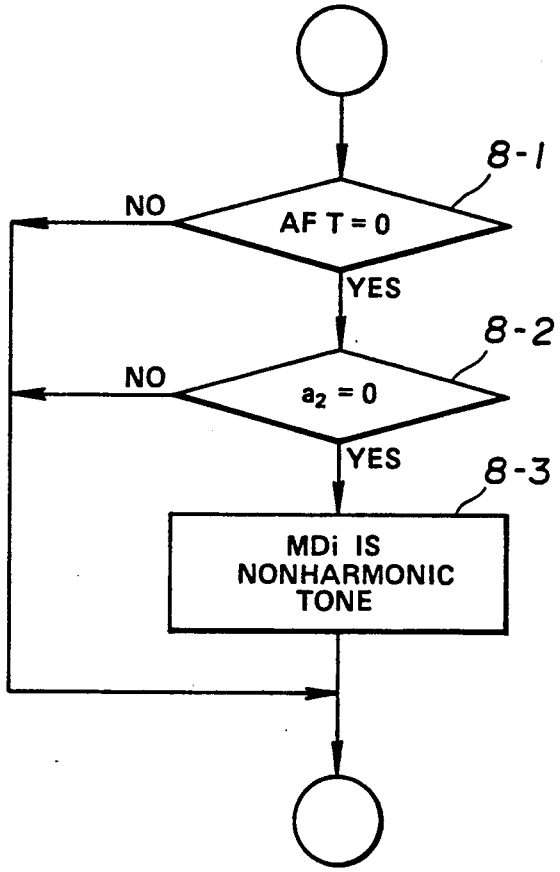
FIG. 8 is a flowchart of extraction of anticipation.

The details of operations 7-4 to 7-8 are illustrated in FIG. 8 to FIG. 12, respectively. For example, FIG. 8 shows detail of anticipation extraction. If the tone under examination, i.e. the i-th note is the last tone in the measure (AFT=0 is true), and has the same pitch with that of the first note in the next measure (a2=0 is true), the tone in question is a first kind of nonharmonic tone or an antipation note. This is what operations 8-1 to 8-3 means. That is, (i) if AFT is zero, and (ii) if a2 is zero, then (iii) MDi is a first kind of nonharmonic tone.

According to this representation, the above (i) and (ii) constitute a condition part (IF part or LHS) of the rule while (iii) forms an action part (conclusion part or RHS) of the rule.

In other words, the above rule of (i) through (iii) defines a first kind of nonharmonic tone in the present embodiment.

It is, therefore, possible to update the definition of the first kind of nonharmonic tone by modifying or correcting the rule.

At a level of implementation, the flowchart shown in FIG. 8 or rule of (i) to (iii) may be described either by means of procedural programming languages or by means of rules in rule-based systems. The latter may be preferable because it is easier to update or improve rules. Such rules may be expressed by, for instance, logic programming languages.

Figure 9:
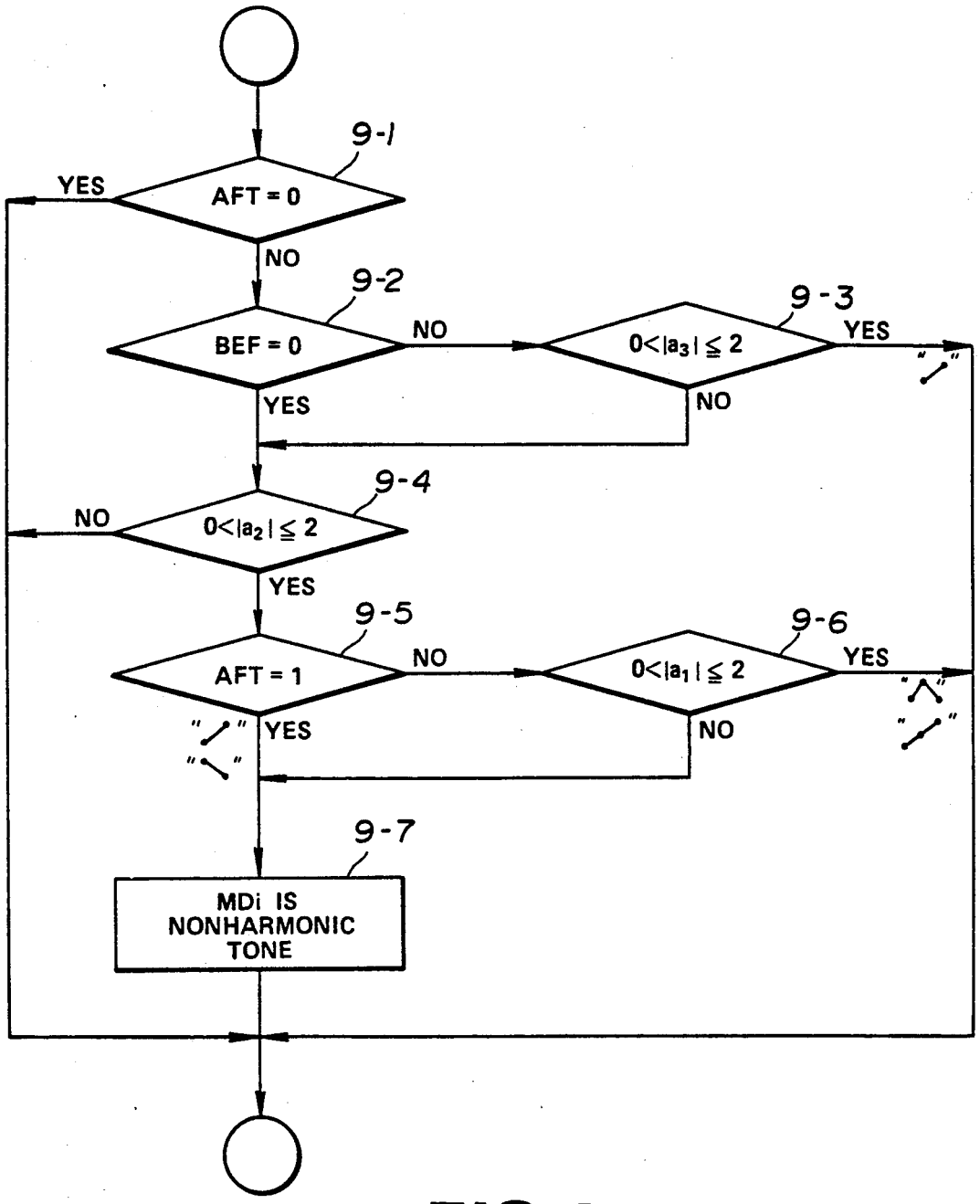
FIG. 9 is a flowchart of extraction of appoggiatura.
Figure 10:
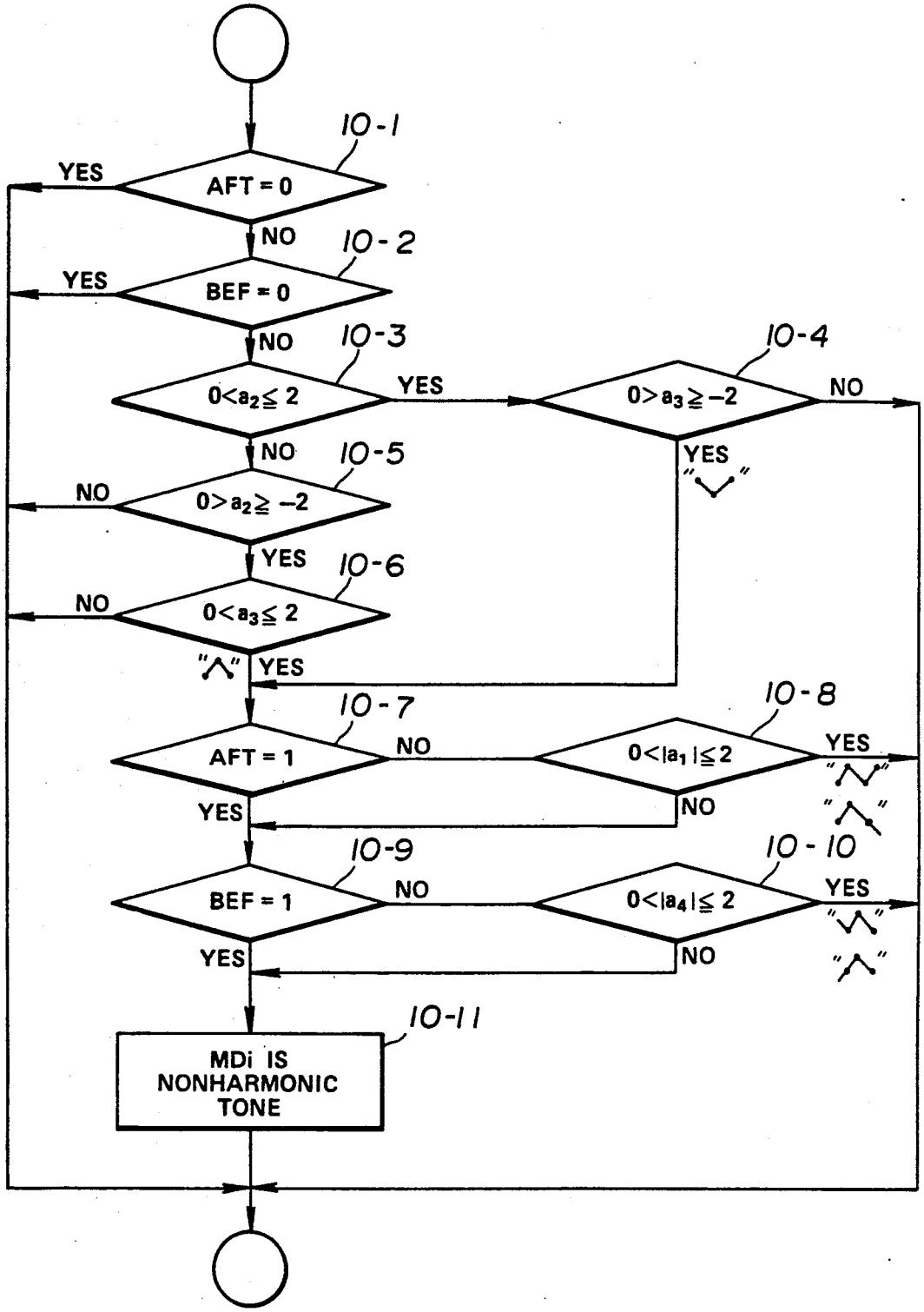
FIG. 10 is a flowchart of extraction of neighbor.
Figure 11:
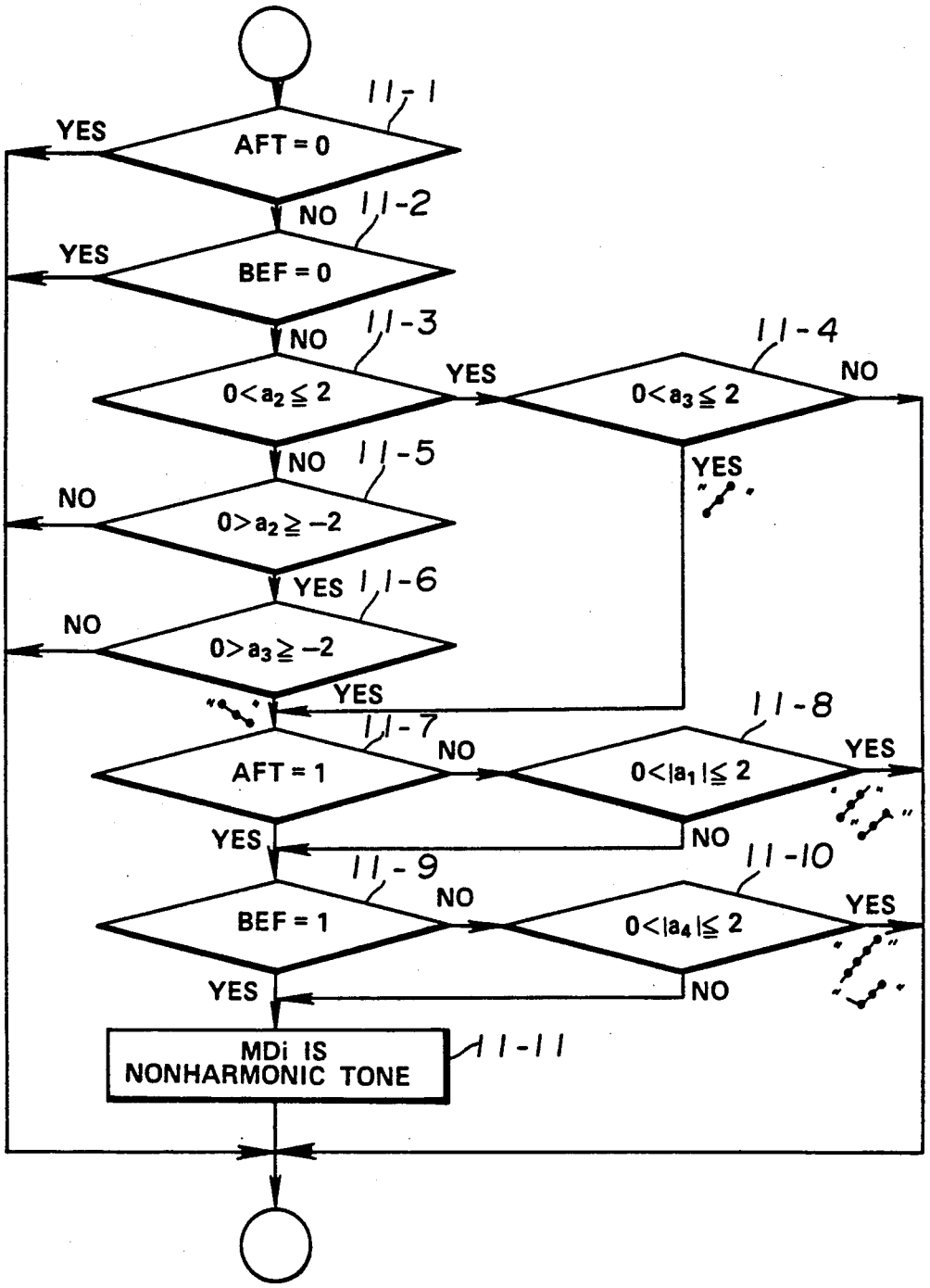
FIG. 11 is a flowchart of extraction of passing.
Figure 12:
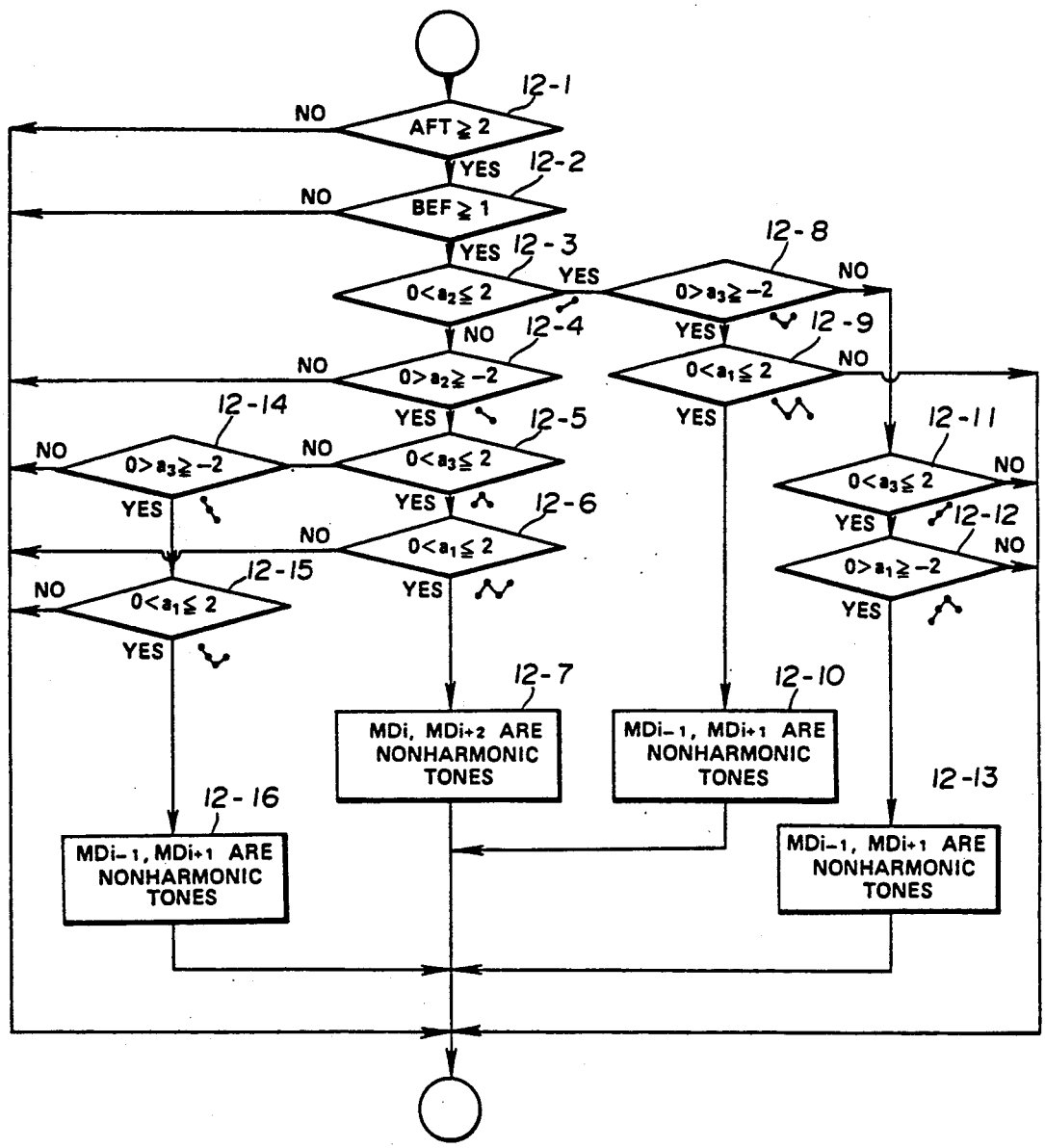
FIG. 12 is a flowchart of extraction of auxiliary.

From a viewpoint of rule, the other extraction processes 7-5 to 7-9 may be similarly regarded. That is, 9-1 to 9-7 in FIG. 9 is the rule or definition of second kind of nonharmonic tone. 10-1 to 10-11 in FIG. 10 is the rule of third kind of nonharmonic tone. 11-1 to 11-11 in FIG. 11 is the rule of fourth kind of nonharmonic tone. 12-1 to 12-16 in FIG. 12 is the rule of fifth kind of nonharmonic tone.

In either case, CPU6 (FIG. 1) carries out the processing in accordance with the flowcharts shown in these Figures and when the extraction condition is met, accept the associated tone as a nonharmonic tone.

Since the flowcharts in FIGS. 9 to 12 are selfexplanatory, individual descriptions thereof are omitted. Instead and as an aid to understanding, a brief description will be made of how nonharmonic tones are extracted from the motif of do, mi, fa, sol and dò for the first measure as illustrated in FIG. 5.

In this example, the total number of motif notes are five. First note is do (MD1=1). For this first note, AFT (the number of succeeding notes in the measure) will be 4 and BEF (the number of preceeding notes in the measure) will be zero at 7-2 in FIG. 7. Because AFT is found to be unequal to zero at anticipation extraction (FIG. 8), the first tone will not be recognized as an anticipation note. At appoggiatura extraction (FIG. 9), the first tone passes the checks for AFT and BEF but fails to pass the check for a2 at 9-4 because a2=MD2-MD1=mi-do=5-1=4. At neighbor processing (FIG. 10), the checks for AFT and BEF are passed but a2 check is not passed because a2 is equal to 4. Similarly, the conditions for passing and auxiliary shown in FIGS. 11 and 12 are not met. Accordingly, the first tone of do is not found to be any type of nonharmonic tone.

i is then incremented and the examination of the second note of mi is similarly performed. mi is not found to be a nonharmonic tone, either.

With i=3, the third tone of fa is analyzed as follows. In this case, AFT=2, BEF=2, al=5 (=dò-sol), a2=2 (=sol-fa), a3=1 (=fa-mi), and a4=4 (=mi-do).

The third tone skips the anticipation processing (does not meet the condition for anticipation), because a2 is unequal to zero. The appoggiatura extraction is skipped. The neighbor extraction is also skipped because a2=2 though a3=1. The condition for the passing is met. More specifically, the process goes from 11-1, passing 11-2, 11-3, 11-4 to 11-7 because a2=2 and a3=1. Since AFT=2 but al=5, the process goes from 11-7 to 11-8, then to 11-9. Here, because BEF=2 but a4=4, the process goes from 11-9 to 11-10 then to 11-11 where MDi, i.e., the third note pitch data MD3 of fa is accepted as a nonharmonic tone. The condition for auxiliary is not satisfied. As a result, the third tone of fa is found to be a passing tone.

Descriptions of processing for the fourth and succeeding tones will be omitted. No condition is met.

The algorithm or rule for extracting respective types of nonharmonic tones as illustrated in FIGS. 9 through 12 is a mere example. From the teaching of the present invention, a person skilled in the art will find it easy to prepare other definitions or rules. For example, conditions of tone duration ratio and/or down beat/up beat may be added to the conditions of interval between adjacent tones, if desired. One goal is to provide appropriate rules of nonharmonic tone extraction from motif or melody input by users having insufficient knowledge of music. Those rules which provide good chance of success in nonharmonic tone extraction from various motifs are desirable.

MOTIF PARAMETER EXTRACTION

After the motif input from a user is evaluated in respect of its nonharmonic tones by the above function of nonharmonic tone extraction, parameters characterizing the motif are extracted by the function of motif parameter extraction. The description will now be made of such motif parameter extraction.

Figure 13:
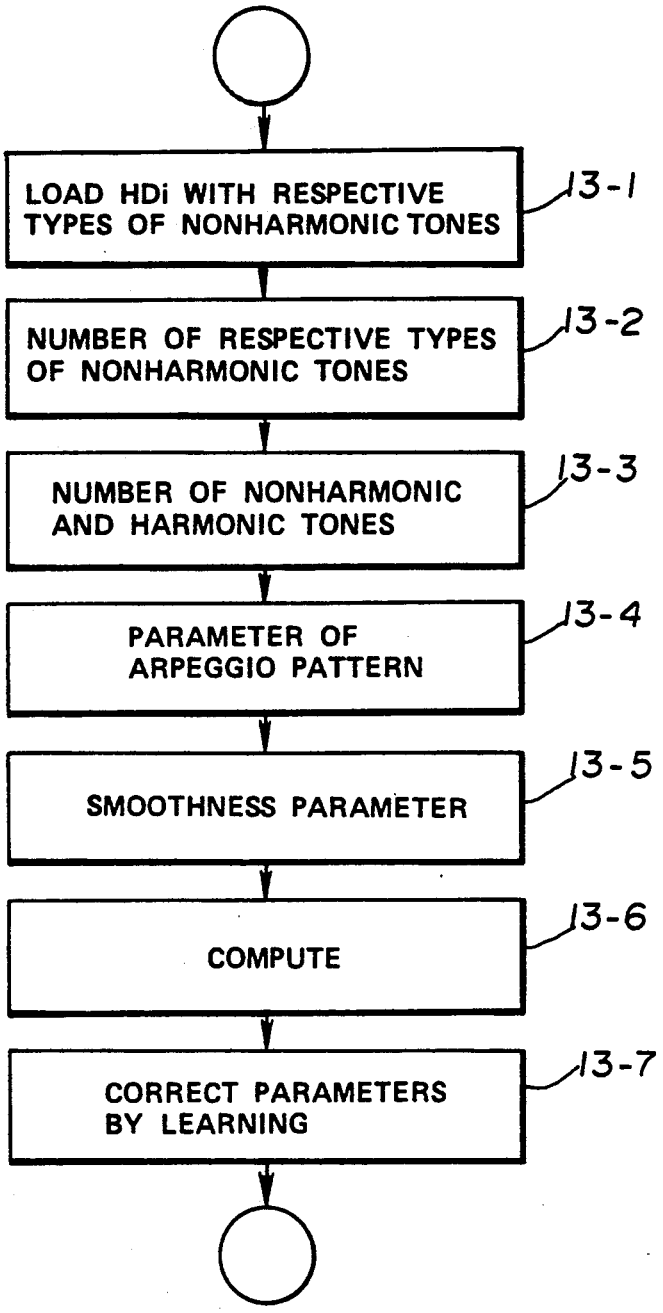
FIG. 13 is a flowchart of extraction and computation of parameters.

FIG. 13 is a flowchart of processing which includes motif parameter extraction. In FIG. 13, operations at 13-1 to 13-4 are concerned with the motif parameter extraction 13-6 denotes a processing of computing or generating parameters C and will be described in other section. 13-7 is a processing of correction of parameters by learning, which will also be described in other section. At the motif parameter operations 13-1 to 13-4, motif pitch data stored in the motif memory 4 (FIG. 1) are processed in the work memory 7 for parameter extraction. For example, in place of variable MDi of motif pitch data, variables or registers HDi having values unique to respective types of nonharmonic tones are used.

Figure 14:
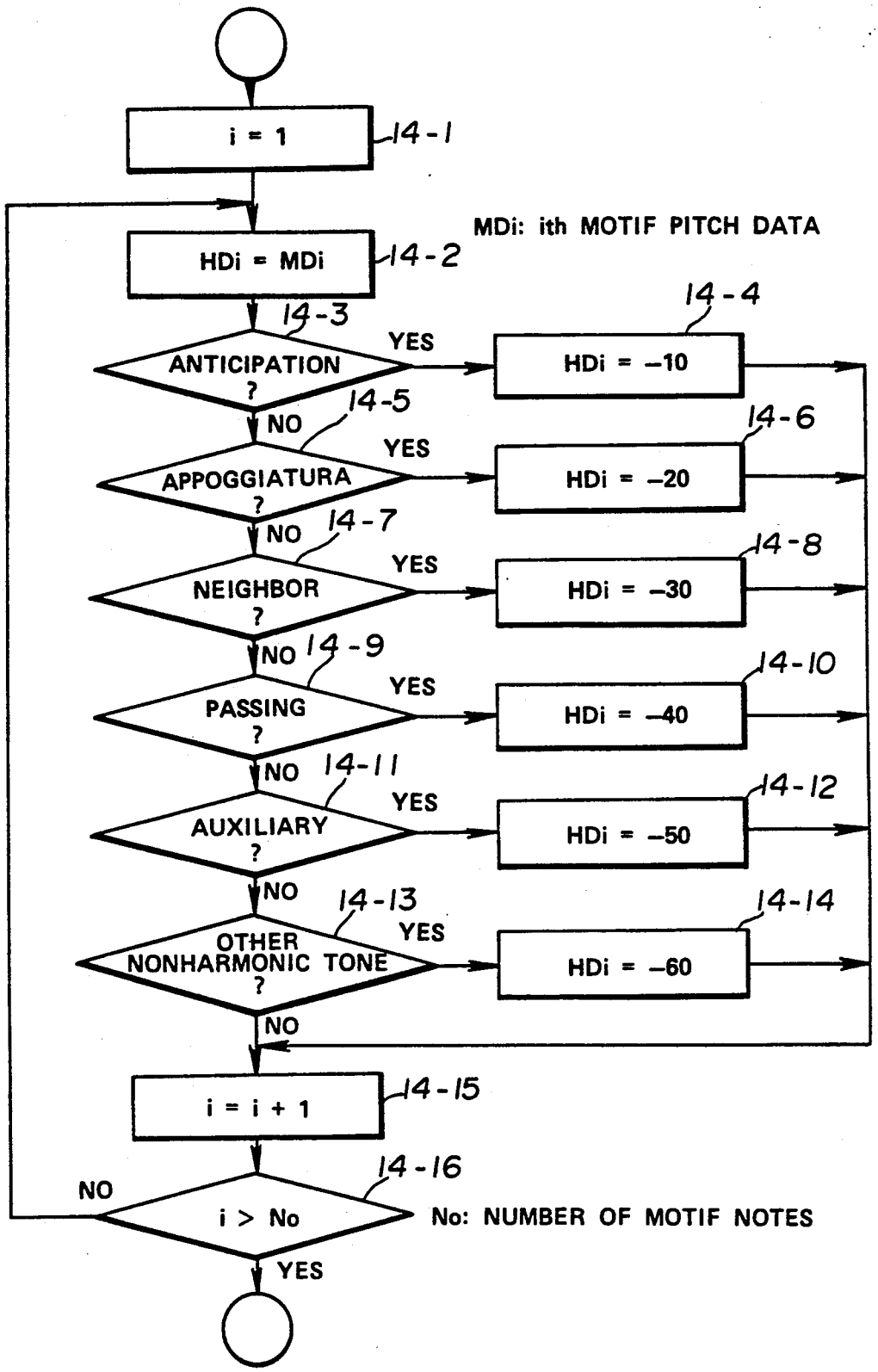
FIG. 14 is a flowchart of loading HDi with respective types of nonharmonic tones.

FIG. 14 shows details of the operation 13-1 in FIG. 13 where data of nonharmonic tones of the motif are converted into unique constants while data of harmonic tones are left as they are. In FIG. 14, i denotes a variable of number i in the motif measure. Since the flow of 14-1 to 14-16 is selfexplanatory, detail description thereof is omitted.

Instead, the result of the operation on the motif at the first bar in FIG. 5 is described. For this motif (do, mi, fa, sol, dò; corresponding numerical expressions are MD1=1, MD2=5, MD3=6, MD4=8 and MD5=13), only the third tone of fa was found to be a nonharmonic tone, in particular, a passing tone while the others were found to be harmonic tones, as stated in the section of nonharmonic tone extraction. Thus, the results of the processing in FIG. 14 will be HD1=1, HD2=5, HD3=−40 (identifier of passing) and HD4=13.

The processing in FIG. 14 may be performed at the stage of nonharmonic tone extraction.

It should be memorized here that if HDi is positive, the value indicates the pitch of a harmonic tone, if HDi is zero, i-th motif note is a rest (see (b) in FIG. 3), and if HDi is negative, the tone is a nonharmonic tone and its value indicates the type of nonharmonic tone.

Figure 15:
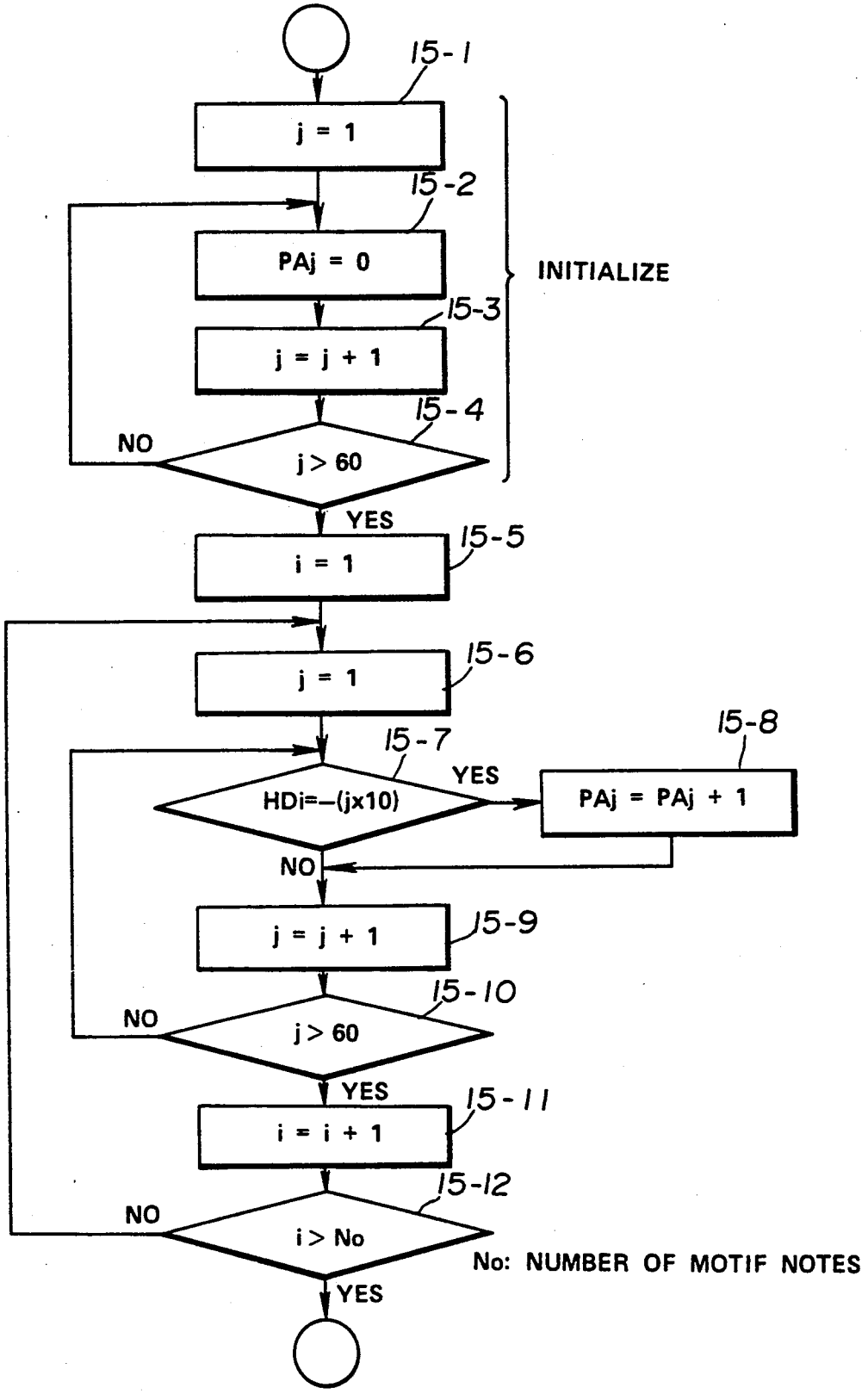
FIG. 15 is a flowchart of extraction of numbers of respective types of nonharmonic tones as motif featuring parameters PA1–PA6.

FIG. 15 shows details of the operation 13-2 in FIG. 13 where the numbers of respective types of nonharmonic tones are extracted as motif parameters. In the Figure, PAj denotes parameters characterizing motif (also referred to as parameters A) or registers storing such parameters. At 15-1 to 15-4, these parameters are initialized. In the following operations 15-5 to 15-12, the number of anticipation tones contained in motif (covering a measure) is stored in PA1, the number of appoggiatura in PA2, the number of neighbor in PA3, the number of passing in PA4, the number of auxiliary in PA5 and the number of other nonharmonic tones in PA6.

Figure 16:
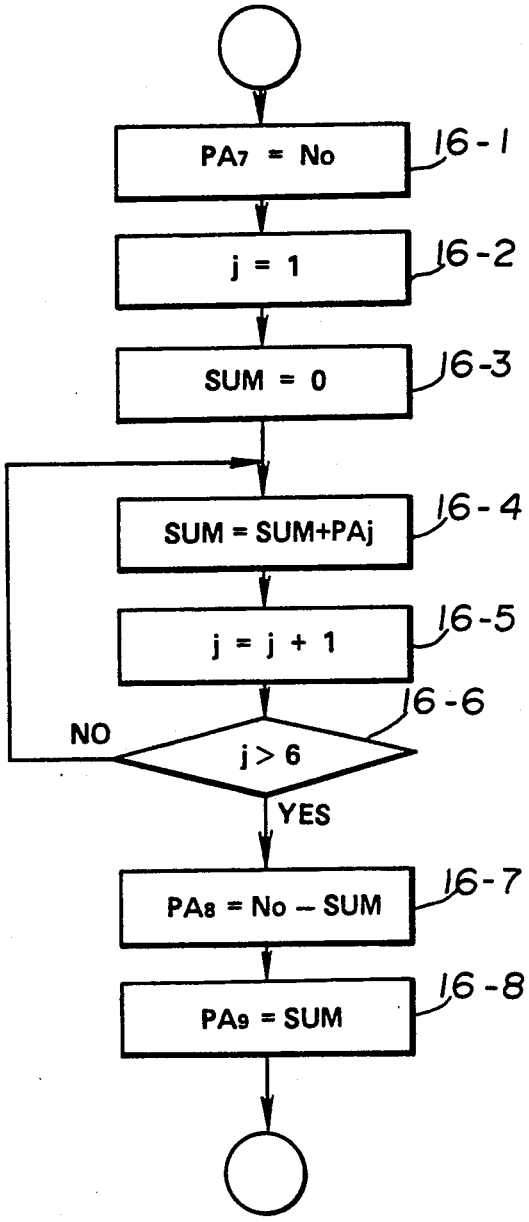
FIG. 16 is a flowchart of extraction of numbers of nonharmonic tones, harmonic tones and motif tones as motif featuring parameters PA7–PA9.

FIG. 16 shows details of the operation 13-3 in FIG. 13 where the total number of nonharmonic tones contained in motif in respect of one measure and the number of harmonic tones are computed. By performing the illustrated operations 16-1 to 16-8, the number of notes contained in motif is stored in PA7, the number of harmonic tones in PA8 and the number of nonharmonic tones in PA9.

Figure 17:
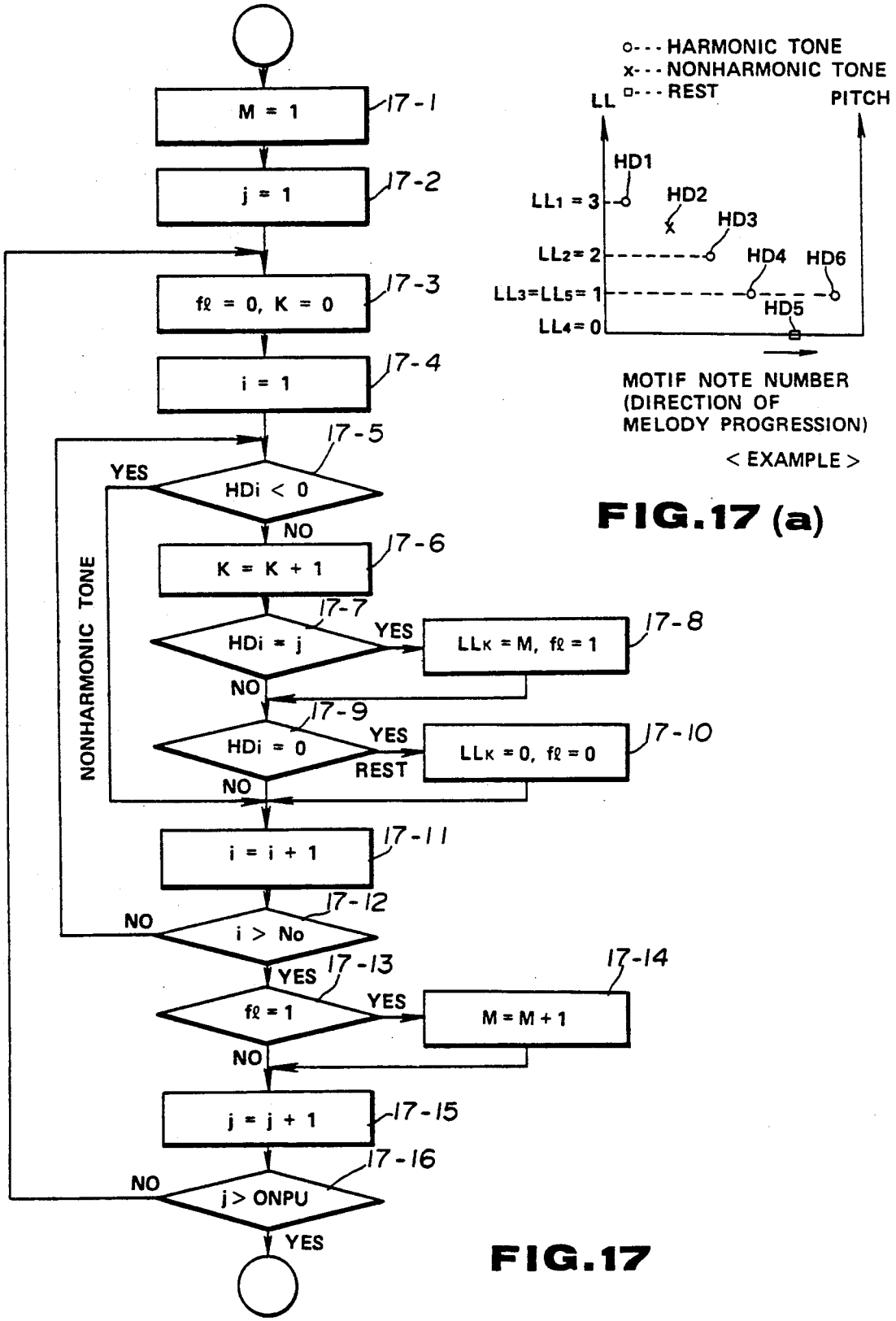
FIG. 17 is a flowchart of extraction of arpeggio pattern as a motif featuring parameter LL, also illustrating a graphic representation of an example (FIG. 17(*a*)) of the extraction process.

FIG. 17 shows details of the operation 13-4 in FIG. 13 where a parameter indicative of the pattern of arpeggio (time sequence of harmonic tones) is extracted from the motif. The primary purpose of the operation is to allocate respective harmonic tones distributed along the stream of motif to relative pitch numbers among the set of the harmonic tones in the motif. Secondary purpose is to find out which numbered note is a rest. In the Figure, variable OMPU indicates the range of tone pitches used in the automatic composer system and is selected to encompass the range of input motif.

In the flow of 17-1 to 17-16, tone pitches are scanned starting from the lowest pitch of the system range and examination is made as to whether the tone (harmonic tone) is contained in the motif. Only if this is the case, variable M of harmonic tone number is incremented so that the incremented value of M is set into LLi. If HDi is zero i.e. the i-th motif data is a rest the corresponding LLi is set at zero to store that fact. For negative HDi, the process is skipped.

FIG. 17(*a*) shows example of the result of the operation. In this example, the first tone of the motif (indicated by HD1) is a harmonic tone and the highest harmonic tone among the illustrated motif tones. The second tone HD2 is a nonharmonic tone. The third tone HD3 is a harmonic tone but lower than the first harmonic tone. The fourth note HD4 of the motif is a harmonic tone (the third appearing harmonic tone of the motif) which is further lowered. The fifth data HD5 of the motif is a rest. The sixth and last note HD6 is a harmonic tone and has the lowest pitch (as low as the fourth note) in the motif. As is seen from FIG. 17(*a*), the stream of the motif is a downward pattern as a whole. The result of the process in FIG. 17 for this motif is as follows. For HD5, zero indicative of a rest is assigned to its LLi. For HD4, "1" indicative of the lowest harmonic tone in the motif is assigned to its LLi. For HD6, same operation is executed. For HD3, "2" indicative the second lowest harmonic tone is assigned to its LLi. Since HD2 is a nonharmonic tone, there is no corresponding LLi. Since HD1 is the highest and third lowest harmonic tone among the motif tones, "3" is given to its LLi. Thus, LL1 for HD1 (the first appearing harmonic tone) is set at "3", LL2 for HD3 (the second appearing harmonic tone) at "2", LL3 for HD4 (the third appearing harmonic tone) at "1". After the third harmonic tone, comes a rest so that LL4 is set at "0" LL5 for the next harmonic tone HD6 is set at "1". This specifies the stream or pattern of harmonic tones (including rests here) in the motif. Namely, {LL}=(LL1, LL2, LL3, LL4, LL5)=(3,2,1,0,1) has been obtained.

The parameter of the pattern of harmonic tones (arpeggio) is, though not written in the form of PA, the one characterizing motif. If the pattern is utilized without any modification in the process of melody generation to be later described in more detail, a melody will be formed involving a high consistency with a characteristic of repeating.

In case of the motif of do, mi, fa, sol and dò in FIG. 5(*a*), LL1 for the first appearing harmonic tone do is set at "1", LL2 for the second appearing harmonic tone mi is set at "2", LL3 for the third appearing harmonic tone sol is set at "3" and LL4 for the fourth appearing harmonic tone do is set at "4". This is a pattern of upward motion.

Figure 18:
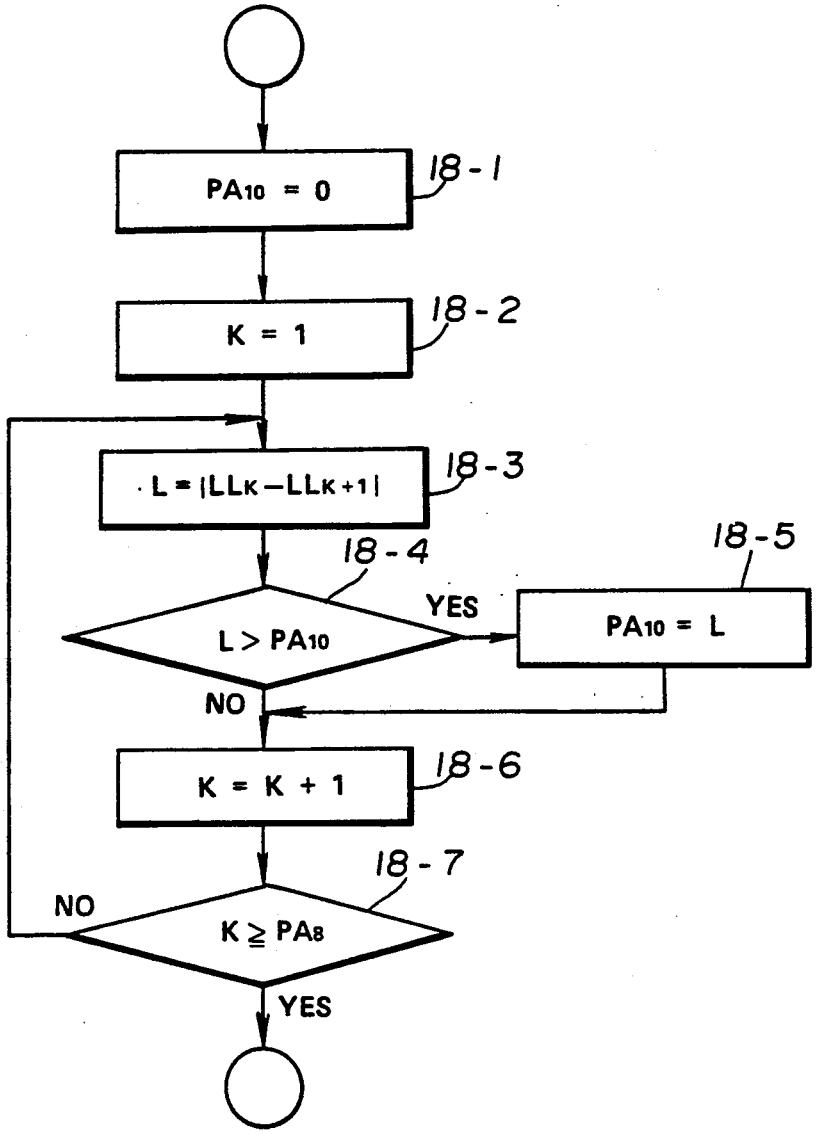
FIG. 18 is a flowchart of extraction of smoothness of arpeggio pattern as a motif featuring parameter PA10.

FIG. 18 shows the details of the operation 13-5 in FIG. 13 where the degree of smoothness (degree of skip) is computed. In the illustrated operations 18-1 to 18-7, the value of smoothness is obtained by examining the difference between LLs of adjacent harmonic tones. The result is set in PA10. In particular, the maximum value among the differences between adjacent pairs of LLs is set in PA10.

The algorithms illustrated in FIGS. 14 to 18 are for exemplification only. From the teaching of the present invention, it is easy for a person having an ordinal skill in the art to program other algorithms. Functionally equivalences which are implemented by, for example, CPU may be employed.

Other motif featuring parameters such as rhythm parameters may also be extracted if desired. This concludes the description of the motif featuring parameters.

MELODY GENERATION

The melody generating function F3 (FIG. 2) serves to automatically generate a melody in accordance with the above described motif featuring parameters and the chord progression.

In the present embodiment, the melody generating function primarily comprises a function which compute parameters C controlling or characterizing a melody to be generated and a function which generates a melody in a concrete form. The latter function includes means for generating an arpeggio in respect of a chord in progress by referencing the chord progression information and means for adding nonharmonic tone(s) before, after an arpeggio tone (harmonic tone) and/or between arpeggio tones.

PARAMETERS C GENERATION

The function of generating parameters C is part of the function of melody generation F3. Before turning to the detail description thereof, fundamental properties of music pieces will be briefly reviewed.

In general, it is said that music involves consistency and variety. For example, those melodies having phrases recurring a number of times are most consistent. Variety comes out when musical elements such as the range of melody vary iith time. Consistency and variety exist in terms of time. Of course, degrees of consistency and variety differ significantly from music to music. Some music pieces place emphasis on consistency. Some music pieces have melodies which are constantly changing with time. However, a completely randomized line of time values and pitches of tones has not been and will not be accepted as a piece within the meaning of music. In a sense music is the expression of emotion and a totally disordered and irregular line of tones makes no sense.

The present automatic composer produces a melody in compliance with a chord progression, thus introducing a sense of order.

Furthermore, the present automatic composer extracts motif featuring parameters from the motif input by a user and produces a melody in accordance with the extracted parameters. Hence, the motif will be reflected in the generated melody and the essence of the input melody will be held throughout the composition.

As mentioned, consistency and variety in a music piece relates closely to time. As often experienced, a phrase which is the same as the previous one or somewhat modified therefrom comes out once again. Therefore, to control the generation of melody using rules which are fixed over a relatively long period of musical time (throughout, for example, the entire length of music composition) would be generally disadvantageous and bring about unsatisfactory results. The present automatic composer contemplates this point. The present automatic composer divides the entire length of piece to be composed into segments each having a suitable length. Each set of parameters C is assigned to each segment for control of melody. Each segment of melody is produced by corresponding set of parameters. In the present embodiment, a measure is selected as the length of segment.

Each parameter C (PC) is expressed by a function of segment number i. That is, parameters C depend on segment number. This is a first property of parameters C. Actually, chord progression has also a similar character.

Parameters C depends also upon parameters characterizing motif. This is a second property of parameters C. In this case, motif featuring parameters may be incorporated into parameters C throughout a music piece regardless of segment number.

Figure 19:
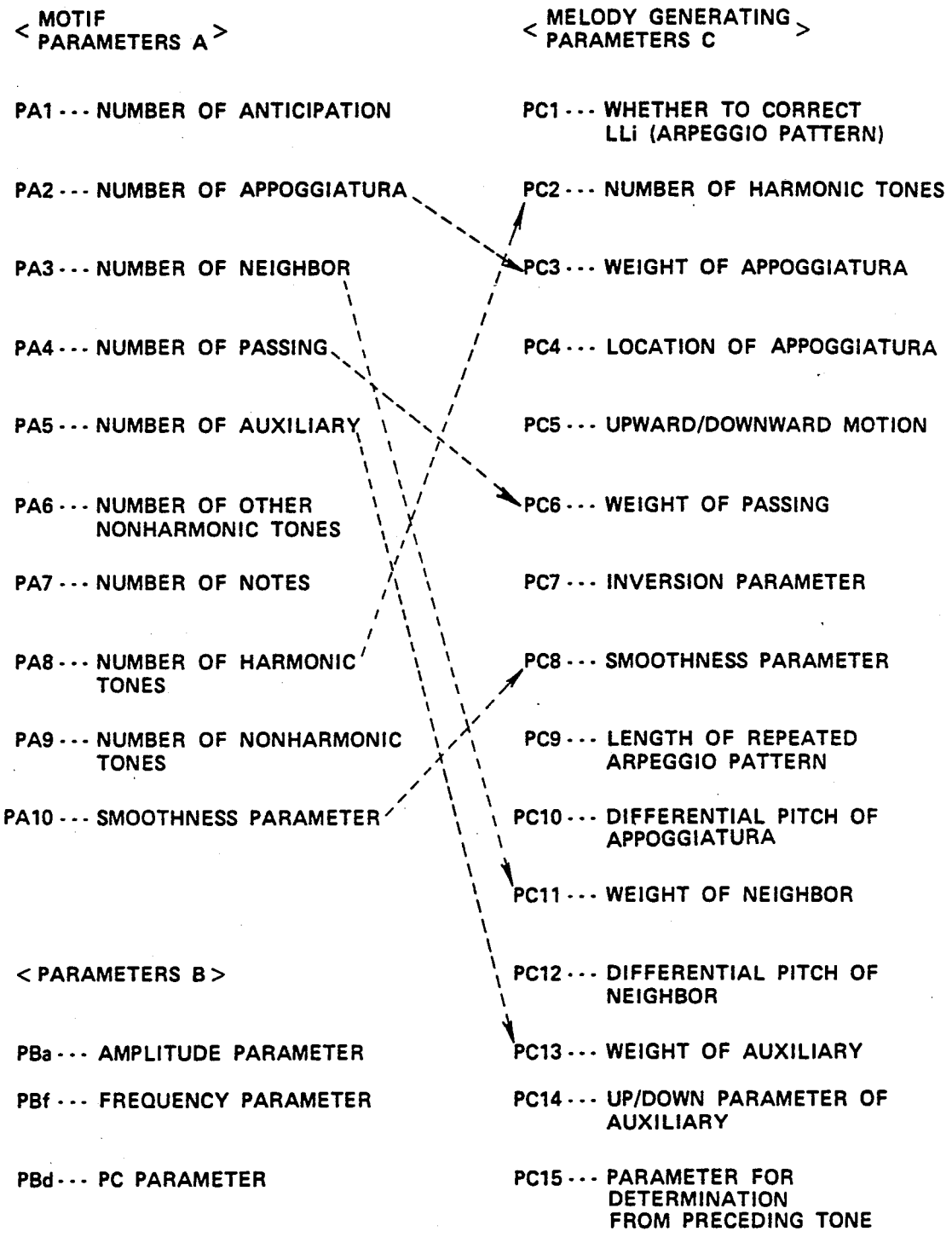
FIG. 19 illustrates a mapping among parameters.

Referring to FIG. 19, there is shown a parameter mapping. In the column of motif parameters A, there are shown examples of motif featuring parameters as extracted by the above described process of motif parameter extraction. The parameter LLi of arpeggio pattern is not shown. In the column of melody generating parameters C, there are shown examples of parameters C. Dotted arrows linking parameters A to parameters C indicate that each former parameter A is reflected in each latter parameter C. The illustrated relationship by dotted arrows is an example. Some parameters C are shown independent from parameters A. One reason thereof is that a relatively short motif as long as one measure is employed in the present embodiment, and the extraction means does not extract motif parameters more than what are needed or unreliable parameters.

In FIG. 19, there are also shown parameters B which include an amplification parameter PBa, a frequency parameter PBf and a DC parameter PBd. If the means for generating parameters C is of a computational type, it will make use of these parameters as a source of information thereto.

In such a case, each parameter C is defined by a computable function of segment number such as measure number i and other variables including at least one of PBa, PBf, PBd and PA (parameter A).

That is, each parameter C or PC has a form of:

$$PC=F(i, PA, PBa, PBf, PBd)$$

Actually, some PC parameters are given by PC=f(i, PA) or PC=f(i, PBd) etc., and are independent from some parameters.

Figures 20A, 20B, 20C, 20D, 20E, 20F, 20G:
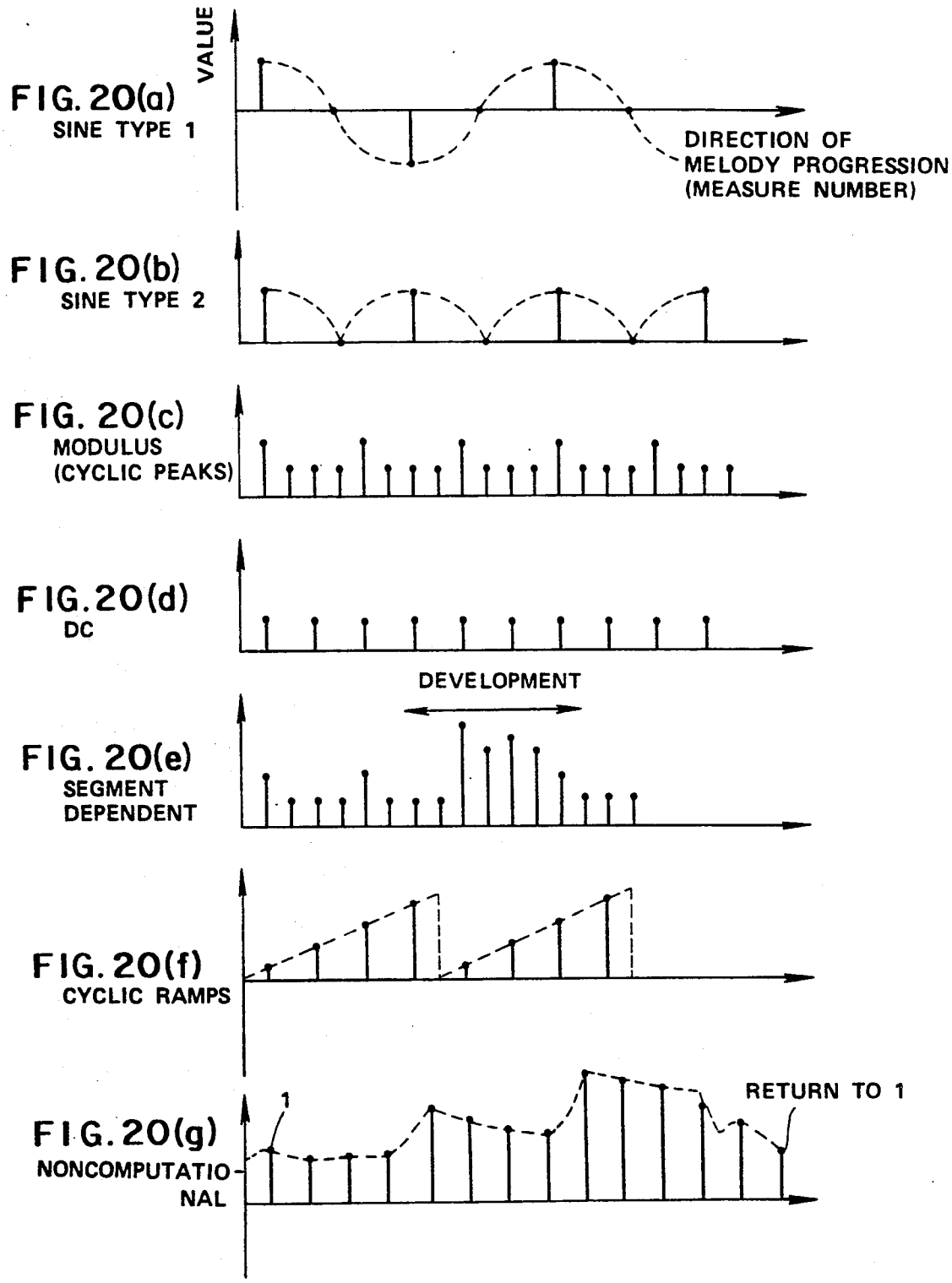
FIGS. 20*a–g* are graphic representations of examples of characteristics of parameter C (melody control parameters)
Figure 21A:
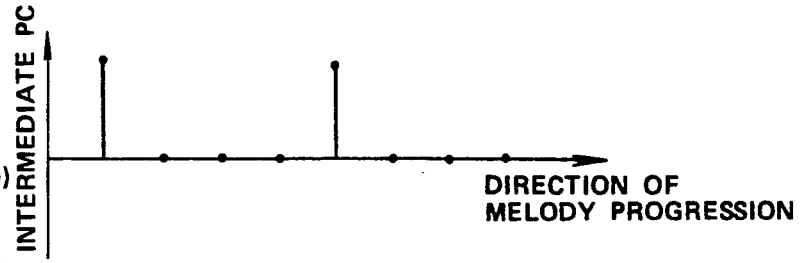
FIGS. 21*a–e* are graphic representations of examples parameter randomization.
Figure 21B:
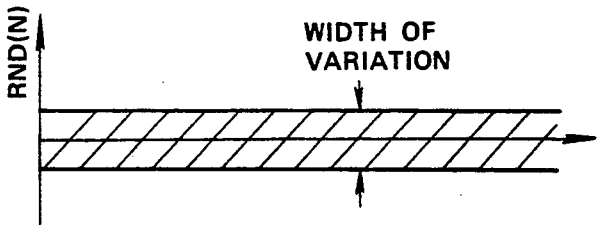
Figure 21C:
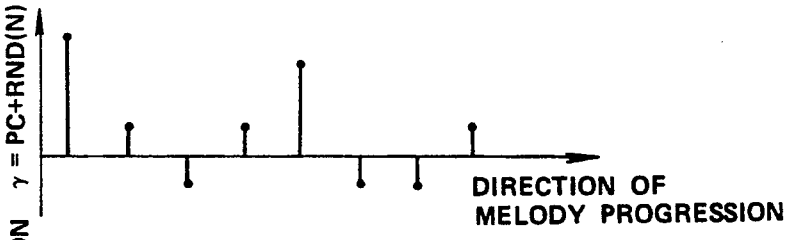
Figure 21D:
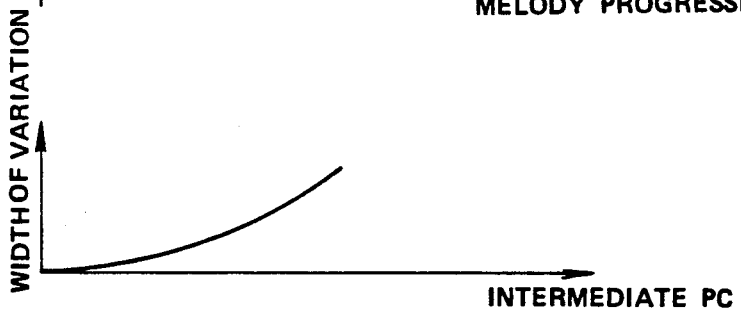
Figure 21E:
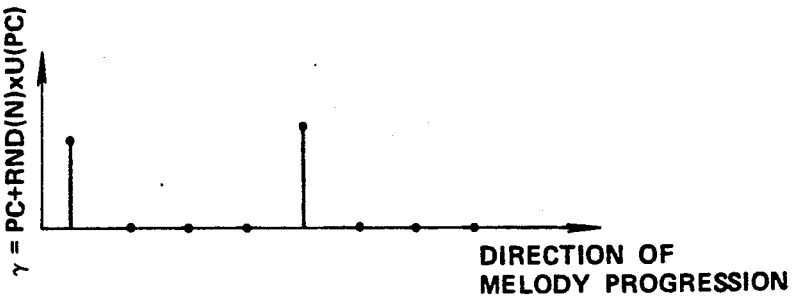

FIGS. 20(*a*)–20(*g*) shows examples of characteristics of parameters C in a graphic representation. Horizontal axis denotes the progression of music piece or measure number. A sine type (1) is illustrated in FIG. 20(*a*). Parameters C of this type may be produced by computation including a cosine or sine. For example, PC is given by:

$$PC=\cos(i\times 2\pi/PBf)\times PBa$$

where i is a measure number.

Another sine type (2) is indicated in FIG. 20(*b*). This type is non-negative and given for example by:

$$PC=|\cos(i\times 2]/PBf)\times PBa|$$

More specifically, F is computed by $F=\cos(i\times 2\pi/PBf)\times Pba$. If F>0, then PC=F and if f<0 then PC=−F.

FIG. 20(*c*) indicates parameter C of cyclic peak type which is, for example obtained as follows. First compute F by $$F=i \text{ MOD } PBf.$$

(quotient resulting from division of i by PBf) If F is zero (measure number i is just divisible by frequency PBf), then PC=constant. If F is not equal to zero, then PC is a different constant (for example PA).

FIG. 20(*d*) indicates a DC type. Computation of this type is obvious.

FIG. 20(*e*) is an example of segment dependent type. The illustrated one is a mix of cyclic peaks for some segments with a different characteristic for a particular segment such as development. This type may be, for example, produced as follows. In addition to the computation of cyclic peaks, computation of a different function is executed for i-th segment if that i satisfies N1<i<N2. The result of such computation becomes PC. Of course, segments other than N1<i<N2 are not necessarily of the cyclic peak type.

FIG. 20(*f*) is an example of a cyclic ramp type. This type may be, for example, given in the following manner. First compute F=Ki (where K is constant). Seek an integer N which satisfies:

$$(N+1)\times PBf>F>N\times PBf$$

or $N=INT(F/PBf)$.

Then compute:

$$F-N\times PBf\,(=Ki-N\times PBf).$$

The result is used as the value of parameter C. The characteristics in FIGS. 2D(*a*)–2D(*f*) are mere examples of parameters C which are easy to compute. They can be components or constituents of parameters C. Any combination of types may be employed as individual parameters C: for example, combination of sine types having different frequencies, combination of sine type and DC type, combination of sine type and cyclic peak type etc. In this connection, FIG. 22A shows an example of computation of PC2 (parameter of the number of harmonic tones for a melody to be generated) and PC8 (parameter of smoothness of a melody to be generated). Also, FIG. 22B shows how PC2 varies with measure number i for several sets of constituent parameters PBf2, PBa2, PBd2 and PA8.

The computational type has an advantage that it conserves capacity of storage locations. The computational type is employed in the present embodiment in which CPU6 (FIG. 1) references the parameters B on parameter B memory 5 and the motif parameters to generate parameters C on a single measure basis. This is done at the operation 13-6 in FIG. 13.

In contrast, characteristic of parameters C indicated in FIG. 20(*g*) is not suitable for computation and may be developed by selecting appropriate parameters from a data base storing a set of sequences of parameters C (i) controlling respective measures of music composition.

In either case, parameters C have the first character as stated, which is apparent from examples in FIGS. 20(*a*)–20(*g*). That is, parameters C have values assigned to each segment (or measure in the illustrated embodiment) of music composition.

Further, parameters C have the second character that they reflect the motif featuring parameters. For n example, DC type illustrated in FIG. 20(*d*) may become a parameter C or a DC component thereof. The parameter C thus produced has a motif feature regardless of measure number.

All parameters C of computation types as exemplified in FIG. 20(*a*)–20(*f*) have definite regularities. Such regularities are often desirable. In other words, such parameters C are univocally determined once constituent parameters (measure number, parameters A, parameters B etc.) and the formula of their computation are given.

However, it is often the case that more liberal or flexible regularities are desirable. A user may prefer those melodies which vary more or less each time the user requests the generation of a melody to those melodies which are identical to previous ones as long as the same motif is given. The present embodiment also takes these factors into consideration. This is a randomized function. Though not shown in FIG. 2, such function may be built into the parameter computation function F31, the arpeggio generation function F32, or the non-harmonic tone generation function F33, or any combination thereof with appropriate charging of the work among them.

In FIGS. 21(*a*)–21(*e*) is assumed for the sake of description that the parameter computation function F31 introduces randomization into parameters C internally generated. In this scheme, parameters C before randomized are intermediate parameters while parameters C after randomized are final parameters C which directly control the generation of a melody.

FIG. 21(*a*) illustrates a characteristic of parameter C before randomized which belongs to the cyclic peak type indicated in FIG. 20(*c*). FIG. 21(*b*) shows an example of a characteristic of a random function. What is meant by this is that the randomization is introduced regardless of the melody progression. Secondly, this means that the value of random variable is combined with (added to, for example) the value of intermediate parameter PC to develop the final parameter.

Assume, for instance, that a pseudrandom function RND(N) generates (2N+1) integers of −N, −N+1, . . . 0, +1, . . . , +N with equal chances: the technique of generating such a pseudrandom function is well known in the art. The result RND(N) is added to an intermediate parameter C (expressed by PC):

$$PC+RND(N)$$

The resultant value becomes the final parameter C (expressed by $\gamma$):

$$\gamma = PC + RND(N)$$

The randomized parameter $\gamma$ has possible values which swing through discrete points having a width of 2N and centering the original value of PC.

FIG. 21(*c*) shows an example of the characteristic of a randomized parameter.

Another example of a random characteristic is shown in FIG. 21(*d*). This example of FIG. 21(*d*) differs from that shown in FIG. 21(*b*) in that the width of randomization or variation depends on the value of intermediate PC. In the illustrated example, the width of variation increases as the intermediate PC increases. This is achieved, for example, by multiplying RND(N) by an increasing function U(PC), and adding the value of PC to the product. This is given by:

$$\gamma = PC + RND(N) \times U(PC)$$

An result of this type of randomization of PC is illustrated in FIG. 21(*e*).

From the comparison of FIG. 21(*e*) and (*c*), it is noted that in FIG. 21(*e*) there is no change at a point where the value of PC (before randomization) is equal to zero. This kind of parameter may be utilized as a determining factor in the melody generation function. For example, the parameter may inhibit adding of a certain nonharmonic tone when its value is zero. The parameter may also be utilized to control the position where a nonharmonic tone is to be inserted. One expanded version of FIG. 21(*d*) is to make different values of random number occur with unequal or distorted chances depending on the values of referenced PC. Such random numbers having a distorted probability distribution may also be used as a parameter controlling the generation of a melody.

The matter common in both FIGS. 21(*b*) and (*d*) is that each function of randomization gives a width of variation using the original value of PC as a reference. In a broader sense, the original value of PC controls or limits the randomized result. Another common factor is that the width of variation is fixed with respect to the melody progression. This will often ensure desirable results. It is possible, however, to select such randomization th width of which varies with measure number, if desired.

In general, the greater the randomization becomes, the greater melodies vary at every cycle of melody generation, though this depends on the type of parameter C. The randomization using the original value of PC as a reference serves to provide a fine control of melody generation while depending on the width of variation.

Another advantage of the randomization is that it provides characteristics of parameters of noncomputational type as illustrated in (g) FIG. 20(*g*) by means of chances.

MELODY GENERATION

The description will now be made of the generation of melody in concrete form in accordance with the present embodiment.

Figure 23:
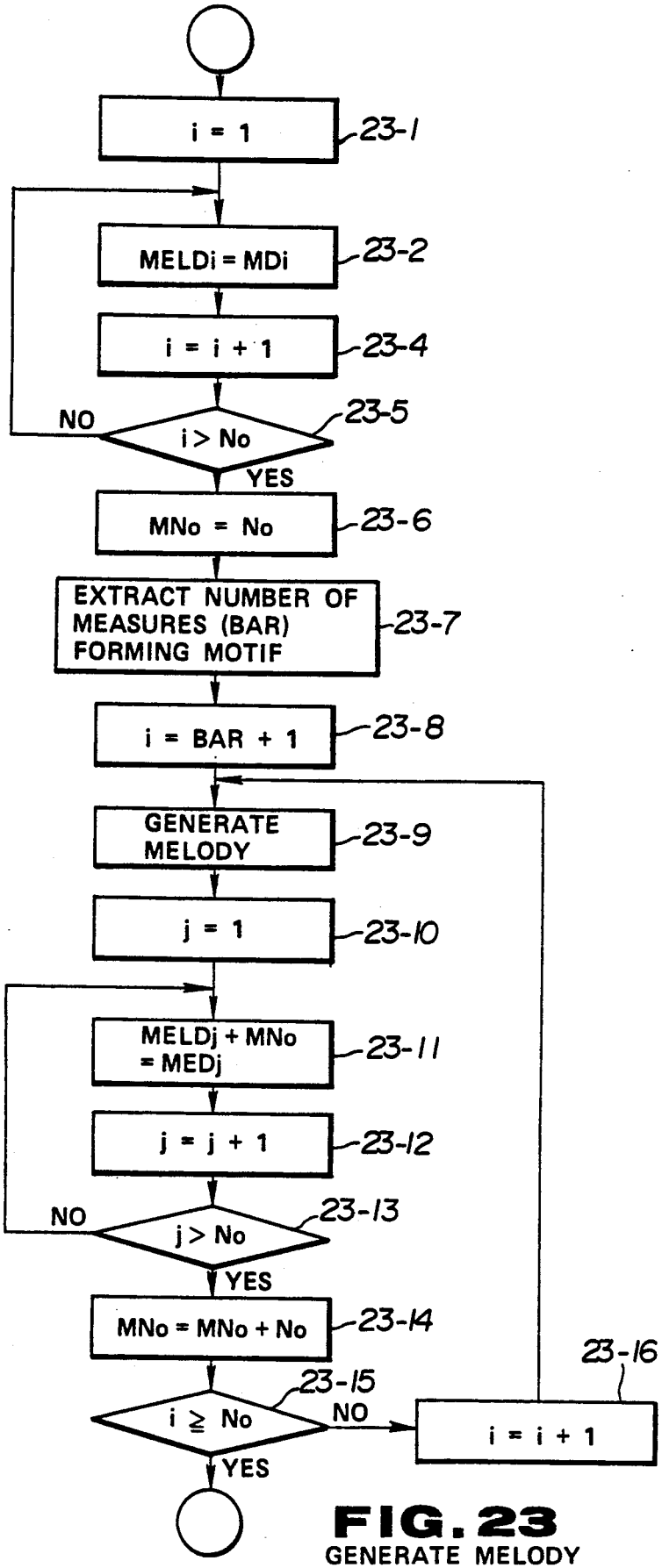
FIG. 23 is a flowchart of generation of melody.

FIG. 23 is a general flowchart of generating a melody. The main portion is step 23-9 where a melody is sequentially generated on a measure by measure basis. The remaining portions are processes such as transferring data between memories.

At 23-1 to 23-5, motif data stored in the motif data memory 4 (FIG. 1) are transferred to the melody data memory 10. "No" shown at 23-5 is the number of notes contained in the motif.

"MNo" at 23-6 and 23-14 is the number of melody notes which have already been produced under the condition in which melody notes are consecutively generated. Since the generation of melody occurs on a single measure basis, the number of measures forming the motif is counted (23-7): this is calculated from the duration data of the motif. It is noted here that the motif can be two or more measure long. How to deal with motifs of two or more measures will be described later. In the meantime, it is assumed, as mentioned at the beginning, that the motif has a length of one measure. "1" is added to the count of the motif measures (23-8). If a melody for one measure has been generated (23-9), the data is written into the melody data memory 10 (23-10 to 23-13). "No" at 23-13 is, of course, the number of melody notes for the measure that were produced in the process 23-9. "CNo" shown at 23-15 is the total number of chords forming the entire chord progression. Since it is assumed in the present example that there is one chord per measure, the process of melody generation completes when the measure number has reached the total number of chords.

The main portion, melody generation 23-9 includes the generation of arpeggio, the imparting of nonharmonic tones and the correction of tone durations. The description will follow in this order.

GENERATION OF ARPEGGIO

Figure 24:
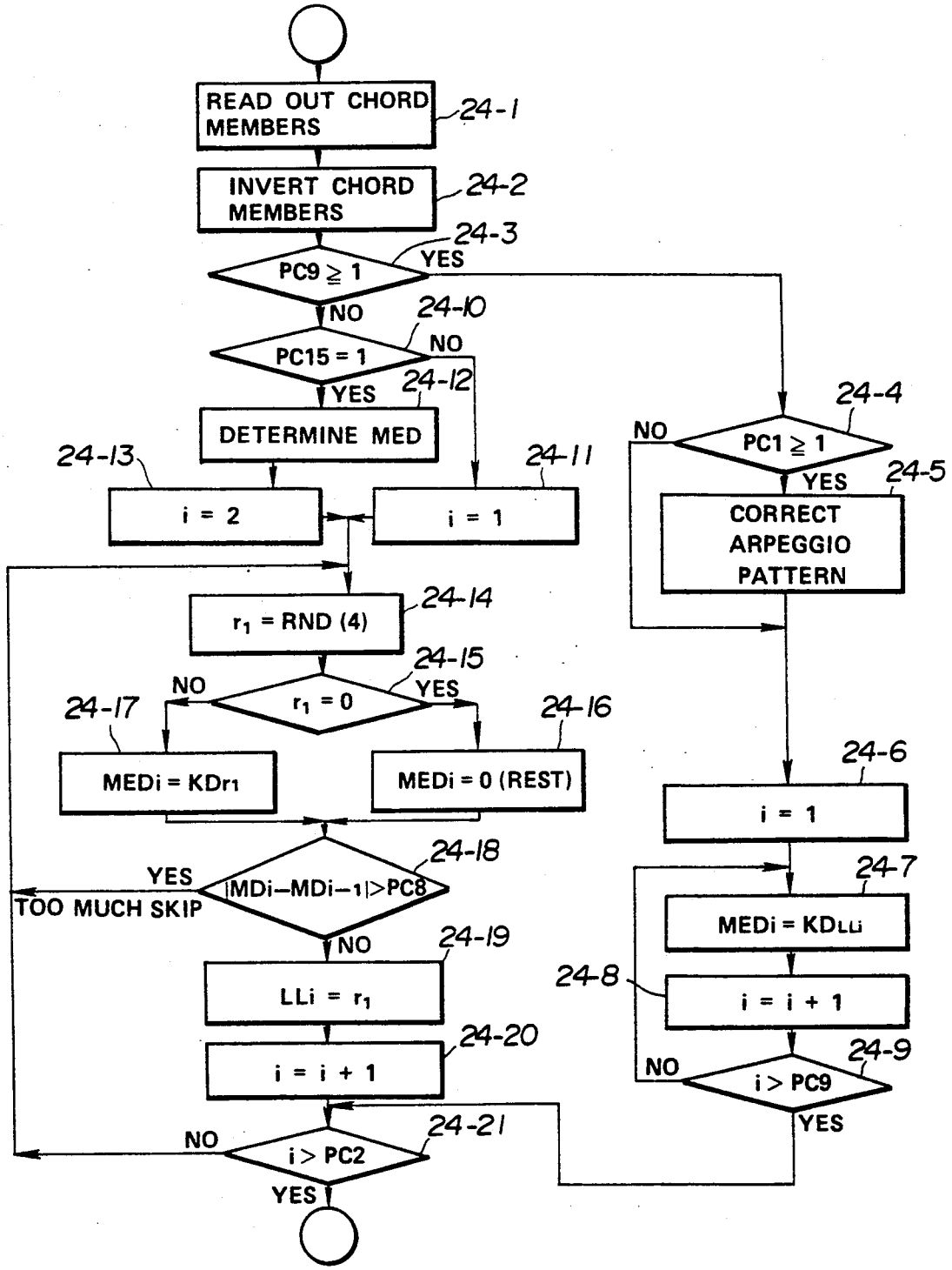
FIG. 24 is a flowchart of generation of arpeggio.

FIG. 24 is an exemplified flowchart of generating arpeggio. The first operation is to read out chord members (24-1), the details of which are illustrated in FIG. 25.

Figure 25:
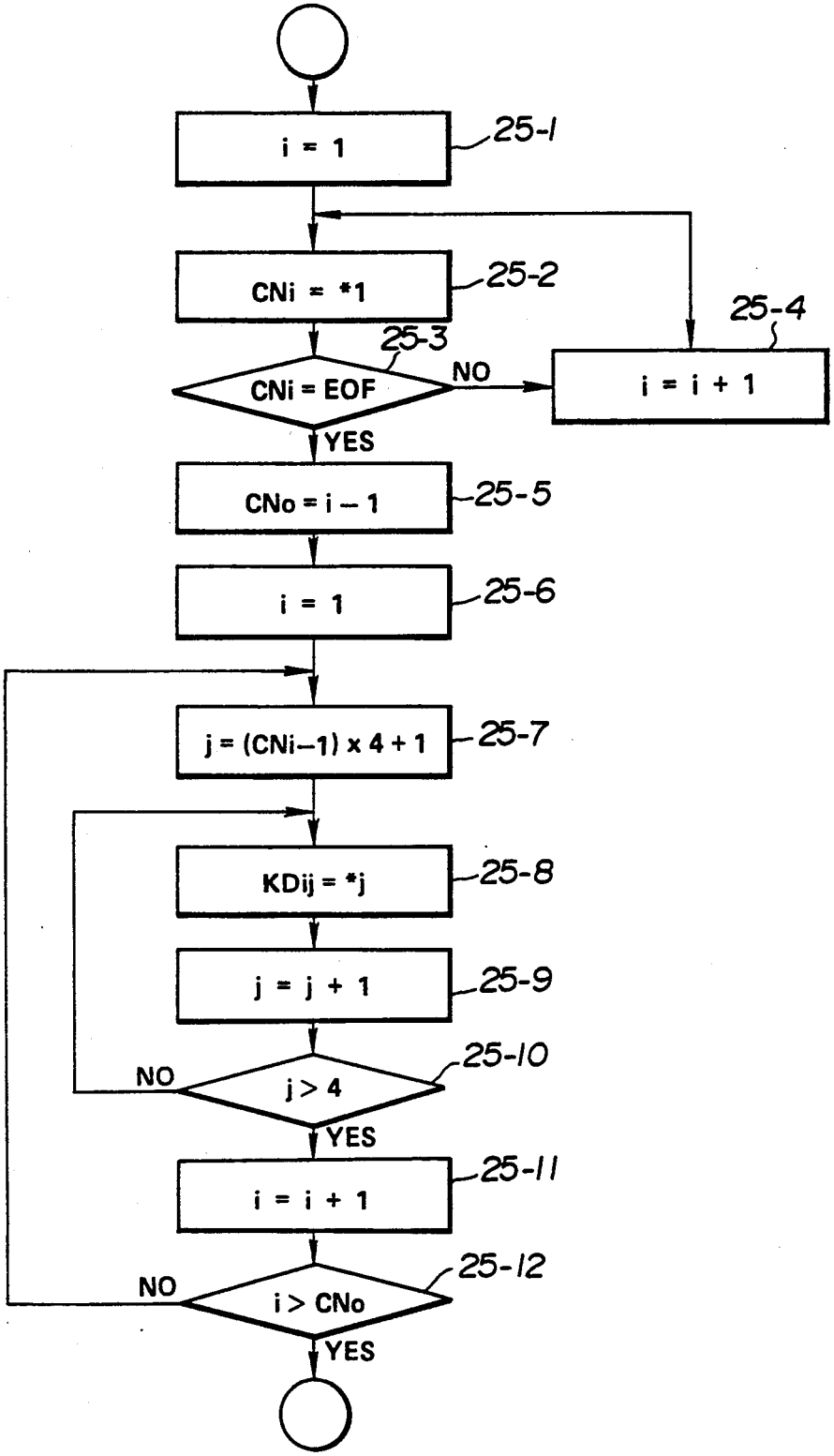
FIG. 25 is a flowchart of read operation of chord members.

In the flowchart in FIG. 25, operations at 25-1 to 25-4 are to sequentially read chord number data (chord names) from the chord progression memory 3 (FIG. 26(*b*)). At 25-2, the content of the address in the chord progression memory 3, i.e. the name for i-th chord is set in a register CNi. "EOF" shown at 25-3 indicates "end of file" code which is stored next to the address for the last chord. When EOF has been received, the read operation of chord names completes.

In the case of FIGS. 5(*a*) and 5(*b*), the chord progression begins with Cmaj (for first measure) and goes through Fmaj, G7 and ends with Cmaj.. The chord progression memory 3 shown in FIG. 26(*b*) accords with this chord progression. Thus, CN1=1, CN2=7, CN3=8 and CN4=1.

At 25-5 to 25-12 in FIG. 25, corresponding chord members in the form of pitch data are read out by referencing chord member memory 2 (see FIG. 26(*a*) and (2) in FIG. 4) from each read chord name. In the present example, it is assumed that each chord consists of four members and that the pitch data of members are stored at four contiguous addresses in the chord member memory 2 in the pitch increasing order. At 25-7, the start address for each chord is computed by $j=(CNi-1)\times 4+1$. At 25-8 to 25-10, four pitch data at locations beginning with the start address are read out and set into registers KDij.

For the chord progression of Cmaj, Fmaj, G7 and Cmaj as illustrated in FIG. 5(*a*), the reading of chord members proceeds as follows. At the first measure of Cmaj, KD11, KD12, KD13, and KD14 are set at KD11=1 (indicative of "do"), KD12=5 (indicative of "mi"), KD13=8 (indicative of "sol") and KD4=13 (indicate of "dȯ", one octave up from the "do"). At the second measure of Fmaj, (KD21, KD22, KD23, KD24)=(1, 6, 10, 13)=(do, fa, la, dȯ). At the third measure of G7, (KD31, KD32, KD33, KD34)=(3, 6, 8, 12)=(re, fa, sol, ti). At the fourth measure which has the same chord as the first measure, (KD41, KD42, KD43, KD44)=(1, 5, 8, 13). The data in the chord member memory 2 in the present embodiment are represented in key C in view of tonal structure.

In the following description, KDi1, KDi2, KDi3 and KDi4 are simply referred to as KD1, KD2, KD3 and KD4 respectively. A register KD1 is used to store the lowest harmonic or chord tone, KD2 the second lowest harmonic tone, KD3 the third lowest harmonic tone and KD4 the highest harmonic tone. At present, the pitch data of chord members in registers KD1 to KD4 (with respect to i-th measure) define a chord in a basic position as the data in the chord member memory 2.

Figure 27:
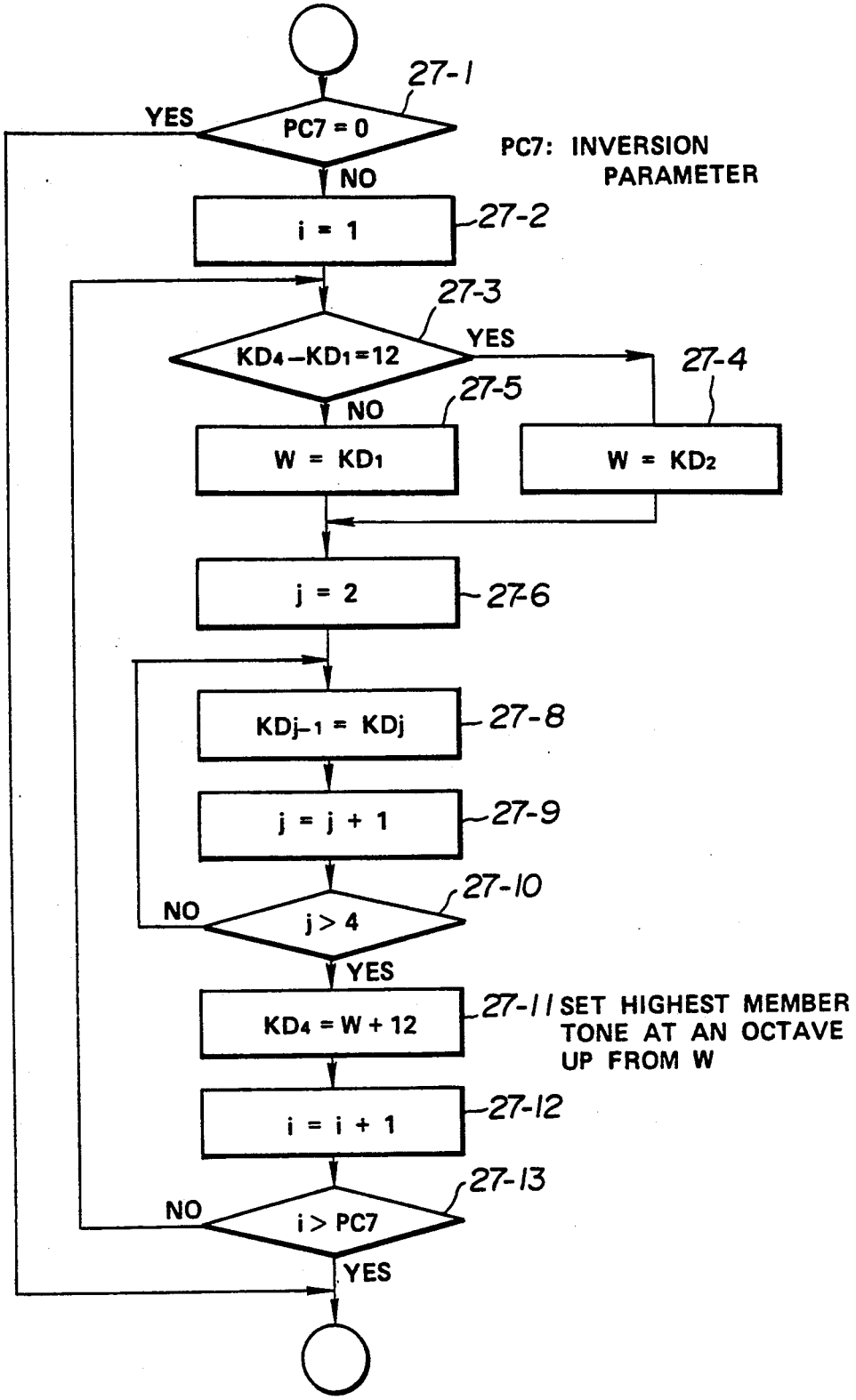
FIG. 27 is a flowchart of inversion of chord members.

Inversion of chord members is performed at 24-2 in FIG. 24; the details thereof is illustrated in FIG. 27.

The purpose of the chord inversion is to change or regulate the range of melody tones to be generated as time goes by (on a single measure basis in the present example), thus controlling the level of excitement in music.

In the flowchart of FIG. 27, members of, say, do, mi, sol and dȯ will be changed to mi, so, dȯ, mi by the first inversion and to sol, dȯ, mi, sȯl by the second inversion, and so on. If the original members are re, fa, sol, ti, they will be shifted to fa, sol, ti, re by the first inversion and to sol, ti, rė, fȧ by the second inversion. The logic of inversion of chord type having an octave interval between end members of the chord such as Cmaj (do, mi, sol, dȯ) differs from that of chord type having a non-octave interval between the end members. More specifically, express an array of pitches of chord before inverted by KD1(old), KD2(old), KD3(old) and KD4(old). For a chord of the type having a non-octave interval, the array of pitches of the chord resulting from the inversion (KD1(new), KD2(new), KD3(new) and KD4(new) is given by:

| | | |
|---|---|---|
| | KD1(new) = KD2(old) | (fa) |
| | KD2(new) = KD3(old) | (sol) |
| | KD3(new) = KD4(old) | (ti) |
| and | (M1) KD4(new) = an octave up from KD1(old) | (rė) |

For a chord of the type having an octave interval, the new array is given by:

| | | |
|---|---|---|
| | KD1(new) = KD2(old) | (mi) |
| | KD2(new) = KD3(old) | (sol) |
| | KD4(new) = KD4(old) | (dȯ) |
| but | (M2) KD4(new) = an octave up from KD2(old) | (mi) |

At 27-3, it is checked as to whether or not the chord has an octave interval. The processes 27-5 and 27-4 are to distinguish the above (M1) from (M2). The data are shifted at 27-6 to 27-10. The process of distinguishing (M1) from (M2) completes at 27-11. "PC7" in FIG. 27 indicates the number of inversions which is, of course, one of the parameters C. As is seen from this example, parameters C serve to control the generation of a melody.

Here, examine how the second measure chord in the chord progression shown in FIG. 5(*a*) is inverted. Assume that the chord inversion parameter PC7 for i-th measure is given by:

$$PC7i=(+\cos((i+2)\times 2\pi/4))\times 1\times 1$$

(see FIG. 4). If i=2, then PC7=2. The chord of the second measure is Fmaj. The basic form of Fmaj (before inverted) is do, fa, la, and do. That is, KD1=1, KD2=6, KD3=10, and KD4=13. Since PC7 is equal to "2" indicating that the chord should be inverted twice. The result is la, dȯ, fȧ and lȧ, i.e., KD1=10, KD2=13, KD3=18, and KD4=22.

As shown in FIG. 24, when the chord inversion has completed, the process goes to 24-3 in which PC9 is a parameter indicative of the length of repeated arpeggio pattern. If PC9≧1, the process goes to a flow of maintaining the pattern, beginning at 24-4 "PC1" at 24-4 indicates whether or not to correct the arpeggio pattern. If PC1≧1, the correction of the arpeggio pattern is performed at 24-5.

Figure 29:
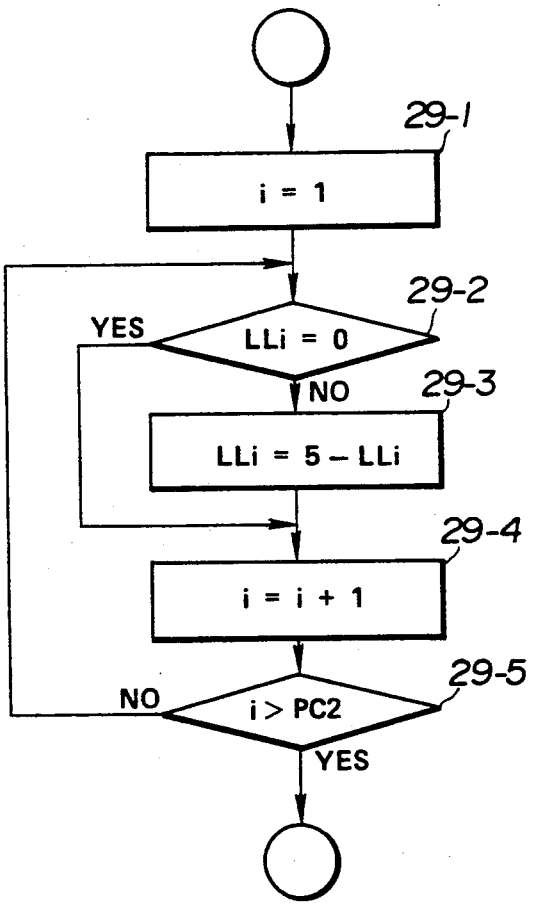
FIG. 29 is a flowchart of correction of arpeggio pattern.
Figure 29:
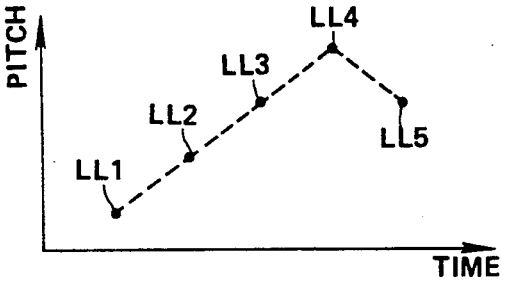
Figure 29:
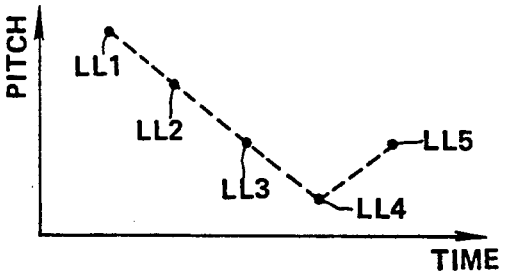

The details of 24-5 are illustrated in FIG. 29. The meaning of the operations 29-1 to 29-5 is illustrated at the right of the flow. That is, in this flow, the arpeggio pattern {LLi}=(LL1, LL2, . . . ,) contained in the motif is converted into the opposite or contrary pattern; as previously stated, LLi indicates the numbered vertical position of i-th appearing harmonic tone in the motif measure relative to its lowest harmonic tone, but when LLi is zero, it indicates a rest (see FIG. 17(*a*)).

At 24-6 to 24-9 in FIG. 24, the values of KDs indicated by LLis covering the length PC9 of repeated arpeggio pattern are moved to registers MEDiS each of which is used to store i-th melody tone pitch data in the current measure. More specifically, {LLi} here is either the motif arpeggio pattern or the one corrected by 24-5, and one of the members KDi=(KD1, KD2, KD3, KD4) of the chord in progress is selected in accordance with the pattern. The selected data are successively written to MEDis. (KDi) here constitutes the set of harmonic tones which were shifted in pitch range by the number of chord inversion parameter PC7 in the process 24-2.

If the arpeggio pattern is not to be repeated, the flow of control branches off the step 24-10 where it is checked as to whether a tone can be determined from the previous tone (here, the last note in the previous measure) by reference to a parameter PC15. If PC15 has a true value of "1", the process goes to 24-12 where the first harmonic tone MEDi in the current measure is determined. Then, go to 24-13 where the note number in the measure is set at the second. If the determining parameter PC15 has a false value, then go to 24-11 where the note number i is set at the first. Thereafter, go to the routine beginning at 24-14 where the pattern of arpeggio is randomly developed.

Figure 28:
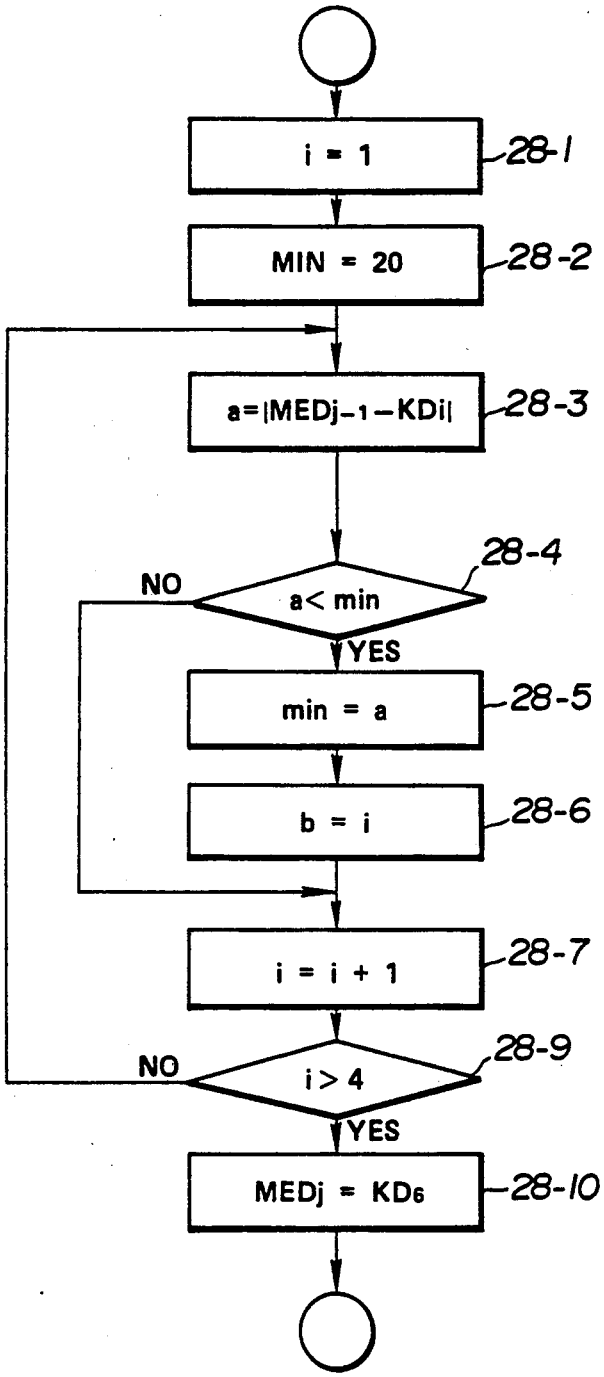
FIG. 28 is flowchart of determination of a tone MEDj from its preceding tone.

The details of 24-12 for determination of MED1 from the previous tone are illustrated in FIG. 28. The logic of the flow is to select the note vertically nearest to the last note in the previous measure as a first chord note in the current measure. The previous tone is indicated by MEDj-1 while the current tone is indicated by MEDj. Since the flow of 28-1 to 28-10 is self-explanatory, further description will be omitted.

At 24-14 to 24-21 in FIG. 24, arpeggio tones are randomly developed within the range limited by the smoothness parameter PC8. A random number γ1 has an arbitrary value among 0, 1, 2, 3 and 4 in accordance with RND(4). PC2 shown at 24-21 is a parameter C which designates the number of harmonic tones assigned to the current melody measure. When this number has been reached, the process of generating arpeggio tones in the current measure will complete. A route from 24-9 to 24-21 is provided to allow the random generation of arpeggio tones when the process of repeating arpeggio pattern over the length PC9 has finished.

As an aid to understanding, how the second measure in FIG. 5(*a*) is processed in the generation of arpeggio pattern is briefly explained. As previously stated in the chord inversion, the set of available harmonic tones consists of la, dò, fà and là i.e., KD1=10, KD2=13, KD3=18 and KD4=24. Assume that the number of harmonic tones to be generated PC2, the length of repeated arpeggio pattern PC9 and the pattern correcting parameter PC1 are given by:

PC2=6, PC9=4 and PC1=1.

Under the condition, the process goes from 24-3 to the routine of 24-4 to 24-9. By the correction of the arpeggio pattern at 24-5, LL1=4, LL2=3, LL3=2 and LL4=1. Then, at 24-6 to 24-9 (maintaining the pattern), four arpeggio tones of là, fà, dò and la are successively produced with là at the beginning of the measure. That is, MED1=KDLL1=KD4=24=là, MED2=18, MED3=13 and MED4=10. The remaining two arpeggio tones are randomly generated at 24-14 to 24-21. They may be, for example given by: MED5=13=dò and MED6=18=fà.

Thus, the melody for the second measure is, up to now, formed with là, fà, dò, la, dò and fà.

This concludes the description of the generation of the arpeggio.

ADDITION OF NONHARMONIC TONES

After the generation of arpeggio, is performed addition of nonharmonic tones which is now described in more detail.

Figure 30:
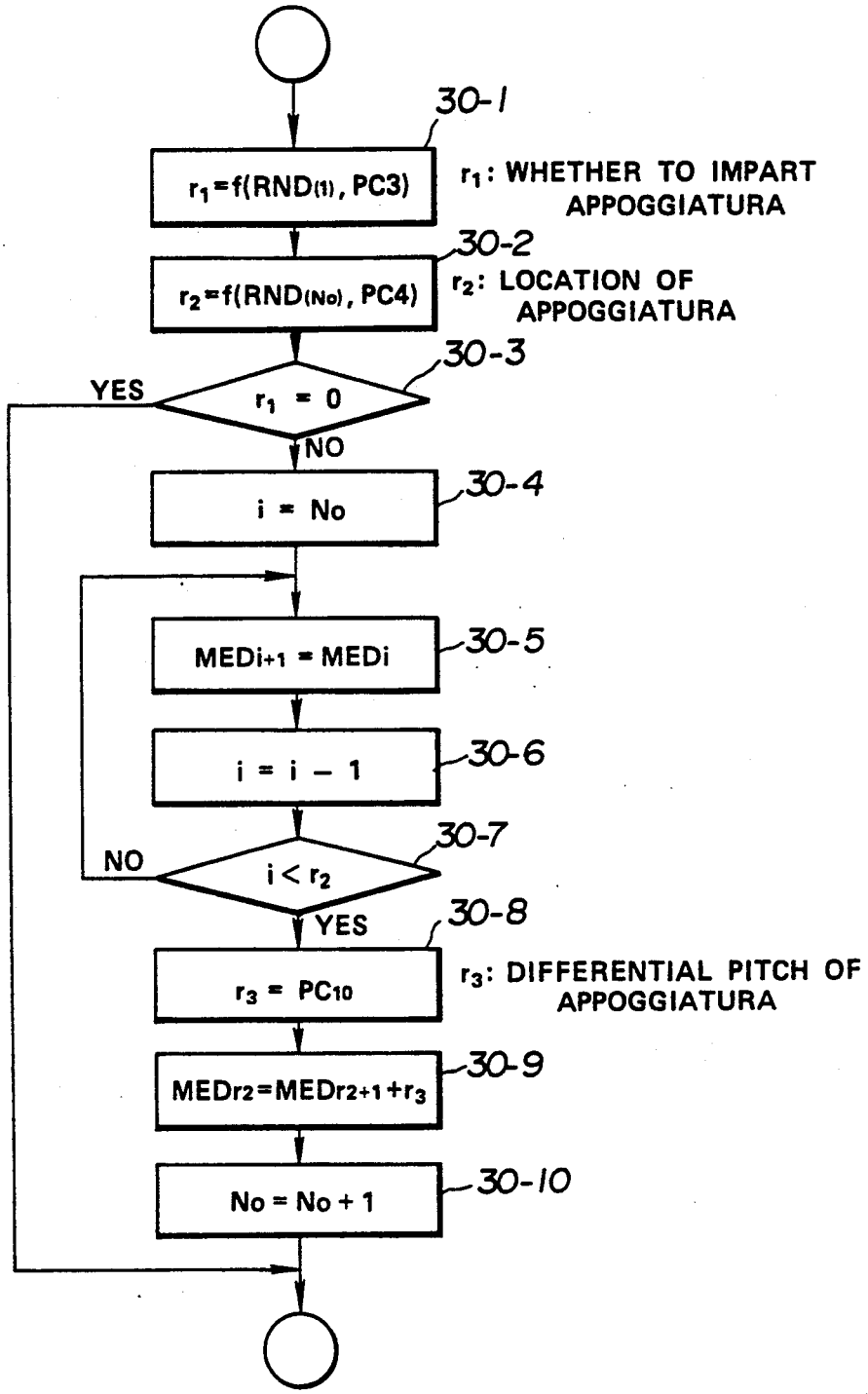
FIG. 30 is a flowchart of addition of appoggiatura.

FIG. 30 illustrates a flowchart of imparting appoggiatura (first type of nonharmonic tones).

At 30-1, a random number γ1 which is used to determine whether or not to impart appoggiatura is computed from f(RND(1), PC3) where PC3 is the weight of appoggiatura assigned to the current melody measure; thus, the value of γ1 is controlled by PC3. Regarding the randomization, refer to the latter part of the section of parameters C and FIG. 21. At 30-2, a random number γ2 indicative of the location of appoggiatura is obtained in such a manner that its value is controlled by an associated parameter PC4.

At 30-3, it is determined as to whether to add appoggiatura. If this is affirmative, then, at 30-4 to 30-9, of an array {MEDi} of No. intermediate melody data, those data following the γ2th melody data are shifted back by one and the γ2th location is reserved as the location of appoggiatura; at 30-8, parameter PC10 of differential pitch of appoggiatura is written to γ3 and at 30-9, addition of appoggiatura is executed. More specifically, γ3 is added to MEDγ2+1 which is a melody tone behind MEDγ2 of appoggiatura, and the resultant pitch data is written to MED 2. At 30-10, the number of notes in the measure is incremented by one because one additional melody tone (here, appoggiatura tone) has been provided.

Figure 31:
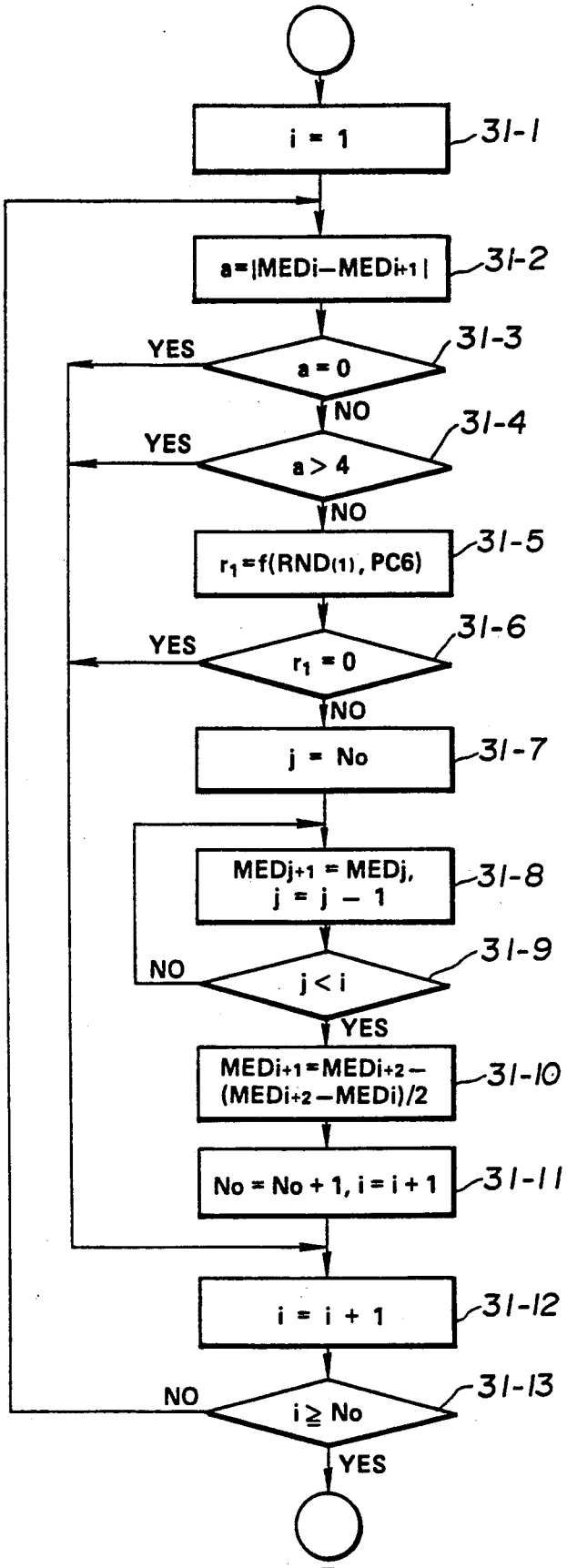
FIG. 31 is a flowchart of addition of passing.

FIG. 31 illustrates a flowchart of imparting passing tones. According to the flowchart, a passing tone is inserted between adjacent melody notes MEDi and MEDi+1 if predetermined conditions are satisfied. If they are not, insertion of a passing tone will not occur. The conditions are as follows:

(i) adjacent melody notes shall have different pitches;
(ii) the interval between the adjacent melody tones shall be equal to or smaller than major third (corresponding to a=4); and
(iii) the random number γ1 controlled by the weight PC6 of passing has a value allowing the addition of passing (γ1=1).

If it is allowed that a passing tone is added, then passing data having a pitch between the adjacent melody tones is inserted therebetween. The pitch of passing tone may be determined on the bases of so called "available notes". 31-10 in FIG. 31 is a mere example.

From the foregoing and the flow of 31-1 to 31-13 in FIG. 31, the operation of imparting passing tones becomes apparent and further description is omitted.

Figure 32:
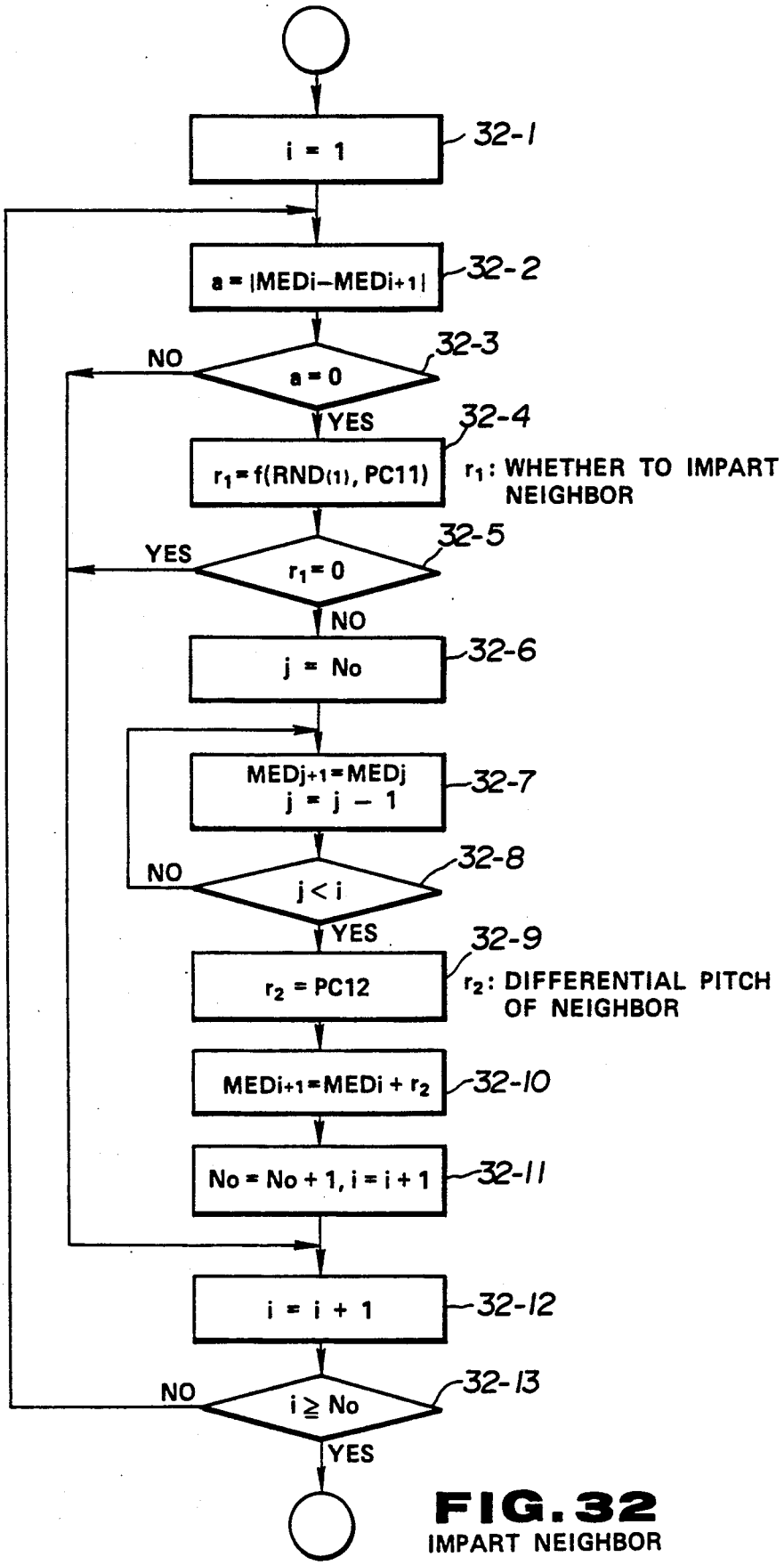
FIG. 32 is a flowchart of addition of neighbor.

FIG. 32 illustrates a flow of imparting neighbor tones. According to the flow, a neighbor tone is added only when there exist predetermined conditions; one of the conditions is controlled by the weight PC1 of neighbor and another condition requires that adjacent melody notes should have the same pitch. The pitch of the neighbor tone is given by adding the pitch of the adjacent tone to the differential pitch PC12 of neighbor. From the above and the flow of 13-1 to 13-13 which is selfexplanatory, the operation of imparting neighbor tones becomes apparent and further description is omitted.

Figure 33:
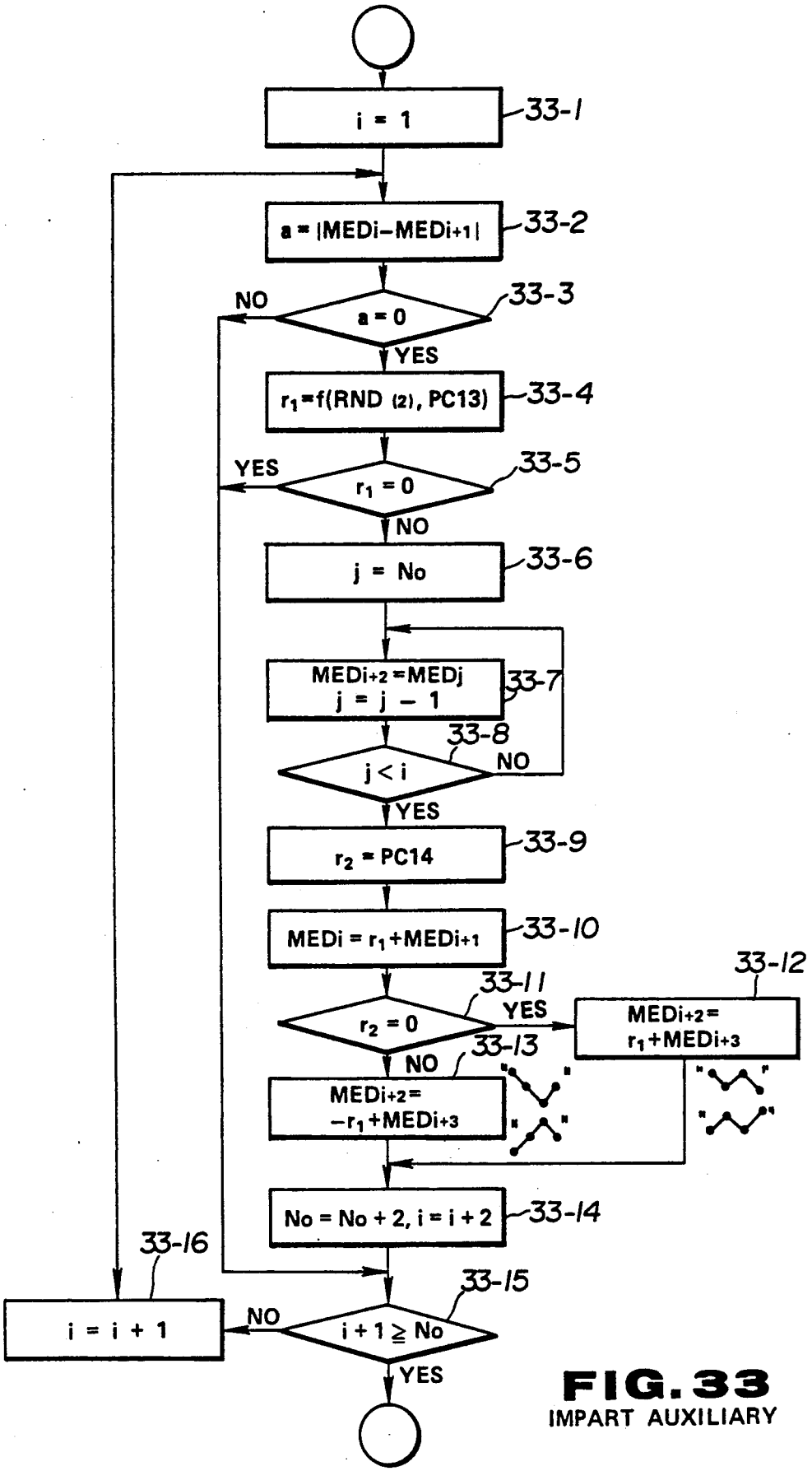
FIG. 33 is a flowchart of addition of auxiliary.

FIG. 33 illustrates a flow of imparting auxiliary tones. According to the flow, two auxiliary tones are placed in front of tones MEDi+1 and MEDi+3 respectively, as MEDi and MEDi+2 only when there exist specific conditions as follows: the adjacent tones of the above MEDi+1 and MEDi+3 have the same pitch and a random parameter γ1 controlled by the weight PC13 of auxiliary is not equal to zero. γ1 shown at 33-10, 33-12, and 33-13 may have a different value from that of γ1 generated at 33-4. To this end, an operation of, say, γ1=PCX (differential pitch of auxiliary) may be interposed between steps 33-9 and 33-10. From the foregoing and the flow of 33-1 to 33-16 in FIG. 33, the operation of imparting auxiliary tones has become apparent.

By way of example, a description is made of how the second measure in FIG. 5(*a*) is transformed in the course of imparting nonharmonic tones (FIGS. 30 to 33). Before entering the nonharmonic tone imparting process, the tone sequence (MEDi) of the second measure is a series of là, fà, dò, la, dò, and fà. That is, MED1=24, MED2=18, MED3=13, MED4=10, MED5=13 and MED6=18.

In the first process of appoggiatura impartion (FIG. 30), γ1 happens to be "0" indicating inhibition. Thus, no appoggiatura is added to the second measure.

Then, the process of passing impartion (FIG. 31) goes as follows. When the melody note number in the measure is "1", a is given by:

$$a=|MED1-MED2=|4$$

The weight of passing PC6 is set at "3", resulting from $PC6=\cos(4\times 2\pi 4)\times 2+PA4$ where PA4=1. Then, a random number $\gamma 1$ is computed; $\gamma 1$, influenced by PC6=3, may be "2". The following shift operations 30-4 to 30-9 result in:

$$\{MED\} = (MED1, MED2, MED3, MED4, MED5, MED6, MED7)$$
$$= (22, 18, 18, 13, 10, 13, 18)$$
$$= (\text{lâ}, \text{fâ}, \text{fâ}, \text{dô}, \text{la}, \text{dô}, \text{fâ})$$

The appoggiatura register MEDi+1 is, here, MED2 and is given by:

$$MED2 = MED3 - (MED3 - MED)/2$$
$$= 20$$
$$= \text{sôl}$$

Thus, the sequence of melody tones {MED} is represented by:

{MED}=(lâ, sôl, fâ, dô, la, dô, fâ)

The note number i is incremented to i+1; the above process will be repeated until i has reached No. It is assumed here that no more passing tone is added for $i \geqq 2$, because of the values of $\gamma 1$ and a.

Similarly, processes of neighbor and auxiliary impartion are performed but, it is supposed here that they do not cleate any result: neigher neighbor nor auxiliary tone is added.

The flow or rule for nonharmonic tone impartion shown in FIGS. 30 to 33 is a mere example. The rule may be modified to the one in which nonharmonic tones are imparted in different ways depending on the values of parameter C such as the weight of each nonharmonic tone. For instance, when the weight is sufficiently light ("1" for example), the maximum number of corresponding nonharmonic tones to be added in a measure is limited to one. When the weight is "2", addition of a plurality of nonharmonic tones is allowable but addition of nonharmonic tones in succession is prohibited. For heavier weights (3 or more, for example), nonharmonic tones are freely added. This may be accomplished by as follows. A counter is provided which counts the number of nonharmonic tones already added in the current measure; the counter may be incremented after 31-10, for example. If the counter indicates that one nonharmonic tone has been added, and if PC=1, then the process of nonharmonic tone addition in that measure will complete. Further, a flag is provided which indicates whether a nonharmonic tone has been added at the position of immediately previous note. If the flag indicates truth and if PC=2, the flag is changed to false so that the process of nonharmonic tone addition (31-7 to 31-11, for example) will be no longer performed, thus prohibiting consecutive addition of nonharmonic tones. If the flag indicates truth and if $PC \geqq 3$, the process of nonharmonic tone addition is repeated without changing the flag, thus permitting nonharmonic tones to be added freely. In the flow of appoggiatura impartion in FIG. 30, the number of added appoggiatura is one per measure at most. An alternative rule is to allow consecutive addition of appoggiatura tones depending on the appoggiatura weight. Various modifications of the rule could be employed.

This concludes the description of nonharmonic tone impartion.

CORRECTION OF TONE DURATIONS

The sequence of tone durations {Rhy} may be arranged in such a manner that a suitable time duration is assigned to each tone so that the entire length of the tones will be equal to the length of current measure (e.g. "16" or 4 times). This time assignment is performed at an appropriate stage, for example, after the generation of arpeggio is complete. If the number of arpeggio tones is, say, four, time value of 4 (=16/4) is assigned to each of Rhy1, Rhy2, Rhy3, and Rhy4. If the number of arpeggio tones is not evenly divisible by 16 (the number is 5, for example) suitable time assignment may give 4 to Rhy1, 2 to Rhy2, 2 to Rhy3, 4 to Rhy4 and 4 to Rhy5. One scheme of time assignment employs a logic of binary division. Assume, for example, that the original rhythm sequence is given by:

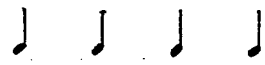

If one note is to be added, the binary division logic partitions the pattern into two as below:

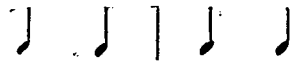

One of the subpatterns is further partitioned into two:

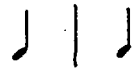

One of the two notes is divided into two:

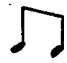

The result is:

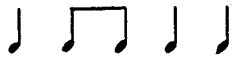

This is a rhythm or a sequence of tone durations or a melody. If one more note is to be added, then the disjoined note by the first division, i.e.

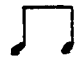

is not further divided. Instead, one of the notes that was not disjoined by the first division, i.e.

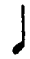

is divided into:

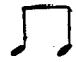

This may result in:

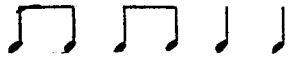

In of nonharmonic tone impartion, the number of melody notes increases by one or two each time the addition is executed. Thus, the time duration assignment may be performed at the time of adding each nonharmonic tone (not shown).

Figure 34:
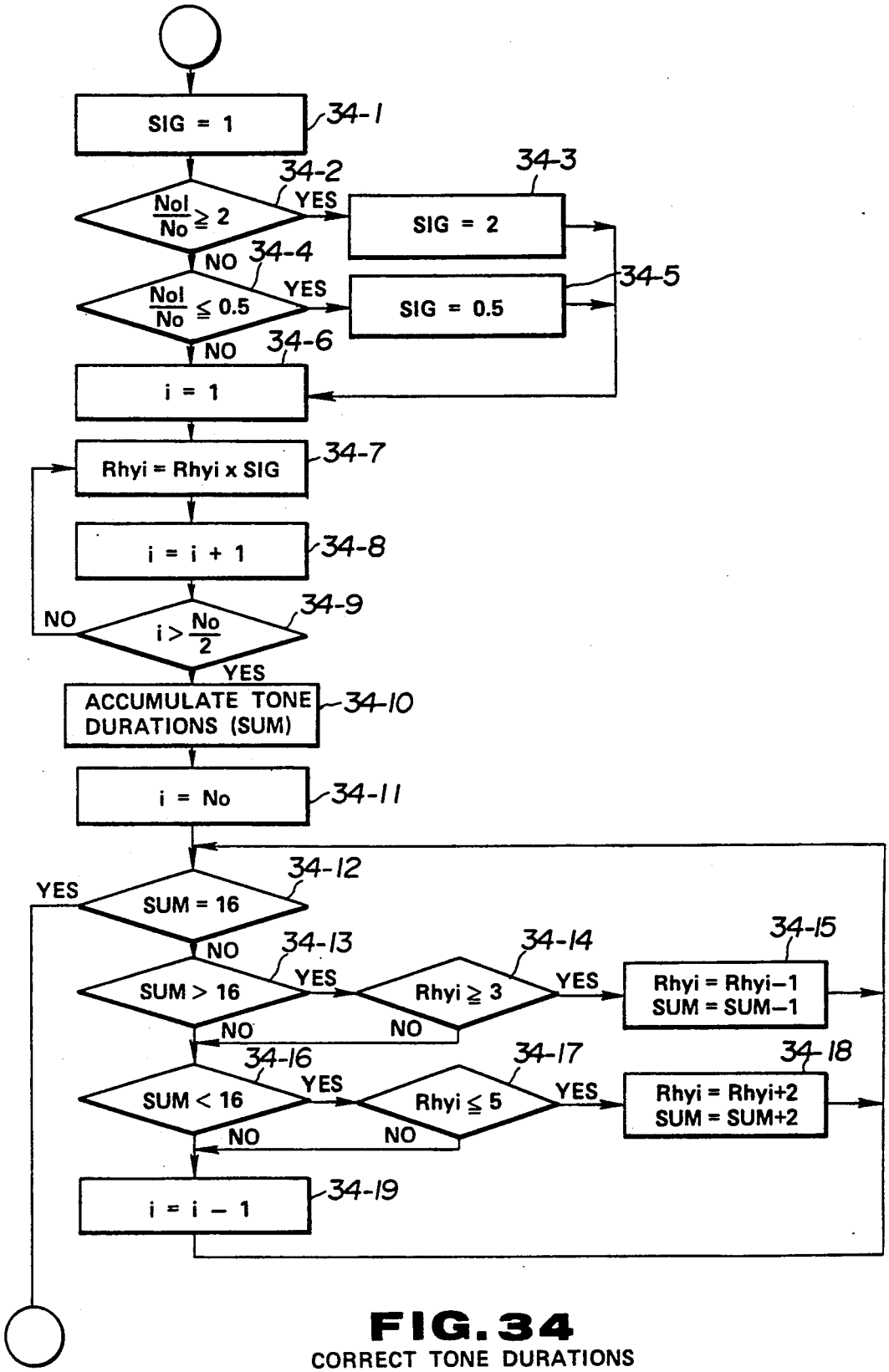
FIG. 34 is a flowchart of correction of tone durations.

Before entering the flow in FIG. 34 where correction of tone durations are made, the above time duration assignment is complete. Reference is now made to the correction of tone durations illustrated in FIG. 34.

The purposes of the correction of tone durations in the present example are firstly to maintain the consistency of tone duration pattern and secondly to adjust the entire length of the duration pattern to the predetermined length of a measure. The consistency of duration pattern is controlled in the process of 34-7 to 34-10. The adjustment of the entire length of duration pattern to the length of the current measure is performed in the process of 34-10 to 34-19.

More specifically, SIG represents a variable the value of which changes when the ratio of the number of melody tones No to the number of motif tones No1 significantly deviates from "1". The changed value is used as a scaling factor of duration: notes of the motif tone duration pattern as many as half of the number of melody measure tones are shortened or lengthened in accordance with the scaling factor. The scaled pattern is used as the first half of the melody tone duration pattern in the measure. For example, if the number of melody tones in the current measure is half of or less than half of the number of tones contained in the motif measure ($NO1/NO \geqq 2$), then SIG is changed to "2". The motif tone duration sequence of, say, "4, 2, 2, . . . " will be converted into a melody sequence of "8, 4, 4, . . . ". Thus, the tempo is momentarily halved relative to that of the motif pattern. On the other hand, if the number of melody tones in the current measure is twice of or more than twice of the number of the tones in the motif ($NO1/NO \geqq 0{,}5$), SIG is set to "0.5". Developed from the motif tone duration sequence of "4, 2, 2, . . . " is a melody tone duration sequence of "2, 1, 1, . . . ", the tempo of which is momentarily doubled compared with that of the motif. In general, the pattern conversion by the ratio of integers does not degrade the quality of rhythmic consistency. If the number of melody tones is close to the number of motif tones ($0.5 < NO1/N02 < 2$), the first half of the melody tone duration pattern uses motif tone duration pattern at it is.

The above process of pattern conversion can cause the entire length of the melody tone durations to mismatch the length of one measure (here 16).

Therefore, when the process of pattern conversion has been completed, matching test is carried out between the entire length of the melody tone durations and the length of measure. If mismatch occurs, correction of tone durations of the melody pattern is performed in a reverse order beginning with the last melody note. If the entire length of the melody tone duration pattern is longer than the measure length, the last note in the measure is firstly examined. If the last note is equal to or longer than three, it is shortened by one and comparison of lengths between the melody pattern and the measure is repeated. If the last note is equal to or shorter than two, the preceding note is checked and the process will be repeated. On the other hand, if the entire length of the melody tone duration pattern is shorter than the measure length, then the last note is examined as to whether it is equal to or shorter than five. If this is the case, the last note is lengthened by two and the length matching test is repeated. If the last note is equal to or longer than 6, similar procedure repeats with respect to the preceding note. Eventually, the entire length of the tone duration pattern matches the measure length and the process of correction of tone durations will be complete.

From the foregoing and the flow in FIG. 34, the operation thereof becomes apparent and further description is omitted.

By way of example, consider the melody generation of the second measure in FIG. 5(*a*). Before entering the correction of tone durations in FIG. 34, the tone duration pattern of the second measure {Rhy} is 2, 2, 2, 2, 2, 2 and 4, or:

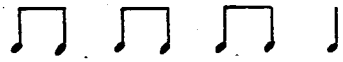

By the process of 24-1 to 34-9, the first half of the pattern becomes identical with the motif pattern so that {Rhyi} is 4, 2, 2, 4, 2, 2, 4. Namely:

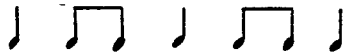

This sequence is adjusted in the process of 34-10 to 34-19 as follows. SUM is initially twenty and longer than sixteen, the measure length. Because the length of the last note Rhy5 is four and longer than three, it is changed to two. For now, {Rhyi} is formed with 4, 2, 2, 4, 2, 2, 2. Seek the tone having a duration equal to or longer than 4 from the sequence in a reverse order. Then the fourth tone from the last is found to have a length of four which is in turn shortened to two. Now SUM becomes sixteen and the length correction completes. {Rhyi} is now formed with 4, 2, 2, 2, 2, 2, 2 or:

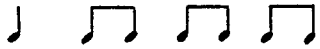

In the below, {Rhyi} is juxtaposed with the corresponding melody pitch pattern already developed.

| | | | | | | | |
|---|---|---|---|---|---|---|---|
| PITCH; | là | sòl | fà | dò | la | dò | fà |
| DURATION; | ♩ | ♫ | | ♫ | | ♫ | |

This is exactly the melody as indicated in the second measure in FIG. 5(*a*).

In a similar manner, melody of third and fourth measure is generated. An example of the result is shown in FIG. 5(*a*). For the third measure of G7, the melody is formed with:

| | | | | | |
|---|---|---|---|---|---|
| PITCH: | mi | fa | sol | ti | rè |
| DURATION; | ♩ | ♫ | | ♩ | ♩ |

For the fourth or last measure of Cmaj, the melody is formed with:

| | | | | | |
|---|---|---|---|---|---|
| PITCH; | dò | sol | fa | mi | do |
| DURATION; | ♩ | ♫ | | ♩ | ♩ |

Assume here that the composition of a music piece has completed.

CORRECTION AND LEARNING

As previous mentioned, a user may request the automatic composer of the correction of a complete music piece by means of the monitor 11. The description will now be made of correction and learning. In the present embodiment, the correction of music piece is performed for a measure.

Figure 35:
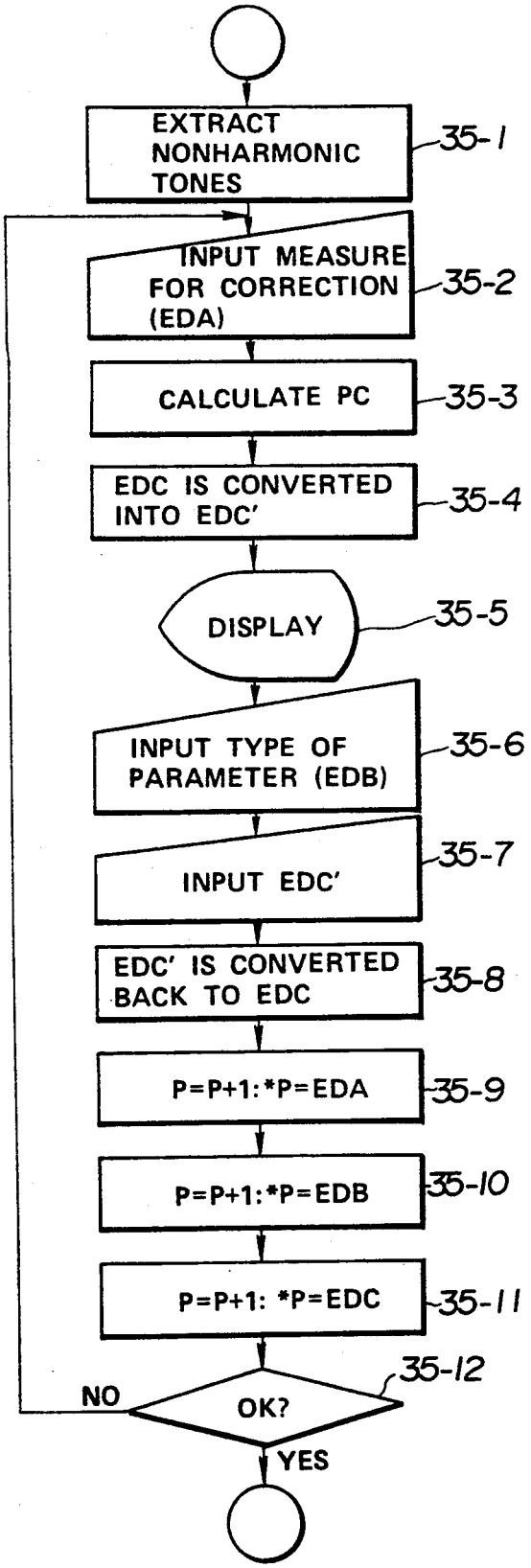
FIG. 35 is a flowchart of correction and learning.

FIG. 35 illustrates a flow of the correction and learning. Initially, nonharmonic tones and motif featuring parameters are extracted from the motif in a similar manner as previously mentioned (35-1). Whereas it is possible here to generate data such as parameters C in terms of all of the measures (from which a music piece similar to the previous one will be generated) this would consume a great amount of storage locations.

Next, a user inputs a measure number which he or she wishes to be corrected (35-2). In response to this, the automatic composer puts the function of parameter C computation into operation so that the parameters C (PCX) with respect to the measure designated for correction are computed (35-3). All of the parameters C are calculated: for example, chord inversion parameter PC7*i* is computed by $PC7i=\cos((i+1)\times 2\pi/4)\times 1+1$.

Then, parameter conversion is performed from the objective data (parameters C) to subjective data. The purpose of this parameter conversion is to provide users with information which they can easily understand or make judgement. For example, PC7*i* serves primarily to control the level of excitement. Thus, when PC7*i*=2, the automatic composer notifies the user that the level of excitement in this measure is 90 percent. Such message will facilitate user's understanding and speed up the correction operation on the user's part. The logic of parameter conversion (including computation of function) may be developed in consideration of factors such as correlation between objective data (PC) and subjective data. For example, a first version of correlation standard is prepared by analysis of existing music pieces and using the method of subjective evaluation on a development machine and is improved by testing the performance.

The result of the parameter conversion (message) is then displayed on a screen of CRT12 (35-5).

In response to the message, the user may input the type of parameter EDB to be corrected (35-6). Assume here that the parameter of excitement level is selected and corresponds, one-to-one, to the inversion parameter, then EDB has the value indicating the type of parameter of excitement level. If the types of subjective parameters {S} do not correspond to types of objective parameters {O} in the form of one-to-one, then the selected type of subjective parameter S(i) may be converted into a plurality of types of associated objective parameters (O(j), O(K) . . . ): in the flow, one-to-one correspondence is assumed. The user then inputs the value of EDC' which is to correct the parameter specified in EDB'. If the user wishes to change, for example, the level of excitement from ninety percent to fifty percent, he or she may designate its parameter name at 35-6 and input the corrected value of fifty percent (EDC') for that parameter at 35-7.

In turn, the automatic composer converts the subjective parameter (EDC') back to corresponding objective parameter (35-8): in the present case, the value of inversion parameter (EDC) is given "1" by reverse conversion of the designated level of excitement which is fifty percent.

Thereafter, the correction data are written to learned data memory 9 (35-8 to 35-9). P points to the location in the learned data memory 9. With pointer P being incremented, the correction data items are sequentially written to the memory (See FIG. 35(*a*).

When there is no further data items to be provided, such as measure number, type or value of parameter for correction, the user will signal end of correction to the automatic composer and the process of correction and learning will be complete (35-12).

The above function of correction and learning serves to develop a melody which is resonant with the user's preference. This will be more apparent from the following description of the operation of the parameter correction by learning taken in conjunction with FIG. 36.

Figure 36:
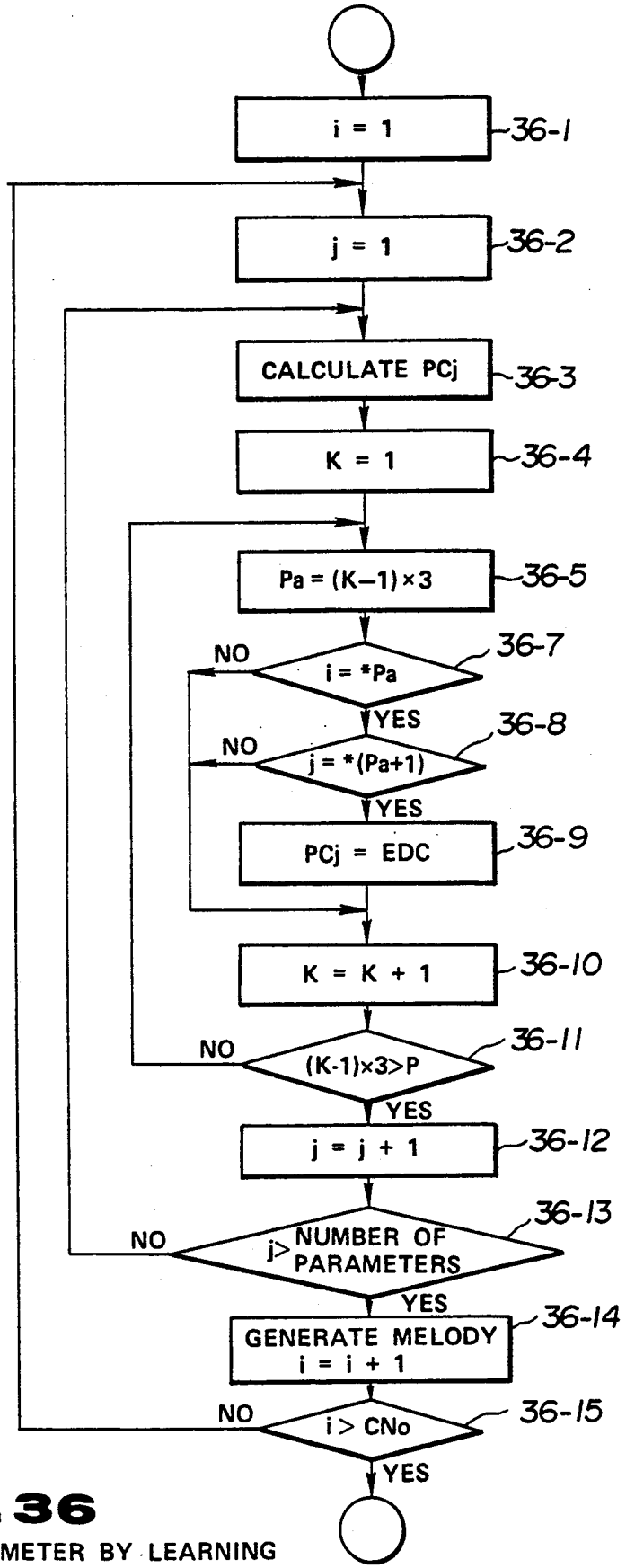
FIG. 36 is a flowchart of parameter correction by learning.

In accordance with the function of parameter correction by learning, parameters C learned by the correction learning function F4 are assigned higher priority over those parameters C computed by parameter computation function F31 (FIG. 2). 36-3 in FIG. 36 is computation of parameters C which is identical with that described in the section of parameters C.

In the process of 36-4 to 36-11, search for parameters from the learned data memory 9 is carried out and the computed parameters C are replaced by the learned parameters for generation of a melody. More specifically, if a measure for correction that matches the currently scanned measure is sought out (i=*Pa), and if a type of parameter for correction that matches the concerned type of parameter is found ($j=*(Pa+1)$), then the correction data EDC defines the value of that type of parameter in that measure (PCj=EDC). According to the example in FIG. 5, the second measure is assigned "1" as the value of inversion parameter PC7 in place of "2" indicating that the chord is to be inverted twice.

In FIG. 36, "i" indicates a measure number, "j" is a type or name of parameter C and used as a suffix to PC as PCj, "Pa" a pointer to the location in the learned data memory 9, and "*Pa" data at the location specified in Pa. When Pa is a multiple of three or $Pa=3\times N$ where N is an integer, the *Pa indicates a measure number for correction. When $Pa=3\times N+1$, the *Pa represents a type of correction parameter. When $Pa=3\times N+2$, the *Pa indicates the value of the correction parameter (see right in FIG. 35).

When j exceeds the total number of parameters C at 36-13, a complete set of parameters C which includes all of the learned items has been produced in respect of the i-th measure.

36-14 is the generation of a melody on a single measure basis and corresponds to the process of 23-9 to 23-14 in FIG. 23. The process 36-14 is shown in FIG. 36 to demonstrate that a new melody is generated using the set of parameters C that has been corrected in the foregoing process ending at 36-11.

It should be noted that once the learned data have been written to the learned data memory 9, they are retrieved each time the user makes a request for composition, and are directly built into the set of parameters C which in turn controls the generation of a melody. In this manner, the generated melody will accord with the user's preference and an effect of learning will come out.

In FIG. 5(*b*), there is shown an example of a corrected melody resulting from the above correction and learning. In this case, for the second measure, the inversion parameter is changed to "1" from "2". The corrected measure is formed with a melody of fà, dò, ti, la, fa, la and dò. The fà, dò, la and fa contained in this melody are harmonic tones of Fmaj. The position of (fa, la, dò, fà) is resulted from inverting the basic position of (do, fa, la, dò) once.

FEATURES OF THE EMBODIMENT

From the foregoing, the features of the present embodiment have become apparent. Some of them are enumerated as follows:

(A) The automatic composer generates a melody in accordance with chord progression information and motif featuring parameters evaluated by the analysis of a motif. Therefore the musical essence or concept contained in the motif is reflected everywhere in the generated music piece. A melody which varies in a great number of ways while controlled so as to conform to the chord progression may be obtained.

(B) The melody generator means includes means which generates parameters C for controlling a melody to be generated: these parameters are assigned their values on a single measure basis and measure-assigned parameters control the generation of melody for each measure. This serves to create a sense of consistency and variety in the stream of music.

(C) The means for generating parameters C is adapted to compute parameters C using compressed data (set of third parameters B) and motif featuring parameters whereby a wide variety of values of parameters C can be developed from relatively small amount of storage data.

(D) Nonharmonic tones are handled in a different manner from harmonic tones. This will cause the generated music piece to be rich in music.

(E) The motif is provided by a user and is reflected in a music piece to be composed. Accordingly it is expected that the user's participation in composing a music piece is noticeable and many music pieces composed are satisfactory to the user.

(F) The user need not have any technical knowledge of music. Once the user creates a relatively short melody, motif, then the automatic composer composes a music piece in line with the given motif.

(G) The automatic composer includes the function of correction and learning which learns the user's preference. In subsequent operations, the automatic composer assigns higher priority to the learned data acquired by the learning function so that a resultant music piece may accord with the user's preference. This will be more interesting to the user.

(H) The automatic composer operates, when provided with some values of parameters, as an apparatus which automatically generates arpeggios. If those parameters which are used to determine whether or not to add nonharmonic tones (such as PC4, PC6, PC11, PC13) have values for inhibition of addition, the function of adding nonharmonic tones is fully disabled so that a melody consisting of only harmonic tones will be produced; in FIGS. 30 to 33, $\gamma 1$ is given zero when the corresponding PC is zero.

MODIFICATIONS

Whereas the first embodiment has been described, various modifications could be made without deporting from the scope of the present invention.

The present invention is not limited to the above embodiment but various modifications, alternations and improvements could be made.

For example, in the above embodiment, every measure has the same length. Instead, variable length measures can be used. This is accomplished by the provision of a counter which counts measure number and means which reads the length of the measure specified by the counter.

Whereas the motif measure in the above embodiment is assumed to be placed at the opening of music composition, any other measure can be the one for the motif. This modification is very easy to make.

Further, it is assumed in the above embodiment that the length of a input motif is a single measure. It can be a plurality of successive measures. If a two measure long motif is provided, for example, a first group of motif featuring parameters (for example, a tone pattern parameter LLi) is extracted from the motif in the first measure while a second group of motif featuring parameters is extracted from the motif in the second measure. From the first group of motif featuring parameters, a first group of parameters C is computed and a second group of parameters C is computed from the second group of motif featuring parameters. The first group of parameters C is utilized to control the generation of a melody in respect of odd numbered measures whereas the second group of parameters C is utilized to control the generation of a melody in respect of even numbered measures; the result of division of the content of the measure number counter by 2 readily determines which group of parameters C is to be selected. Some music pieces, however, have a musical style of, say, A, B, A, with A forming a phrase of eight measures, B a phrase of seven measures and C a phrase of eight measures. In such a case, means is provided which compares the value of each phrase (8, 7, 8)=(the number of measures in the first phrase, the number of measures in the second phrase, the number of measures in the third phrase) with the count in the measure number counter. When the measure number has reached 9 and the beginning of the second phrase is detected, then the measure number counter is reset to "1". What is required is to generate the first group of parameters C for odd numbered measure within each phrase, and the second group of parameters C for even numbered measure within each phrase.

Whereas it has been assumed in the above embodiment that there is one chord per measure, the number of chords per measure could be two or more. Now suppose a measure with the first two times or beats assigned a first chord and the latter two times assigned a second chord. In an arrangement, the function of parameter C generation produces parameters C on a single measure basis. On the other hand, the function of arpeggio generation produces arpeggio tones based on the first chord for the first half of the measure, and for the latter half of the measure, produces arpeggio tones based on the second chord; the parameters C are, however utilized on a measure basis. The function of adding nonharmonic tones adds nonharmonic tones on a measure basis. In another arrangement, the function of adding nonharmonic tones operates also on a two time (a single chord) basis. Other arrangement could be made. The function of correction of tone durations may be modified so as to adjust the length of melody tones for each chord to the length of the chord or the one similar thereto if desired.

A function of selecting a musical style or the like may be added to the automatic composer. For example, the parameter B memory is configured so as to form a classified data structure. A selected input from the input device specifies the data to be read from the parameter B memory and parameters C are developed from the specified data (parameters B). Parameters C depend on parameters B as previously mentioned. Thus, if parameters B are changed, parameters C are changed and the resultant melody is also changed. Similarly, the chord member memory 2 in connection with the chord progression may also be configured so as to define a classified data structure based on musical styles. In the chord member read operation, members of each chord are successively read from a selected set of chord members in accordance with the sequence of chords on the chord progression memory. Thus, if a different set of chord members is selected, a different arpeggio tones may be produced by the function F32 and this will influence some elements in a generated melody. In other words, the selected set of chord members defines a set of chords in a selected field of music.

Another optional approach is to provide the function of parameter computation F31 with different functions (arithmetic and logic functions) for individual fields and cause one of the functions to be active in response to the designated field from the input device. Similar schemes may be incorporated into the function of arpeggio generation F32 and/or the function of adding nonharmonic tones F33.

The function of motif evaluation F1 may be provided with a function of chord determination. In consideration of the case where a measure long motif that may conform to two successive chords rather than a single chord, the chord decision function initially causes the nonharmonic tone extraction function to extract nonharmonic tones on the assumption of one chord per measure. Then, the chord decision function examines whether the remaining tones constitute a chord. If there is no corresponding chord, the chord decision function regards the measure in question as the one containing two consecutive chords and causes the nonharmonic tone extraction function to extract nonharmonic tones on a two beat basis.

Whereas the above embodiment sequentially generates a melody on a measure by measure basis, techniques of parallel or concurrent processing could be utilized for melody generation: note, however, that there are dependent measures (for example, the first note of a measure can be determined from the last note of the previous measure. Thus, for those measures which require the information on the preceding measures, the melody generation occurs after the preceding melody has been completed.

OVERALL ARRANGEMENT

Figure 37:
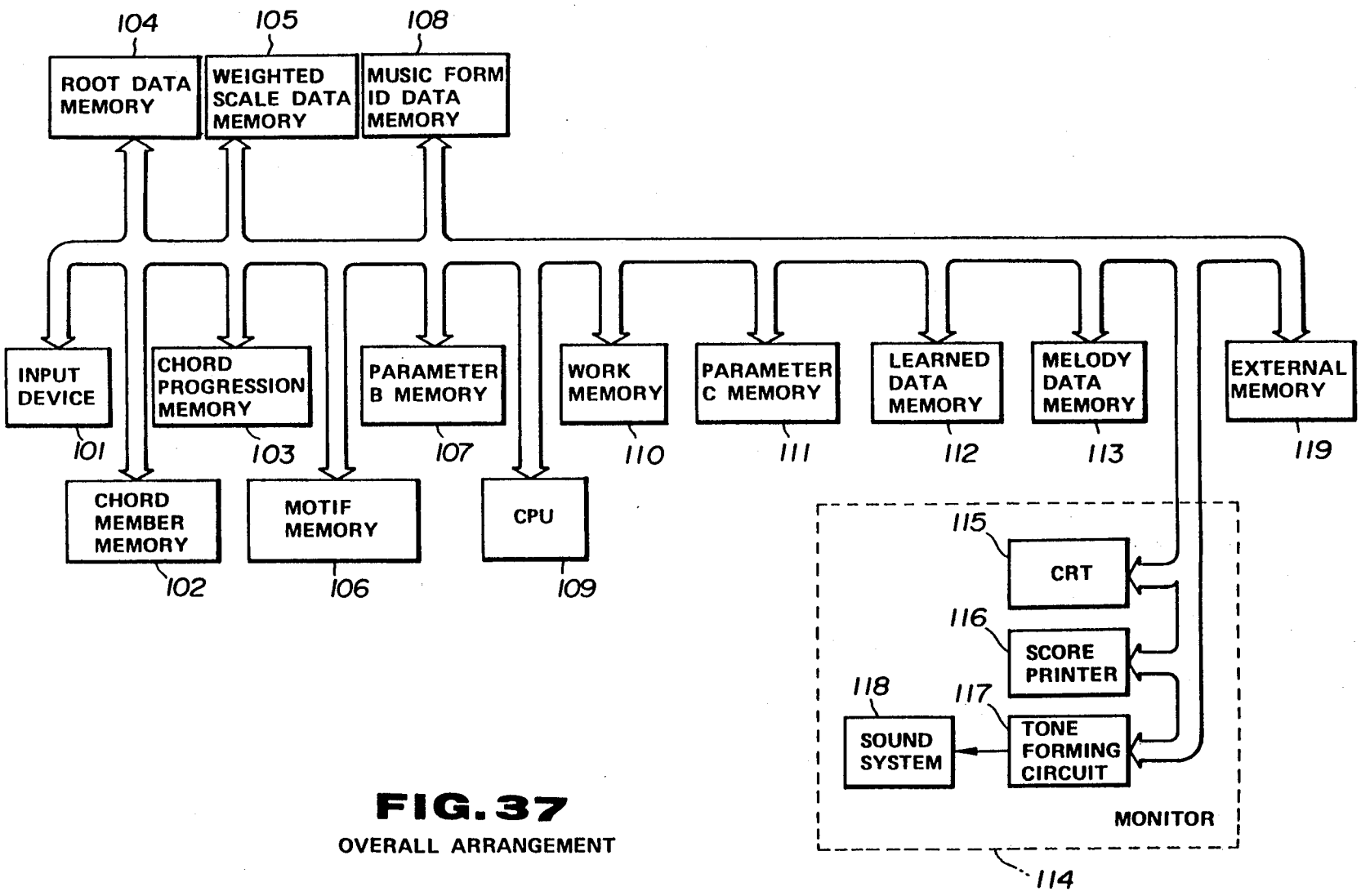
FIG. 37 is an overall arrangement of an automatic composer in accordance with a further embodiment of the present invention.

Referring now to FIG. 37, there is shown an overall arrangement of an automatic composer in accordance with a second embodiment of the present invention. The present automatic composer comprises an input device 101, a chord member memory 102, a chord progression memory 103, a root data memory 104, a weighted scale data memory 105, a motif memory 106, a parameter B memory 107, a musical form data memory 108, a CPU 109, a work memory 110, a parameter C memory 111, a learned data memory 112, a melody data memory 113, a monitor 114 comprising a CRT 115, a score printer 116, a tone forming circuit 117, and a sound system 118, and an external memory 119.

The motif memory 104 is adapted to store the information on a motif (input melody) from the input device 101. The motif information comprises a sequence of pitch data and a sequence of tone duration (time value) data. In the operation of composition, CPU 109 is to extract parameters characterizing the motif (motif featuring parameters).

The chord progression memory 103 stores chord progression information in the form of a sequence of chord names. The chord progression information may be provided either by designating chords in a sequential manner by means of the input device operated by the user or by automatic generation by CPU 109 in response to a macro-instruction (musical form, for example). Automatic generation of chord progression is made possible by connecting basic or frequently used chord patterns, for example, or linking acceptable chord pairs or combinations. With regard to the logic for linking, such a model as Markov chain may be utilized.

In the chord member memory 102, there are stored members in the form of pitch data for various chords. In the present embodiment, the contents of each address (chord name) in the chord progression memory 103 specifies address locations where member data for the corresponding chord are stored. In the process of automatic composition, CPU 109 advances the address of the chord progression memory 103 at every time of chord change (each measure, for example) and from the content of the advanced address, i.e., chord name, calculates corresponding addresses of the chord member memory 102 to read pitch data of chord members at those addresses.

In the root data memory 104, the root data of chords are stored. In the weighted scale data memory, there are stored a set of weighted note scales: each note scale is represented by weights assigned to respective tone pitches on the scale and indicative of pitch effectiveness. In the process of automatic composition, a scale is selected and read from the memory in a suitable way. The root data memory 104 is utilized for shifting the read weight data by the root.

On the other hand, in parameter B memory 107, there are stored data (parameters B) for controlling consistency and variety in the stream of a melody. Further, the musical form data memory 108 is utilized to provide music with higher level of hierarchy. In automatic composition, CPU 109 generates parameters C (melody planning information) which depend upon parameters B, musical form ID data (decoded), motif featuring parameters and a variable of segment in the progression of music (measure number, for example). The parameters C have a property of controlling or characterizing a melody to be generated. The generated parameters C are stored in the parameter C memory.

In the work memory 110, there are stored intermediate data (melody data in process) generated by CPU 109 for automatic composition.

The melody data memory 113 stores melody data forming a complete piece.

A complete music piece may be outputted by the monitor 114 when necessary. For example such a piece may be listened through the tone forming circuit 117 and the sound system 118. Also the music may be printed on a score by the score printer 116.

From the monitor 114, a user may wish to correct some part of the music piece. In such a case, the present embodiment allows the user to request correction via CRT 115 and the input device 101: the correction may be executed in an interactive manner between the user and the machine. Thus, corrected data may be accumulated in the learned data memory 112 as knowledge. For subsequent composition CPU 109 will make use of this knowledge to generate a melody.

The external memory 119 is utilized for providing a back-up copy of completed pieces learned knowledge or as a resource for other programs of automatic composition for substitution.

FUNCTION OF AUTOMATIC COMPOSITION

The functions of the automatic composer in accordance with the present embodiment will now be described with reference to FIG. 38.

Figure 38:
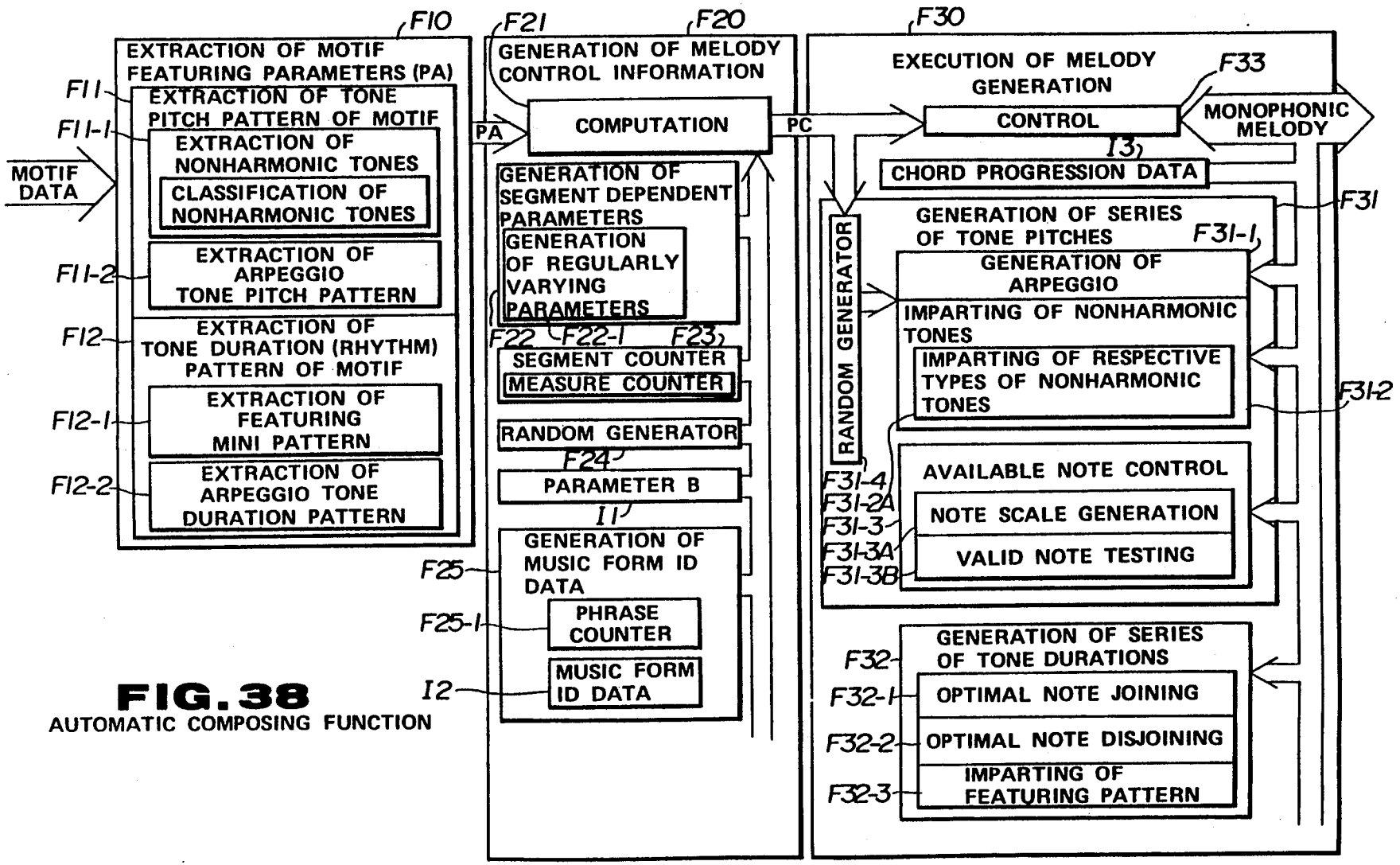
FIG. 38 is a block diagram illustrating functions of the automatic composer.

As shown in FIG. 38, the major function of the automatic composer comprises motif featuring parameter extraction means F10 adapted to evaluate or extract characteristics of motif, melody control information generation means F20 adapted to generate the information (collectively designated by PC) for controlling a melody from the information provided by the means F10 (collectively designated by PA) and melody generation execution means F30 adapted to generate a melody (monophonic) in concrete form in accordance with the information PC provided by the means F20. The melody control information generation means F20 has the ability to associatively infer or plan a melody based on the motif featuring parameters PA while the melody generation execution means F30 is capable of interpreting the plan (represented by PC) and has a rule of generating a melody in accordance with the plan. In a broader aspect, the means F20 and F30 cooperates together to form a melody generation means. In respect of reasoning, the motif featuring parameter extraction means F10 has a function essentially opposite to that of the melody generation execution means. Specifically the motif characteristic parameter extraction means F10 has a reasoning ability of deducing featuring parameters PA forming the essence of the motif from the concrete motif (input melody), while the melody generation execution means F30 has a reasoning ability of deducing a concrete melody from the melody featuring parameters PC forming the essence of the melody. The melody control information generation means F20 has a wide planning space and is capable of controlling the degree of reflection of PA over PC freely and in various ways. In the illustrated example, the input to the melody control information generation means F20 is only through PA from the means F10. However it can be so constructed as to receive other input data (such as user's request from the input device 101, macrocommands serving to restrict the association space of the means F20). Although not illustrated, it may be left at the discretion of a user entirely or partly as to the selection of which parameters B to be used from the parameter B memory, or which musical form ID data to be used out of the musical form memory 108.

In general, music varies depending on its progression. However, viewing a limited period of time, some characteristics of music are stationary. The present automatic composer has taken this point into consideration and has derived a concept of "segment" unit regarded as stationary. For example, the respective functions in the motif featuring parameter extraction means F10 are adapted to extract PA on a segment basis. Similarly, the melody control information generation means F20 transfers the values of PC allocated to each segment to the melody generation execution means F30 which generates in turn a melody for each segment by utilizing the allocated values of PC. Of course, this does not mean that all of PCs vary similarly with a common segment unit of variation (this also applies to PA). In general, the length of segment in which the value is fixed differs depending on the kind of PC. Accordingly in principle it is possible to assign different segment units to respective types of PC and generate their values on different segment basis. This requires, however, a complicated processing. In view of this the present embodiment employs a greatly reduced types of segments, preferable a single segment unit common to all PCs (an interval of the greatest common divisor). This is similarly applied to the motif featuring parameter extraction means F10.

Particularly in the arrangement which will be fully described later, all of the functions F10, F20 and F30 are designed to have a common segment as the simplest case; one measure is closen as a unit of segment. The present invention, however is not limited to this segment but the various functions may have two or more different segments. For example, the segment size for a tone pitch sequence should not necessarily be the same as the segment size for a tone duration sequence. It is also possible to allow chords to change on a basis of a segment other than a measure while permitting the means F20 to assign PC values to respective measures.

The details of the major functions F10, F20 and F30 shown in FIG. 38 will now be explained.

The motif featuring parameter extraction means F10 comprises a motif tone pitch pattern extraction means F11 and a motif tone duration (rhythm) pattern extraction means F12. The motif tone pitch pattern extraction means is adapted to extract the characteristic of the sequence of pitches of motif tones and includes a nonharmonic tone extraction means F11-1 adapted to extract nonharmonic tones contained in motif and an arpeggio pattern extraction means F11-2 adapted to extract the pattern of arpeggio (later referred to as LLi) which is a pattern of tone pitches divested of nonharmonic tones from the motif. The means F11-1A serves to classify the types of nonharmonic tones and is a mode of the means F11-1. The motif tone duration (rhythm) pattern extraction means F12 is adapted to evaluate or extract the characteristic of the sequence of durations of motif tones and includes a characteristic mini-pattern extraction means F12-1 adapted to extract a characteristic mini-pattern contained in motif and an arpeggio (rhythm) pattern extraction means F12-2 adapted to form an arpeggio pattern which is the sequence of durations of tones consisting of only harmonic tones with the durations of nonharmonic tones in the motif being absorbed into the harmonic tones.

The above scheme of extracting tone pitch pattern and rhythm pattern of "arpeggio" by the means F11-2 and F12-2 is based on the concept of the present embodiment that the harmonic tones form fundamentals of melody (Similar concept is held in the elements F31-1, F31-2 etc., in the function F30.).

Within the block of the melody control information generation means F20, there is shown a progression dependent parameter generation means F22 adapted to generate parameters depending on the segment number indicated by a segment counter F23. Among these parameters are parameters which regularly vary as music proceeds: such parameters are generated by a regularly variable parameter generation means F22-1. A random number generation means F24 operates on the parameters generated by the means F22 and is capable of introducing randomization or variations into the parameters in such a manner that the variations are self-controlled by the corresponding parameters. The elements F22 and F23 are illustrated to clarify that parameters having the above-mentioned property may be included in PC and also to show that even noncomputational type (such as data base for parameters C) can generate parameter C (melody control information). Actually, in the present embodiment, the parameters C are generated by the means of computational type. It is the element F21 which performs such computation.

The computation means F21 is operable to receive at its input, motif featuring parameters PA provided by the means F10, the information of the parameter B shown at I1, measure number indicated by the measure counter F23-1 and musical form identification data provided by the musical form ID data generation means F25 and compute parameters C from these input variable data. The musical form ID data generation means F25 includes a phrase counter F25-1 by which the means F25 selects the information concerning the specified phrase from the musical form ID data I2. The phrase information includes type of phrase (repeat or development). The musical form ID data generation means F25 reads the measure number as counted by the measure counter F23-1, checks the position of the measure number relative to the phrase and decodes the associated form ID data based on the result of the check. The decoded form ID data will then be transferred to the computation means F21. The purpose of the musical form ID data generation means is to provide music with a higher level of hierarchy.

From the foregoing, it is understood that the melody control information generation means F20 generates various PCs: Some PCs are stationary over a relatively long period of time. Some PCs vary in a cycle comparable to a unit of segment, here a measure. Some other PCs change, under the influence of musical form, to a different value at particular segments or points. Depending on the values of PBs, the values of musical form data, and the types of function used by the computation means F21, extremely various PCs are generated from the same PAs.

The melody generation execution means F30 mainly comprises a tone pitch sequence generation means F31 and a tone duration sequence generation means F32. The tone pitch sequence generation means F31 includes arpeggio generation means F31-1 adapted to generate a sequence of pitches of arpeggio tones by using the chord in progress provided by the chord progression data F3 and PC directly provided by the melody control information generation means F20 or PC with fluctuations incorporated by a random number generation means F31-4. The means F31 further includes nonharmonic tone imparting means F31-2 adapted to add nonharmonic tone(s) before, after arpeggio tone(s) and/or between arpeggio tones in accordance with the plan of PC and the internal rule of addition. Means for imparting respective types of nonharmonic tones F31-2A is an example of the means F31-2. Tone pitch control means designated by F31-3 serves to control the use of melody note candidates generated in the process of the means F31-1 and/or F31-2. Specifically, the tone pitch control means F31-3 causes note scale generation means to generate note scale data having weights assigned to respective pitches and commands effective pitch checking means F31-3B to test the effectiveness of that candidate based on the assigned weight. Those notes that have passed the test are sent back to the means F31-1, F31-2 where they are used as genuine melody notes.

The tone duration sequence generation means F32 comprises optimal note joining means F32-1, optimal note disjoining means F32-2, and characteristic pattern incorporation means F32-3 and is operable to generate a sequence of tone durations in accordance with the PC planning. In the present embodiment, the optimal note joining means F32-1 and optimal note disjoining means are used to generate a sequence of durations of arpeggio tones. The optimal joining means F32-1 is operable to join tone durations a number of least times based on an initial sequence of tone durations (for example, the extracted sequence of arpeggio pattern as provided by the arpeggio (rhythm) pattern extraction means F12-2 in the means F10 or its qualified pattern) until the targeted number of notes of arpeggio (provided as a PC) has been reached. Similarly, the optimal disjoining means F32-2 is operable to disjoin the tone durations in the initial sequence a number of least times until the planned number of arpeggio tones PC has been reached. Further, both of the means F32-1 and F32-2 are adapted to perform note joining and joining by using a pulse scale. While such a pulse scale may be supplied as a PC (melody planning information) from the means F20, in the flow of the operation of the present embodiment, the pulse scale is built in the rule of disjoining and joining in these means. The characteristic pattern incorporation means F32-3 is operable to the associated PC to incorporate a characteristic mini-pattern into the sequence of melody tone durations. In the present example, the characteristic mini-pattern is injected in the last process of melody generation.

Control means F33 serves to activate various elements in the melody generation execution means F30 and control data transfer among these elements. The resultant data from the melody generation execution means F30, melody data are stored in the melody data memory 113 (FIG. 37).

GENERAL FLOW

Figure 39:
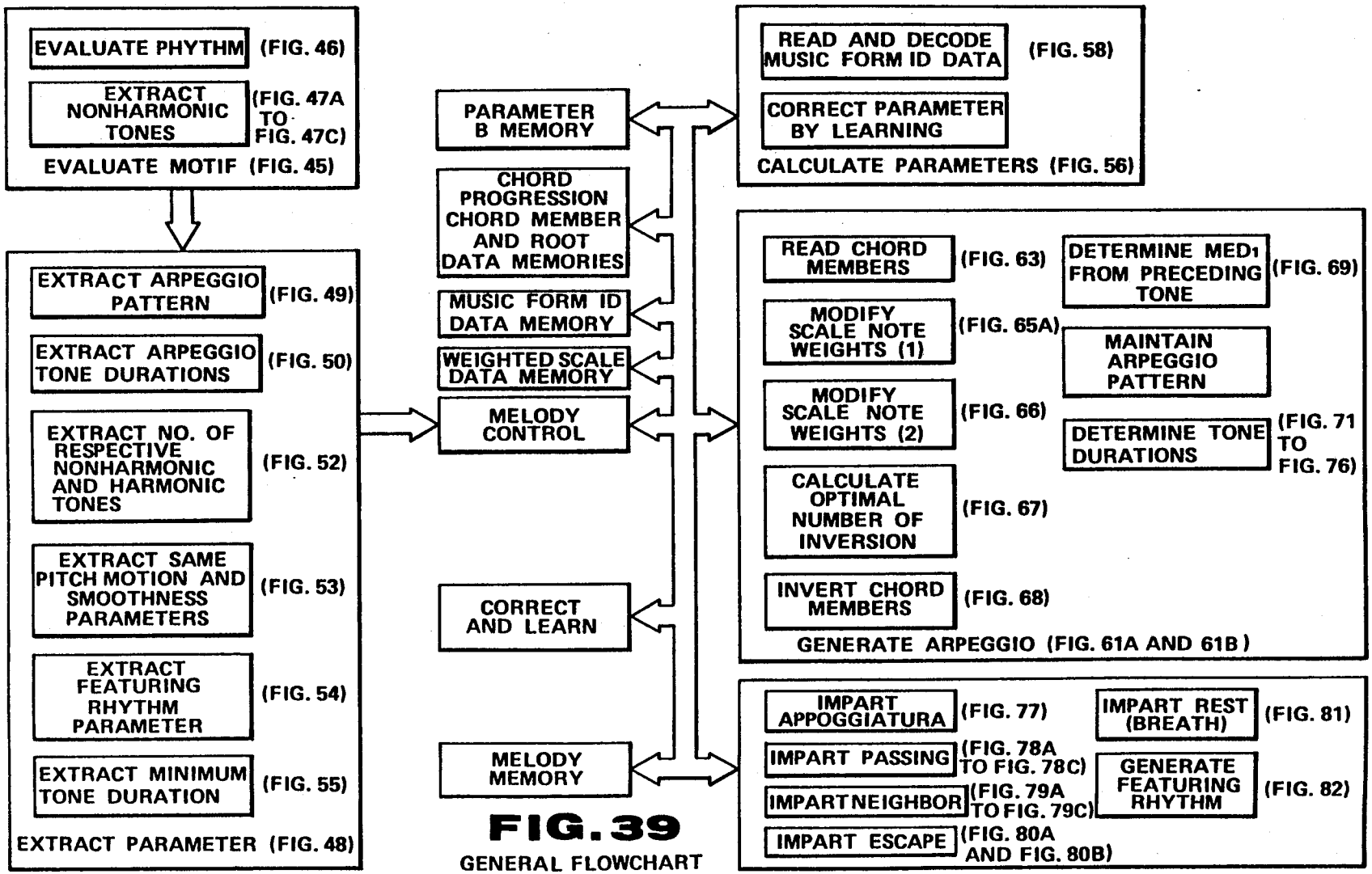
FIG. 39 is a general flowchart of the automatic composer.
Figure 44A:
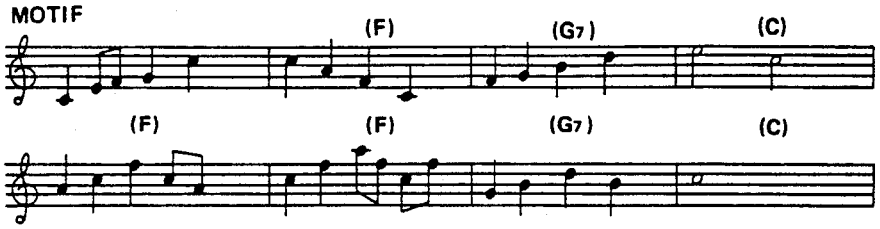
FIGS. 44(*a*)–(*e*) show generated melodies at various stages of music composition, using the data shown in FIGS. 42 and 43.
Figure 44B:
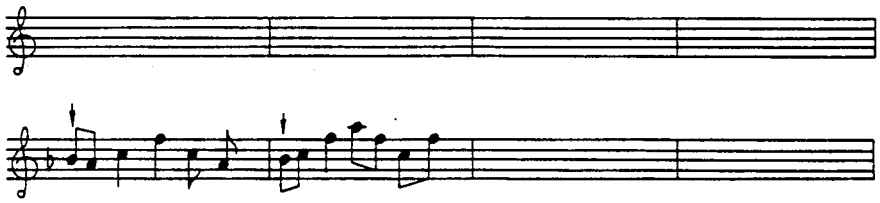
Figure 44C:
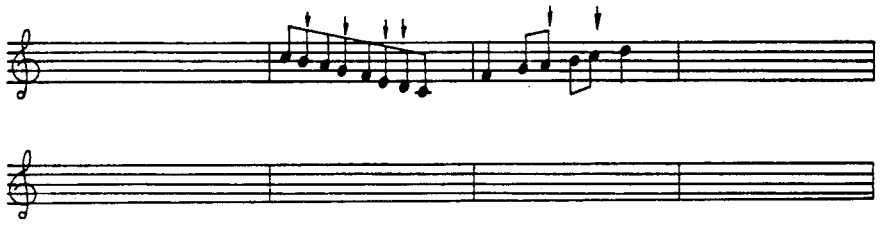
Figure 44D:
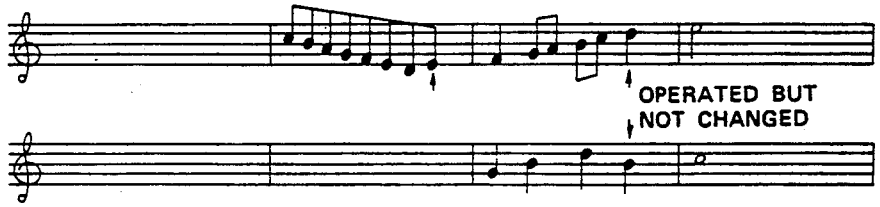
Figure 44E:
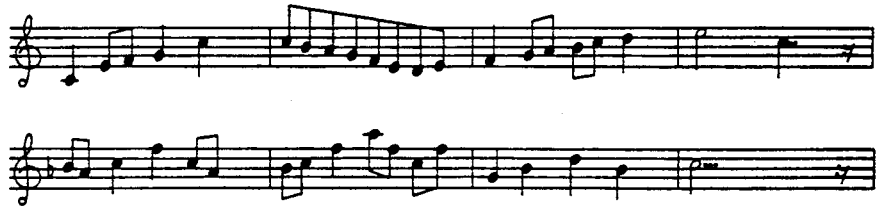

FIG. 39 is a partly block and partly flow diagram illustrating the overall operation of the present automatic composer. FIG. 39 is illustrated to give locations of various processes and further description thereof is omitted here.

PRELIMINARY ITEMS

Before turning to the detailed description of the operation of the second embodiment, preliminary items will be described.

FIG. 40 is a list of main variables used in the automatic composer. Because FIG. 40 is selfexplanatory, the description is omitted. FIG. 41 is a list of parameters C. Though the melody control information includes parameters not shown, only those parameters with letters of PC that are used in the following Figures are shown in FIG. 41. Further description is omitted because of selfexplanatory nature of FIG. 41.

It is assumed that format of pitch data is identical with that of the first embodiment. That is, the pitch data assignment as shown in part (a) in FIG. 6 is used.

Also assumed is that the unit of "segment for extraction" and "segment for generation" is one measure. In this connection, chord progression information is supposed to have one chord per measure.

It is also assumed that the length of motif (input melody) is one measure, unless otherwise stated.

The length of measure is supposed to be equal irrespective of measure number.

For the purpose of description, each chord is assumed to consist of four pitches. One type of chord consists of four independent voices such as C major seventh chord of do, mi, sol and ti whereas the other type of chord is essentially triad with two voices having an octave relation with each other. Thus, the triad of do, mi and sol is expressed, here, by four data of do, mi, sol and dò (an octave up from do). In this connection, address locations for each chord in the chord member memory 102 are made up of four addresses with respective addresses storing values corresponding to the respective pitches of the members: the chord of say (do, mi, sol and dò) is represented by data of (1, 5, 8, 13).

The above assumptions are made merely for the purpose of description.

FIG. 42 shows an example of input data (part one) for the description of the operation. The melody shown at (1) in FIG. 42 is a motif taken in conjunction with the following description of the operation. Since the remaining portions in FIG. 42 are selfexplanatory, so the description thereof is omitted here.

FIG. 43 is an example of data (part two) regarding the values of PCs.

FIG. 44(*a*)–44(*e*) illustrate melodies at various stages in the process of music composition. They are generated using the data shown in FIGS. 42 and 43.

This concludes the description of preliminary items and turns to the detailed description of the operation.

MOTIF EVALUATION

The motif information is input by the input device 101 in FIG. 37 and is stored in the motif memory 106. The first job of the automatic composer is to evaluate the motif information.

Figure 45:
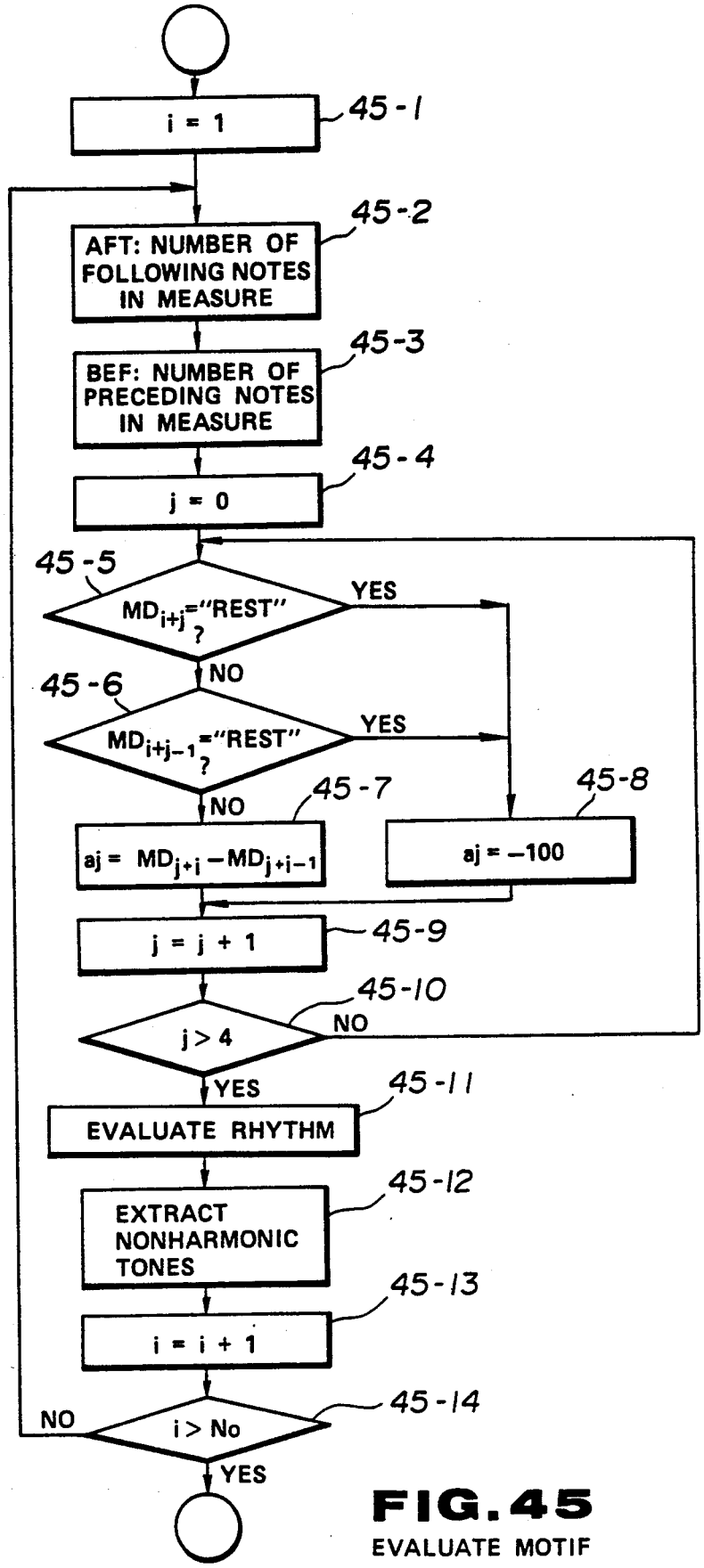
FIG. 45 is a flowchart of evaluation of motif.

FIG. 45 is a flow of evaluation of motif executed by CPU109. CPU109 evaluates the motif on a single measure basis.

The main portions of the flow in FIG. 45 are rhythm evaluation at 45-11 and nonharmonic tone evaluation at 45-12. In FIG. 45 i is a motif data number i.e., a variable indicative of note number in the motif measure of interest. AFT is a variable or register indicative of the number of notes following the i-th note in the measure. BEF is a variable of the number of notes preceding the i-th note (45-2, 45-3). In the process of 45-4 to 45-10, computation is performed of the pitch difference or interval between each of adjacent pairs of tones in the sequence of pitches of six notes MDi−1 to MDi+4 surrounding the i-th note MDi. For example, al indicates the interval between MDi (note of interest) and MDi+1 (next note). A rest is processed in a specialized manner because it does not involve the concept of pitch (45-5, 45-8).

In the process of nonharmonic tone extraction 45-12, nonharmonic tones contained in the motif are extracted and classified from the position of the note of interest relative to the bar lines AFT, BEF and the interval motions a0 to a4 surrounding that note, as will be described later. Accordingly, the above operations of 45-2 to 45-10 are a prearrangement for the nonharmonic tone extraction 45-12. "No" indicates the total number of notes (including rests) contained in the motif measure. When the evaluation has been carried out of all of the notes (i>No), the process goes out from the illustrated flow. Further description of the flowchart in FIG. 45 is omitted except the process of 45-11 and 45-12 because FIG. 45 is, obvious per se.

RHYTHM EVALUATION

Figure 46:
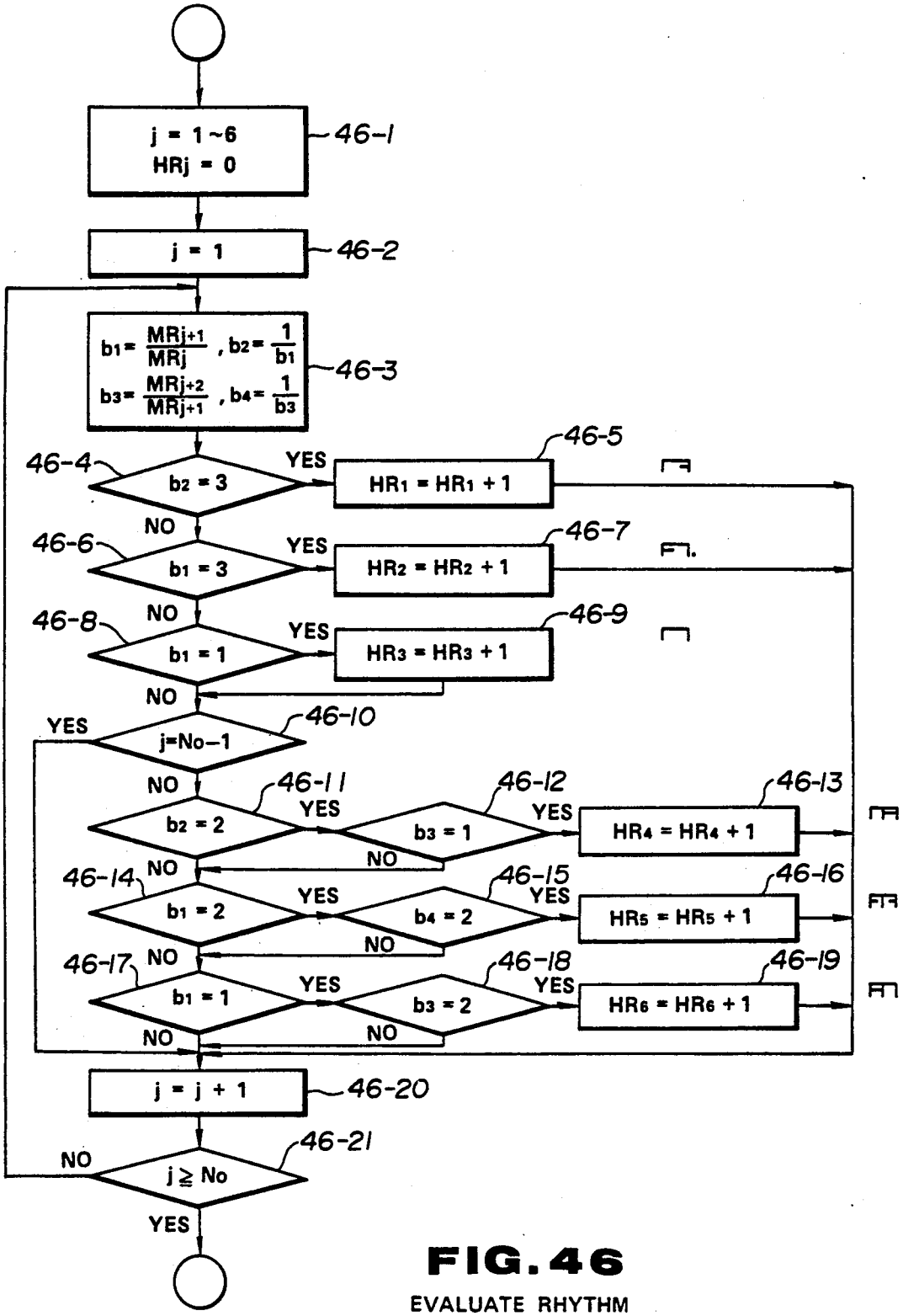
FIG. 46 is a flowchart of evaluation of rhythm.

FIG. 46 illustrates the details of the rhythm evaluation 45-11 in FIG. 45. The purpose of this process is to examine what kind of and how much mini-patterns are contained in the motif. In FIG. 46, mini-patterns (sequences of tone durations) for investigation are given by:

a pattern of ratio of 3-1, for example, ♫, ♩♭,
a pattern of ratio of 1-3, for example, ♬,
a pattern of ratio of 1-1, for example, ♩♩,
a pattern of ratio of 2-1-1, for example ♩♫,
a pattern of ratio of 1-2-1, for example ♫♩, and
a pattern of ratio of 1-1-2, for example ♬♩.
(rests as well as notes are included in patterns)

The number of patterns of ratio of 3-1 contained in the motif is counted in HR1, the number of patterns of ratio of 1-3 in HR2, the number of patterns of ratio of 1-1 in HR3, the number of patterns of ratio of 2-1-1 in HR4, the number of patterns of ratio of 1-2-1 in HR5 and the number of pattern of ratio of 1-1-2 in HR6.

At 46-3, computation is made of the ratio of durations of adjacent notes MRj, MRj+1. Since only the notes in measure is under examination, the check of the patterns of three notes is carried out until the second note from the last note in the measure has been reached (then, $j=No-1$ at 46-10).

For the motif of ♩♫♩♩ do, mi, fa, sol, do) as shown in the first measure FIG. 44(*a*), the counter HR3 of 1-1 pattern indicates "2" (one for ♫ and one for ♩♩, totaling two), the counter HR4 of 2-1-1 pattern "1" (one for ♩♫), the counter HR6 of 1-1-2 pattern "1" (one for ♫♩) and the other counters HR1, HR2, HR5 "0".

It is possible to find a characteristic or dominant mini-pattern characterizing the motif by examining the magnitudes of counts in the respective mini-pattern counters HR1 to HR6, as will be described later. Further, it is possible that the rhythmic characteristics of the motif are reflected in a melody to be generated by the incorporation of the characteristic mini-pattern into the sequence of melody tone durations.

EXTRACTION OF NONHARMONIC TONES

Figure 47A:
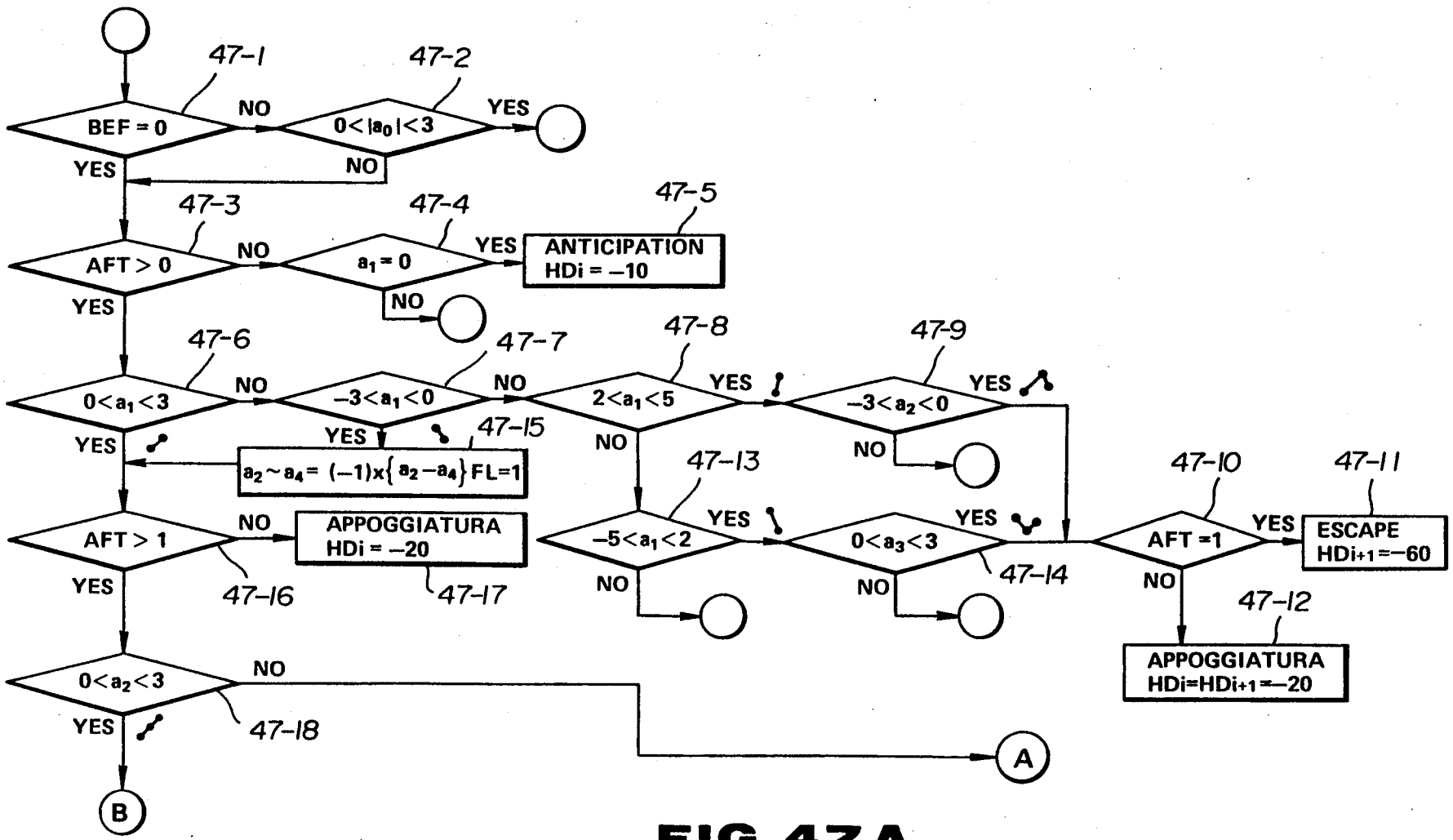
FIGS. 47A, 47B and 47C show, in combination, a flowchart of classification of nonharmonic tones.
Figure 47B:
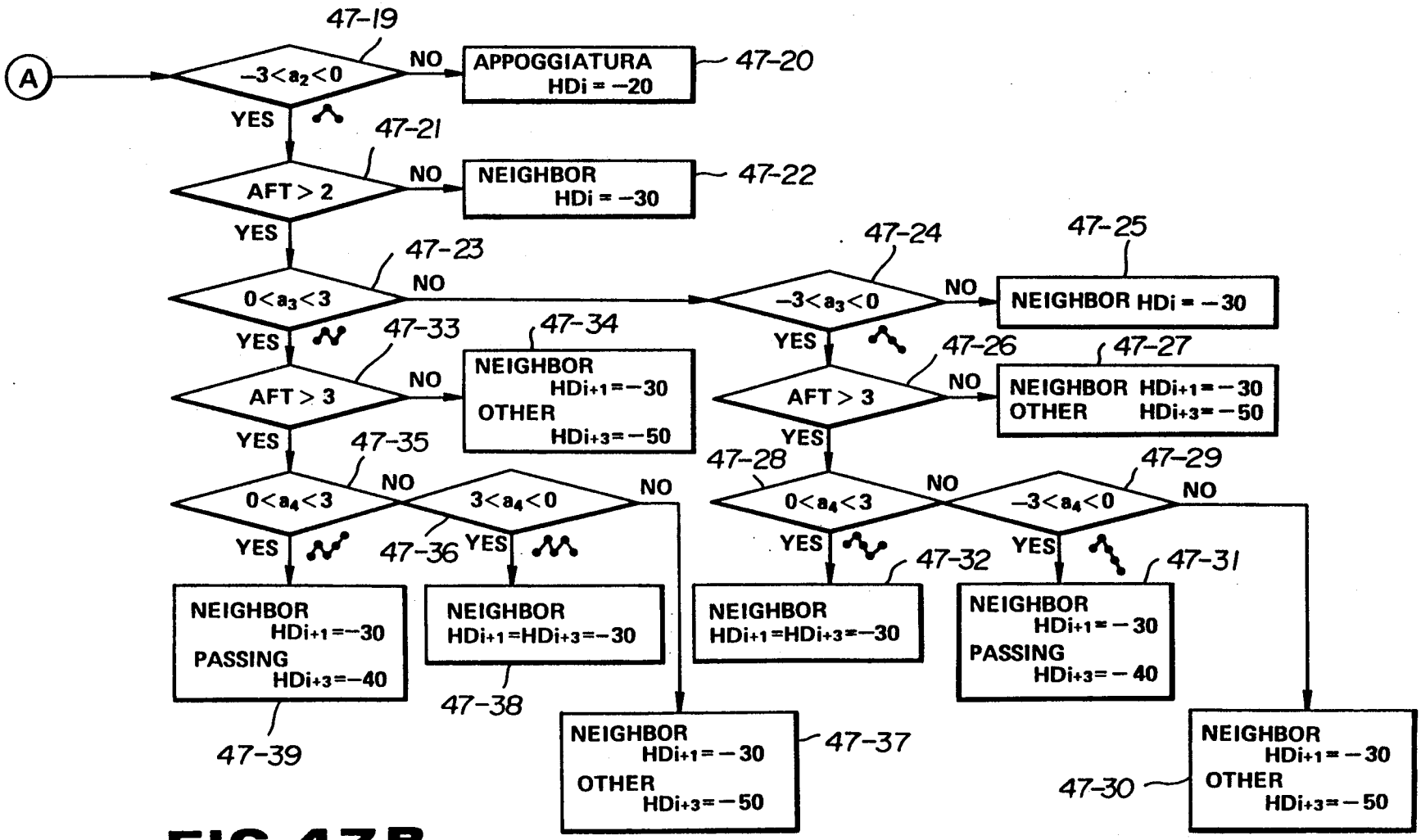
Figure 47C:
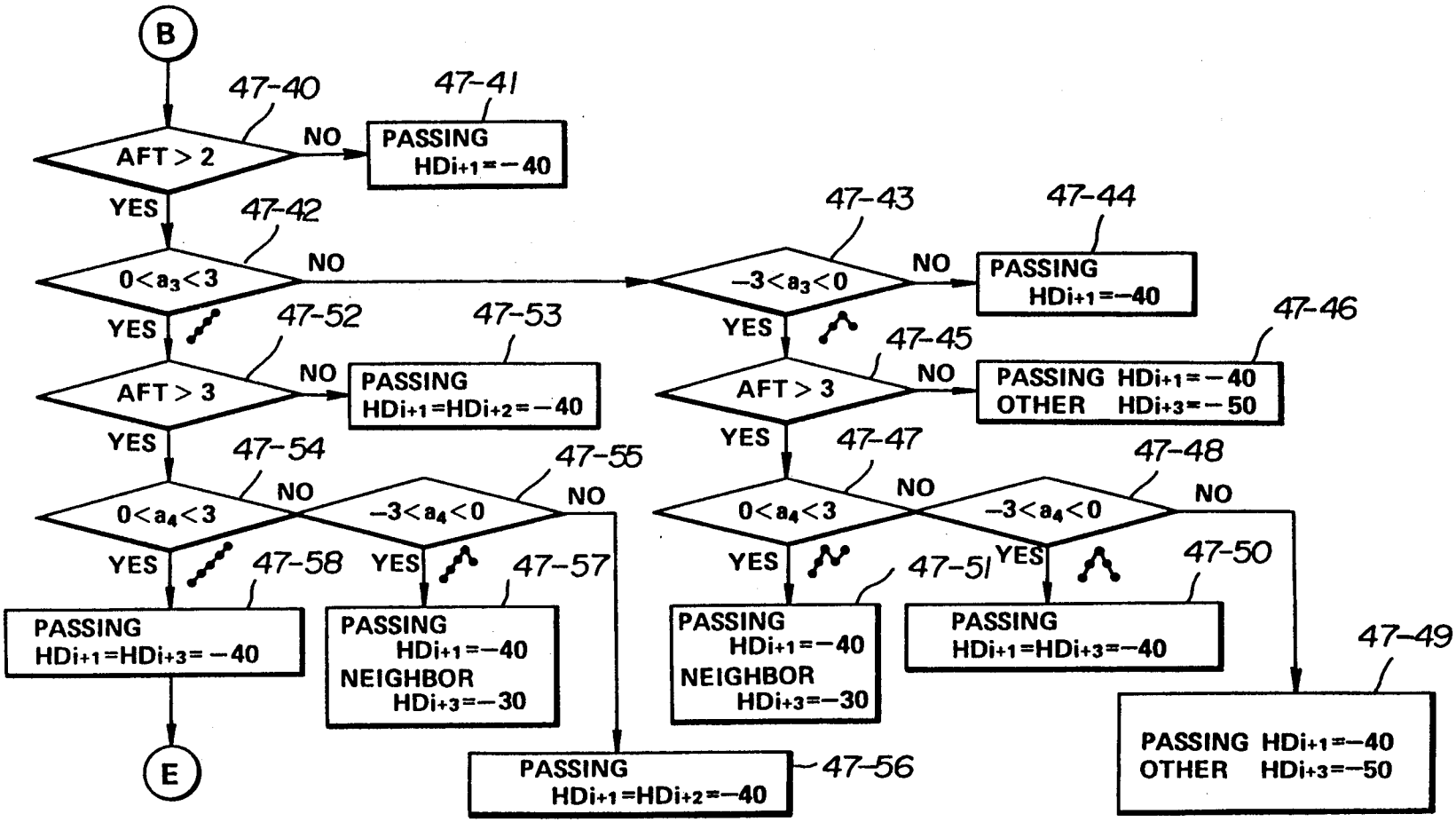

FIGS. 47A, 47B and 47C illustrate the details of nonharmonic tone extraction 45-12 in FIG. 45. As shown, the flow of 47-1 to 47-58 forms a tree structure so that the automatic composer will deduce the type of nonharmonic tones for any particular note in a forward reasoning from the positional information AFT, BEF about the note of interest relative to the bar lines and the interval motions a0–a6 formed by the sequence of notes surrounding that note. The result that any particular note is any particular type of nonharmonic tones is recorded by writing unique values to numbered registers HDi in the array {HDi}: the array {HDi} is allocated to a certain area in the work memory 110 and is initialized with the pitch data of motif {MDi}. For example, HDi=−40 means that the i-th note in the motif measure of interest is a nonharmonic tone called passing. In FIGS. 47A to 47C, as nonharmonic tones, there are shown anticipation, appoggiatura, neighbor, passing and other nonharmonic tones. These terms are however merely for the sake of description. In other words, terminals of the structured flow or network describe conclusions (for example, $HDi+1=-40$ at the terminal 47-41 is the conclusion that the (i+1)th note is a passing tone). There exist one or more routes going to a particular conclusion from the root of the tree. These routes are conditions that the associated conclusion must satisfy or the definition of the conclusion. In short, the flow in FIGS. 47A to 47C classify or define types of nonharmonic tones. This implies that other definitions can be made of respective types of nonharmonic tones. From the teaching of the present invention, a person skilled in the art could easily design extraction of nonharmonic tones using other definitions.

Since the flow in FIGS. 47A to 47C is selfexplanatory, further description will be omitted.

EXTRACTION OF MOTIF PARAMETERS

The above mentioned evaluation of motif may be referred to as the first analysis of motif and then the extraction of motif parameters which will be described hereinafter may be called the second analysis of motif. Either function is directed to do analysis of motif characteristics.

Figure 48:
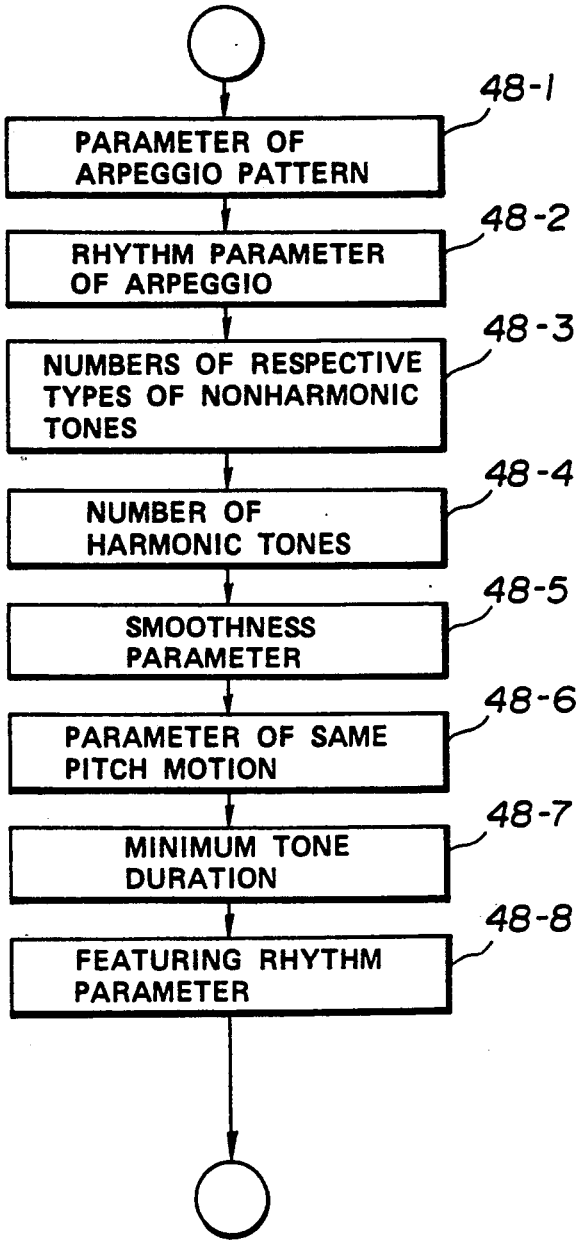
FIG. 48 is a simplified flowchart of extraction of parameters.

FIG. 48 is a general flow chart illustrating extraction of motif parameters. According to the flow, at 48-1, extraction is performed of a parameter indicative of a pattern of harmonic tones, or a stream of pitches of arpeggio tones contained in the motif, or a pattern of vertical components {LLi}. At 48-2, extraction is made of a pattern indicative of a stream of durations of arpeggio tones or a pattern of horizontal components {RHi}. At 48-3, computation is made of the number of respective types of nonharmonic tones. At 48-4, calculation is made of the number of harmonic tones. At 48-5, a parameter indicative of smoothness of the sequence of pitches of motif is extracted. At 48-6, a parameter indicative of the number of consecutive same pitches (same pitch motion) is extracted. At 48-7, extraction is made of the shortest tone in the motif. At the final step 48-8, extraction is made of a parameter indicative of characteristic rhythm in the motif. The order of these processes is not limited to that illustrated.

Additionally speaking, the present automatic composer handles a nonharmonic tone and a harmonic tone in a distinguished manner. The flow of 48-1 to 48-6 in FIG. 48 is associated with this. For example, at 48-2, nonharmonic tones are removed from the sequence of motif tone durations. That is, notes of nonharmonic tones are absorbed into notes of harmonic tones, thus forming a sequence of durations of tones consisting only of harmonic tones. Smoothness parameter and same pitch motion parameter at 48-5, 48-6 considers only arpeggio tones, disregarding nonharmonic tones. This extraction approach is based on the concept that harmonic tones constitutes fundamentals of melody.

EXTRACTION OF PATTERN OF HARMONIC TONES

Figure 49:
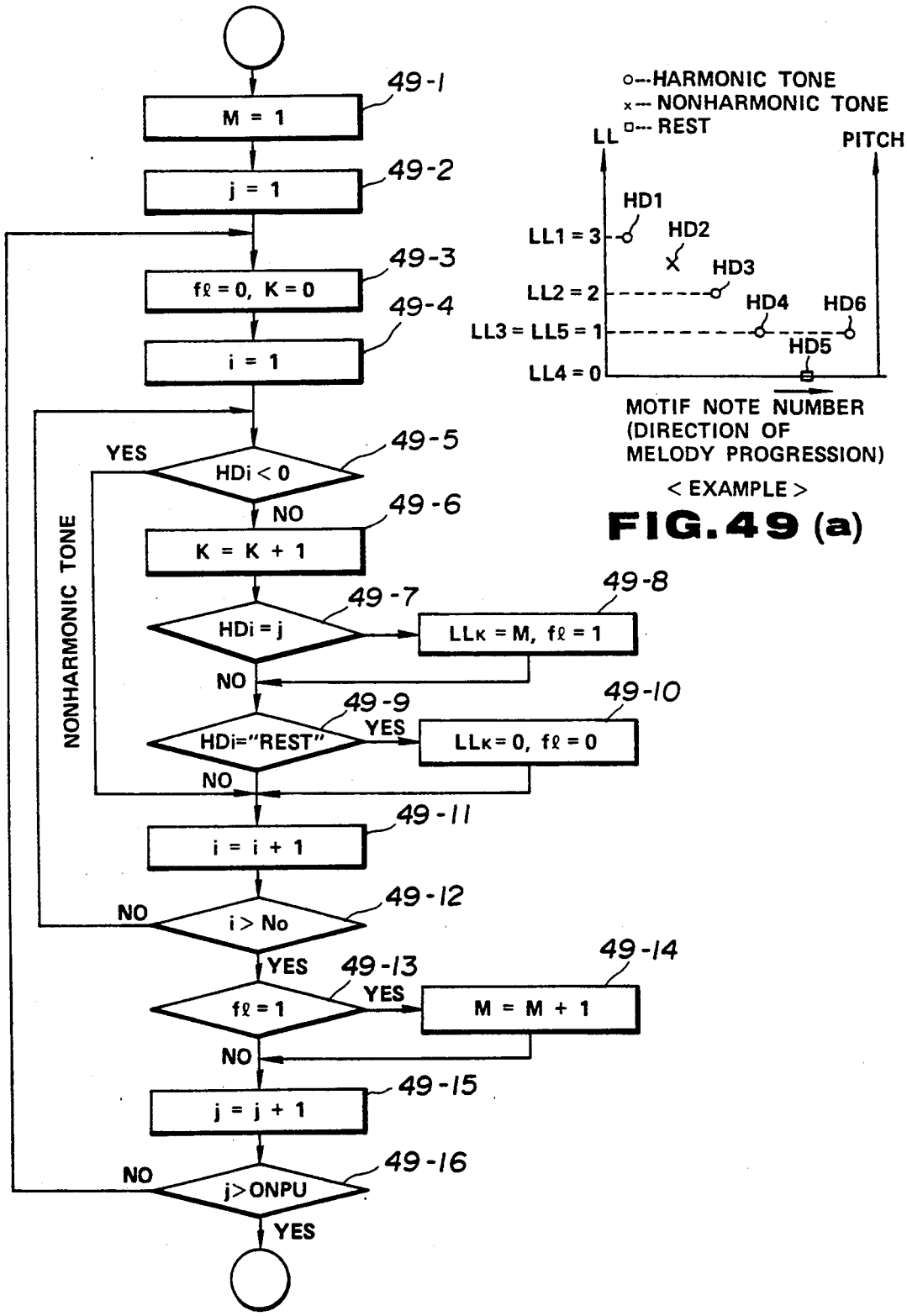
FIG. 49 is a flowchart of extraction of a parameter indicative of arpeggio pattern.

FIG. 49 illustrates the details of extraction of pattern of harmonic tones 48-1 in FIG. 48. See also FIG. 49(*a*). Because this extraction is identical with that of the first embodiment (FIG. 17), the description thereof is omitted.

EXTRACTION OF PATTERN OF HARMONIC TONE DURATIONS

Figure 50:
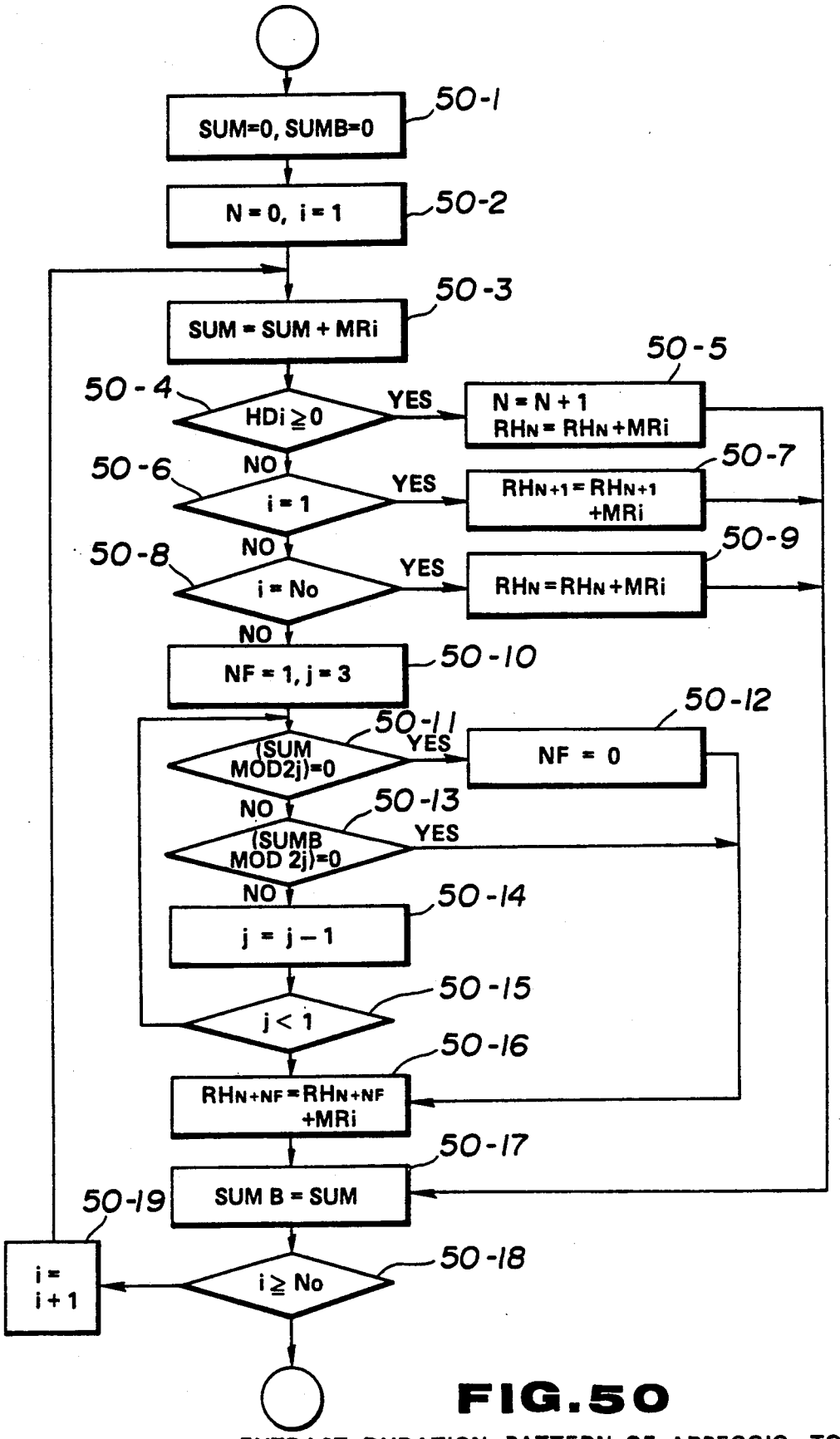
FIG. 50 is a flowchart illustrating extraction of pattern of durations of harmonic tones.
Figure 51:
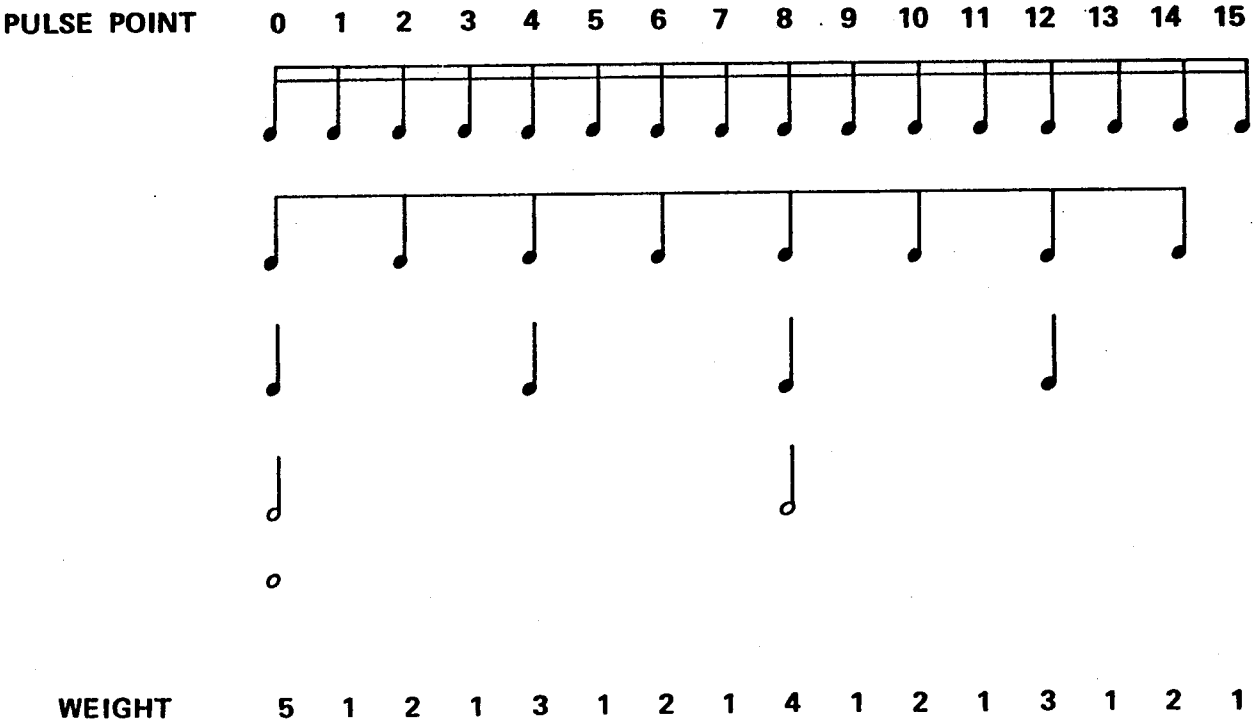
FIG. 51 shows a pulse scale used in the flowchart in FIG. 50.

FIG. 50 illustrates the details of the process 48-2 in FIG. 48. The purpose of this process is to form a sequence of durations of tones consisting of only harmonic tones with nonharmonic tones eliminated from the motif containing both harmonic tones and nonharmonic tones. In the process, durations of individual nonharmonic tones are absorbed into the durations of adjacent harmonic tones. Which harmonic tone absorbs which nonharmonic tone is determined based on a pulse scale for a quadruple time as illustrated in FIG. 51. Suppose that a nonharmonic tone is interposed between tones. The weight of the starting point of that nonharmonic tone is compared with the weight of the point where the next note (assumed to be a harmonic tone) starts. If the weight of the starting point of the next note is lighter, the duration of the nonharmonic tone is absorbed into the duration of the next note. If the weight of the starting point of the next note is heavier, the duration of the nonharmonic tone is absorbed into the preceding note (assumed to be a harmonic tone for simplicity). The above is the logic of absorption of nonharmonic tone durations. The harmonic tone that has absorbed the nonharmonic tone duration becomes longer than the original by the nonharmonic tone duration.

The pulse scale of (5, 1, 2, . . . ) shown in FIG. 51 is a logical scale and is built into the flow in FIG. 50.

In FIG. 50, SUM is a register indicative of the distance or length between the starting location of the next note and the preceding bar line. SUMB is a register indicative of the distance or length between the starting point of the current note and the preceding bar line. MRi indicates the duration of the i-th note in the motif. RH initially indicates the duration of the Nth harmonic tone in the motif and will be the duration of the original plus the durations of zero to several surrounding nonharmonic tones at the end of the process in FIG. 50. No is the total number of motif notes. SUM MOD $2^j$ is a quotient resulting from the division of SUM by $2^j$. Similarly, SUMB MOD $2^j$ is a quotient resulting from the division of SUMB by $2^j$.

At 50-4, check is made as to whether the i-th note is a harmonic tone. If this is the case, N is incremented and the duration of the i-th note is added to the duration of the Nth harmonic tone (50-5). At 50-6, it is checked as to whether the nonharmonic tone of interest is the first note. At 50-8, check is made as to whether the nonharmonic tone is the last note. If the nonharmonic tone is the first note, the starting point of that tone coincides with the first pulse point on the pulse scale (FIG. 51) and has the maximal weight of 5. In accordance with the pulse scale logic, the duration of this tone is absorbed into the next note (50-7). Similarly, if the nonharmonic tone in question is the last note, the starting point of the next note has the maximal weight (assuming that there is no note crossing a bar line). Accordingly, the last note is absorbed into the preceding note (50-9). At 50-10 to 50-15, examination is carried out as to whether the nonharmonic tone which is neither the first nor the last note is measure is to be absorbed into the preceding (harmonic) tone duration RHN or the next (harmonic) tone duration RHN+1 in accordance with the logic of pulse scale.

For instance, the motif in FIG. 44(*a*) is given by:

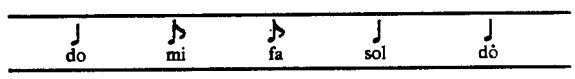

The fa is a nonharmonic tone and the other tones are all harmonic tones. The starting point of the next tone sol to the fa is 8th from the beginning of measure assuming that the length of measure is 16 (see upper part of FIG. 51). Its weight is 4. The starting point of the fa is 6 with the weight of 2. Because the weight of the so (4)>the weight of the fa (2), the nonharmonic tone fa is absorbed into the preceding harmonic tone mi: according to the flow, the check 50-11 is affirmative at j=2, 50-12 causes NF=0 and 50-16 cause *RH2=RH2+MR3*.

The result is given by:

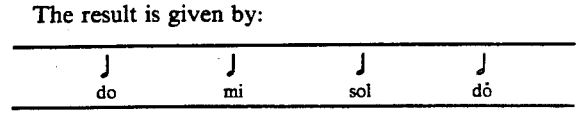

In words, the resultant pattern of durations of harmonic tones is:

$$\{RHi\} = (RH1, RH2, RH3, RH4) = (4, 4, 4, 4)$$

From the foregoing and the selfexplanatory nature of the flow in FIG. 50, the operation of the extraction of the pattern of harmonic tone durations has become apparent and further explanation is omitted.

It should be noted that the pulse scale shown in FIG. 51 is a mere example and it is possible to form a sequence of harmonic tone durations by using other pulse scales. This is obvious. When an opposite logic stating that for the weight of starting point of a nonharmonic tone > the weight of the starting point of the next harmonic tone, the nonharmonic tone is to be absorbed into the previous tone whereas for the weight of starting point of the nonharmonic tone < the weight of the starting point of the next harmonic tone, the nonharmonic tone is to be absorbed into the next harmonic tone is employed, then the result from the same motif is given by:

| ♩ | ♪ | ♩. | ♩ |
|---|---|---|---|
| do | mi | sol | dô |

or {RHi}=(4, 2, 6, 4)

THE NUMBERS OF RESPECTIVE NONHARMONIC TONES AND THE NUMBER OF HARMONIC TONES

Figure 52:
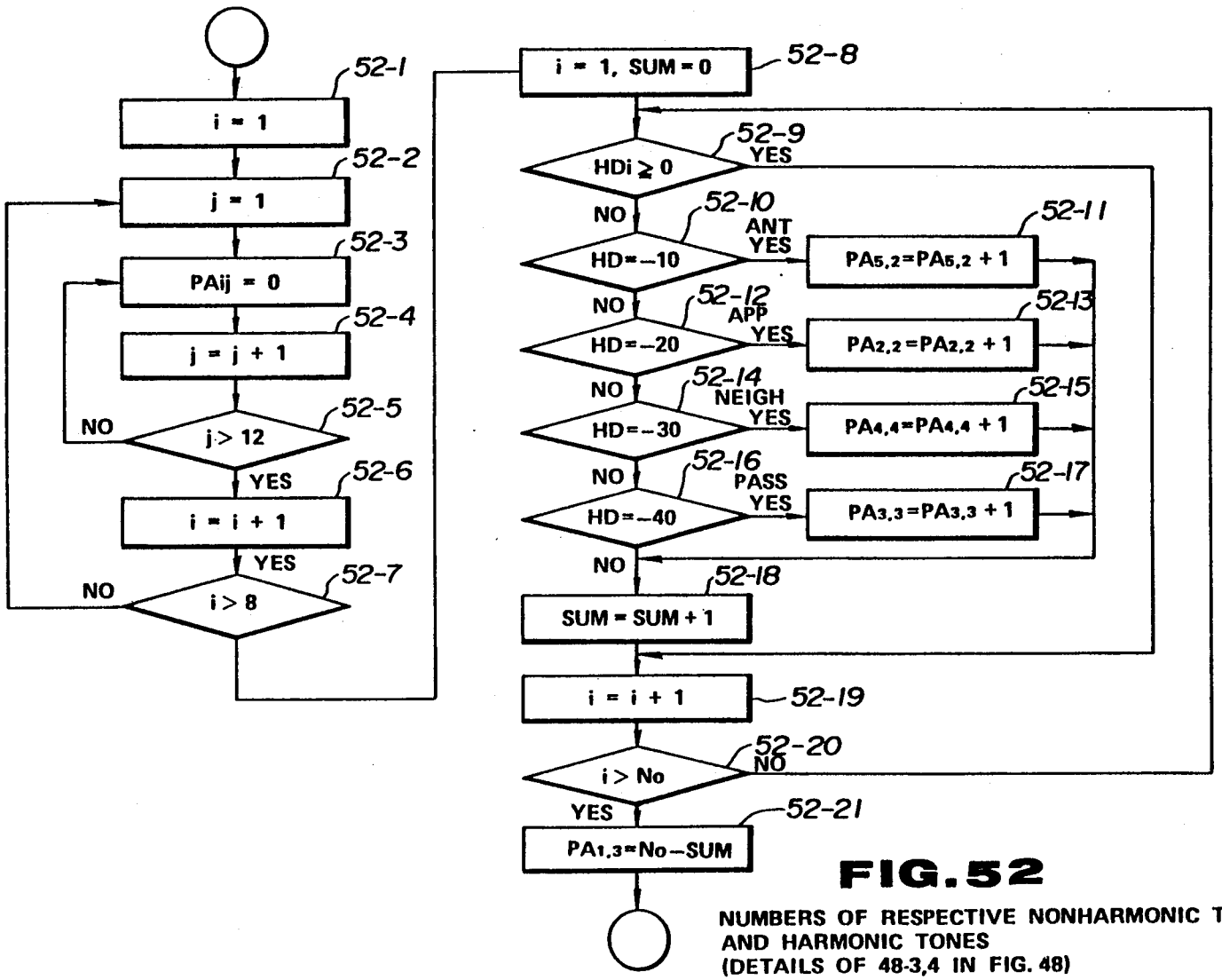
FIG. 52 is a flowchart of extraction of numbers of respective types of nonharmonic tones and number of harmonic tones.

FIG. 52 illustrates the details of the processes 48-3 and 48-4 in FIG. 48. In the flow of 52-1 to 52-7, parameters PAij are initialized. The number of anticipation contained in the motif is loaded in PA5,2, the number of appoggiatura in PA2,2, the number of neighbor in PA4,4 and the number of passing in PA3,3. SUM results in the total number of nonharmonic tones contained in the motif measure. The contents of PA1,3 indicate the total number of harmonic tones contained in the motif measure.

SMOOTHNESS AND SAME PITCH MOTION

Figure 53:
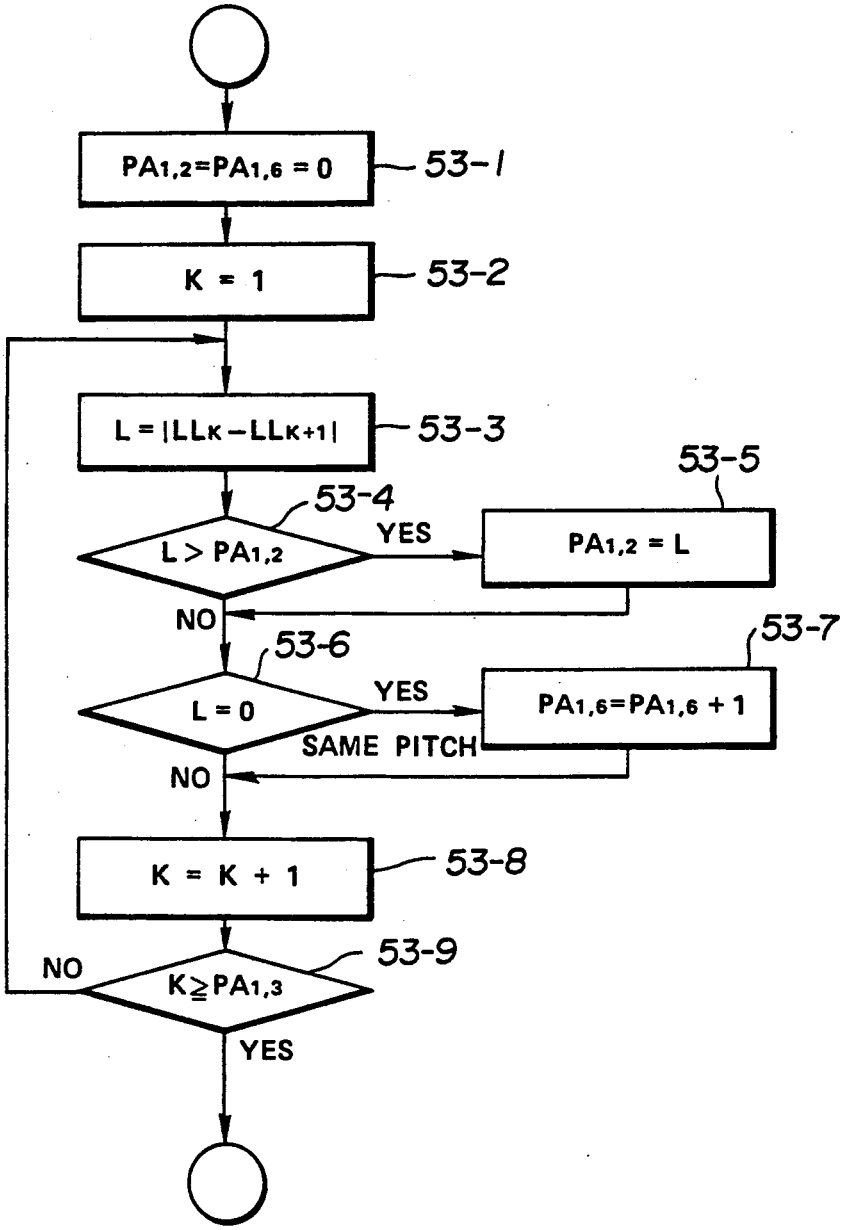
FIG. 53 is a flowchart of extraction of smoothness and same pitch motion parameters.

FIG. 53 illustrates the details of the processes 48-5 and 48-6 in FIG. 48. As mentioned, {LLk} is the pattern of arpeggio tones in the motif measure. According to the illustrated flow, PA1,2 is set at the degree of maximal skip motion among adjacent pairs of harmonic tones or smoothness parameter and PA1,6 is set at the number of consecutive same pitch harmonic tones as a same pitch motion parameter. LLk for a rest lacking the concept of pitch is set at zero. In this connection, the result of check 53-4, 53-6 is negative when at least one of LLk and LLk+1 indicates a rest: this is achieved for example by determining whether LLk=0 or $LLk+1=0$ after the operation 53-3 and setting L=−1 if this is the case.

CHARACTERISTIC RHYTHM PARAMETER

Figure 54:
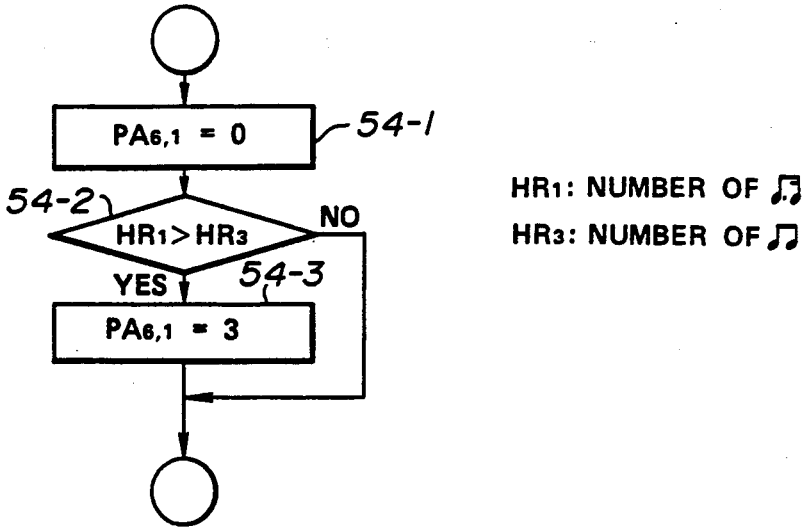
FIG. 54 is a flowchart of extraction of a parameter indicative of a characteristic rhythm.

FIG. 54 illustrates the details of the process 48-8 in FIG. 48.

As described in conjunction with FIG. 46, the automatic composer of the present embodiment examines what mini-patterns and how much such mini-patterns are contained in the motif. The remaining question is to decide which mini-pattern is a pattern characterizing the motif. In the present example, the pattern characterizing the motif is a dominant mini-pattern.

The evaluation based on this approach is exemplified in the flow in FIG. 54. According to the flow, it is examined which of mini-patterns of ratios of 3-1 ( ♫ for example) and 1-1 (♫ for example) is dominant in number. If the number of the mini-pattern of the ratio of 1-1, HR3 is greater, PA6,1 is set at zero. If the number of the mini-pattern of the ratio of 3-1, HR1 is greater, PA6,1 is set at 3.

In the motif in FIG. 44(*a*), HR1=0 and HR3=2 and the 1-1 mini-pattern is dominant, thus the value of PA6,1 is set at zero, indicating that the 1-1 mini-pattern characterizes the motif.

The flow in FIG. 54 is a mere example. A person having an ordinal skill in the art can easily prepare other extraction of featuring rhythm parameter. For example the numbers of other mini-patterns (such as HR2, HR4, HR5, HR6) may also be considered.

As will be described later, the featuring minipattern identified by the value of PC6,1 is built into the sequence of melody tone durations whereby the rhythmic characteristic of motif is reflected in the melody.

EXTRACTION OF MINIMAL TONE DURATION

Figure 55:
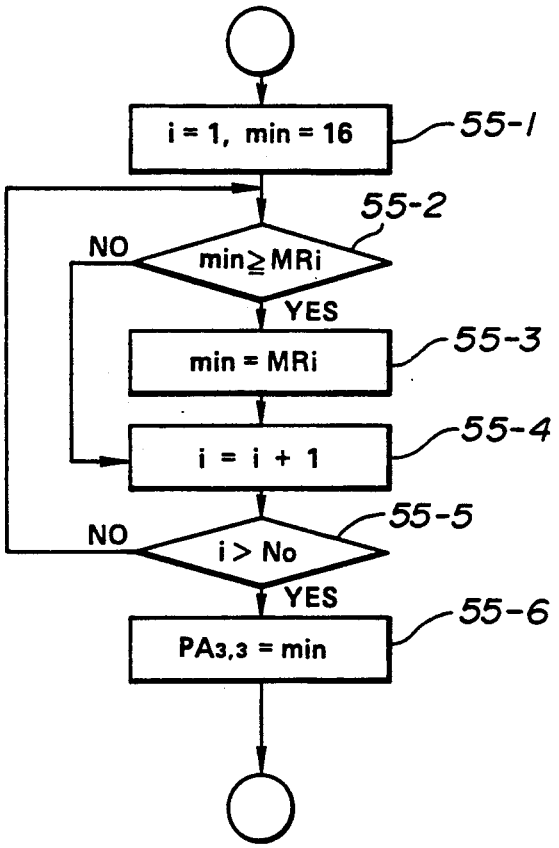
FIG. 55 is a flowchart of extraction of the shortest tone.

FIG. 55 illustrates the details of the process 48-7 in FIG. 48. According to the flow, the minimal tone duration found in the search of motif tone durations MRi is set in a register min in an updated fashion and the final minimal tone duration is stored in PA3,3.

The minimal tone duration information PA3,3 may be associated with the minimal tone duration in a melody to be generated. For example, if it is planned that the minimal tone duration in motif PA3,3 is equal to the minimal tone duration in melody PC3,3, then no melody notes shorter than motif notes will be generated: of course, this does not mean that the equality is a must but involves controllability. Under any circumstance, PA3,3 is one of the motif tone duration (rhythm) parameters.

MELODY GENERATION

So far, it has become apparent how the present automatic composer evaluates a given motif and extracts its characteristics.

The next job of the automatic composer is to generate a melody based on the result of such evaluation and extraction. In the present automatic composer, the function of melody generation is primarily divided into two parts, one for planning the outline of a melody to be generated (melody planner) and the other for generating a melody in a concrete form in accordance with the plan laid by the melody planner.

The melody planner corresponds to the melody control information generation means F20 in FIG. 38: if chord progression information is automatically formed, then the function of such automatic generation of chord progression may also be included in the melody planner because the chord progression information also serves to regulate the melody to be generated.

The main task of the melody planner is to associatively infer or plan a melody to be generated from the result provided by the motif featuring parameter extraction means. The melody planner supplies planned information i.e., melody control information to various portions in the melody generation execution means (corresponding to F30 in FIG. 38). The melody generation execution means carries out the generation of melody in accordance with the supplied melody control information. The major two functions of the melody generation execution means are to generate a sequence of melody tone pitches and to generate a sequence of melody tone durations.

PLANNING OF MELODY

The melody plan information or melody control information will be called parameters C or PC hereinafter.

A melody formed by the melody generation execution means is greatly dependent on parameters C. In other words, parameters C characterize a melody to be generated.

The general job of the present automatic composer is to generate a complete melody or music piece from a motif or a part of music piece.

As is often experienced, some music pieces are characterized by recurrence of the same or very similar motif. In some music pieces, the motif is qualified, modified or developed as music proceeds. In some other music pieces, a motif exists only momentarily, then changes to another and to another. The first mentioned class of music involves a high level of consistency. The second class of music involves variety while retaining some consistency. The third class of music involves free variety though lacking in consistency.

In accordance with the present invention, the automatic composer can compose music in a wide range from the one faithful to the melody provided by the user to the one placing emphasis on freedom and variety rather than faithfulness to the user's motif.

The characteristics of parameters C (PC) and various ways of forming parameters C have been fully described in the first embodiment. So, the detailed description thereof is omitted here.

The first property of parameters C is that they depend on the progression segment of music. The second property is that parameters C depend on the motif featuring parameters. The first property is related to consistency and variety in music structure. The second property is associated with a degree of reflection of the motif on the music piece to be composed.

In the present embodiment, a measure is chosen as a unit of segment of music and parameters C are assigned to respective measures. Parameters C are formed by means of computation. Constituent parameters for the computation include parameters B for controlling consistency and variety in the stream of melody and motif featuring parameters (sometimes referred to as PA). Further the constituent parameters include musical form data or parameters in order to provide music with a higher level of hierarchy.

The parameters B reside in the parameter B memory 107 in FIG. 37. The musical form data are placed in the musical form data memory 108. The user may directly or indirectly requests the automatic composer to use particular parameters by means of the input device 101 if desired. Similarly, the user may designate a musical form by the input device 101, thus requesting the automatic composer to use specified musical form data. The man-machine interface associated therewith (for example, conversion between user's conceptual space and internal representation space such as parameters B in the automatic composer) is not the subject matter of the present invention and further description thereof is therefore omitted.

COMPUTATION OF PARAMETERS C

Figure 56:
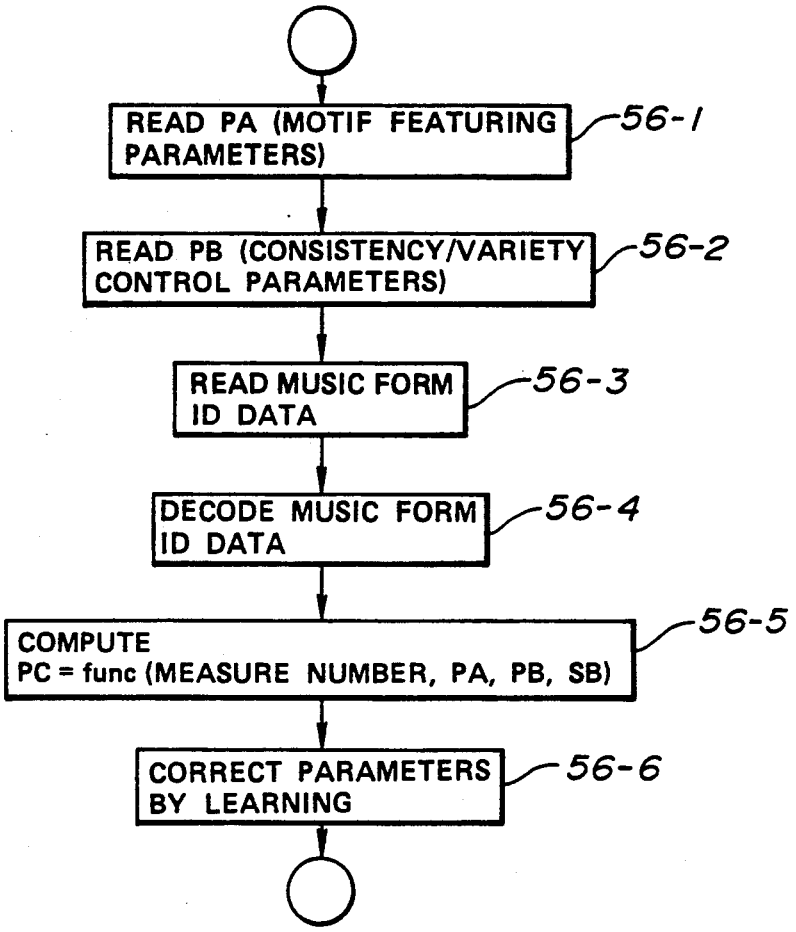
FIG. 56 is a simplified flowchart of computation of parameters C.

FIG. 56 illustrates a flow of computation of parameters C. At 56-1, motif featuring parameters PA are read. At 56-2, consistency and variety control parameters PB are read. At 56-3, musical form data are read from the musical form data memory 108. These three steps are not necessarily performed each time the measure number is incremented but may be carried out at a time. That is, these steps are independent in respect of process from the measure number of melody to be generated. The operations 56-4, 56-5, 56-6 are performed on a single measure basis and correspond to the step 60-9 of computation of PC as will be described in conjunction with FIG. 60. At 56-4, musical form data are decoded. At 56-5, computation is made of the values of PC assigned to the measure of melody which will be generated at 56-5. As shown, the parameters C have a form of function of constituent parameters or variables comprising measure number, PA (motif featuring parameters), PB (consistency and variety control parameter) and SB (musical form parameters or higher level control parameters). This does not mean however that any parameter PC actually depends on any of the measure number, PA, PB and SB. As exemplified in FIG. 41, parameters C are a set of large number of parameters. Some parameters C may have a DC characteristic independent from the measure number. Further, this does not mean that once the measure number, PA, PB and SB are given, the value of PC must be uniquely determined. The uniquely determined intermediate value of PC may be randomized by the random number generation means (F24 in FIG. 38). Preferably, such randomization is a controlled one and the final parameter C is formed by the introduction of random numbers controlled by the intermediate value of PC (by introducing for example pertubations centering the intermediate value of PC).

At 56-6, the parameters are corrected by the function of learning.

CONTROL OF MUSICAL FORM

In general, development section in music has properties of the difference as a whole from the preceding section and the approaching element to the development section. For example, the measure immediately preceding the development normally has a sense of cadence or ending and yields a psychological effect of anticipation of the development to come. The whole development phrase usually differs in musical elements such as the pitch range, the number of tones, or the rhythm.

In order to provide music with such a higher level of hierarchy, the present embodiment is adapted to generate musical form data to control the musical form. The operations 56-3, 56-4, 56-5 in FIG. 56 are associated therewith.

FIG. 57 shows an example of data stored in the musical form data memory 108 (FIG. 37). The data format comprises an upper digit A1 and a lower digit A2. The upper digit A1 indicates a measure number where a particular phrase starts. The lower digit A2 indicates the type of phrase starting at the measure number specified in the upper digit A1: particularly, when the value of A2 is zero, it represents a repeat phrase and when the value is not zero, A2 represents a development phrase and the value indicates the type of development. For example, the data of SB1=10, SB2=91, SB3=130 indicate that the musical form is A→B→A: the first phrase A is of repeat type extending from the first to eighth measure, the second phrase B is of development type lasting from the ninth to the twelfth measure and the third phrase A is of repeat type starting at the thirteenth measure.

Figure 58:
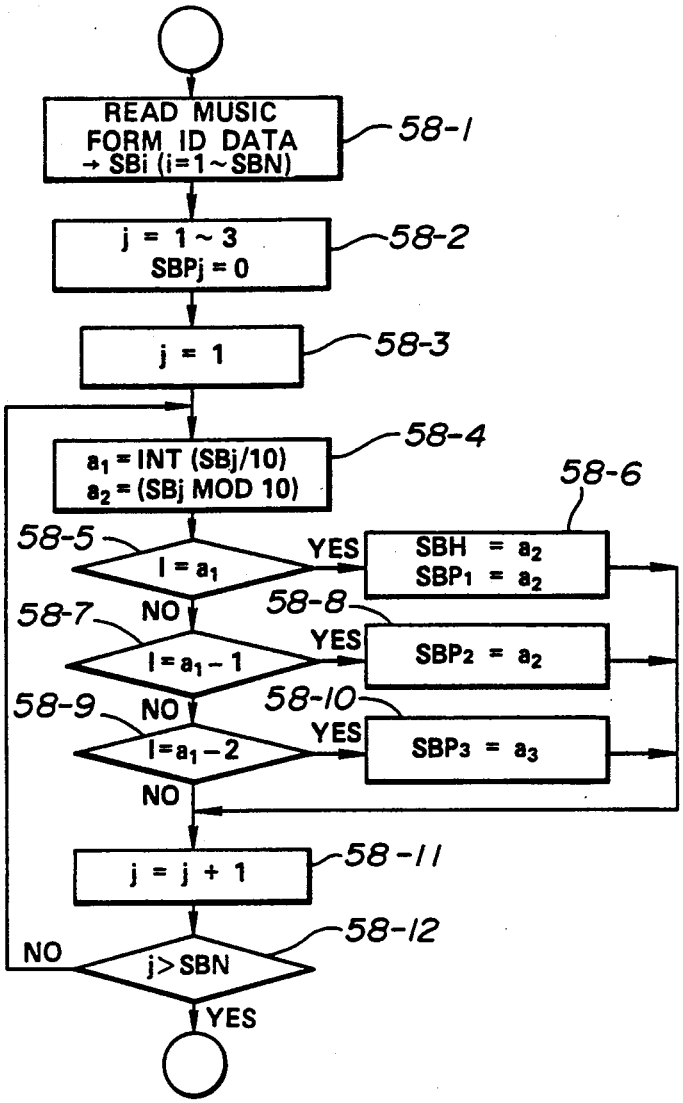
FIG. 58 is a flowchart of read operation and decoding of musical form data.

FIG. 58 illustrates the details of the process 56-4 in FIG. 56: the operation 58-1 however corresponds to the operation 56-3 in FIG. 56 in order to clarify the meaning of the flow in FIG. 58.

Figure 59:
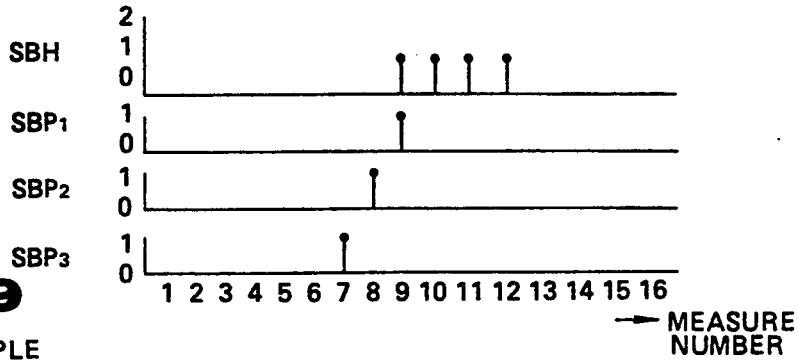
FIG. 59 shows an example of the decoded result.

From the flow description in FIG. 58 and the format of the musical form data (original) in FIG. 57, it will be readily understood how the musical form is controlled in the present embodiment (see FIG. 59).

Specifically, in order to control musical form, there are provided hold parameters SBH for characterizing the whole development melody and pulse parameter SBPi for characterizing the transition to the development phrase.

According to the flow in FIG. 58, when the measure number where a melody is to be generated is I, CPU109 enters the step 58-2 to reset registers SBPj of pulse type musical form ID parameters. In the present example, three pulse parameters SBP1, SBP2 and SBP3 are provided as seen from FIG. 59. The pulse parameter SBP3 is operatively assigned to the measure which is two measures before the development phrase (starting at the ninth measure in FIG. 59). The pulse parameter SBP2 is assigned to the measure immediately preceding the development phrase. SBP1 is assigned to the starting measure of the development. A single hold parameter SBH is provided and operatively assigned to the whole development (extending from the ninth measure to the twelfth measure).

The process of 58-3 to 58-12 in FIG. 58 is directed to the implementation of the above parameter assignment. At 58-3, phrase number counter j is initialized. At 58-4, the upper digit of the original musical form ID data or the starting measure number of the j-th phrase is placed in a register al and the lower digit or the type of that phrase is stored in a register a2. When the melody generation measure number I indicates the measure two bars before the starting measure of the next phrase, a variable a3 is placed in the third pulse musical form ID parameter SBP3 (58-9, 58-10). When the melody measure number I points to the measure immediately preceding the starting measure of the next phrase, the variable of the type of the phrase a2 is moved to the second pulse musical form ID parameter SBP2 (58-7, 58-8). When the melody measure number coincides with the starting measure of phrase, the value a2 is placed in both of the first pulse parameter SBP1 and the hold parameter SBH (58-5, 58-6). SBN at 58-12 is the total number of phrases contained in a music piece. Thus the illustrated flow uses the melody measure number as a key data item to search among the starting measures of all phrases for the one coinciding with the melody measure number for the parameter allocation associated. Since SBPi is reset each time the melody measure number is updated, it will be a pulse. On the other hand, SBH is set at the type of a phrase only when the starting measure of that phrase coincides with the melody measure number. Hence, if the phrase is a development, SBH has a value of nonzero during the time of the development whereas if the phrase is a repeat, SBH has a value of zero so that it does not contributes to parameter C.

The decoded musical form data or parameters are used as constituent parameters (such as DC components) for the computation of parameters C at 56-5.

GENERATION OF MELODY

Figure 60:
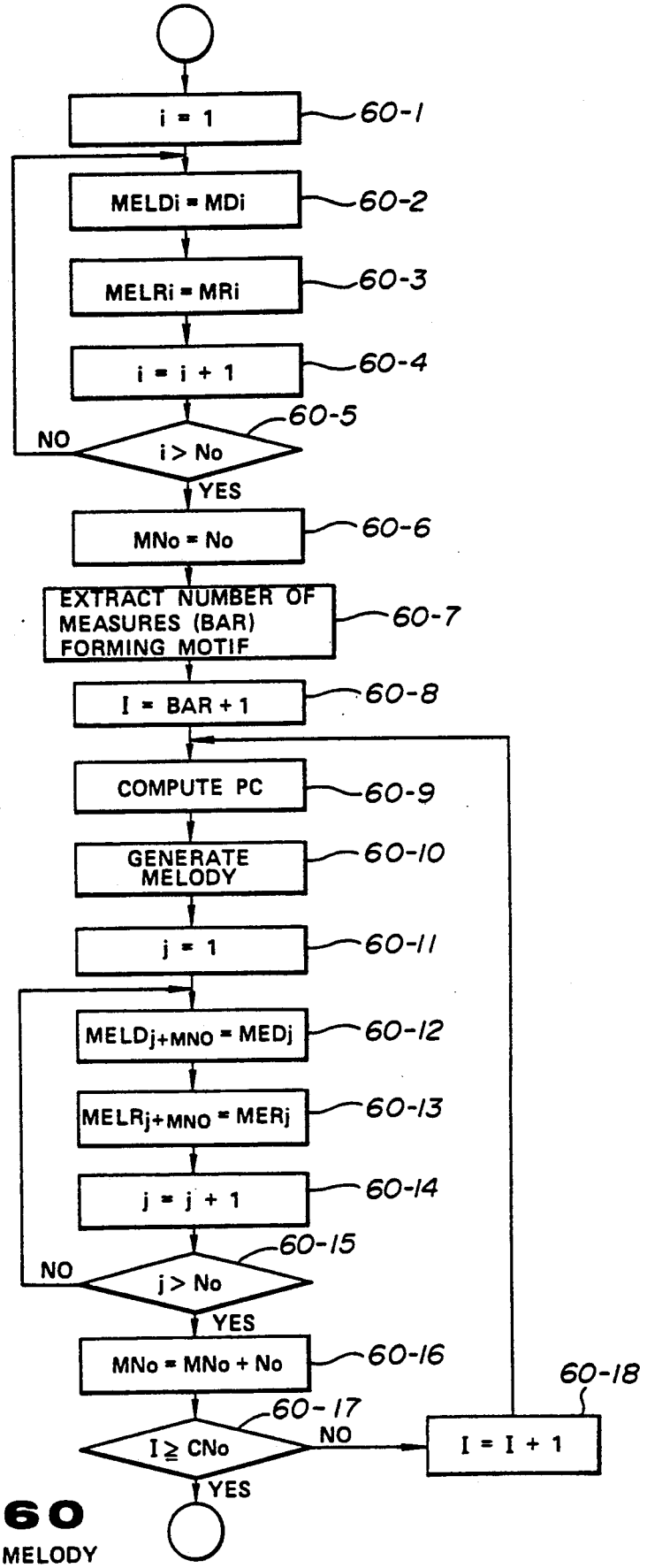
FIG. 60 is a flowchart of melody generation.

FIG. 60 illustrates a general flowchart for successive generation of melody. The main portion of this flow is the computation of PC at 60-9 (corresponding to 56-4 to 56-6 in FIG. 56) and the generation of melody at 60-10 (which will be described later in detail). The remaining portions ar concerned with the data transfer between memories or the like handled by the melody control in FIG. 39.

The operations of 60-1 to 60-5 are directed to the transfer of the motif data from the motif memory 106 (FIG. 37) to the melody data memory 113. No at 60-5 is the number of notes contained in the motif.

MNo shown at 60-6 and 60-16 is the number of melody notes already generated in the course of successive generation of melody data. Since the generation of melody occurs measure by measure, the number of measures forming the whole motif is computed (from the tone duration data of the motif, for example) (60-7). The computed number of motif measures is then incremented by one (60-8). When a melody for one measure has been formed (60-9, 60-10), those melody data are written to the melody data memory 113 (60-11 to 60-15). No at 60-15 is the number of melody notes generated at 60-10 covering one measure. CNo at 60-17 is the total number of chords involved in the chord progression. Since there is one chord per measure in the present example, the generation of melody will be complete when the melody measure number has reached the total number of chords.

The generation of melody in a concrete form will now be described in detail.

GENERATION OF MELODY IN CONCRETE FORM

The function of generation of melody in a concrete form mainly comprises two parts, one for generating a sequence of melody tone pitches and the other for generating a sequence of melody tone durations. Either function is operable in accordance with the melody plan information or melody control information supplied measure by measure from the melody planner and forms melody notes based on the internal generation rule incorporating the respective melody control information (collectively referred to as parameter PC) therein (for example in the form of constraints).

The melody tone pitch sequence generation function includes arpeggio generation means for generating a sequence of arpeggio tone pitches and nonharmonic tone addition means for adding nonharmonic tone(s) to the front and/or back of arpeggio tone(s) and/or between arpeggio tones. The melody tone pitch sequence generation means further includes pitch control means adapted to determine a note scale for use in the arpeggio generation means and the nonharmonic tone addition means and to check the pitch effectiveness of melody note candidates. Only those candidates that have been found to be effective are accepted as melody notes.

The melody tone duration sequence generation means comprises means for generating a sequence of durations of arpeggio tones, means for adjusting the sequence of tone durations taken in conjunction with the addition of nonharmonic tone pitches and means for incorporating a rest and a characteristic mini-pattern to provide a complete sequence of melody tone durations.

In the following flowcharts, above respective means are put into operation where appropriate.

In respect of process, firstly a melody consisting only of arpeggio tones (duration and pitch sequences) are formed. Then nonharmonic tones are added to provide a melody including arpeggio and nonharmonic tones. Lastly the final adjustment of the sequence of melody tone durations is carried out.

GENERATION ARPEGGIO TONES

Figure 61A:
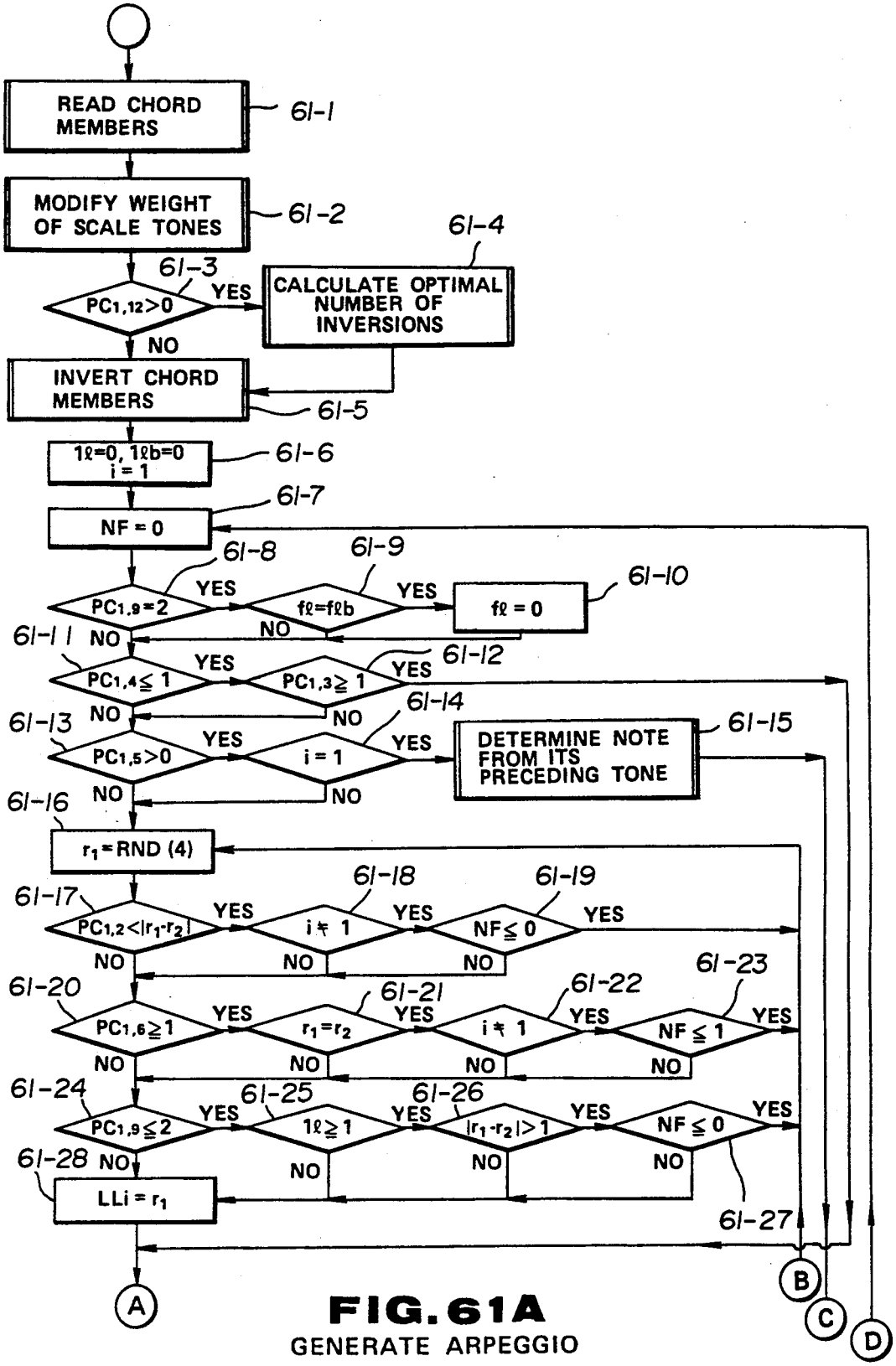
FIGS. 61A and 61B show, in combination, a flowchart of generation of arpeggio.
Figure 61B:
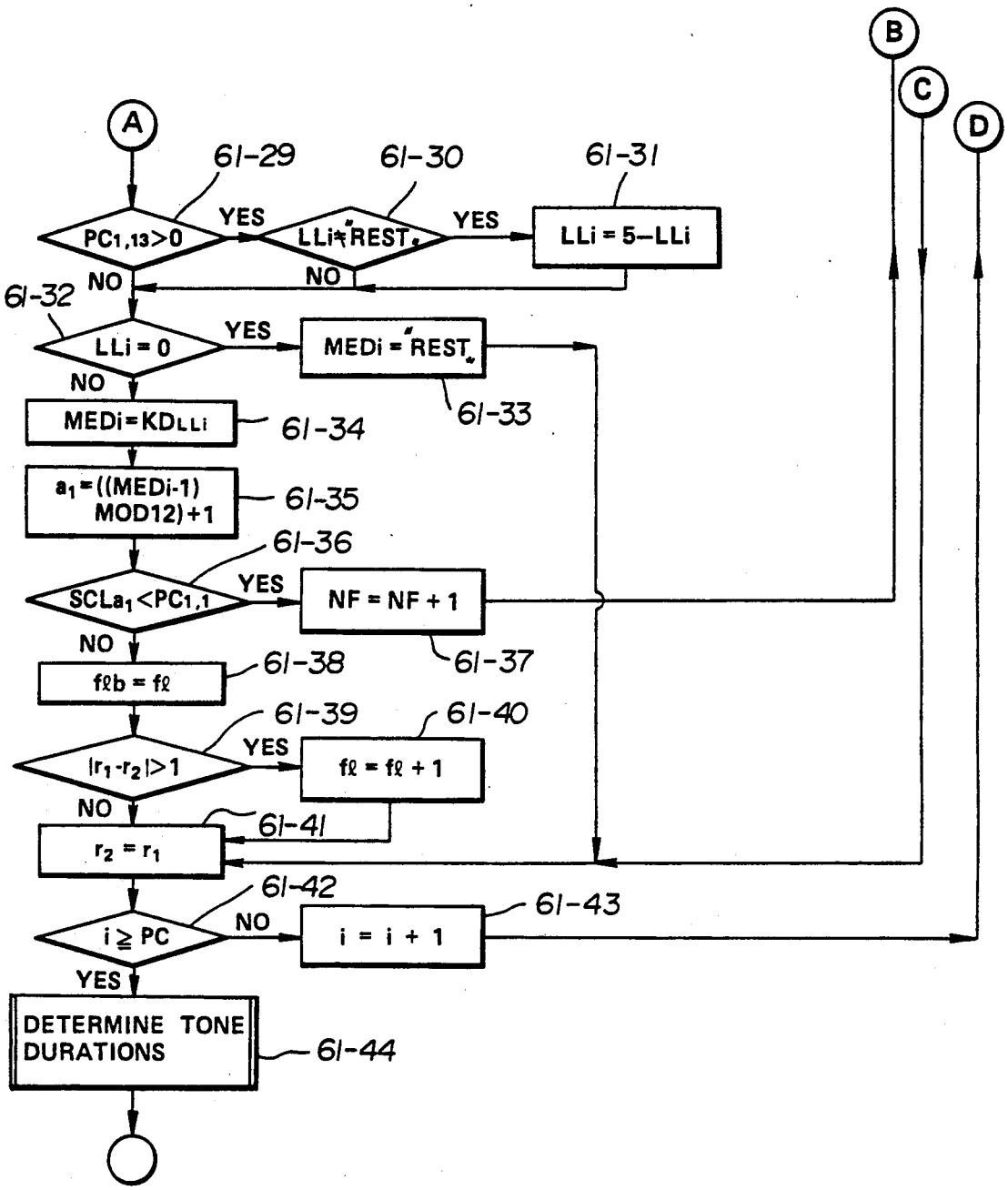

FIGS. 61A and 61B illustrate a flow of generating arpeggio tones.

The process of 61-1 to 61-5 is essentially a preparation for the generation of the sequence of arpeggio tone pitches executed from 61-6 to 61-42. At 61-1, read operation is performed of the chord members assigned to the melody measure in progress. At 61-5, the read chord members are inverted. PC1,12 at 61-3 indicates whether to use an optimal inversion number or an ordinary inversion number specified in PC1,7. If PC1,12>0, the optimal invention number is computed at 61-4 and PC1,7 is updated with the computed number. The inversion of chord members influences the pitch range of melody measure being generated. In the present example, the greater the inversion number is the higher the pitch range will be. The purpose of optimal inversion is to provide a current measure melody which is optimally connectable with the stream of the previous measure melody. This function is particularly effective in concatenation of similar arpeggio patterns.

At 61-2, weighted note scale data {SCLi} are read to modify the read weights of tone pitches depending on predetermined conditions (for example, the pitch is a member of the chords or the root shift operation is requested).

The modified note scale data {SCLi} are referenced when a candidate of melody note of arpeggio is provided. If the candidate tone is found to have a weight heavier than the value of threshold PC1,1 supplied from the parameter computation means, then it is accepted as a genuine melody note. The modified note scale data are also referenced in the process of addition of nonharmonic tones (as will be described later) and those candidates having a weight greater than the threshold value are adopted as valid melody notes.

The final step 61-44 in FIG. 61B is the determination of tone durations or the generation of the sequence of arpeggio tone durations.

FIGS. 61A and 61B have been generally described, turning now to its details.

READ OPERATION OF CHORD MEMBERS

In order to generate an arpeggio, the first thing to do is to know the chord in progress. This chord progression information is provided by the chord progression memory 103 and the chord member memory 102 in FIG. 37.

Figure 62:
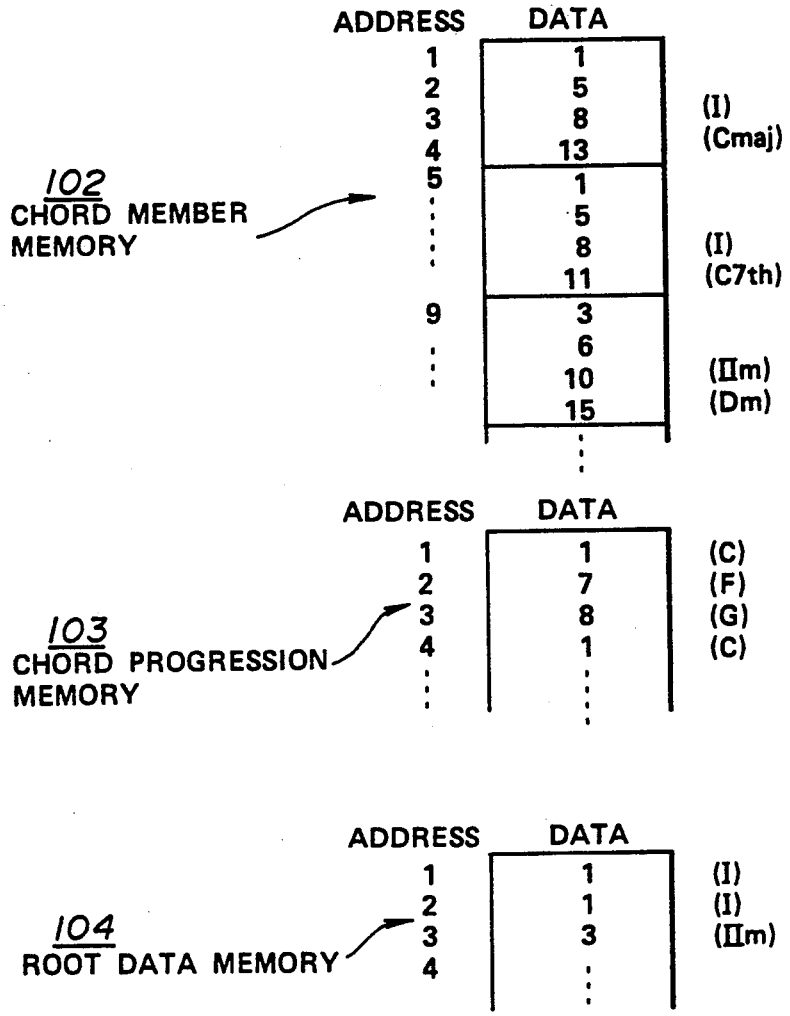
FIG. 62 shows an example of chord member memory, chord progression memory and root memory.

FIG. 62 shows an example of chord progression data stored in the chord progression memory 103 and member data for each chord stored in the chord member memory 102. FIG. 62 further shows contents of chord root data memory 104.

In the illustrated example, assuming that each chord have four members (formed with four independent voices, or containing octave related two voices therein), the area in the chord member memory 102 for storing each chord consists of four successive addresses where pitch data of the chord members are stored in the increasing order. For example, the contents of the chord member memory 102 at addresses 1 to 4 are "1" (=do), "5" (=mi) "8" (=sol) and "13" (=dó) respectively, thus representing the members of chord Cmaj.

Data indicative of the name or type of chord are stored at each address of successive locations in the chord progression memory 103. The sequence of such data represents a chord progression. The start address in the chord member memory 102 where a first chord member is stored is computed from the data of chord type stored at each address of the chord progression memory 103. Similarly, the data at each address of the chord progression memory 103 specifies the address in the root data memory 104 where the root of the chord is stored. In the illustrated example, the start address in the chord member memory 102 is generated by the computation of $(DATA-1)\times 4+1$ where DATA is the chord type data.

The read operation of chord members is carried out by firstly reading the chord in progress from the chord progression memory 103 and using the read data as a pointer to the chord member memory 102 to read the corresponding members therefrom.

Since assumption is made in the present example that there is one chord per measure, at the I-th measure, the I-th chord in the chord progression memory 103 (file of chord progression) are read by specifying the I-th address. At the end of the chord progression file, there is stored a code EOF (end of file) indicative of the end of the chord progression.

In the present example, the read operation of chord members are performed in a burst mode by reading all chords in the file of chord progression and their corresponding members in the file of chord members: of course, the chord inversion at 61-5 occurs with respect to one chord in progress.

Figure 63:
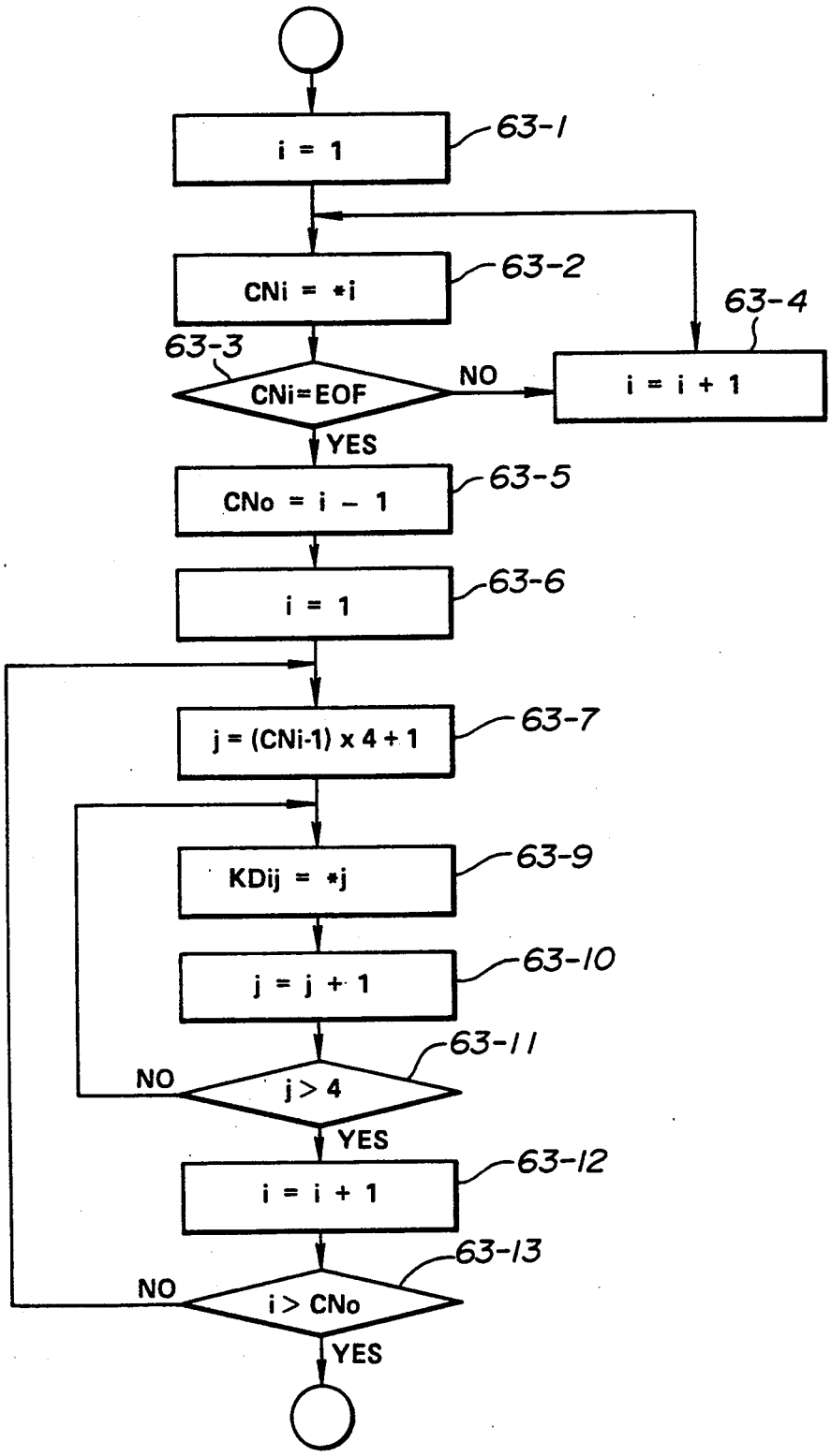
FIG. 63 is a flowchart of read operation of chord members.

FIG. 63 illustrate a flow of reading members of all chords at a time (details of 61-1 in FIG. 61).

In the flow in FIG. 63, at the operations 63-1 to 63-4, chord number or name data are successively read from the chord progression memory 103 (FIG. 62). Particularly, at 63-2, the content of the i-th address in the chord progression memory 103 or the name of the i-th chord is set in a register CNi. EOF at 63-3 is the end of file code stored next to the last chord name address. When the EOF is encountered, the read operation of chord names will be complete.

In the process of 63-5 to 63-12 in FIG. 63, using each read chord name, reference is made to the chord member memory 102 to read pitch data of corresponding chord members. At 63-7, the start address of chord members is computed by $j=(CNi-1)\times 4+1$. At 63-8 to 63-10, four pitch data following the start address are placed in registers KDij.

In the following, KDi1, KDi2, KDi3 and KDi4 are referred to simply as KD1, KD2, KD3 and KD4 respectively. The register KD1 is used to store the lowest harmonic tone in the chord, KD2 the second lowest harmonic tone, KD3 the third lowest harmonic tone and KD4 the highest harmonic tone. So far, KD1, KD2, KD3 and KD4 store pitch data of chord members in a basic position as the chord member memory 102. For the chord G7 in the third measure in FIG. 44, the corresponding KD1 to KD4 are given by:

$KD1 = 3, KD2 = 6, KD3 = 8, KD4 = 12$
(re, fa, sol, ti)

MODIFICATION OF WEIGHTS OF NOTE SCALE

When a melody note candidate is generated in the process of arpeggio and nonharmonic tone generation, it is checked as to whether the pitch of that candidate is effective or valid, as will be described later. The basic information for such check is a note scale.

Figure 64:
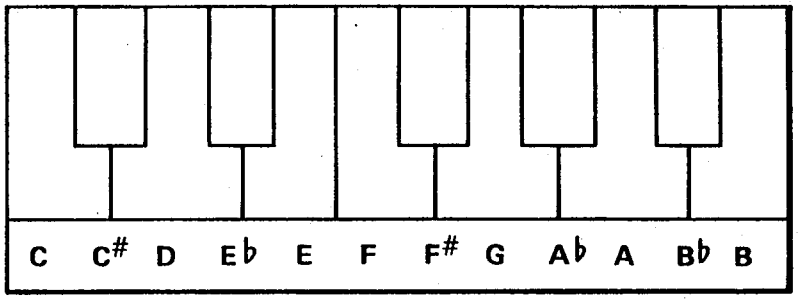
FIG. 64 shows an example of weighted note scale data.

In the present embodiment, a set of weighted note scales are stored in the weighted scale data memory 105 in FIG. 37. An example is shown in FIG. 64 where four kinds of note scales are illustrated: they are a yona nuki minor scale, a yona nuki major scale, an Okinawa scale and a Western major scale. For example, on the Western major scale, the pitches of do, re, mi, fa, sol, la and ti are assigned a weight or value of 75. The remaining pitches are assigned a value of 25. The weight assigned to each pitch indicates a degree of effectiveness with which that pitch is used as a melody note. In respect of memory terms, the Western scale data are stored in the weighted scale data memory 105 at addresses 36 to 47. If the Western scale data is read in the flow in FIG. 65A at 65A-1, data at the 36th address or the weight 75 of do is set in the first register SCL1 in the array {SCLi}. Similarly, SCL2 is set at weight 25 of do sharp at the 37th address and SCL3=75, SCL4=25, SCL5=75, SCL6=75, SCL7=25, SCL8=75, SCL9=25, SCL10=75, SCL11=25 and SCL12=75.

Figure 65B:
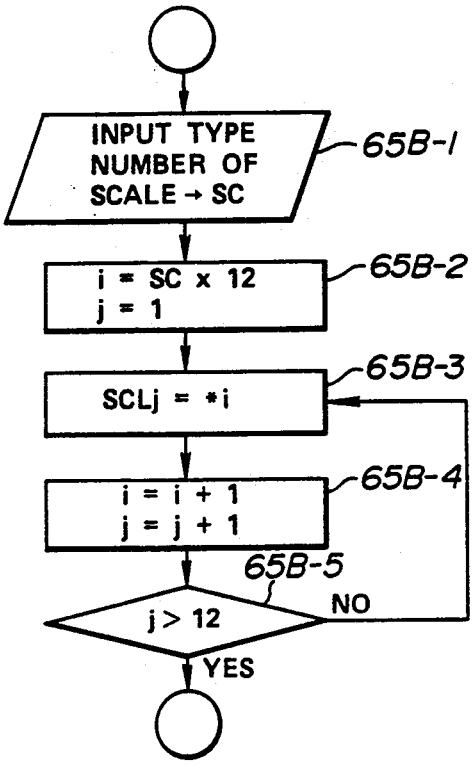
FIG. 65B is a flowchart of read operation of weighted note scale data.
Figure 65A:
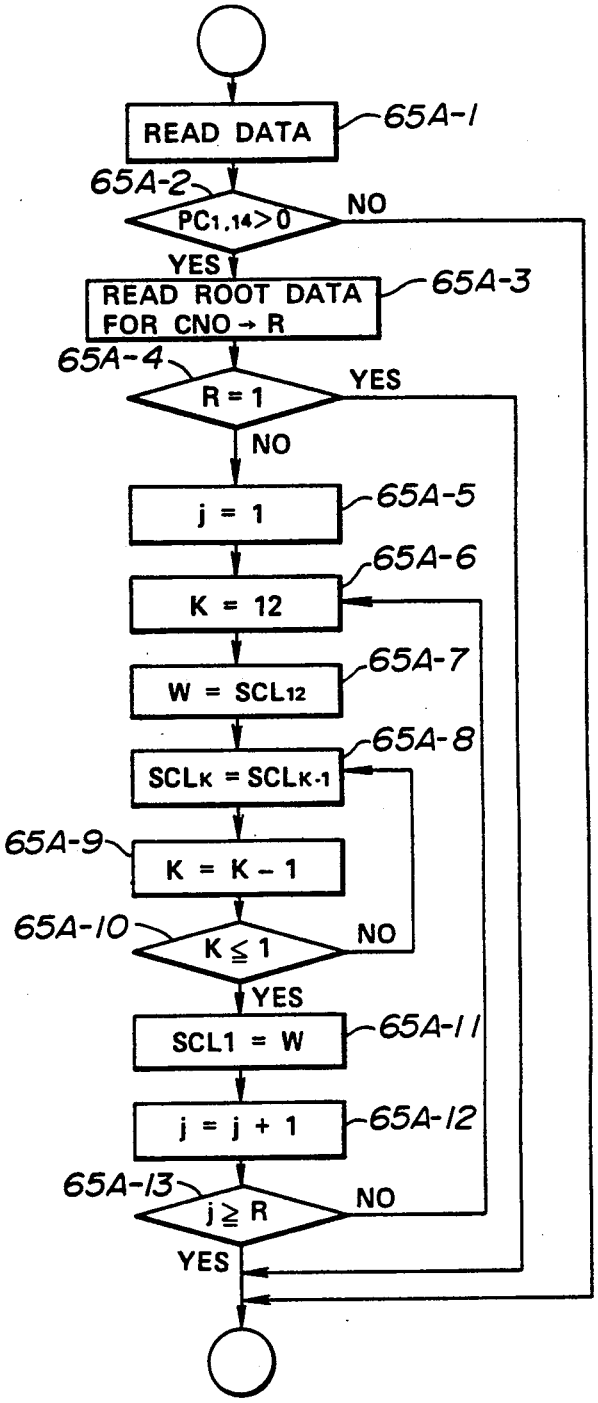
FIG. 65A is a flowchart of first modification of weighted note scale.

FIG. 65B illustrates the details of read data operation 65A-1 and FIG. 65A.

The user inputs the type of note scale by means of the input device 101 (65B-1). From the input information, CPU109 computes the start address of the designated note scale data in the weighted scale data memory 105 (65B-2), and writes twelve data at addresses following the start address to the array {SCLi}.

Figure 66:
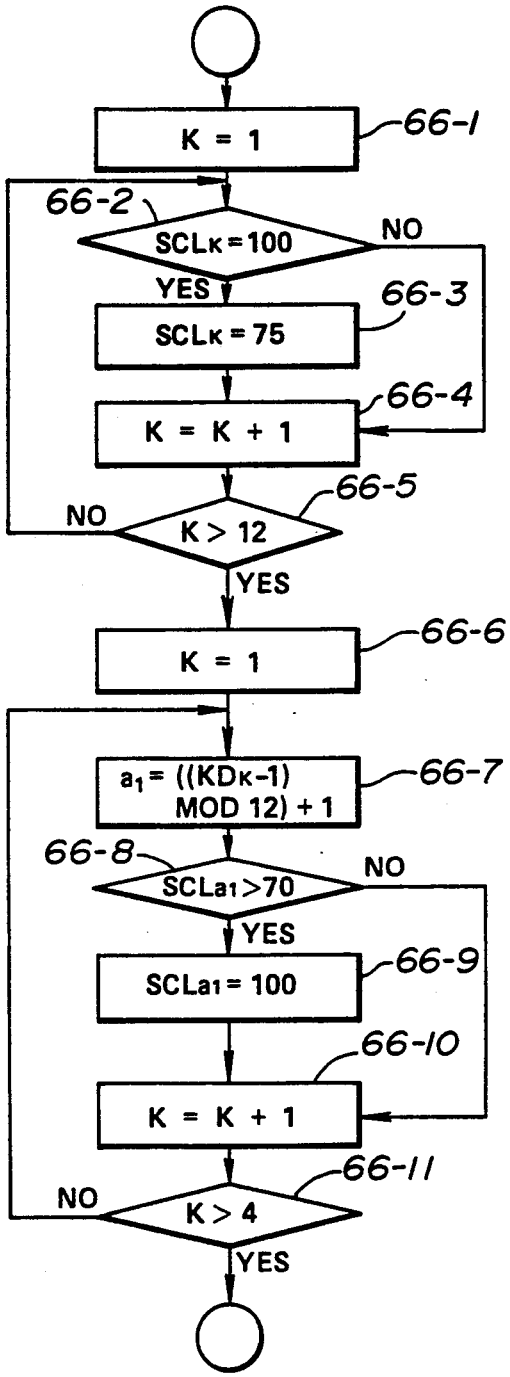
FIG. 66 is a flowchart of second modification of weighted note scale.

PC1,14 shown at 65A-2 in FIG. 65A is a parameter supplied from the parameter C computation means and indicating whether or not to shift root. If PC1,14>0 the process goes to the shift-root routine of 65A-3 to 65A-13. If not, the process skips over the routine to the flow in FIG. 66: FIG. 65A and FIG. 66 show in combination the details of 61-2 in FIG. 61.

The steps following 65A-3 in FIG. 65A are a flow of shift-root. At 65A-3, the root data corresponding to the current chord name CNi is read from the root data memory 104. When the read root data R is "1", no shift root operation occurs because the root or tonic of the scale matches the chord root. When the chord root mismatches the scale root, R is greater than 1 or indicates one plus the interval of mismatch. Suppose, for example, that the chord root is G and the note scale root is C (any scale data in FIG. 64 are described with their tonic or root of C), then R=7. In this case, the root shift operation of 65A-5 to 65A-13 is executed: the weight of root placed in SCL1 is shifted to SCL8, and similarly SCL2→SCL9, . . . SCL5→SCL12, SCL6→SCL1, SCL7→SCL2, . . . SCL12→SCL8. The function of the shift root operation may be applied, for example, to modal music in jazz.

In the score example in FIG. 44(*a*)–44(*e*), any measure is assigned the Western scale with PC1,14=0 and no shift root operation occurs.

For the simplicity of description, assume that there is no shift operation in the following. That is, no modification of weighted scale data by the flow in FIG. 65A has not occurred and on the entry to the flow in FIG. 66, {SCLi} stores the note scale data as the weighted scale data memory 105.

FIG. 66 shows a flow for modifying the weights of scale data in a different manner from the shift root process. Referring again to FIG. 64, on each scale, the greatest value or weight is 75 and the least value is 25. Some scales contain an intermediate value of 50. The note assigned the maximal value is referred to as a "scale note". For example, on the Western major scale, notes of do, re, mi, fa, sol, la, ti along a diatonic scale are assigned the maximal weight of 75 and the other notes are given the least value of 25. In general, Western major scale consists of do, re, mi, fa, so, la, ti: this fact is represented in the scale data in (4) in FIG. 64.

From the foregoing, the operation of the flow in FIG. 66 will be apparent. Specifically, the process of modification of weighted scale data in FIG. 66 is to raise the weight of those notes that are scale notes and at the same members of the chord to 100 while leaving the weight of those notes that are merely scale notes as is 75. The computation of ((CKDk-1) MOD 12)+1 at 66-7 determines what numbered note on the scale corresponds to the K-th lowest chord member. If the weight of the determined numbered note SCLa1 is heavier than 70 indicating a scale note, then that weight is raised to 100 (66-8, 66-9). At 66-1 to 66-5, initialization is made for a new chord. Those scale weight registers SCLk that were increased to the value of 100 in the process of the previous chord are reset to the value of 75 indicative of a scale note.

In short, the flow in FIG. 65A is directed to the shifting of the reference note on the scale or cyclic shift of the array {SCLi} whereas the flow in FIG. 66 is directed to raising the weight of the note which is found to a chord member.

OPTIMAL INVERSION

By way of example, consider what arpeggio on a chord F is optimally connected to a melody of do, mi, so and do. Connection of |do, mi, so, do| to |fa, la, dò, fa | would be unnatural when going from do to fa through the bar line (through depending on what music is intended). The most natural chaining would be |do, mi, so, do| to |do, fa, la, do|.

In order to provide an optimal concatenation of such tone patterns, the present embodiment employs optimal inversion means.

As shown in FIG. 61, the optimal number of inversions is computed when PC1,12>0 (61-3, 61-4).

Figure 67:
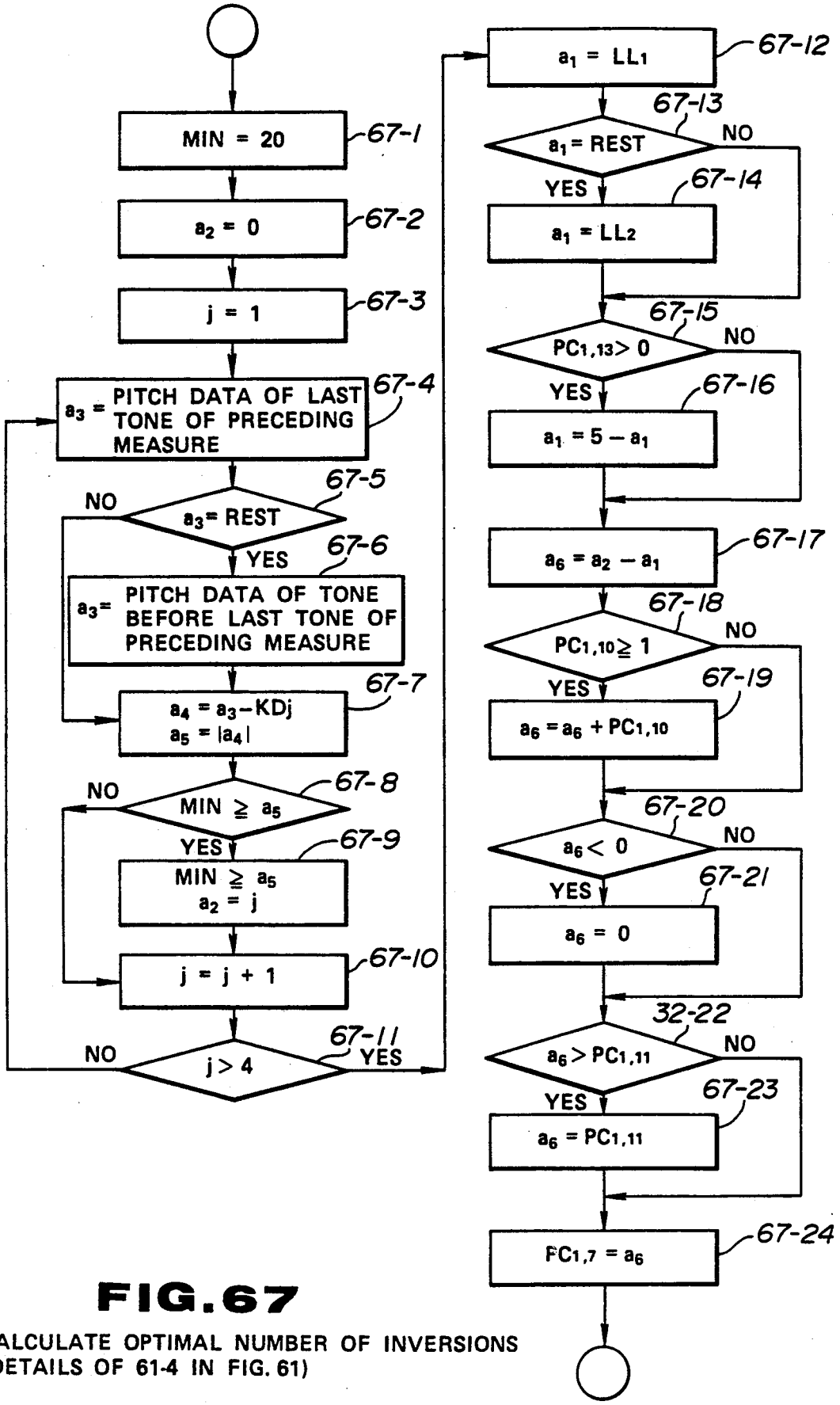
FIG. 67 is a flowchart of computation of optimal number of inversion.

FIG. 67 illustrates the details of the computation of optimal inversion number 61-4. In FIG. 67, PC1,10 is a parameter supplied from the parameter C computation means and indicative of the value adjusting or raising the optimal inversion number (see 67-18, 67-19). PC1,11 is also supplied from the parameter C computation means and indicates the upper limit of optimal inversion number (67-22, 67-23). LL1 is the vertical position of harmonic tone appearing first in the previous measure or the information defining what numbered lowest harmonic tone in the measure (see 67-12). LL2 is the vertical position of harmonic tone appearing second in the previous measure (67-14). PC1,13 is used to determine whether to make a complementary tone pattern. KDi is the i-th lowest chord member pitch as is read from the chord member memory without any inversion.

In the first column in FIG. 67 (67-1 to 67-11), examination is made as to which chord member tone (before inverted) in the current measure is closest to the last note (excluding a rest) in the previous measure: if there are two closest tones, the higher one is selected. As a result, a register a2 stores the vertical position of the chord member tone closest to the last tone in the previous measure.

At 67-12 to 67-17 in the second column in FIG. 67, from the vertical position of the harmonic tone (excluding a rest) first appearing in the previous measure and PC1,13 for determining whether to form a complementary arpeggio pattern in the current measure, positional information al on the vertical position of the harmonic tone first appearing in the current measure is deduced, and from the position al (after inverted) and an optimal position a2 before inverted, the optimal number of inversions a6 is determined. At 67-18 to 67-24, the optimal number of inversions is corrected when the raising of the optimal inversion is required (PC1,1O), or the calculated optimal inversion (a6) is a negative value or exceeds the upper limit PC1,11. The final optimal inversion number a6 is placed in PC1,7. That is, the value of the parameter PC1,7 directly generated by the parameter C computation means is updated here.

INVERSION OF CHORD MEMBERS

Figure 68:
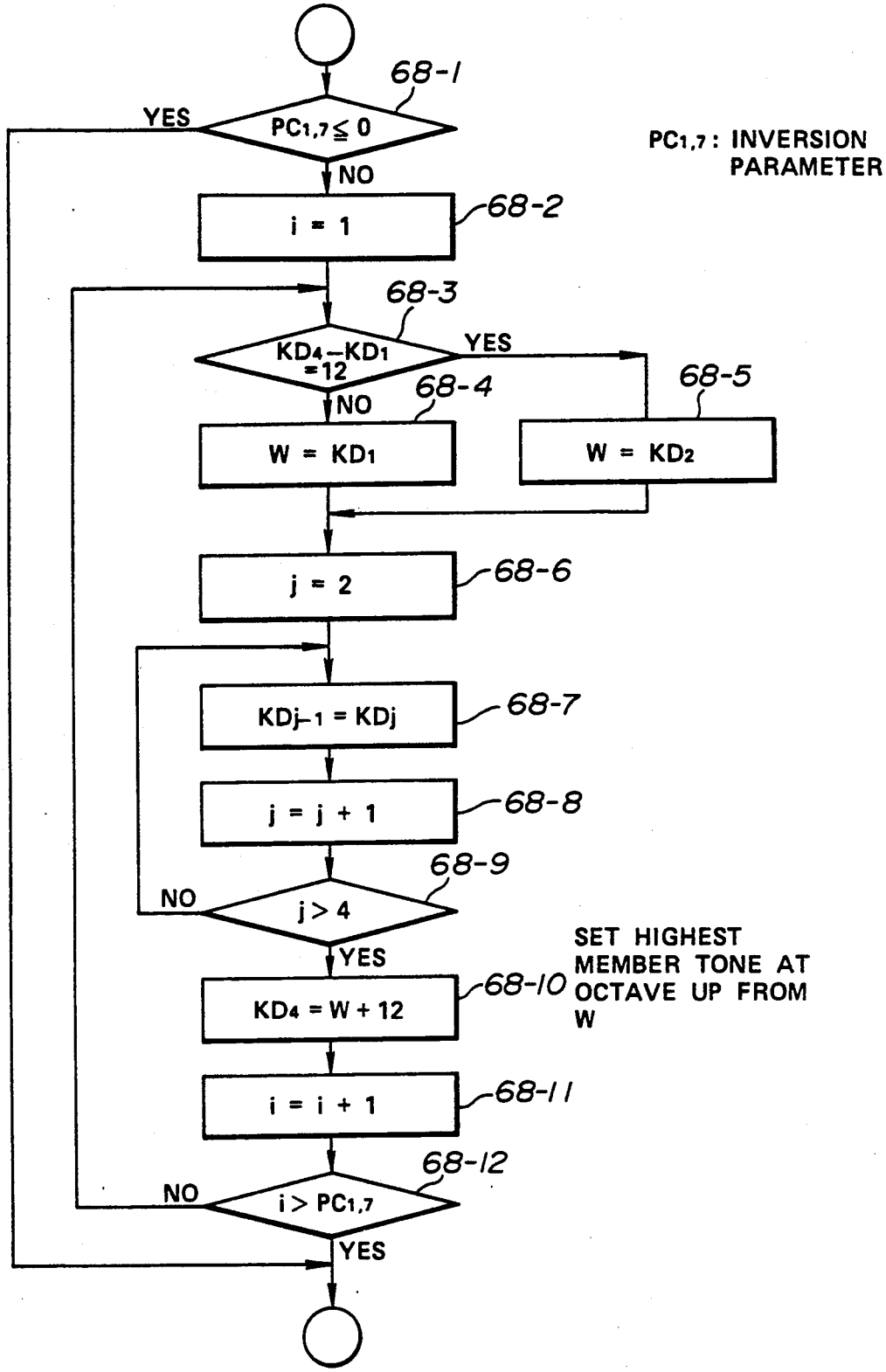
FIG. 68 is a flowchart of inversion of chord members.

FIG. 68 illustrates the details of the inversion of chord members 61-5 in FIG. 61. PC1,7 in FIG. 68 is a parameter indicative of how many inversions are to be made and has a value provided directly by the parameter C computation means or updated for the optimal inversion.

In other respects, the illustrated process is identical with the inversion process in the first embodiment (FIG. 27). So, further description is omitted.

GENERATION OF THE SEQUENCE OF PITCHES OF ARPEGGIO TONES

Having passed the process of 61-1 to 61-5 in FIG. 61, preparation is complete for the generation of the sequence of arpeggio tone pitches. For example, the pitch range of arpeggio tones has been determined with KD1, KD2, KD3 and KD4 being set at pitches of chord members in that pitch range in the course of the operation 61-5: the pitch range has been controlled by PC1,7 directly supplied from the parameter C computation means or indirectly supplied therefrom via the optimal inversion number computation 61-4 for optimal concatenation of arpeggio patterns. Further the process 61-2 has provided current chord members with a weight heavier than that of ordinary "scale notes".

Figure 70:
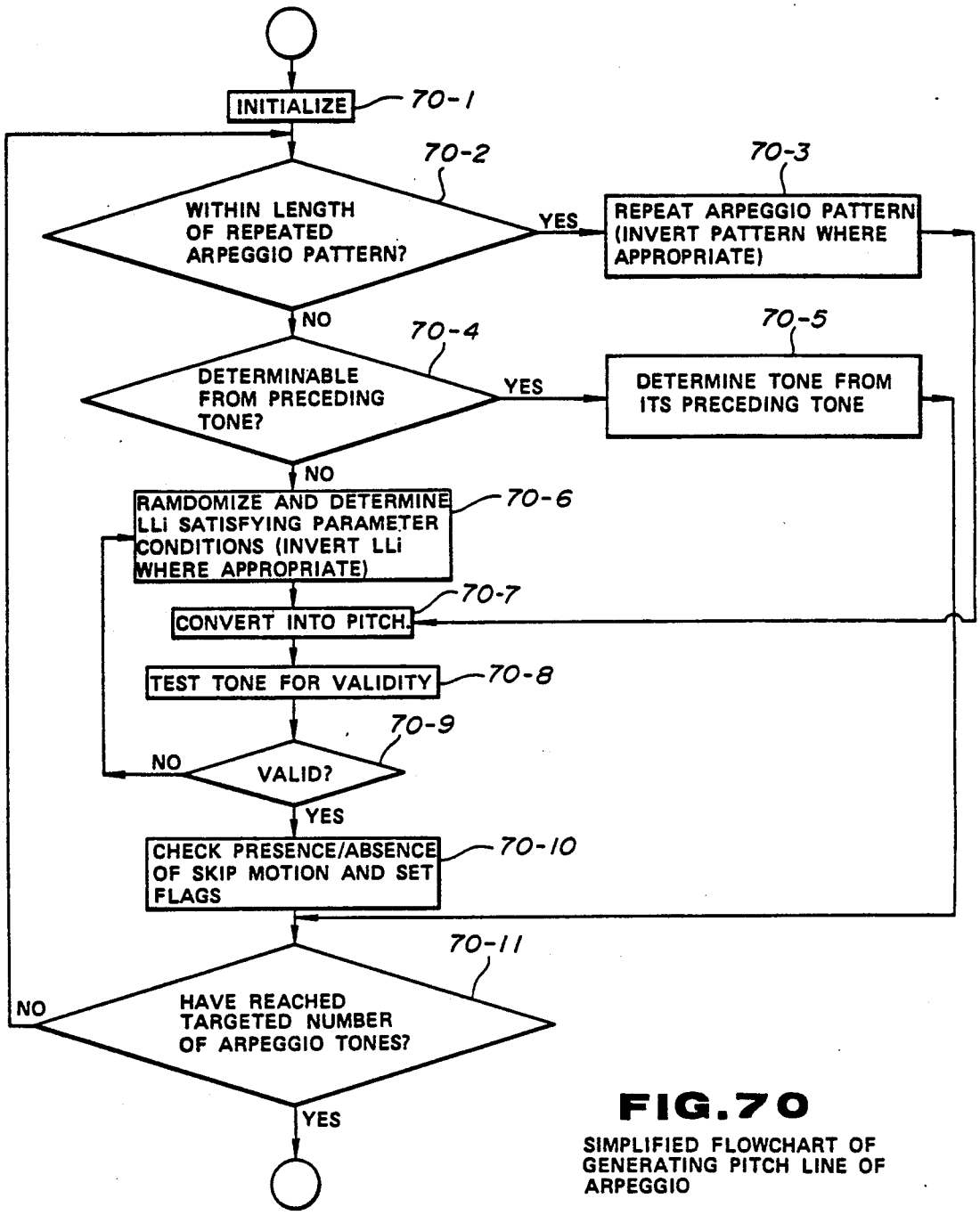
FIG. 70 is a simplified flowchart illustrating generation of tone pitches of arpeggio.

After such preparation, the sequence of pitches of arpeggio tones is actually generated in the process of 61-6 to 61-42. For better understanding, an simplified flow of the process is shown in FIG. 70. The process includes several features. First, among PCs generated by the parameter C computation means is a parameter PC1,3 for determining whether to repeat the previous arpeggio pattern. When the repeat is required, the range of the repeat (from (PC1,4) and to (PC1,3)) is also supplied. In turn, the arpeggio tone pitch sequence generation means performs the repeat of arpeggio pattern in the specified range. Further the pitch sequence generation means inverts the arpeggio pattern {LLi} (against the previous measure arpeggio pattern) if such inversion is requested (PC1,13>0). For example, if the pattern in the previous measure is an upward motion, the pattern of downward motion {LLi} is generated in the current measure.

If the repeat of arpeggio pattern is planned at the beginning, the parameter C computation means may supply (if necessary) a command that the first tone in the current measure is to be determined from the last tone in the previous measure (PC1,5>0). In turn, the arpeggio tone pitch sequence generation means makes a smooth concatenation of the first tone in the current measure to its previous note: this function may be substituted for the optimal chord inversion means for providing a smooth connection of arpeggio tones. If such smooth concatenation is not necessary, the parameter C computation means supplies the associated parameter having a value indicative of the unnecessary to the arpeggio tone pitch sequence generation means.

The parameter C computation means further issues a parameter PC1,9 for controlling the skip motion of arpeggio tones. In turn, the arpeggio tone pitch sequence generation means interpretes PC1,9 as follows. PC1,9=0 means inhibition of skip motion. PC1,9=0 means that only one skip motion is allowed. PC1,9=2 means inhibition of consecutive skip motions. PC1,9≧3 means no restriction of skip motions. To observe the command PC1,9, the tone pitch sequence generation means checks to see whether any skip motion has occurred, using flags for confirmation.

The parameter C computation means sometimes allows a random generation of arpeggio tones when, for example, the repeat of the previous arpeggio pattern is not planned. The parameter C computation means provides, however, some restrictions such as the upper limit of skip motion PC1,2 and the control parameter of the same pitch motion PC1,6 to avoid a totally random arpeggio tones. In turn, the arpeggio tone pitch sequence generation means generates a sequence of tone pitches that satisfies such limitations or is controlled by PC.

When it generates a candidate of an arpeggio tone, the arpeggio tone pitch sequence generation means references the note scale data {SCLi} and reads the weight of that candidate for the check of its effectiveness. The parameter C computation means supplies a parameter PC1,1 of the threshold value of valid tone pitch. If the read weight of the tone candidate is heavier than the threshold PC1,1, the candidate will be adopted as an effective tone i.e., a melody note of arpeggio.

The job of the arpeggio tone pitch sequence generation means is complete when the number of the generated arpeggio tones has reached the targeted number provided by the PC computation means.

From the foregoing, it will be understood that the parameter C computation means supplies various parameters of planned values to the arpeggio tone pitch sequence generation means which in turn "interpretes" the various parameters C as received to generate a sequence of arpeggio tones. Thus, the arpeggio tone pitch sequence generation means has a rule of generation of tone pitch sequence in accordance with the planned parameters C. Similar relationship exists between the parameter C computation means and other melody generation execution means.

Figure 69:
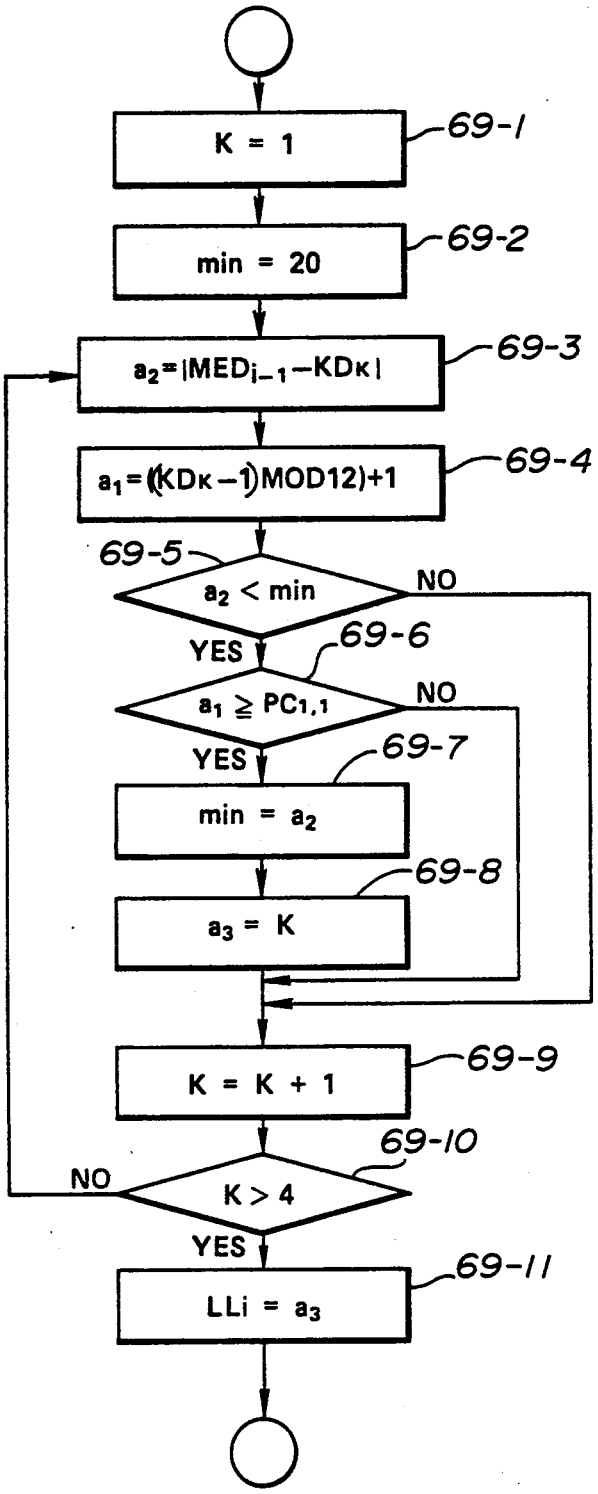
FIG. 69 is a flowchart of determination of MED1 (first tone in measure) from its preceding tone.

In the process of 61-6 to 61-42 in FIG. 61, i is a note number, fl and flb are flags for controlling skip motion. NF indicates SLCa1<PC1,1 (invalid pitch) at 61-36. PC1,9=2 indicates inhibition of consecutive skip motions (see 61-8). fl=flb indicates that the previous motion was not a skip motion (see 61-38, 61-39). 61-16 to 61-28 form a process of determination of LLi by randomization. The flag NF also serves to avoid infinite loop operations including the process of randomization (see 61-37, 61-19, 61-23, 61-27). The tone pitch check (61-36) or the limitation provided by the weight control parameter PC1,1 takes precedence over the command indicated in the skip motion control parameter PC1,9 (see 61-38). This considers the situation where the skip motion control (PC1,9) conflicts with the weight control (PC1,1) which can inhibits the use of every other chord members {KDi}. The details of the determination of the tone from the previous tone 61-15 are shown in FIG. 69. Among the chord members {KDk}, the tone which is a valid pitch (the check 69-6 is affirmative), and closest to the previous tone MEDi-1 (see 69-3, 69-5, 69-7, and 69-8) is selected and set in LLi (to be precise, LL1) in the form of vertical position number.

From the foregoing and the selfexplanatory nature of the flow of 61-6 to 61-42 in FIG. 61, the operation of the actual generation of the sequence of arpeggio tones has become apparent and no further description is needed.

GENERATION OF SEQUENCE OF DURATIONS OF ARPEGGIO TONES

In the present embodiment, the process of generation of duration sequence of melody tones is essentially independently performed from the process of generation of pitch sequence of melody tones.

In broader aspect, once the number of notes and the overall length of the notes (one measure length in the present example) are given, a sequence of tone durations satisfying the given conditions may be generated using any suitable generation rule for tone duration sequence.

In the present example, the number of tones in each measure is planned and issued by the parameter C computation means (as initial value of PC in FIG. 42).

As previously mentioned, the motif arpeggio tone duration pattern forming means (FIG. 50) has removed the nonharmonic tones in the motif, the durations of which have been absorbed into the harmonic tones, thus forming a duration sequence of tones consisting only of harmonic tones. This sequence will be referred to as motif arpeggio pattern.

The number of arpeggio tones planned by the parameter C computation means depends on the progression of music. Hence, the number of arpeggio tones in some measure can be equal to, greater than or less than the number of arpeggio tones in the motif measure.

If the number of arpeggio tones in a melody measure is equal to the number of arpeggio tones in the motif measure, then what sequence of arpeggio tone durations is desirable as the arpeggio tone pattern for that melody measure ?

In the present embodiment, the motif arpeggio tone pattern is used as the melody arpeggio tone pattern when their numbers of tones match. This is to greatly reflect the rhythmic characteristics of the motif on the melody to be generated. Of course, a pattern qualified or modified from the motif arpeggio pattern may be used as the melody arpeggio pattern if desired: an example of means for implementing such pattern modification will be described in another section. The present embodiment considers a sequence of tone durations faithfully holding the rhythmic characteristics of the motif.

The next question is what to do if the number of arpeggio tones in a melody measure mismatches the number of arpeggio tones in the motif measure.

In accordance with the present embodiment, the pattern of arpeggio pattern in such a melody measure is formed by a minimum number of disjoining or joining of tone durations. This approach places emphasis on consistency rather than freedom. The operation of the minimum number of tone joining or disjoining yields a pattern having least modification from the initial pattern (or the motif arpeggio pattern if used as the initial pattern). Further, the pulse scale which was used to extract the motif arpeggio pattern is used to disjoin or join tone durations. While this introduces the characteristic of the pulse scale into the generated tone duration pattern, the pattern does not change irregularly but keeps the consistency of rhythm associated with the pulse scale involved. Thus, a well controlled conversion of tone duration pattern is achieved.

The generation of the sequence of arpeggio tone durations is performed at 61-44 in FIG. 61 (this could be performed at other stages). The details of this process are shown in FIGS. 71 to 76.

Figure 71:
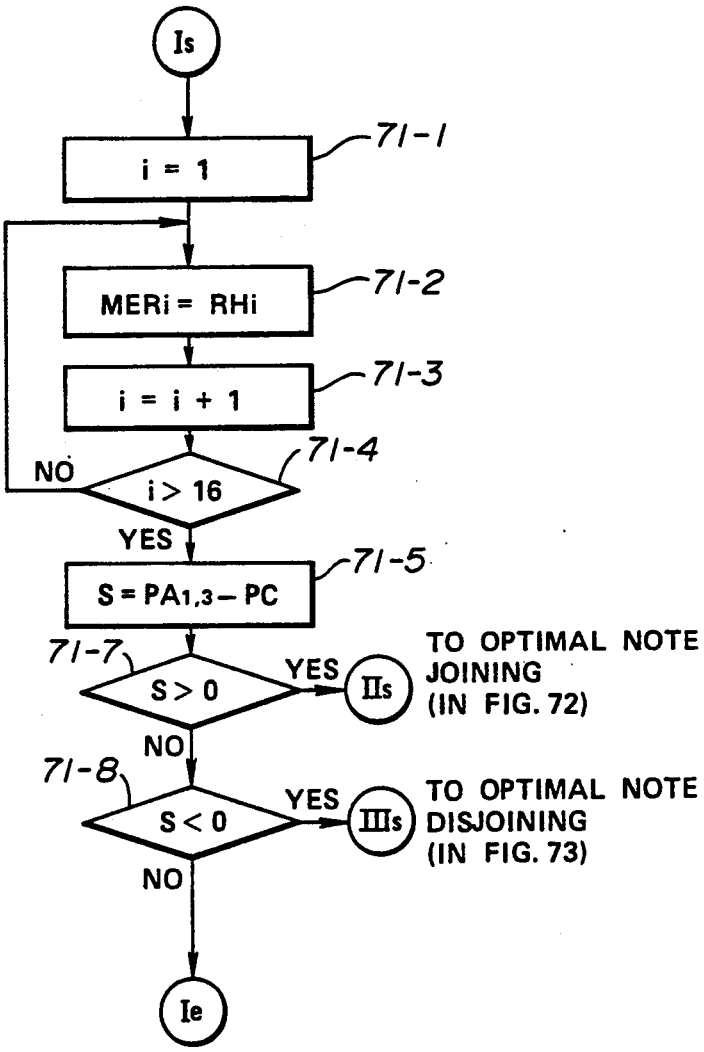
FIG. 71 is a flowchart of determination of tone durations of arpeggio.

In FIG. 71, i is a note number in the current measure. RHi is the duration of the i-th harmonic tone in the motif measure. MERi is the duration of the i-th melody tone (harmonic tone, here) in the current measure. PC is the number of arpeggio tones assigned to the current measure as planned by the parameter computation means. PA1,3 is the number of arpeggio tones contained in the motif measure. S is the difference between the number of melody arpeggio tones and the number of motif arpeggio tones. At 71-1 to 71-4, the motif arpeggio pattern {RHi} is used as the initial pattern of the melody arpeggio pattern {MERi}. If S=0 or the numbers match, the motif arpeggio pattern becomes the melody arpeggio pattern, completing the job.

Figure 72:
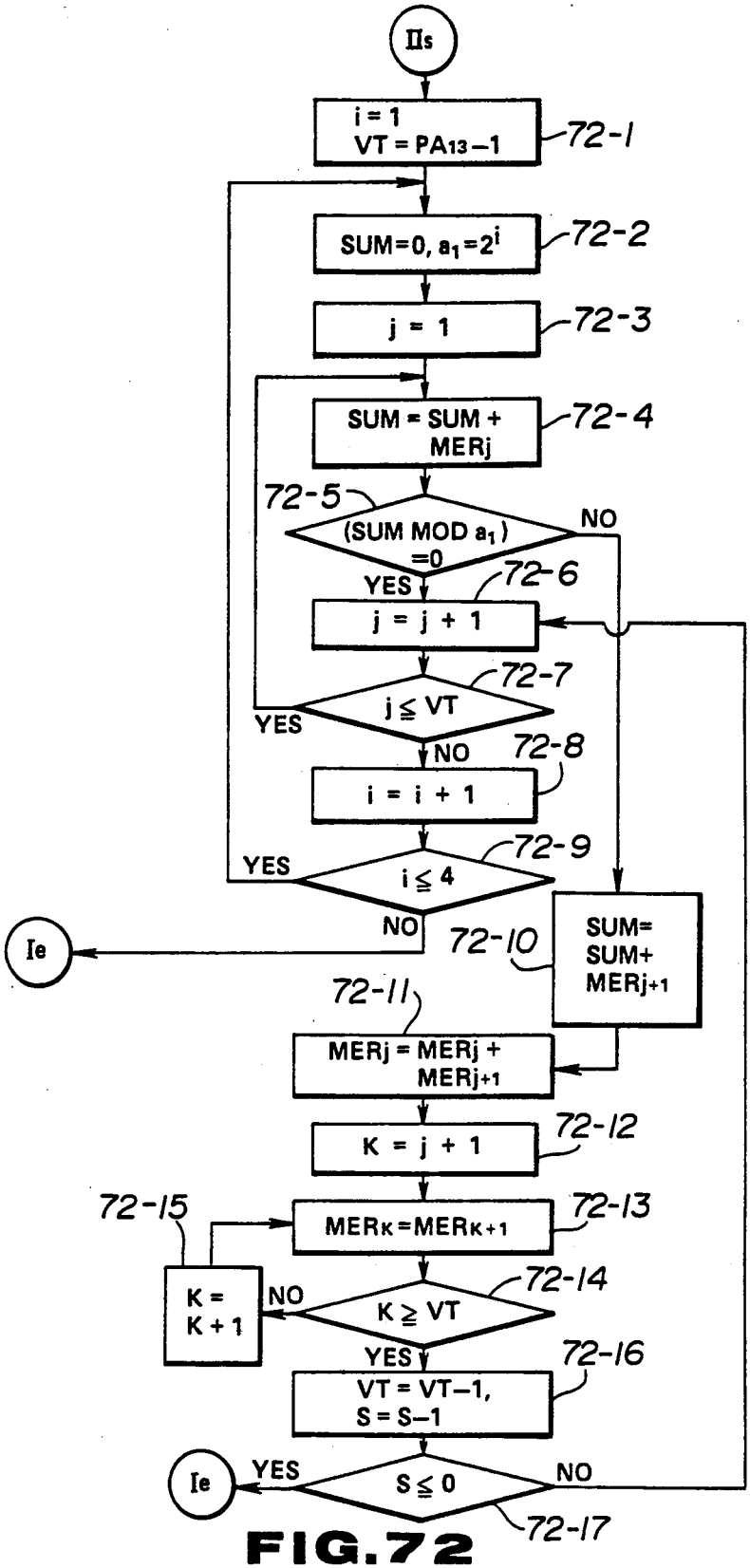
FIG. 72 is a flowchart of optimal joining of tone durations.
Figure 73:
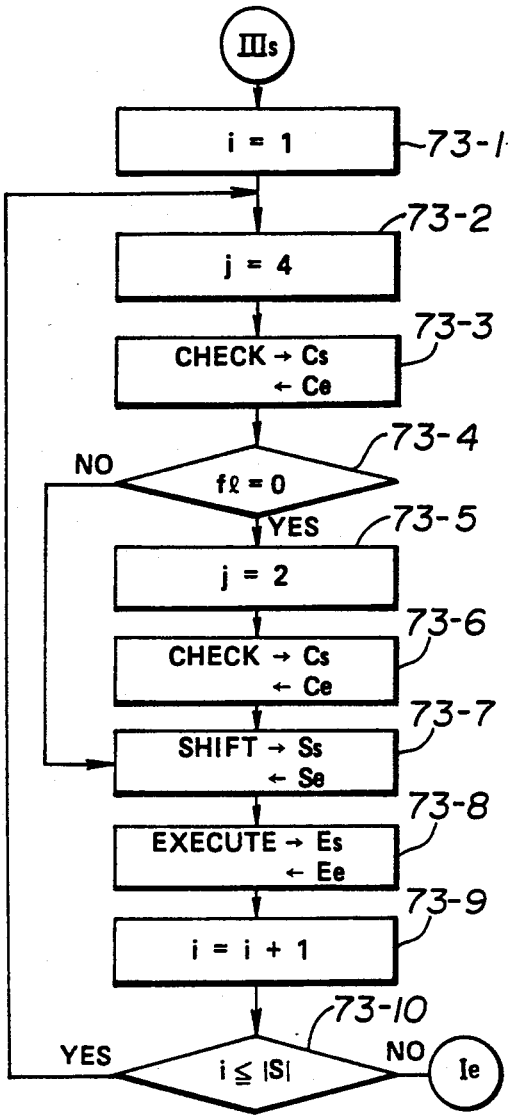
FIG. 73 is a flowchart of optimal disjoining of tone durations.

When S>0 or the number of the motif arpeggio tones is greater than the planned number of the melody arpeggio tones, optimal joining of notes is performed (FIG. 72). When S<0 or the number of the motif arpeggio tones is less than the number of the melody arpeggio tones, optimal disjoining of notes is carried out (FIG. 73).

The optimal note joining employs a logic as follows:

(a) join tone durations minimum number of times until the number of the generated notes reaches the planned number PC, and (b) join preferentially a note starting at a pulse point having the smaller value on the pulse scale (FIG. 51) with its preceding note.

For example, first search for those next note which begin at points 1, 3, 5, 7, 9, 11, 13, 15 (having a weight of 1) among the positions 0 to 15 as seen in FIG. 51. If such next notes exist, they are joined with their immediately preceding notes (so long a there is any). If the targeted number is not reached, then it is checked to see whether there is (are) note(s) starting at a point having weight of 2. If any, such a note is joined to its preceding note (the current note). If the goal number is not yet reached, it is checked to see whether there are notes starting at a point having weight of 3 and if any, such a note is joined to its preceding note. The process continues similarly. In short, those notes starting at a point having the lighter weight are preferentially joined to their preceding notes. In FIG. 72, SUM is the starting of the next note or the distance from the preceding bar line. VT indicates the length of array {MERj} i.e., the current number of arpeggio tones (to be precise, the current number minus 1, the number of arpeggio tones to be reached next). The occurrence of $i>4$ at 72-9 means a whole note (a single note per measure). At 72-11, the tone duration of the next note MERj+1 is joined to the tone duration of the current note MERj. At 72-12 to 72-16, the array {MERj} is shifted. The check at 72-5 means as follows. When $j=1$, it is checked as to whether the next note begins at a point of weight 1 on the pulse scale shown in FIG. 51. If this is the case, the process goes to the execution routine of tone duration joining starting at 72-10. When $j=2$, check is made as to whether the next note begins at a pulse point of weight 2. Similarly for $j=3$, check is made of the next note starting at a point of weight 3 and for $j=4$, check is made of the next note starting at a point of weight 4. When the number of the generated arpeggio tones has reached the goal number PC, then $S=0$ and the process is complete (72-17).

On the other hand, the optimal disjoining notes employs the following logic:

(a) disjoin tone durations a minimum number of times until the planned number of arpeggio tones has been reached, and (b) disjoin preferentially those notes which cross the heavier pulse points using these points as boundaries.

Figure 74:
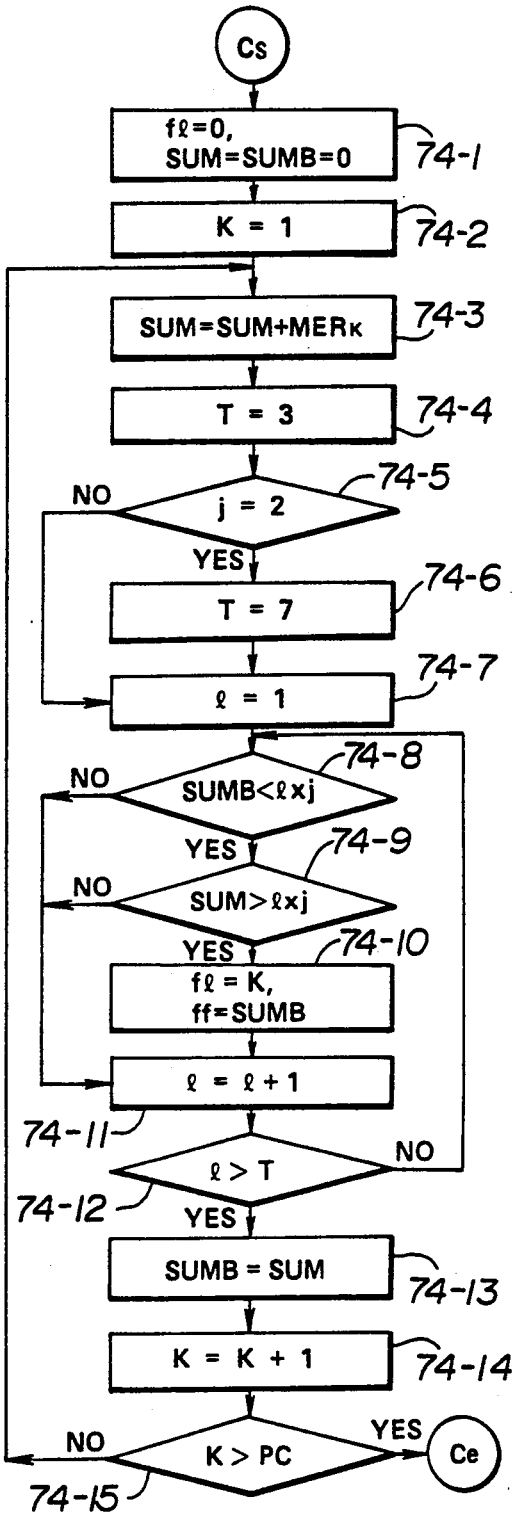
FIG. 74 is a flowchart illustrating the details of check in FIG. 73.
Figure 75:
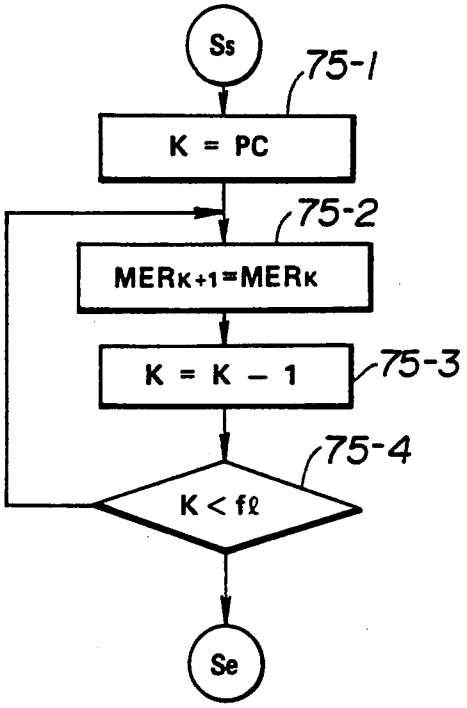
FIG. 75 is a flowchart illustrating the details of shift in FIG. 73.
Figure 76:
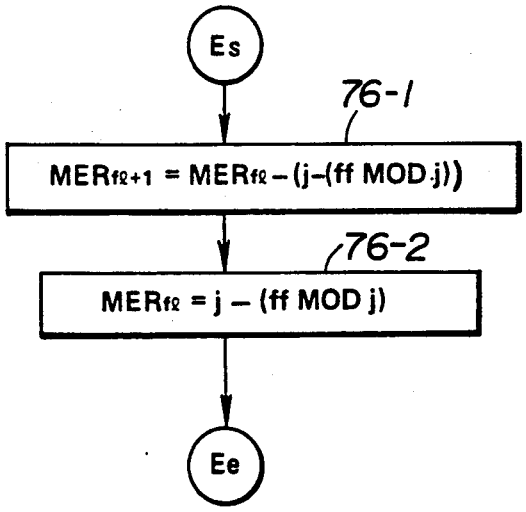
FIG. 76 is a flowchart illustrating the details of execution in FIG. 73.

According to the flow in FIG. 73 together with FIGS. 74 to 76, first search is performed as to whether there are notes crossing a pulse point having weight of 3 or more. Each time such a note is found, it is disjoined into two notes using the pulse point as the boundary. If there is no note crossing such a pulse point or the planned number PC has not yet been reached even though disjoining has been performed with the result that there is no further note crossing such a pulse point, then second search is performed as to whether there are notes crossing a pulse point having a weight of 2, and if any, similar note disjoining will be performed.

In the check routine in FIG. 74, search is made of notes crossing a pulse point of interest. If such a note is found, the note number is placed in a flag fl and the starting position of that note is set in a flag ff (see 74-8 to 74-10). Since fl is reset at zero at 74-1, if the search fails to find a note crossing a pulse point of interest, then fl holds zero at 73-4 in the main flow (FIG. 73) and the process will go to the check of notes crossing a lighter weighted pulse point. In the main flow, the process goes down only to the point where $J=2$ indicative of a pulse point of weight 2. Rigidly, it is necessary to explore deeper to assure that the targeted number of arpeggio tones PC is reached in view of the situation where the parameter C computation means plans an extremely large number of arpeggio tones: the modification of the flow to this end is very easy to make.

When the check (FIG. 74) has found a note crossing a pulse point of interest, then the tone duration array {MERj} is shifted and lengthened by one note (FIG. 75). Finally, the note disjoining is performed as shown in FIG. 76: the fl-th note to be disjoined is disjoined using the pulse point that the note crosses as the boundary.

From the foregoing and the selfexplanatory nature of the flow in FIGS. 71 through 76, the operation of the determination of tone durations, or the generation of the sequence of arpeggio tone durations has become apparent and further description is omitted.

So far, the sequence of durations and the sequence of pitches of arpeggio tones have been completed. An example is shown in FIG. 44(*a*).

ADDITION OF NONHARMONIC TONES

After arpeggio tones are generated, nonharmonic tones are added.

Regarding the addition of nonharmonic tones, there are several questions such as whether or not to add, where to add, what pitch and how long.

In the present embodiment, the parameter C computation means plans a melody as previously mentioned. Thus, parameters concerning nonharmonic tones are also generated by the parameter C computation means taking into consideration musical style, motif characteristics extracted, the progression of music and so on. The generated nonharmonic tone related parameters are supplied to the execution means for adding nonharmonic tones. The execution means has a logic or rule for interpreting the received parameters and performing the addition of nonharmonic tones in accordance with the decoded plan. This rule is to dissolve the above mentioned problems of the addition of nonharmonic tones. The rule of addition of nonharmonic tones in the present embodiment causes the results of addition to vary greatly with the values or data of parameters involved. In this respect, the rule is a data-driven one. However, whatever values of parameters C may be, an "illegal" addition of nonharmonic tone will not occur: data (parameters) do not have the power to violate the rule.

Figure 79A:
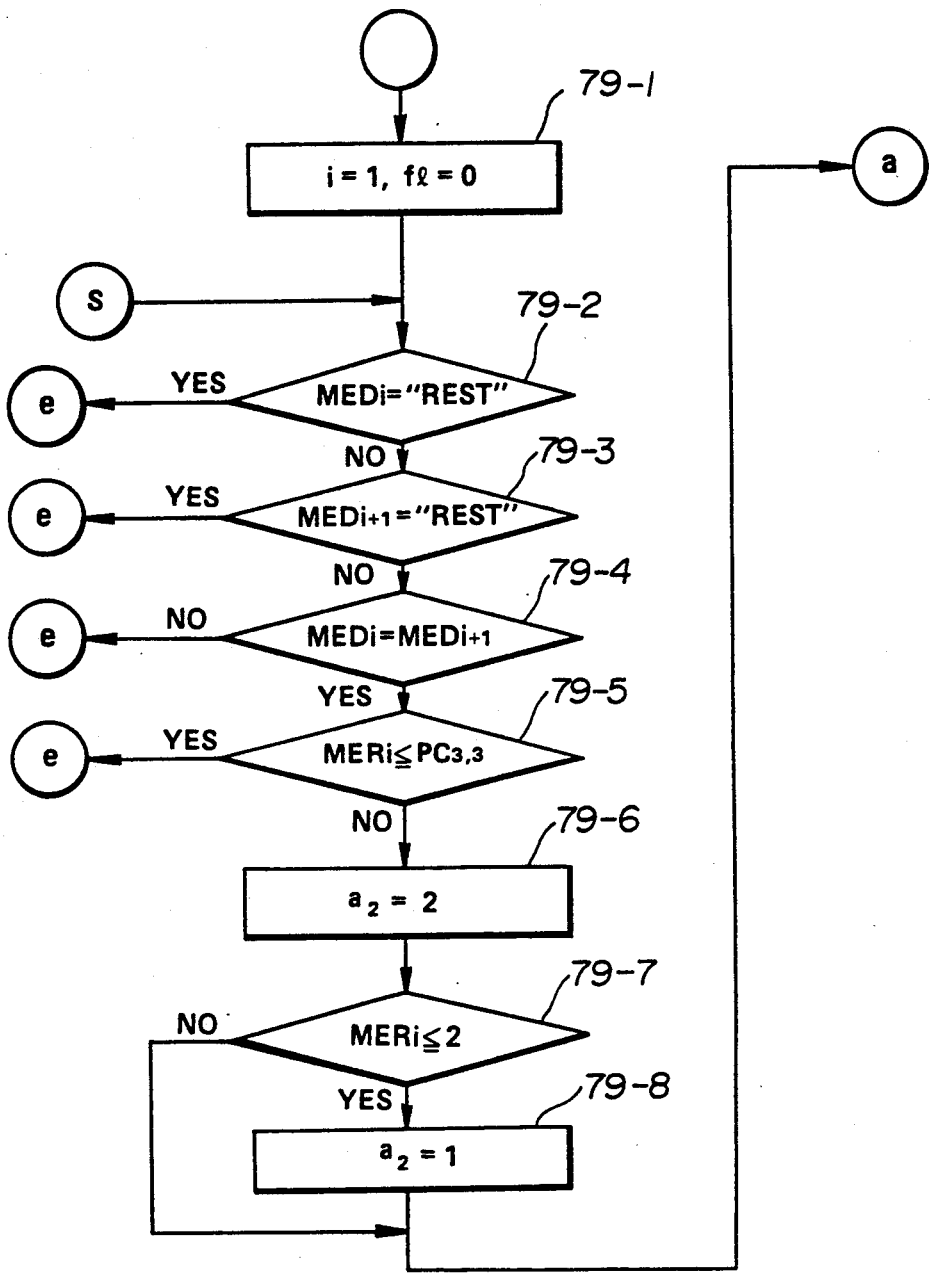
FIGS. 79A, 79B and 79C show, in combination, a flowchart of addition of neighbor.
Figure 79B:
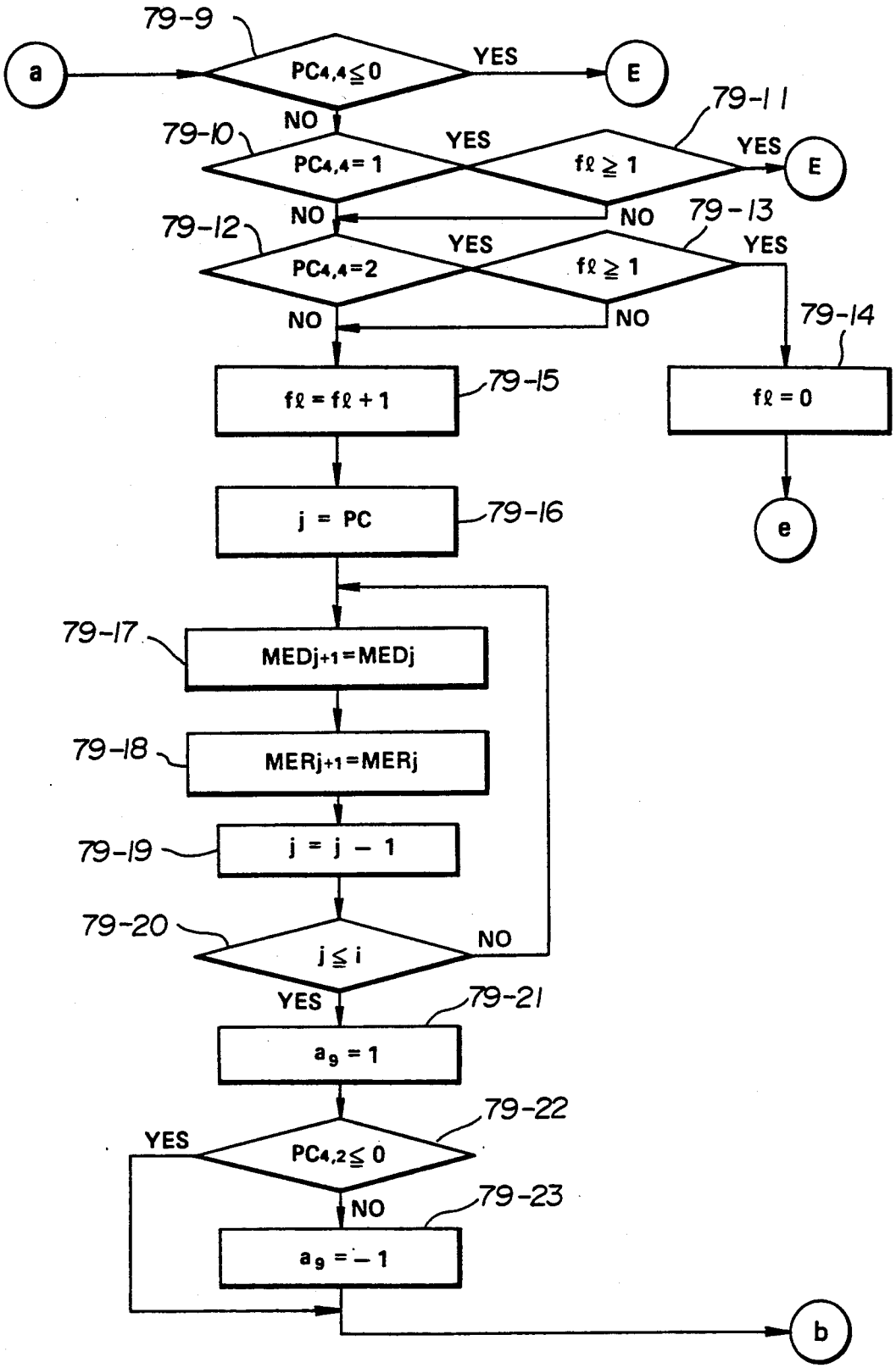
Figure 79C:
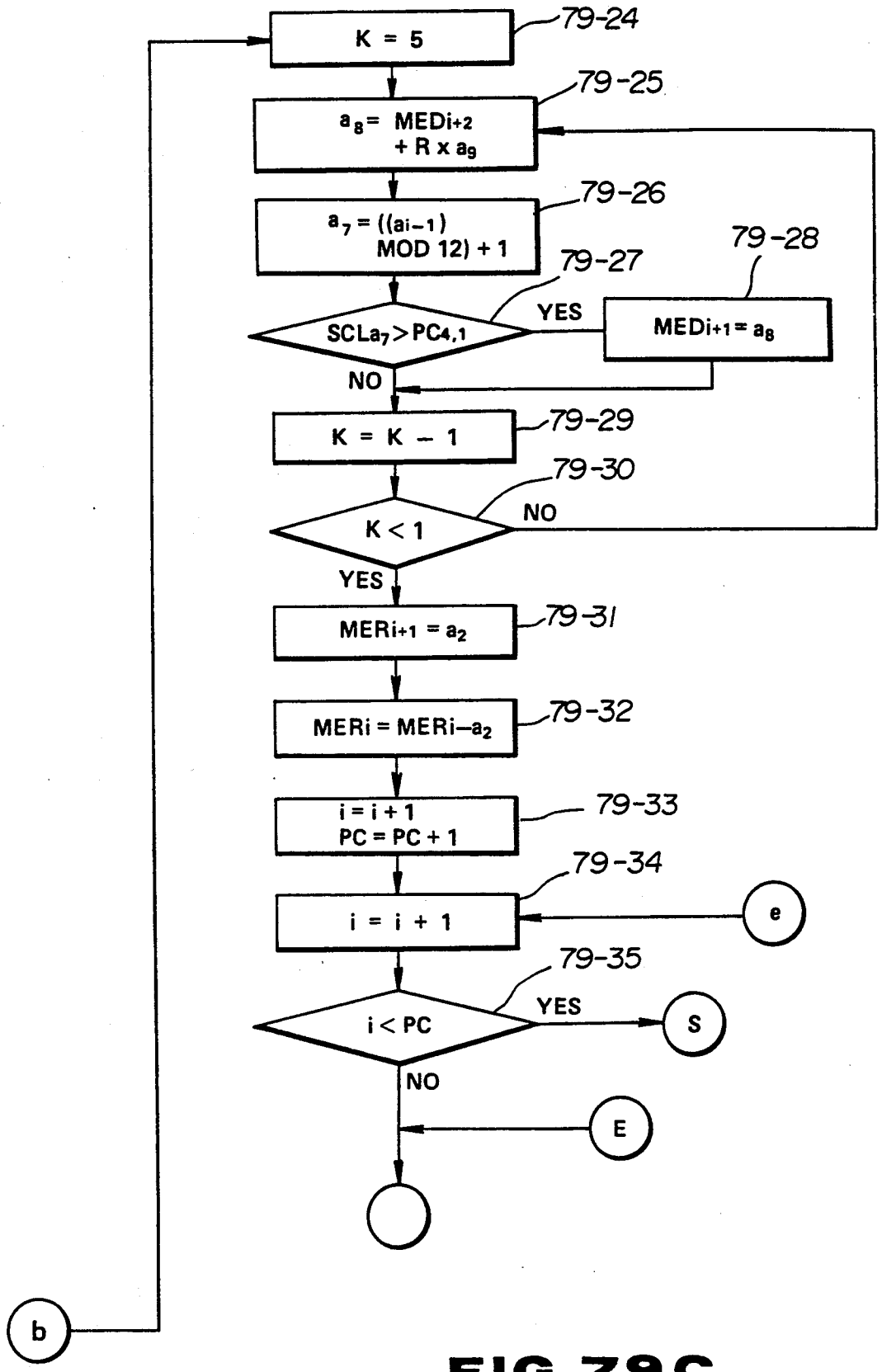
Figure 80A:
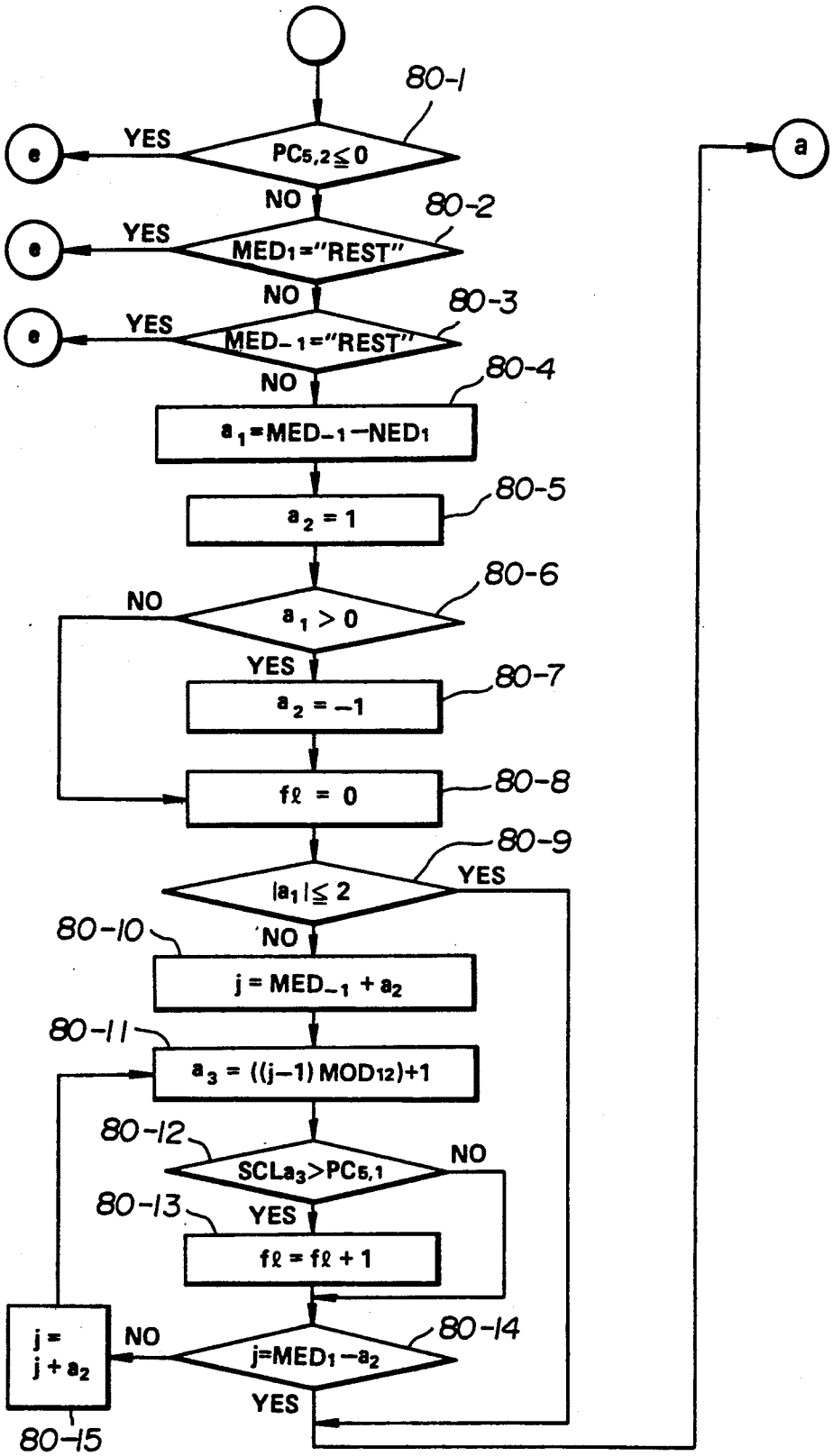

In the illustrated example, the addition of nonharmonic tones is performed on a type by type basis: there are illustrated the flow of the addition of appoggiatura (FIG. 77), the addition of passing (FIGS. 78A to 78C), the addition of neighbor (FIGS. 79A to 79C) and the addition of escape (FIGS. 80A and 80B). Here again, these terms "appoggiatura", "passing", "neighbor" and "escape" are merely for the sake of description. For example, an appoggiatura tone is added only when specified conditions are satisfied under the control of parameters C. In other words, each means for adding each type of nonharmonic tone has the ability of reasoning to add nonharmonic tones.

What is given is a pattern of tones consisting of only harmonic or arpeggio tones. Using such a pattern as clue information, the execution means for adding nonharmonic tones is operable to find nonharmonic tones "hidden" in the pattern in accordance with the plan supplied from the parameter C computation means. Such reasoning is essentially opposite to the reasoning involved in the extraction of nonharmonic tones from a melody containing both harmonic and nonharmonic tones: the former is of the type of $A \rightarrow A+B$, whereas the latter is of the type of $A+B \rightarrow A$.

The rule of addition of nonharmonic tones which will be described hereinafter is a mere example. So a person skilled in the art can easily design other rules from the teaching of the present invention. For example, the number of notes increases when the addition of a nonharmonic tone is determined: in the present example, escape tones are treated exceptionally, however. To form a sequence of durations of tones of increased number, a part of the duration of the harmonic tone located in front of or back of the nonharmonic tone to be added is removed and used as the duration of the added nonharmonic tone in the following flowcharts of addition of nonharmonic tones. In the alternative, the above mentioned note disjoining based on a pulse scale could be used.

It will be helpful to see FIG. 44(*a*)–44(*e*) in understanding how respective types of nonharmonic tones are added.

ADDITION OF NONHARMONIC TONES

Figure 77:
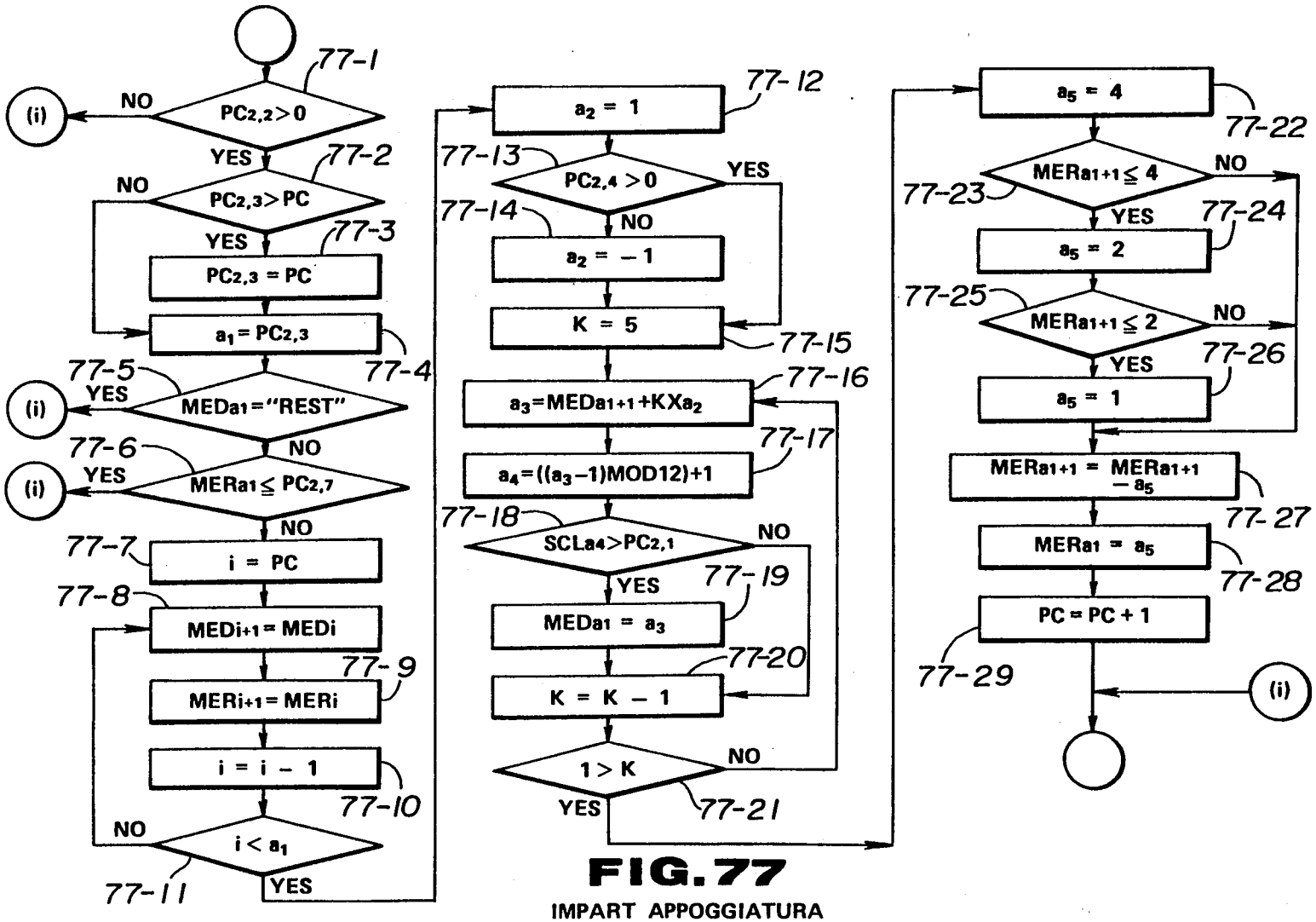
FIG. 77 is a flowchart of addition of appoggiatura.

FIG. 77 illustrates a flowchart of addition of appoggiatura. According to the shown flowchart, the following conditions must be satisfied in order that an appoggiatura is added:

(i) The weight parameter PC2,2 of appoggiatura from the parameter C computation means allows the addition of appoggiatura or PC2,2>0 (77-1), (ii) The note next to the appoggiatura is not a rest (77-5), and (iii) The next note is longer than the allowable minimum tone duration indicated by parameter PC2,7 (77-6).

At 77-2 to 77-4, the note number or location where an appoggiatura tone is placed is determined and set in a register al. At 77-7 to 77-11, shif-tarray operation is performed of the sequence of pitches of melody tones {MEDi} and of the sequence of durations of melody tones {MERi} for making the place of appoggiatura data. At 77-12 to 77-14, it is determined whether to place the appoggiatura higher than the next note (a2=1) or lower (a2=−1) in accordance with PC22. At 77-15 to 77-21, the pitch of the appoggiatura is determined. More specifically, the pitch is initialized at fourth degree (K=5) up or down from the next note to the appoggiatura. The pitch interval is sequentially decremented by step of a half tone. The pitch that is last found to be effective (the pitch satisfying SCLa4>PC2,1) is set in MEDa1 as the pitch of appoggiatura. At 77-22 to 77-16, the duration of appoggiatura is determined by shortening the next tone.

At 77-27, the duration of the next tone is reduced by the length of the appoggiatura and is set in MERa1+1. At 77-28, the duration of the appoggiatura is set in MERa1. At the final step 77-29, a counter of note number PC is incremented.

An example of the result of the addition of appoggiatura is shown in FIGS. 44(*b*).

ADDITION OF PASSING

Figure 78A:
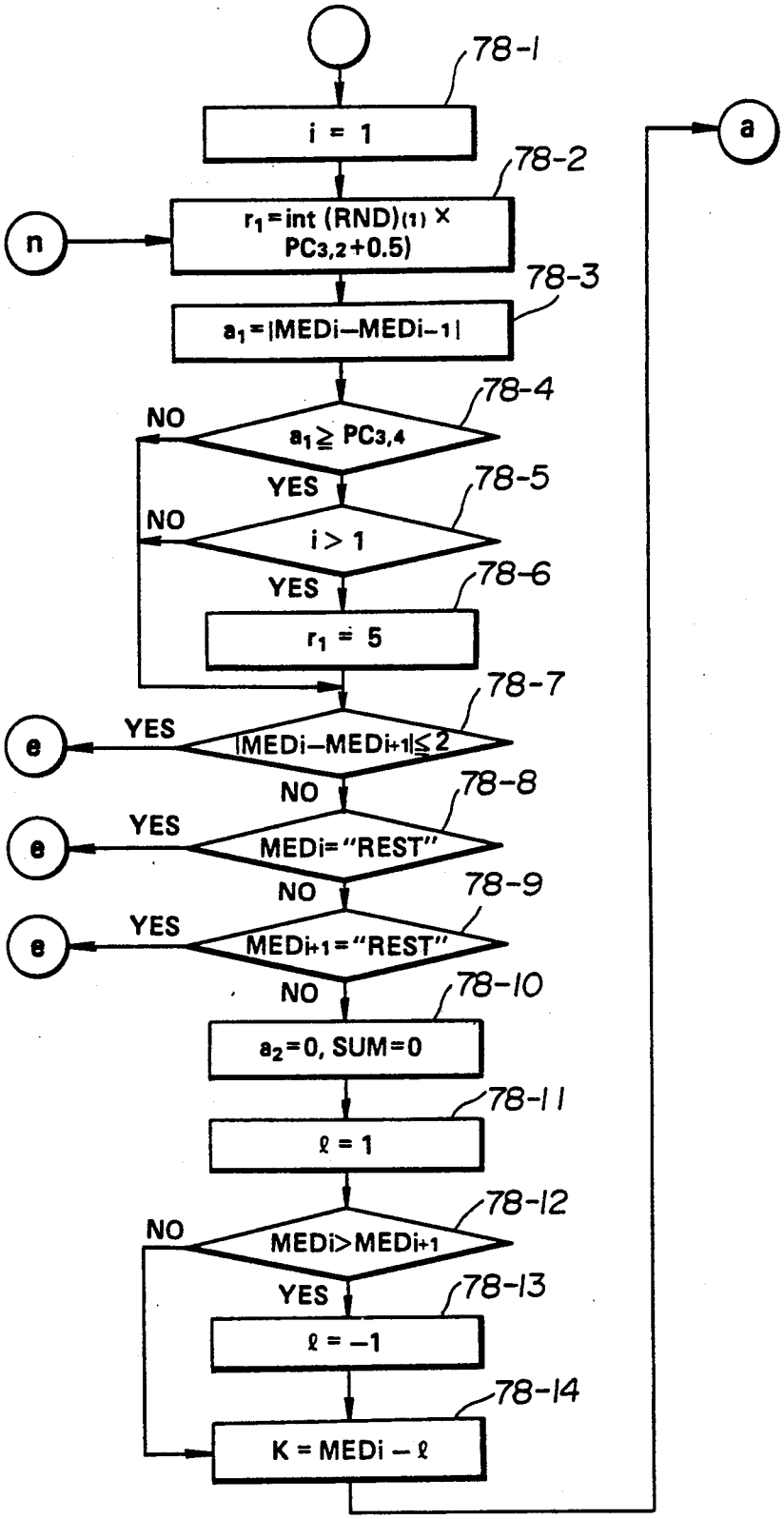
FIGS. 78A, 78B, and 78C show, in combination, a flowchart of addition of passing.
Figure 78B:
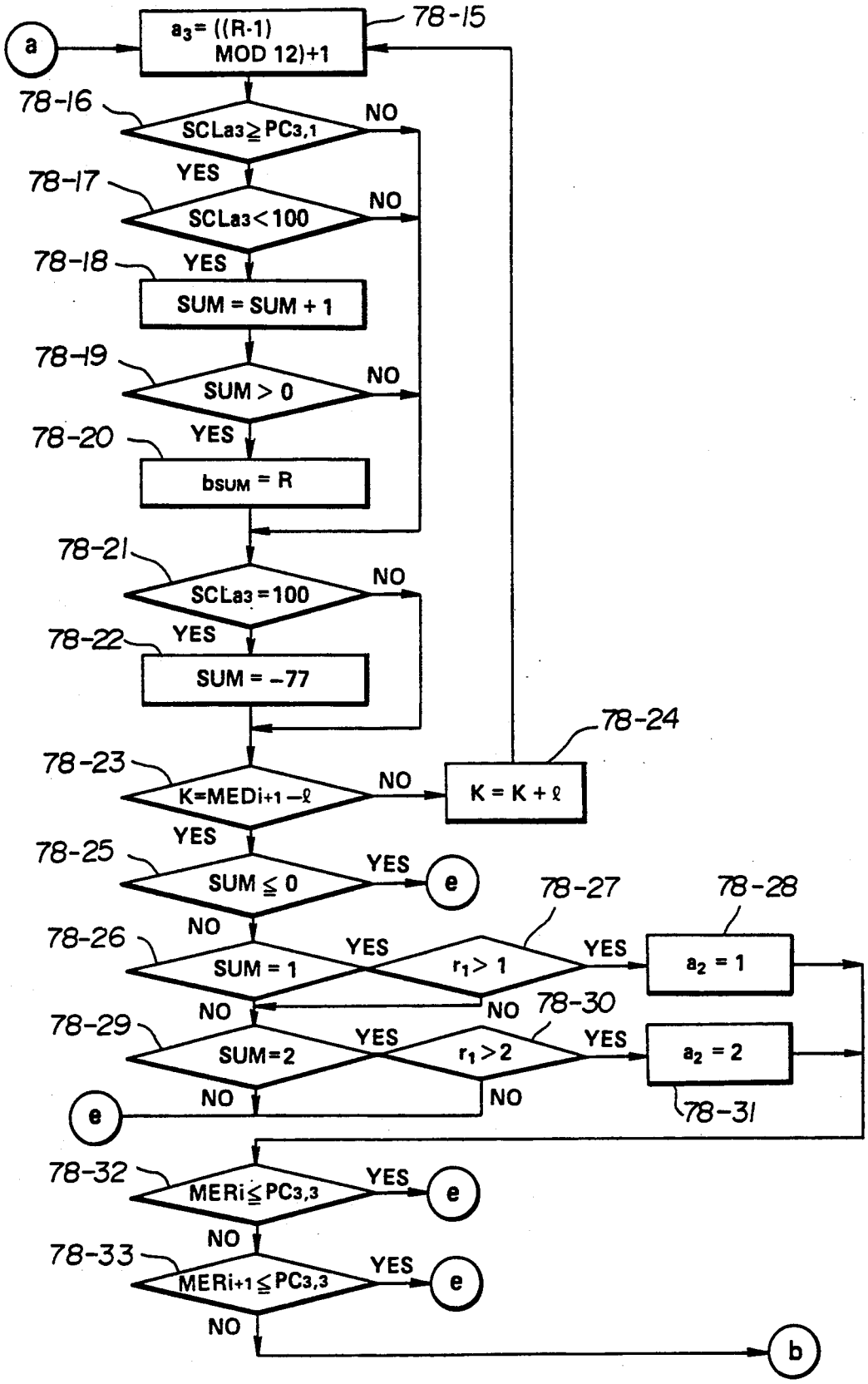
Figure 78C:
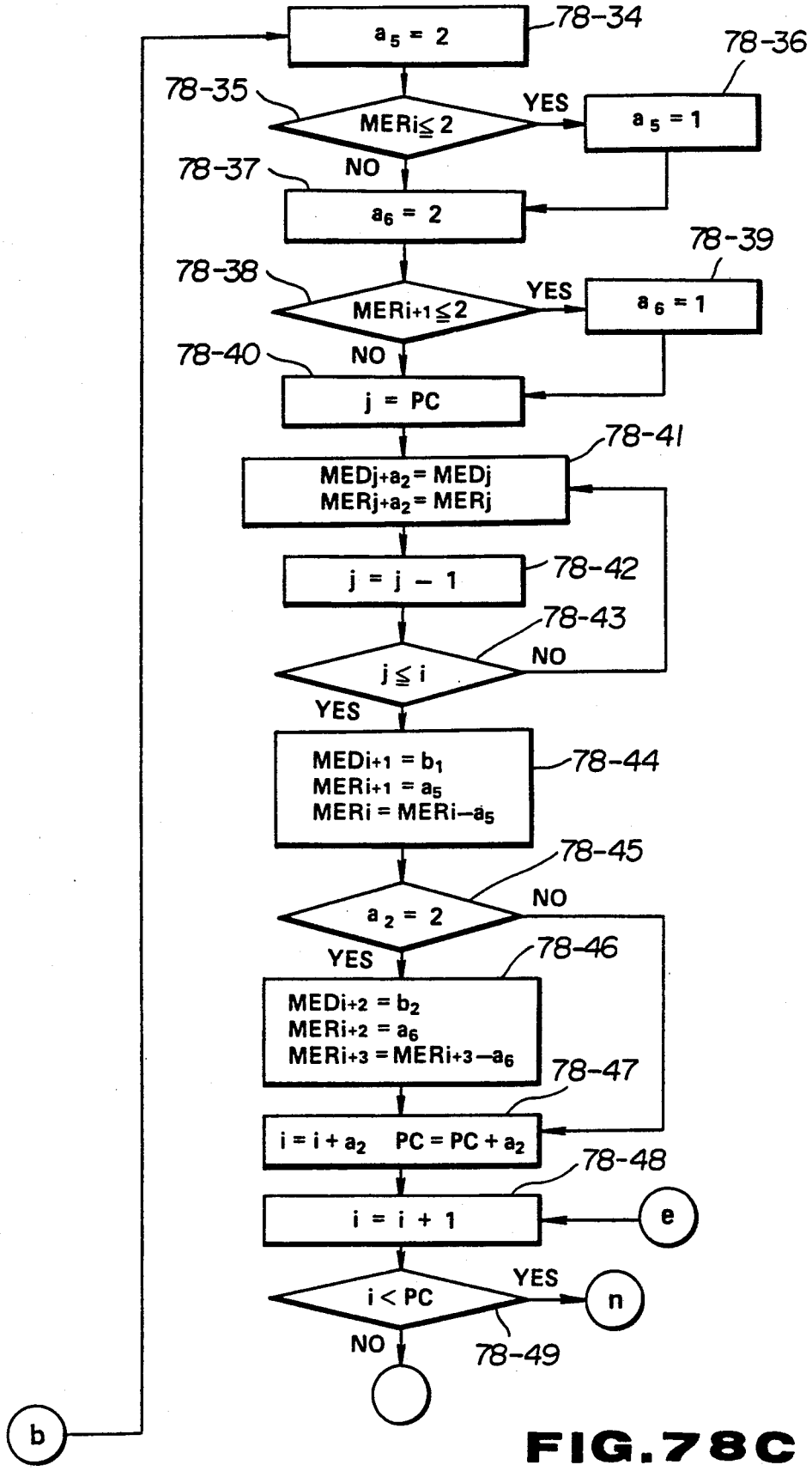

FIGS. 78A to 78C illustrate a flowchart of addition of passing. The present example is arranged that step motions are likely to occur after a skip motion (78-2 to 78-16, 78-27, 78-30). The value of r1 indicates the likelihood of the addition of passing. At 78-3, r1 is randomly computed from PC3,2. When the previous motion is a skip motion (a1≧PC3,4), then r1 is forcibly set at a high value (here 5).

The necessary conditions of the addition of passing in the illustrated flow are as follows:

(I) The interval between the notes in front of and in back of the passing tone is larger than a specific interval (here, a whole tone, 78-7), (II) Neither of these notes is a rest (78-8, 78-9), and (III) Each of these notes is longer than a specific length (78-32, 78-33).

Other conditions are necessary in order that a passing tone be added. These conditions depend on the result of the search of passing candidates performed at 78-5 to 78-24. The process of 78-10 to 78-14 is a preparatory operation for the search. For example, if the preceding tone (the tone in front of passing) is lower than the following tone (the tone behind passing), thus forming an upward motion, then the tone of the pitch a half tone up from the preceding tone is selected as the first candidate of passing. If they form a downward motion, the pitch a half tone down from the preceding tone is selected as the first candidate. In the search operation, the candidate is shifted by a half tone for each cycle of the loop (78-24). During the search 78-10 to 78-14, SUM counts the number of candidates having an effective pitch: if there is found, however, a harmonic tone pitch between the pitches of the preceding and the following tones, SUM is set at a specific value to avoid the addition of passing. Each tone pitch data that has passed the pitch test (78-15, 78-16) is written to an array {bSUM}. The search continues until the candidate pitch has reached a half tone from the following tone.

The result of the search sometimes inhibits the addition of passing. The following are examples.

(a) In the search, there was found no effective pitch on the chromatic scale from the preceding tone to the following tone (78-25), (b) Harmonic tone(s) were found on the chromatic scale from the preceding tone to the following tone (78-21, 78-22, 78-25), or (c) Too many (here, three or more) effective pitches were found on the chromatic scale from the preceding tone to the following tone.

(The process goes to e from 78-16 via 78-29.)

The remaining conditions of the addition of passing are described in 78-25 to 78-31. That is, on the chromatic scale from the preceding tone to the following tone, (IV) there is no harmonic tone, and (V) there is one or two effective pitches and (a) for one effective pitch, the liklihood of the addition is greater than a specific value, here r1>1, (b) for two effective pitches, the likelihood of the addition is greater than another specific value, here r1>2.

When there is a single effective pitch, then a2=1 indicating that a single passing tone be inserted between the preceding tone and the following tone. When there are two effective pitches, then a2=2 determining that two passing tones be interposed between the preceding tone and the following tone.

In FIG. 78C, at 78-34 to 39, the portion of harmonic tone duration(s) for use as the passing tone duration(s) is determined.

In FIG. 78C, at 78-40 to 78-43, arrays {MEDi} and {MERi} are shifted for insertion of passing tone(s).

When a2=1 (a single passing tone is added), the determined pitch data and duration data are written respectively to registers MEDi+1 and MERi+1 for the passing tone, and a register for the duration of the preceding tone is corrected (78-44): for a2=1, a portion of the preceding tone duration is removed therefrom and given to the duration of the single passing tone. After 78-44 and when the check 78-45 is negative, the process goes to 78-47, to update the information such as the note number. When a2=2 (two passing tones are to be added), the pitch and duration of the first passing tone are set at 78-44 and the second passing tone pitch and duration are set at 78-46. The duration of the second passing tone is given by reducing the following tone duration.

ADDITION OF NEIGHBOR

FIGS. 79A to 79C illustrate a flowchart of addition of neighbor. Since the addition of passing has been described in full detail, the explanation of symbols or the like in the flow in FIGS. 79A to 79C will be unnecessary except for special ones.

In order that a neighbor tone be added, the preceding tone and the following tone must have the same pitch (79-2 to 79-4). The preceding tone must be longer than a preselected length (79-5) because the duration of neighbor is given by reducing the duration of the preceding tone (79-6 to 79-8, 79-31, 79-32).

The parameter C computation means supplies a parameter PC4,4 for control of the neighbor addition. When PC4,4 is zero, this means inhibition of neighbor. When PC4,4=1, only one addition is allowed. For PC4,4=2, consecutive additions are inhibited though a plurality of additions are allowed. For PC4,4≧3, neighbor tones can be added freely. In order to meet such requests from the parameter C computation means, there is provided a process as shown at 79-9 to 79-14.

The parameter C computation means further issues a command PC4,2 as to whether to place a neighbor tone higher than the adjacent tones or lower. The corresponding process is shown at 79-21 to 79-23.

At 79-16 to 79-20, arrays {MEDi} and {MERi} are shifted for the insertion of neighbor. 79-24 to 79-30 is a process of determination of pitch of neighbor (which is similar to the process 77-15 to 77-21).

ADDITION OF ESCAPE

FIGS. 80A and 80B illustrate a flowchart of addition of escape. The present flow adopts a rule according to which the number of notes is invariable in the case of escape. Interval motions formed by three consecutive tones are taken into account. An escape tone is assumed to be the last tone in measure. Thus, an appropriate pitch of escape is computed from the interval between the tone preceding the last tone in the current measure and the first tone in the next measure, and is substituted for the last note already generated in the current measure.

When the parameter C computation means inhibits the addition of escape (PC3,2≦0), the present flow follows this command (80-1). Since the addition of escape takes account of three consecutive tones (excluding rests), the addition of escape will not happen when the preceding or the following note is a rest (80-2, 80-3).

Escape tones are classified into three types depending on the interval motions of three consecutive tones involved. These types are shown in the lower portion in FIG. 80B. Neighbor type is developed when the last but one tone MED-1 in the current measure and the first tone MED1 in the next measure have the same pitch. Passing type is developed when on the chromatic scale from MED-1 to MED1, there are effective pitches (in the present flowchart, a single effective pitch) that have passed pitch test 80-11, 80-12. Appoggiatura type is defined when there is no effective pitch in the range from MED-1 to MED1 at half tone intervals.

The number of effective pitches between tones MED-1 and MED1 is computed at 80-4 to 80-15 (se particularly 80-9 to 80-15). fl is set at the number of effective pitches found. When there have been found two or more effective pitches, no addition of escape will occur (80-16).

Either of the above three types is further classified into upper and lower types. For example, the neighbor type is classified into two depending on whether the tone is placed higher than the adjacent tones MED-1 and MED1 or lower. The corresponding operations are performed at 80-17 to 80-19 (upper/lower is determined from the value of PC5,3). The passing type is classified into two depending o whether the interval motion from MED-1 to MED1 is an upward or downward motion. So is the appoggiatura type: there is no effective or valid pitch in the range between MED-1 and MED1 in the case of the appoggiatura type, however. Thus, the tone is escaped. That is, when the motion from MED-1 to MED1 is an upward motion (↗), then a pitch higher than both of MED-1 and MED1 is selected as the escape tone. When the motion from MED-1 to MED2 is a downward one (↘), a pitch lower than both of MED-1 and MED1 is selected (80-4 to 80-7, 80-23). For ↗, a7=1 and for ↘, a7=−1. In the process following 80-24, search is made of an effective tone, starting at the pitch (MED1+5×a7) and stepping the pitch by a half tone.

The process 80-24 to 80-30 is essentially identical with the process 79-24 to 79-30 in FIGS. 79A to 79C. Here, the pitch candidate is initialized at the fourth degree up or down (determined by a7) from the first tone MED1 in the next measure. The pitch then approaches to the first tone MED1 by half tone steps while searching for effective pitches. The effective pitch that is last found in the search or the closest to the first tone in the next measure is determined as the escape tone. While the present flow performs the search in a decremental way (approaching to the first tone), an incremental way of search can be used. In that case, the effective tone that is first found in the search is determined as the tone to be added: in view of the situation where there is not an effective tone at all, it is necessary to get out of the search loop when the pitch has arrived at a certain distance from the initial position.

ADDITION OF REST

Figure 81:
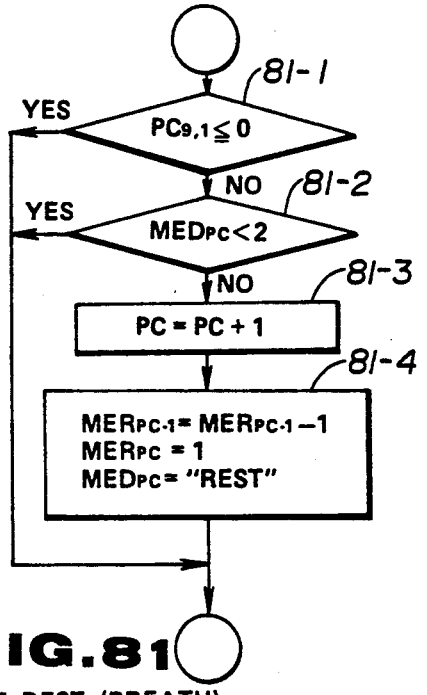
FIG. 81 is a flowchart of addition of rest (breath)

FIG. 81 illustrates a flowchart of addition of rests. In the present example, the addition occurs only when there is a room for a sixteenth note to be added (81-2 to 81-4). PC9,1 at 81-1 is supplied from the parameter C computation means and indicates whether or not to add a rest note. The parameter C computation means changes PC9,1 to the value to add a rest typically at the time of the last measure in phrase.

GENERATION OF CHARACTERISTIC RHYTHM

As previously mentioned, in the automatic composer of the present embodiment, the rhythm evaluation means extracts what mini-patterns and how much such patterns are contained in the motif. The characteristic rhythm pattern extraction means determines the mini-pattern characterizing the mini-pattern. Based on the result, the parameter C computation means plans a measure of mini-pattern or melody rhythm control information characterizing each melody measure. It is characteristic rhythm generation means (featuring pattern incorporation means which injects mini-patterns in the sequence of melody tone durations in accordance with the melody rhythm control information provided by the parameter C computation means.

The necessary function of the characteristic rhythm generation means is the ability to interpret the melody rhythm control information supplied from the parameter C computation means and to modify the sequence of melody tone durations in accordance with the decoded plan.

Figure 82:
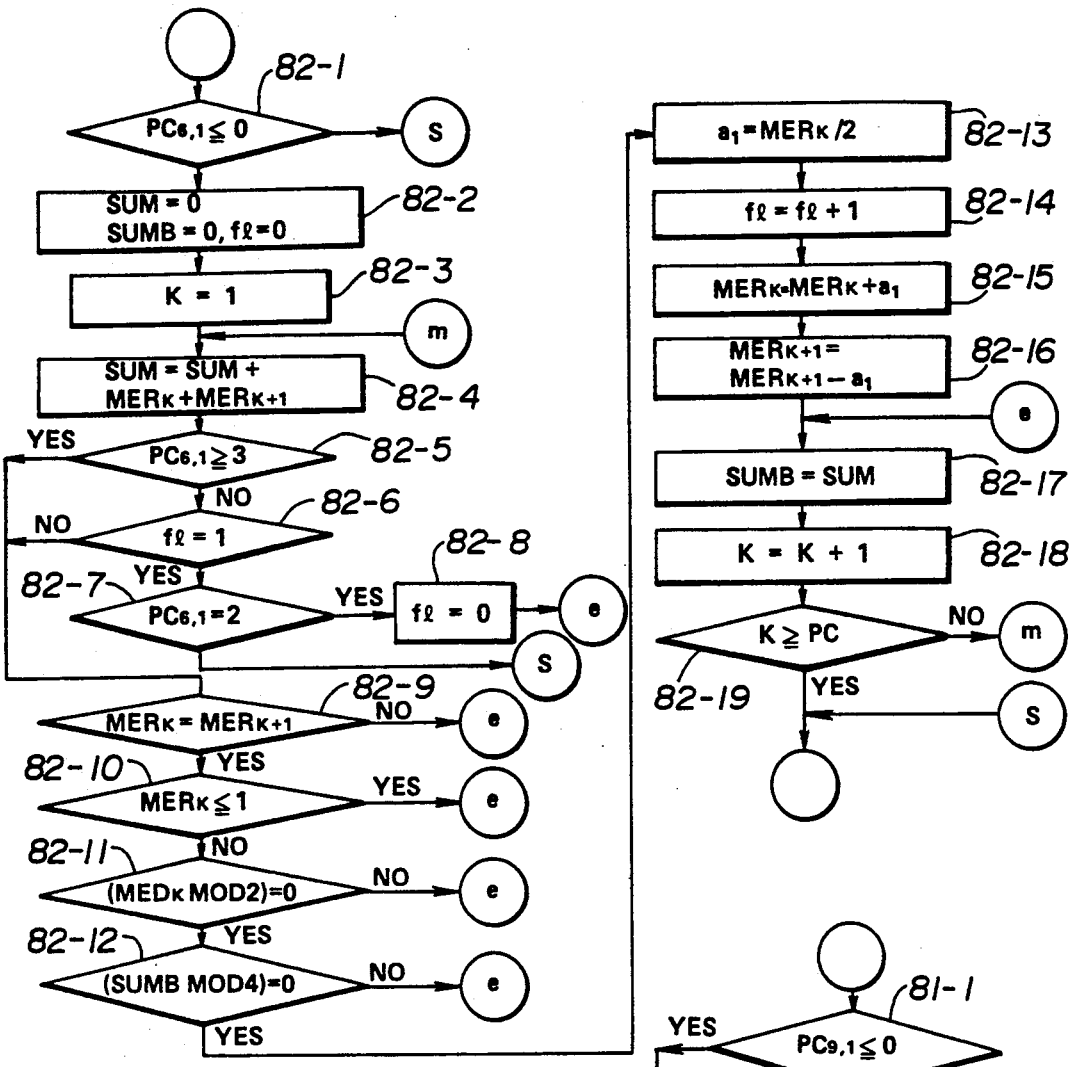
FIG. 82 is a flowchart of generation of characteristic rhythm.

FIG. 82 illustrates a flow executed by the characteristic rhythm generation means. In the flow, only one parameter PC6,1 is used as the rhythm control information. This is merely for the purpose of description. The parameter C computation means may supply a plurality of melody rhythm control parameters and the characteristic rhythm generation means may comprises composite functions to interpret those parameters and to develop a rhythm from the result of the interpretation.

Parameter PC6,1 in FIG. 82 has the following meaning (see 82−1). When PC6,1 is negative or zero, the injection of mini-pattern is inhibited. When PC6,1 is 1, the injection of mini-pattern is allowed only once. When PC6,1 is 2, the consecutive injection is inhibited. When PC6,1 is 3 or more, free injection of mini-pattern is allowed. In conjunction with the rhythm process described so far (for example, PA6,1 in FIG. 54), the parameter PC6,1 relates to the mini-pattern of the duration ratio of 3-1. That is, in a systematic sense, the value of the parameter PC6,1 indicates the frequency of the mini-pattern of 3-1 ratio appearing in a melody measure. Hence, the flow in FIG. 82 involves the algorithm to generate the mini-patterns having 3-1 ratio depending on the values of PC6,1.

The generation process of characteristic rhythm in FIG. 82 is the process performed last in the course of melody generation. Before this process, the process of generating arpeggio tones and the process of adding nonharmonic tones is already complete. In the process of arpeggio tones, the sequence of arpeggio tone durations (melody arpeggio pattern) has been formed based on the motif arpeggio pattern excluding nonharmonic tone from the motif. In the process of adding nonharmonic tones, hidden nonharmonic tones have been determined by inference and a minimum modification of the sequence of tone durations has been carried out by removing a portion of the adjacent harmonic tone duration for use as the duration of the nonharmonic tone. The process of transforming the motif including nonharmonic tones to the motif arpeggio pattern excluding nonharmonic tones is essentially opposite in reasoning to the process of transforming the melody arpeggio pattern excluding nonharmonic tones to the melody including nonharmonic tones. Thus, at the beginning of the process of generation of characteristic rhythm, the sequence of the pitches of melody tones is complete and the sequence of durations of melody tones is almost perfected in man cases. Therefore, this last process should be done carefully. If patterns of 3-1 tone duration were forcibly formed by randomly reducing or increasing tone durations, this would be likely to greatly deteriorate the original pattern, producing a rhythm which should not exist by nature. In this view, the present characteristic rhythm generation means is arranged in such a manner that mini-patterns be injected in line with the plan made by the parameter C computation means while preserving the quality of the sequence of tone durations already formed as much as possible. In short, the characteristic rhythm generation means has a rule of a minimum modification of the given sequence of tone durations.

More specifically, in the characteristic rhythm generation in FIG. 82, only each pair of tone durations for which specific conditions are satisfied is converted into 3-1 ratio of tone durations. The conditions are as follows.

(i) two consecutive tones have the same duration (82-9), (ii) the duration is equal to or longer than a eighth note (82-10), (iii) the duration is a eighth note or its multiple (82-11), and (iv) the first of the two tones starts at a position of an integer multiplied by 4 (including zero position) (82-12).

When the above conditions as well as the condition concerning the value of PC6,1 are satisfied, the pattern of the two consecutive tone durations is converted into a pattern of the tone duration ratio of 3-1 (82-13 to 82-19). The condition (iv) serves not t introduce syncopation.

The process 82-5 to 82-8 is provided to obey the command indicated in PC6,1. A flag fl is used when PC6,1 is 1 (where only one injection of rhythm pattern is allowed) or 2 (where consecutive injection is inhibited). Upon the injection of the pattern, the flag changes to 1 from 0 (82-14). When PC6,1=1, fl changes to 1 upon the first injection and then the process exits the flow, through 82-5, 82-6, 82-7 and S. When PC6,1=2, the first injection causes fl to change to 1 and the next pass goes through 82-7, 82-8 and e to skip over the next tone, thus inhibiting the pattern injection in the pass following fl=1.

The shown flow is a mere example. A person skilled in the art can easily construct other rules according to which mini-patterns are incorporated in the sequence of tone durations.

In the example in FIGS. 44(*a*)–44(*e*), the process of generation of characteristic rhythm results in NOP.

In the process of melody generation in FIG. 60, the generation of arpeggio tones, the addition of nonharmonic tones, the addition of rest and the generation of characteristic rhythm patterns are executed measure by measure. If there are seven measures where melody is to be generated with a single measure motif, as illustrated in FIGS. 44(*a*)–44(*e*) the entire process repeats seven times to complete a music piece.

LEARNING BY CORRECTION

Since the learning by correction is identical with that of the first embodiment (FIGS. 35, 36), the description is omitted here.

FEATURES OF EMBODIMENT

From the foregoing, the features of the automatic composer of the present embodiment have become apparent. Some of the features are given below.

(a) The automatic composer generates a melody in accordance with the chord progression and the motif featuring parameters extracted from the motif. Hence, the musical essence or concept of motif is reflected everywhere in the composed music piece. At the same time, the melody is variable in a great number of ways under the control of chard progression.

(b) The melody generation means includes means for generating parameters C (melody featuring parameters, melody control information). The parameter generation means is operable to form parameters segment (measure) by segment. The measure-assigned values of parameters C serve to control a melody in each measure thus developing consistency and variety in the stream of melody.

(c) The parameter C generation means computes parameters C using compressed data (parameter B) and motif featuring parameters. Accordingly, various values of parameters C are obtained while conserving storage locations.

(d) The parameter C generation means (melody control information generation means) further includes musical form data generation means which provides music with a higher level of hierarchy.

(e) Harmonic tones and nonharmonic tones are treated in distinct manners so that the developed music piece will be full of musicality.

(f) The motif is provided by the user and is reflected in the generated music piece. Accordingly, the user feel active in the music composition and at the same time he is satisfied with the composed piece.

(g) The reflection of the motif characteristics on the melody is controlled for each element of the motif features, thus providing a very wide space of possible composition.

(h) Regarding rhythm, a characteristic minipattern is extracted from the motif and based on the result, characteristic patterns are incorporated into the melody according to a plan. Therefore, it is possible for any extent of the rhythmic characteristic of the motif to be reflected in the melody.

(i) Regarding the formation of the sequence of arpeggio tone durations, there is provided means for disjoining and joining tone durations a minimum number of times, using a pulse scale. While there is a possibility that rhythmic characteristic not found in the motif is developed in the melody due to the pulse scale, such variation involves consistency and yields a well controlled transformation of the pattern of tone durations.

(j) Pitch control means is provided which checks the effectiveness of the candidate of melody note pitch. Effective note scales far larger in number than the set of note scales stored in the memory may be developed by controlling, for example, the values of threshold.

(k) The automatic composer may turn to be an apparatus for forming arpeggio tones depending on the setting of parameters.

(l) The automatic composer includes AI (artificial intelligence) functions which perform forward reasoning and backward reasoning to analyze motif or convert from motif to parameters and to convert back to melody from the parameters.

(m) The user does not need any technical knowledge of music. Once the user has created a short motif, the automatic composer will compose music in consistent with the motif.

(n) The automatic composer further includes a learning function which learns the user's preference. Thereafter, the automatic composer composes music by giving the learned data the highest priority. Thus, the composed piece will fit the user's preference so that his interest will be endless.

This concludes the description of the second embodiment. Modifications, developments and applications of the present invention will be described.

NOTE SCALE (PITCH CONTROL)

The description will now be made of a modification of the pitch control means involved in the generation of the sequence of melody tone durations.

In the second embodiment, the pitch control means comprises means for generating a note scale and means for checking the effectiveness of pitch (see FIG. 38). The note scale generation means comprises means for reading weight data of note scale from the weighted note scale data memory 105 (FIG. 64) and means for modifying the read note scale data in accordance with the root of chord and the members of chord. The effective pitch check means examines melody note candidates generated in the course of generating arpeggio tones and adding nonharmonic tones as to the weights assigned to those candidates on the note scale. Specifically, the weight of this candidate is compared with the threshold value (PC2,1, for example) planned by the parameter C computation means or melody control information generation means. If the weight of the candidate is heavier than the threshold value, the candidate is determined as a valid note.

In the example in FIG. 64, some note scales have two kinds of weights and other note scales have three different weights. As is seen from the read operation of weighted scale data in FIG. 65B, the user may select by the input device 101 which note scale to use. In the example, it is assumed however, that the read note scale is independent from the chord information.

Referring to FIGS. 83A(*a*)–83A(*e*), 83B and 84, there is shown a modified example of the pitch control means in which the note scale read from the memory is dependent on the type of chord. Here, the concept of available note scale is utilized. There is at least one available note scale for a chord. The selection of available note scale for a particular chord is automatically made here, though it can be done by the user (see FIG. 84).

Specifically, in FIGS. 83A(*a*)–83A(*e*), a memory 1 is used to store chord progression information with numeric values or chord numbers indicative of type of chord placed at consecutive address locations (see FIGS. 83(*d*) and 83(*e*). The array {CNi} of those chord numbers represents chord progression. A memory 2 is a table which describes the number of available note scales for each chord (CNi). A memory 3 stores the name of available note scale (ANS) in the form of a numeric value for each chord. The name of available note scale specifies the scale data in the form of weight pattern stored in a memory 4. "0" in the ANS area in the memory 3 indicates a natural mode, "1" a pentatonic scale, "2" a blue note scale, "3" a whole tone scale and "4" an altered scale. The start address of the scale data in the memory 4 is computable from the value of ANS. Also, the content in the memory 2 specifies the ANS in the memory 3. Further from the content (chord type) in the memory 1, the number of available note scales for that chord type may be read from the memory 2. For example, when CNi is "7" indicative of V7 chord, the number of available notes for V7 is found to be 3 by gaining access to the memory 2 at the address 6 which is CNi (here 7) minus 1. The details of these three available note scales for V7 or the weighted scale data may be obtained as follows. First accumulate the number of available note scales using the memory 2 until (CNi-1), here 6 has been reached. The accumulated value here 10 indicates the start of the addresses in the memory 3 where the list of names of available note scales (ANS)

for chord type V7 is started. The number of ANS was found 3. Thus compute the start address, the next address and the next address one by one and compute the start address of each available note scale data to be read from the memory 4. In the memory 4, each note scale data has a length of 12 addresses. In this manner, data of available note scales for V7, i.e., data of natural mode, pentatonic scale and blue note scale are read from the memory 4.

Therefore, it is possible to use the memories illustrated in FIGS. 83A(*a*)–83A(*e*) as a data base of available note scales. Data or list of names of available note scales for the chord of interest may be readily displayed by a monitor such as CRT if desired. Using such a monitor, the user may easily choose an available note scale which fits better the progression of music.

The data base of available note scales in FIGS. 83A(*a*)–83A(*e*) is easy to expand. For example, a new chord not found in the list of chords (see FIGS. 83A(*d*) and 83A(*e*) may be added to the list. A new chord type is assigned a value which is the maximum CNi in the current list plus 1. Once the name of each available note scales for the new chord type has been given, the memory 2 is extended in such a manner that the new chord type (chord number) and the number of available note scales for that chord type are written at the next address. The memory 3 is also extended to record the names. When new available note scale data are input, a new name (5 in the illustration) is given thereto and the memory 4 is extended for storing the new scale data. Thus, the user can easily register a new chord, the number of available note scales for the chord, the name, and the weight pattern (scale data). It is also easy to modify (add, delete, correct) the list of available note scales for the registered chord.

Figure 84:
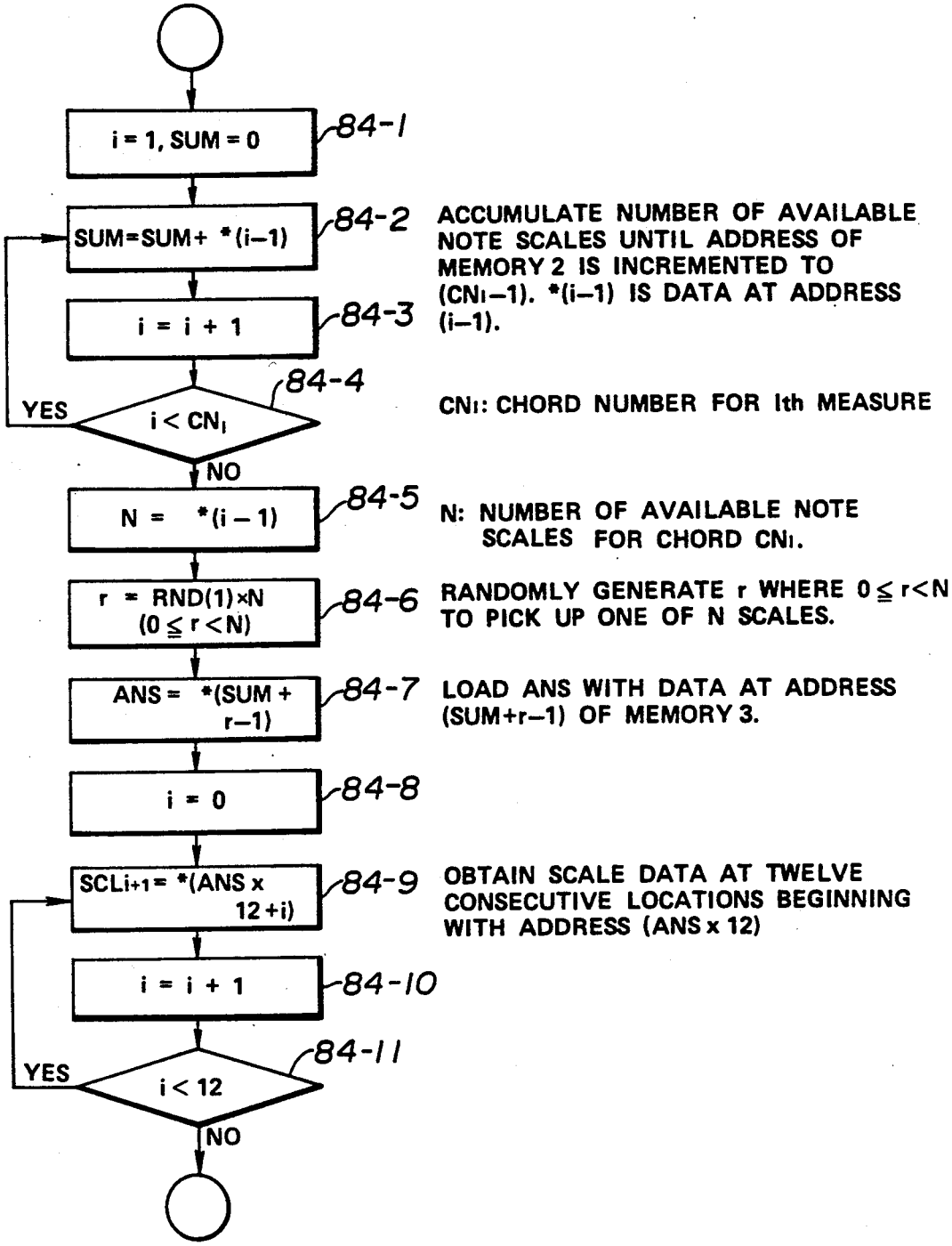
FIG. 84 is a flowchart of read operation of weighted note scale data.

In the flow in FIG. 84, for the given chord (CNi), an available note is selected using random numbers (84-5, 84-6). In other respects, the read operation of the names and the data of available note scales for a particular chord is similar to what has been described. The comments on the flow are shown in the righthand in FIG. 84 and no further description will be necessary.

SYNTHESIS OF NOTE SCALE

The set of weighted note scales may be stored in a note scale data memory (the memory 5 in FIG. 37 or the memory 4 in FIG. 83B).

The subject for discussion here relates to synthesis of note scale. The data of chromatic scale may be given by:

| (a) | i: | 1 | 2 | 3 | 4 | 5 | 6 | 7 | 8 | 9 | 10 | 11 | 12 |
|---|---|---|---|---|---|---|---|---|---|---|---|---|---|
| | SCLi | 25 | 25 | 25 | 25 | 25 | 25 | 25 | 25 | 25 | 25 | 25 | 25 |

The data of pentatonic scale may be given by:

| (b) | i: | 1 | 2 | 3 | 4 | 5 | 6 | 7 | 8 | 9 | 10 | 11 | 12 |
|---|---|---|---|---|---|---|---|---|---|---|---|---|---|
| | SCLi | 25 | | 25 | | 25 | | | 25 | | 25 | | |
| | | | 0 | | 0 | | 0 | 0 | | 0 | | 0 | 0 |

The data of Western major scale may be expressed by:

| (c) | i: | 1 | 2 | 3 | 4 | 5 | 6 | 7 | 8 | 9 | 10 | 11 | 12 |
|---|---|---|---|---|---|---|---|---|---|---|---|---|---|
| | SCLi | 25 | | 25 | | 25 | 25 | | 25 | | 25 | | 25 |

-continued

| | | | | | | | | | | | | | |
|---|---|---|---|---|---|---|---|---|---|---|---|---|---|
| | | | 0 | | 0 | | | | 0 | | 0 | | 0 |

The addition of the above three scale data yields:

| (d) | i: | 1 | 2 | 3 | 4 | 5 | 6 | 7 | 8 | 9 | 10 | 11 | 12 |
|---|---|---|---|---|---|---|---|---|---|---|---|---|---|
| | | 75 | | 75 | | 75 | | | 75 | | 75 | | |
| | SCLi | | | | | | 50 | | | | | | 50 |
| | | | 25 | | 25 | | | 25 | | 25 | | 25 | |

Note that the data (d) exactly matches the data of yona nuki major scale illustrated in part (2) in FIG. 64. Addition of double of the data (c) to the data (a) will match the data of Western major scale as shown in part (4) in FIG. 64.

The above example is intended to show that scale data are developed by linear combination of data of two or more scales. This has two advantages. First, scale data representing an existing note scale may be developed by the combination of scale data of a plurality of existing but different note scales. Second, scale data representing a new scale may be obtained by the combination of data representing two or more existing note scales. This will lead to the possibility of automatic composition using experimental note scales.

In respect of storage capacity, the above approach advantageously allows a reduced set of weighted scale data stored in the scale data memory. Desired scale data are automatically generated by the linear combination where appropriate. Such linear combination may be easily performed once the names of the scales involved and coefficients of respective scales have been determined. Suppose SCLij as the weight of the j-th note on the i-th note scale. Then, the combined scale data SCLi New is readily given by SCLi, NEW$=\Sigma$ajSCLij (where aj is coefficient).

THRESHOLD

In the second embodiment, the threshold value used in the pitch test is generated by the melody control information generation means. The pitch determination means compares the weight assigned to a pitch candidate and supplied from the note scale generation means with the threshold value, and adoptes the candidate as a melody note if the specific condition is satisfied (in the second embodiment, if the weight of the candidate is heavier than the threshold value).

When the condition of effective pitch is given by weight of candidate$\geqq$threshold value, the effect of the threshold value on the candidate is as follows. Suppose that the note scale supplied from the note scale generation means has only two different weights. In this case, if the threshold is heavier than both of the weights, no effective pitch will generate. If the threshold is between the two weights, the pitch heavier than the threshold is treated as a valid note and the pitch lighter than the threshold is treated as an invalid note. When the threshold value is smaller than both of the weights, any pitch on the note scale is treated as effective: chromatic music will result. The effect of threshold value will be similarly understood even when the note scale has three or more different weights.

In the second embodiment, those scale notes that are chord members at the same time are raised to heavier weights. Thus, if the threshold is given by:

weight of scale note < threshold < weight of note that is a scale note and a chord member then, the automatic composer of the second embodiment turns to be an apparatus for generating arpeggio tones.

The note scale generation means in the second embodiment does not include means for introducing variations or pertubations. Such variation means can be easily implemented, however. This will cause some pitches to be effective with chance. For example, for each element in the note scale data array {SCLi}, variation (raising component, for example) controlled by the value of element is introduced by random number generation In the alternative, for those elements that are close to the threshold value, relatively small value generated at random is added. Such controlled variation introducing means defines pitches that are always effective, pitches that are sometimes effective and pitches that never becomes effective.

This will enrich possible note scales in a different manner from the linear combination means.

As previously mentioned, note scale data may be user-programmable. Also, the threshold value may be freely set by the input device if desired.

RHYTHM

In the second embodiment, rhythm is controlled by the following means. The first means is the extraction and injection of mini-pattern and the second is the joining and disjoining tone durations using a pulse scale.

Specifically, in the analysis of motif, from the motif including nonharmonic tones, a characteristic mini-rhythm pattern dominant in the motif is extracted and in the last process of melody generation, characteristic mini-rhythm patterns are incorporated in the sequence of melody tone durations based on the extraction. On the other hand, tone duration joining/disjoining means by the pulse scale is used as means for forming motif arpeggio tone pattern (the sequence of durations of motif arpeggio tones) divested of nonharmonic tones from the motif and is also used as means for forming melody arpeggio tone pattern (the sequence of durations of melody tones consisting of only arpeggio tones).

The mini-pattern means provides direct control of rhythm and mini-patterns have a superficial similarity to "words" in natural languages. The pulse scale means is more indirect approach than the mini-pattern means.

The second embodiment employs an approach to use "arpeggio tones" as fundamentals of melody for analysis and synthesis of the sequence of tone duration so that the tone duration joining/disjoining means using the pulse scale works effectively to extract the arpeggio tones (of the motif) and generate the arpeggio tones (of the melody). The pulse scale means and the mini-pattern means cooperate to finely adjust or control the rhythm or the sequence of tone durations.

This does not necessarily mean that both of the means are indispensable, however. In accordance with the present invention, the mini-pattern means for itself, or the pulse scale means for itself can work as rhythm control means. It should not be interpreted that the pulse scale means is useful for arpeggio tones only. Each of the pulse scale means and the mini-pattern means is useful irrespective of arpeggio tones. The relationship between the pulse scale means and arpeggio tones is that the pulse scale means is one of the effective means for forming the sequence of durations of arpeggio tones and accordingly other mean could be used to form the sequence of durations of arpeggio tones. In other words, the pulse scale means which is useful to form the sequence of durations of arpeggio tones may also be utilized to form the sequence of durations of other tones such as melody tones in general. The embodiments thereof will be described later.

JOINING/DISJOINING NOTES REFERENCING TABLE

The second embodiment utilizes a pulse scale of pulse points having weights for joining and disjoining notes. The pulse scale is built in the program, however (see FIGS. 50 and 51).

A modified pulse scale generation means includes a table (memory) which stores pulse scale data. This arrangement using pulse scale table has an advantage that by providing data of various pulse scales and supplying the selected pulse scale to the note joining and disjoining means, it can modify the sequence of tone durations in various ways even if the rule involved in the note joining and disjoining means is invariable. In other words, the arrangement eliminates the need for complicated rules involving various pulse scales.

Tone duration joining and disjoining means referencing table will now be described in detail.

Figure 85:
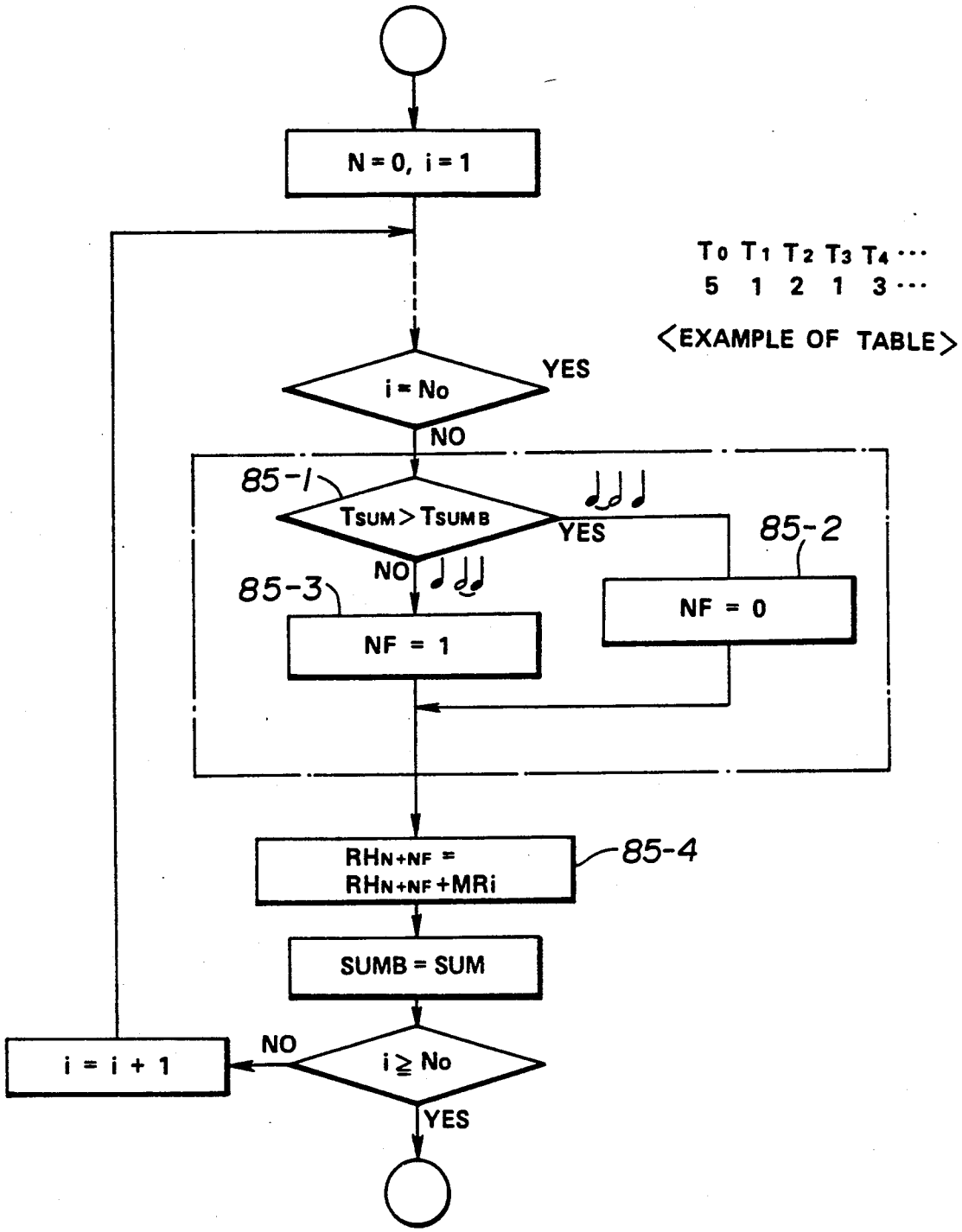
FIG. 85 is a flowchart illustrating extraction of pattern of durations of harmonic tones, referencing a table of pulse scale.

FIG. 85 illustrates a flow of extraction of motif arpeggio pattern by referencing table. Those portions not shown are identical with corresponding portions in the flow in FIG. 50.

TSUMB at 85-1 indicates the weight of the starting point (SUMB) of the tone of interest, and is the SUMB-th data item stored in the pulse scale table {Ti}. TSUM is the weight of the starting point (SUM) of the next tone on the pulse scale {Ti}. Hence, the process 85-1 to 85-4 does the following.

(i) If the weight of the next note's starting point is heavier than the current note's starting point, the current note's duration MRi is added to its previous note's duration RHN.

(ii) If the weight of the current note's starting point is heavier, the current note's duration MRi is added to the next note's duration RHN+1: in the case of the same weight, the current note's duration is absorbed into the next note's duration.

Accordingly, if the table is the pulse scale as shown in the upper righthand in FIG. 85 which is identical with the pulse scale shown in FIG. 51, then the result of extraction of duration pattern of harmonic tones by executing the flow in FIG. 85 will be identical with that by executing the flow in FIG. 50. It should be noted that the flow in FIG. 50 can use no more than a single pulse scale in the weight order of (T0>T8>T4=T12>T2...=T14>T1=...=T15), as illustrated in FIG. 51, whereas the flow in FIG. 85 can use any pulse scale to extract a tone duration pattern: depending on the type of pulse scale, the result will vary in various ways.

Figure 86:
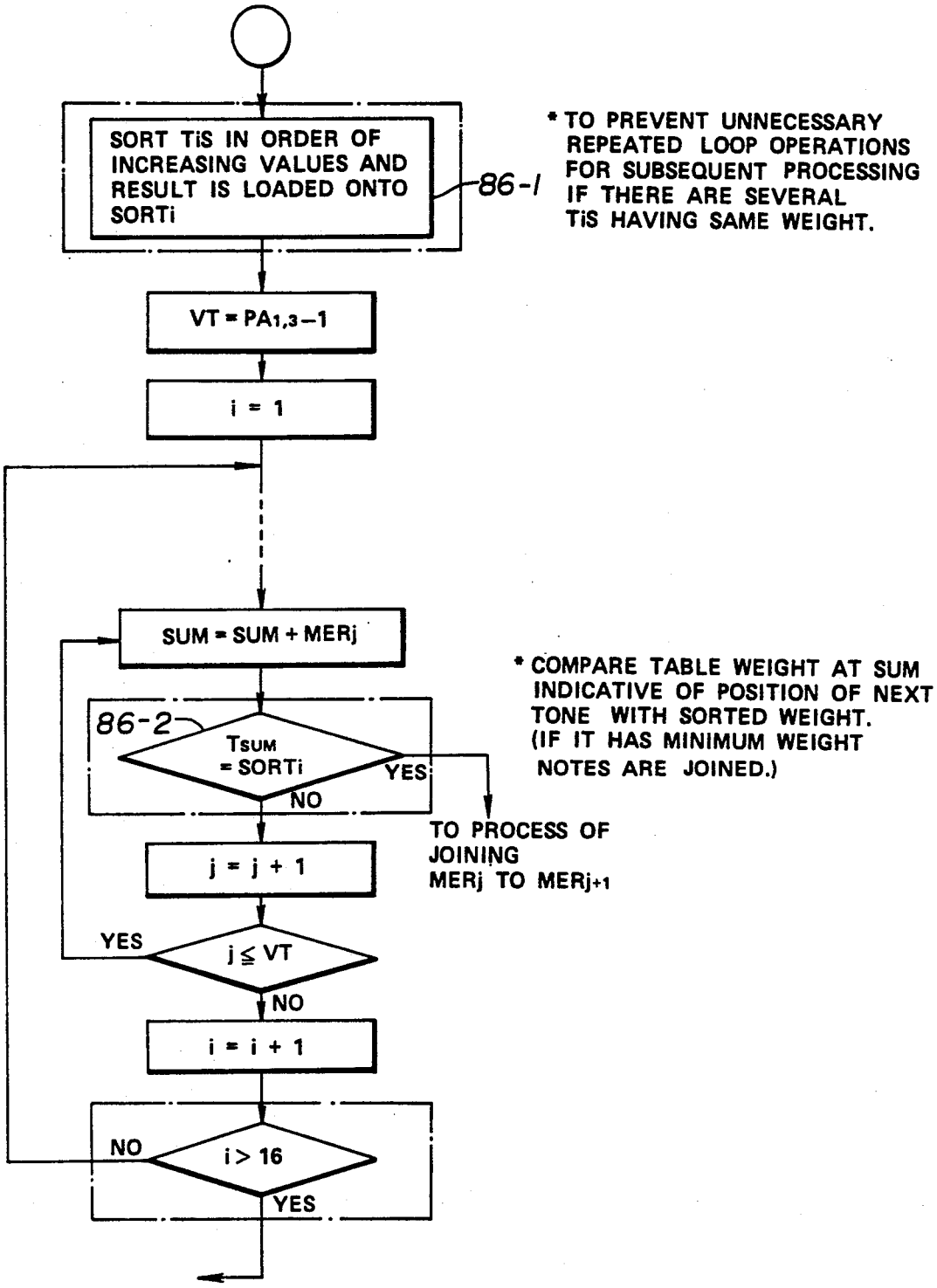
FIG. 86 is a flowchart illustrating optimal joining of tone durations referencing the table.

FIG. 86 is a modification of FIG. 72, illustrating a flow of optimal note joining, referencing table. To speed up subsequent processing, sort T1 to T16 in the order with the least value in the front and set the result in SORTi at step 86-1. At 86-2, compare the pulse scale weight of the next note's starting position SUM with the weight indicated in SORTi. At the beginning, SORTi is SORT1 which is the lightest weight in the pulse scale. Thus, those notes (MERj+1) which starts at the point having the lightest weight are preferentially joined to their preceding notes (MERj). Thereafter, the next lightest notes are joined.

Figure 87:
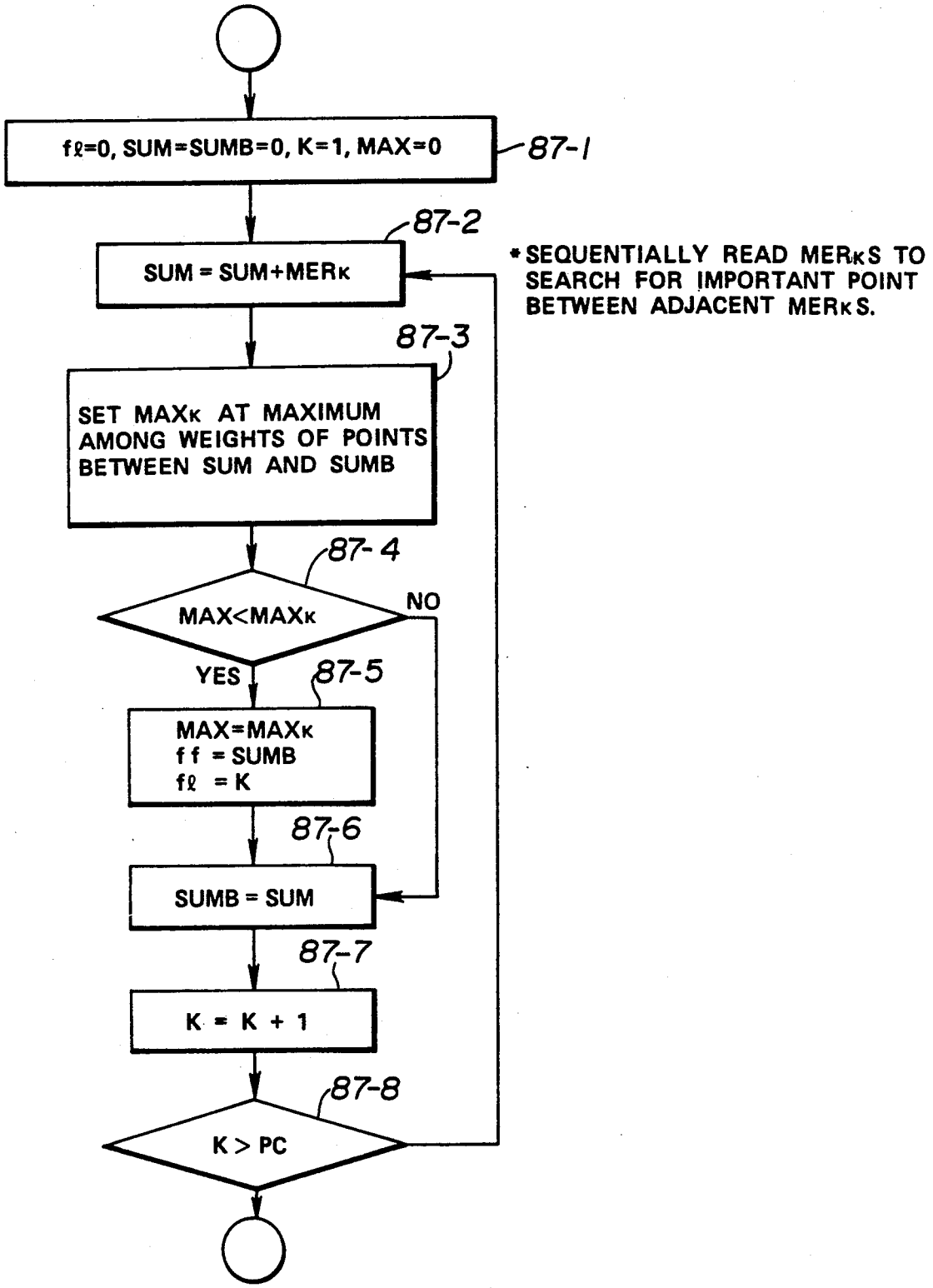
FIG. 87 is a flowchart illustrating the details of check in FIG. 88.
Figure 88:
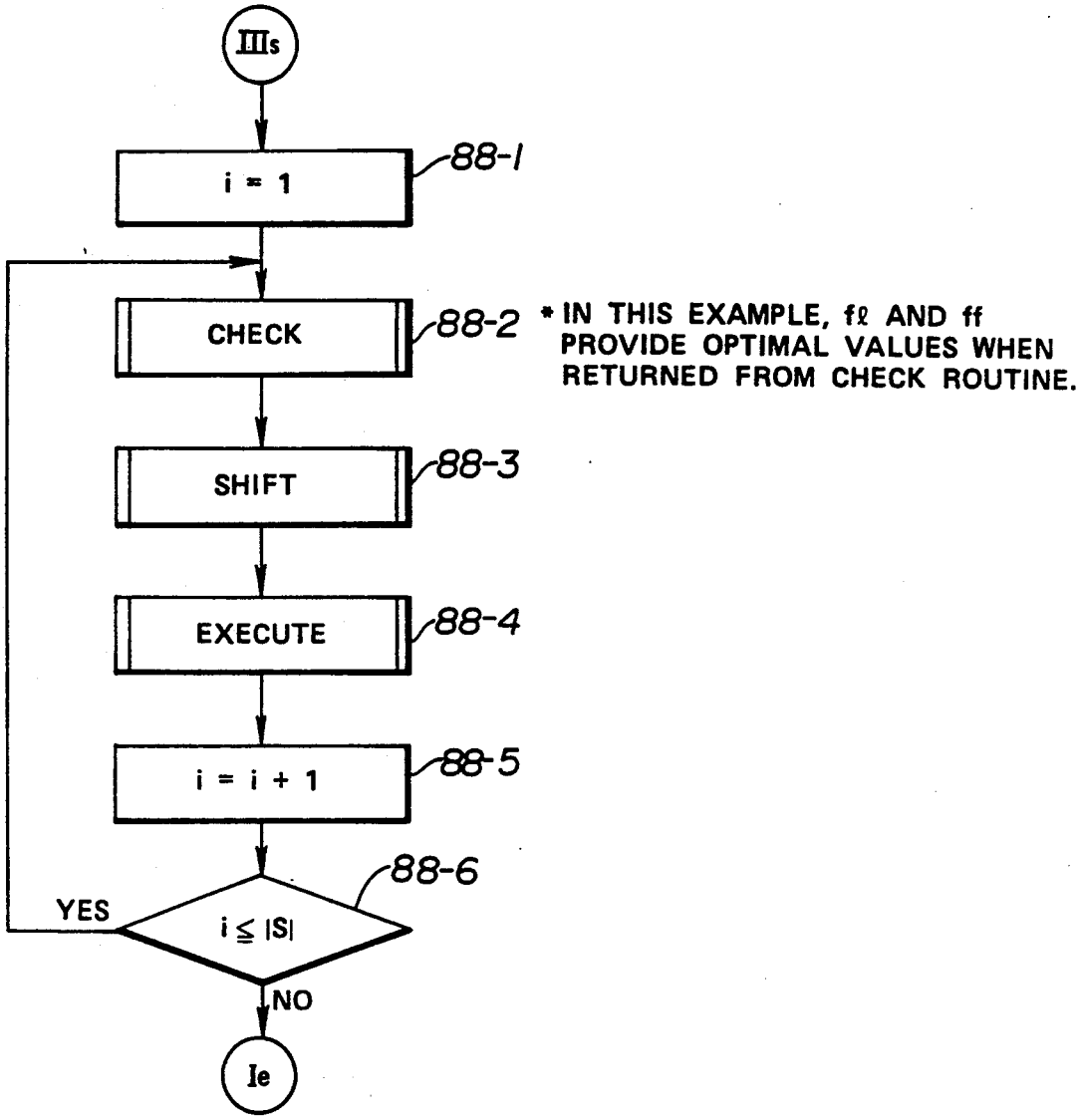
FIG. 88 is a flowchart illustrating optimal disjoining of tone durations referencing the table.

FIGS. 87 and 88 illustrate a flow of disjoining tone durations referencing table. The flow in FIG. 87 shows details of check 88-2 in FIG. 88. The flow in FIG. 88 may be substituted for FIG. 73 in the second embodiment. The details of shift 88-3 and execute 88-3 in FIG. 88 are shown in FIG. 75 and FIG. 76, respectively.

In FIG. 87, SUM is the next note's starting point (the current note's finishing point) and SUMB is the current note's starting point. At 87-3, search is performed of the maximum weight among those pulse points that are crossed by the current note. When the loop process of 87-2 to 87-8 continues until K>PC (all the notes have been checked), then, a flag ff is set at the start point of the note which crosses the maximally weighted pulse point among all the notes, a flag fl is set at the number of that note, and a register MAX stores the maximum weight.

In the execute process 88-4 in FIG. 88, the note found in the check 88-2 is disjoining into two note durations with the maximally weighted point as their boundary. When the number of notes has reached the goal number, i>|S| is satisfied, completing the disjoining process.

Figure 89:
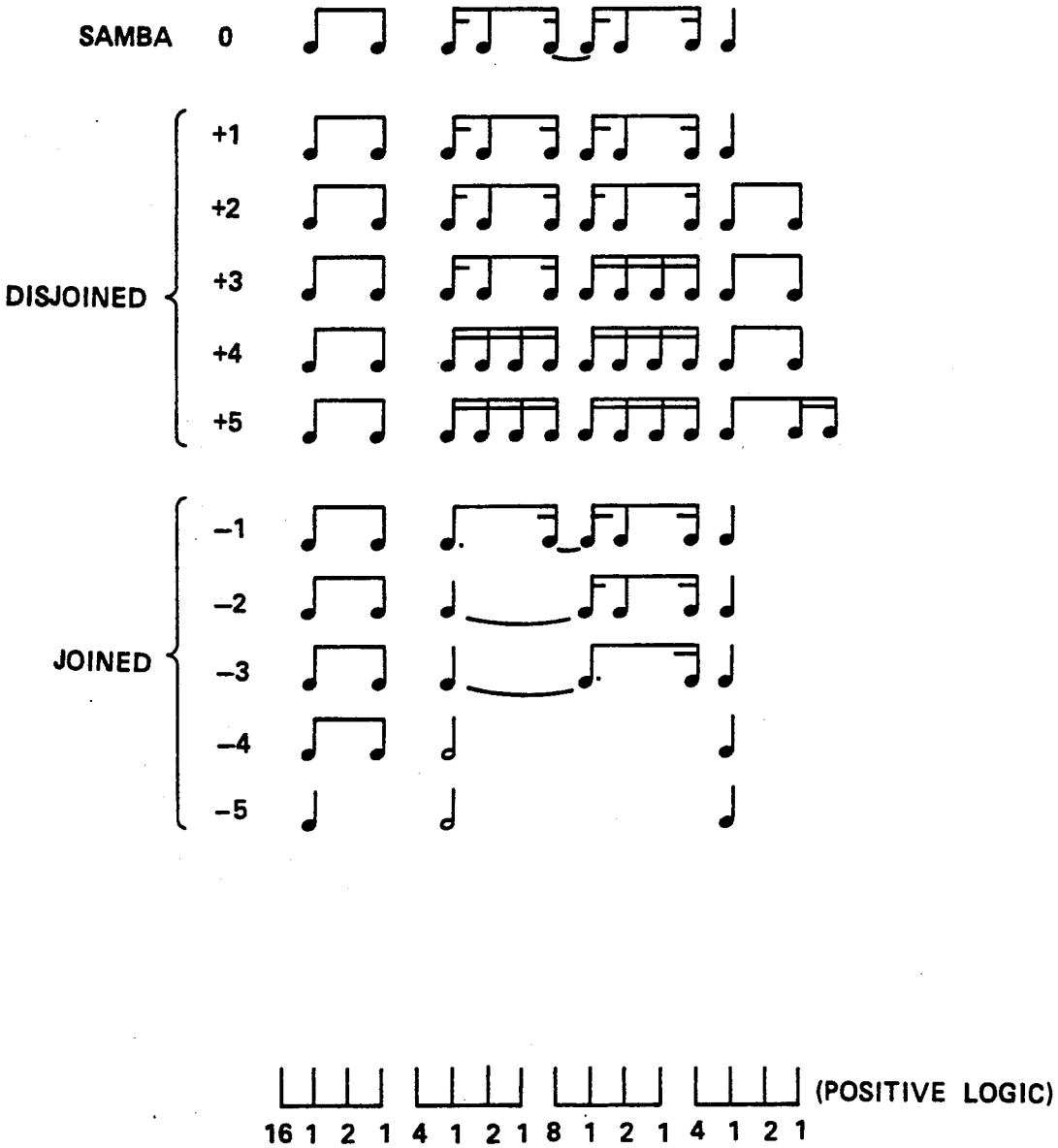
FIG. 89 shows a positive logic (normal) pulse scale and an example of note disjoining and joining by means of the positive logic pulse scale.
Figure 90:
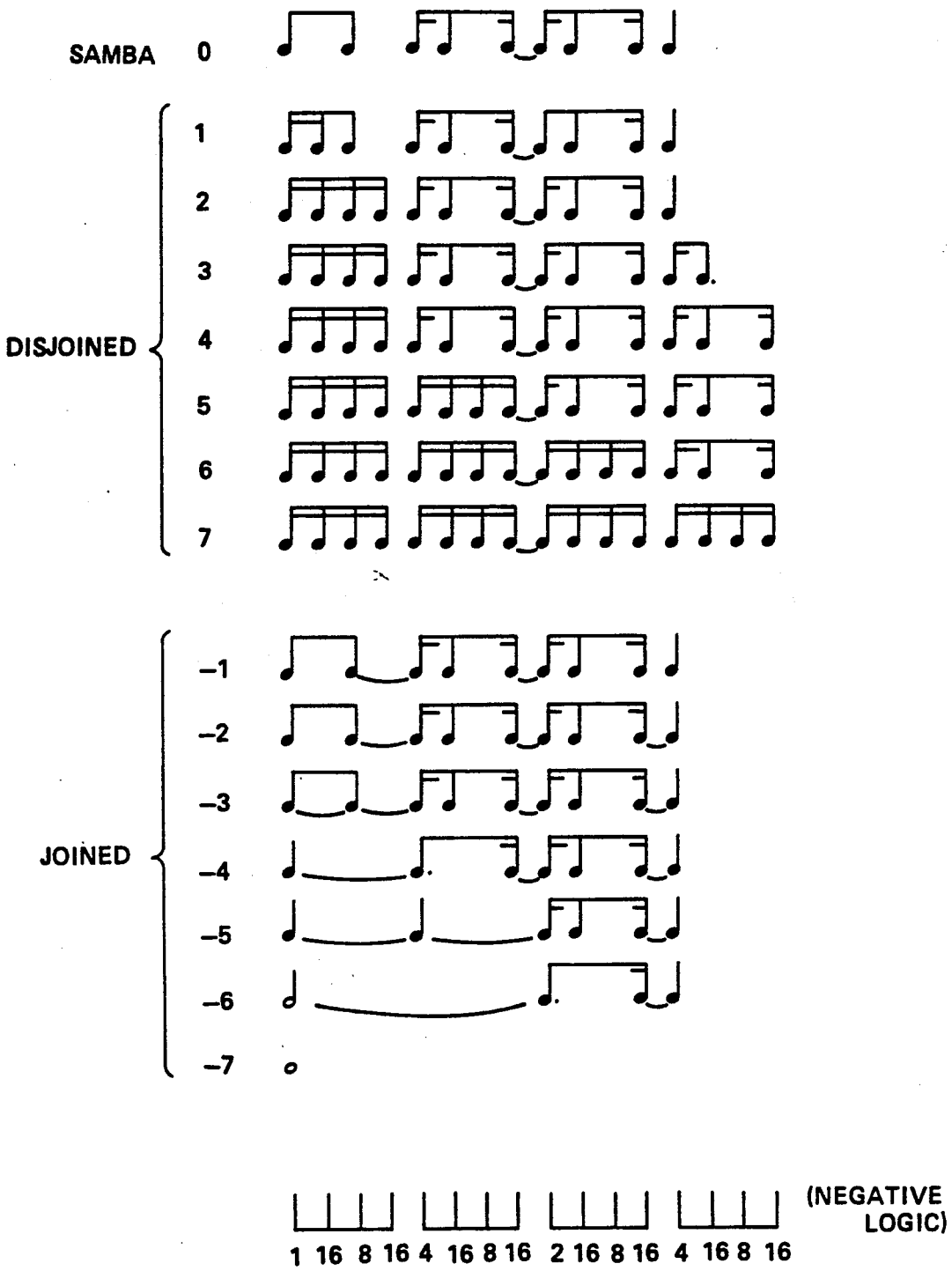
FIG. 90 shows a negative logic pulse scale and an example of not disjoining and joining by means of the negative logic pulse scale.

Examples of the result of the table referenced joining and disjoining notes are shown in FIGS. 89 and 90. In either case, the original tone duration pattern is given by:

In FIG. 89, a pulse scale as shown (referred to as a positive logic pulse scale, hereinafter) was used to join and disjoin notes. In FIG. 90, a pulse scale opposite or complementary to the one shown in FIG. 89 (referred to as a negative logic pulse scale) was used for joining and disjoining.

POSITIVE LOGIC, NEGATIVE LOGIC, EVALUATION VALUE

Express a pulse scale by {Ti} where i=0, 1, . . . 15. Thus, Ti is the weight of the i-th point on the pulse scale. Express a rhythm pattern by {Ri}. Ri is either 0 or 1. Ri=1 indicates that there is a note which starts at the i-th point. Ri=0 indicates that no note starts at the i-th point. Hence, the number of the notes N contained in the rhythm pattern is given by:

$$N = \sum_{i=0}^{15} Ri$$

Now suppose a function (evaluation value) given by:

$$V = \frac{1}{N} \sum_{i=0}^{15} (Ri \times Ti)$$

Now review the logic of the above mentioned note joining and disjoining by reference to this function.

The principal rule of the note disjoining means says that among the given notes, the note which crosses the point of the maximum weight is disjoined into two notes with that point as their boundary. Thus, the difference between the evaluation value before disjoining V(BD) and the evaluation value after disjoining V(AD) relates to the above "maximum" weight. Therefore, the logic of the note disjoining causes the function V to change (increase) maximally by disjoining note.

On the other hand, the principal rule of the above note joining means says that among the given notes, the note which begins at the pulse point of the minimum weight is joined to its preceding note using that pulse point as the junction. Thus, the difference between the evaluation value before the joining V(BT) and the evaluation value after the joining V(AT relates to the above "minimum" value.

The above two principal rules are referred to as "positive logic" rules or simply as "positive logic."

"Positive logic" in this context is a rule which is not violated by a weight pattern representing a pulse scale involved. However, a pulse scale and its opposite or complementary pulse yields, when the rule is executed, results of opposite nature with each other. Pulse scales complementary to each other means that the point of the maximum weight in the one of the scales corresponds to the point of the minimum weight in the other scale. For example, the pulse scale shown in FIG. 89 is complementary to the pulse scale shown in FIG. 90.

When notes in the rhythm pattern are to be disjoined by the positive logic rule using the pulse scale shown in FIG. 89, the point of the "maximum" weight in the pulse scale crossed by a note in the rhythm pattern will become the boundary where that note is disjoined. When the positive logic rule of note joining, using the same pulse scale is applied to the rhythm pattern, it pays attention to the note in the rhythm pattern that crosses the point of the "minimum" weight in the pulse scale and adopts the point of the minimum weight as the junction where that note is joined. On the other hand, when the rule uses the pulse scale shown in FIG. 90 which is complementary to the one shown in FIG. 89, the point of the "minimum" weight in the "FIG. 89" pulse scale and crossed by a note in the rhythm pattern will become the note boundary, and the point of the "maximum" weight in the "FIG. 89" pulse scale will become the note junction. Thus, even if the same rule is applied, complementary pulse pulse scales yield opposite results with each other. Accordingly, the pulse scale shown in FIG. 89 is named a "positive logic" scale whereas the pulse scale shown in FIG. 90 is called a "negative logic" scale.

Instead of "positive logic", the tone duration disjoining means may adopt "negative logic" rule. In another arrangement, the means selects "positive logic" rule at one time and selects "negative logic" rule at another time.

According to "negative logic" rule, in the case of disjoining note, the point having the "minimum" weight in the pulse scale and crossed by a note in the rhythm pattern becomes the note boundary. Hence, the variation (increase) in the evaluation value V is minimized. In the case of joining notes, the starting point of a note which is assigned the "maximum" weight in the pulse scale becomes the note junction. Therefore, the variation (decrease) in the evaluation value is maximized.

In summary, all possible combinations of logics applied to disjoining and joining notes are as follows:

(i) adopt positive logic for both of disjoining and joining;

(ii) adopt positive logic for disjoining and adopt negative logic for joining,
(iii) adopt negative logic for disjoining and adopt positive logic for joining, and
(iv) adopt negative logic for both of disjoining and joining.

These combinations of logics will be further described later from another aspect.

SYNTHESIS AND ANALYSIS OF PULSE SCALE

A pulse scale has properties that it is synthesizable from a plurality of pulse scales and conversely it is analyzable into a plurality of more primitive pulse scales.

FIG. 91(A)–91(G) show examples of rhythm patterns and essence of several rhythms. FIG. 91(A) is an example of samba rhythm which may be played by three instruments (or four including the one for the rhythm part marked inside the parenthesis). At the bottom in FIG. 91(A), there is shown a pattern derived from the addition of the number of instruments played at the same time. This pattern is expressed by:

| | | | |
|---|---|---|---|
| 2122 | 3212 | 1213 | 3111 |

Larger numbers also indicate when higher sound pressures generate. This numeric pattern may be used as a pulse scale. The present pattern may also be regarded as a numeric representation of samba-like polyphonic rhythm. FIG. 91(B) shows an example of sixteen beats. The corresponding numeric representation (resulting from the addition) is given by:

| | | | |
|---|---|---|---|
| 3010 | 4010 | 3111 | 4020 |

FIGS. 91(C)–91(G) show examples of monophonic rhythms or essence: they represent purified rhythm. It is noted that the polyphonic rhythm of sixteen beats has the flavors of four-four time, rock and eight beats. In other words, a linear combination of rhythm essence patterns such as shown in FIGS. 91(C)–91(F) forms a pattern which strongly resembles to the one numerically representing the sixteen beats shown in FIGS. 91(B).

In a sense, a pulse scale given by a pattern having three or more different weights represents a polyphonic rhythm. As is clarified in the above example, existing polyphonic rhythms are a combination of more primitive monophonic rhythms: they are formed by the play of several instruments. Suppose that monophonic rhythm is represented by a pattern or pulse scale containing weights of 1 and 0. Then, patterns characterizing existing polyphonic rhythms may be developed from linear combination of a plurality of such pulse scales.

Further those pulse scales that characterize novel polyphonic rhythms may be similarly formed. For example, the rhythm pattern of the second part of samba (A):

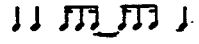

is expressed by a pulse scale:

| | | | |
|---|---|---|---|
| 1010 | 1101 | 0101 | 1000 |

The essence of rock is shown by a pulse scale:

| | | | |
|---|---|---|---|
| 0000 | 1000 | 0000 | 1000 |

If the above two pulse scales are linearly combined, this will result in a pulse scale characterizing a samba-rock polyphonic rhythm.

In an arrangement, there is provided a memory which stores a set of pulse scales Tij. Pulse scale synthesizing means is operable to use data of two or more pulse scales stored in the memory to compute a synthesized pulse scale by linear combination:

$$Ti\ (\text{synthesized}) = \Sigma aj \times Tij$$

where aj is a coefficient.

This arrangement can develop a vast number of pulse scales from a limited number of pulse scales. To conserve storage locations as much as possible, a set of independent pulse scales tij each consisting of only weights of 1s or 0s is preferably stored in the memory.

DEPENDENCE OF PULSE SCALE ON PROGRESSION OF MUSIC

When music enters into certain segments such as fill-in, development and four bar variation, the rhythmic characteristic of melody usually changes. To this end, the pulse scale may be variable depending on the progression of music. For example, the parameter C computation means plans or selects the pulse scale involved. Another means may be also provided which introduces very small variations or fluctuations into the pulse scale. For example, in order to obtain rhythm (sequence of tone durations) which varies from the one in a measure:

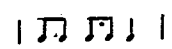

to the other in the next measure:

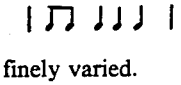

the pulse scale is finely varied.

MOTIF EVALUATION & MELODY GENERATION BY PS

Suppose a motif is given. As stated, a motif is represented by a sequence of tone durations and a sequence of tone pitches in the illustrated embodiment.

Using a pulse scale as previously mentioned, it is possible to evaluate data of the sequence of tone durations {MRi} or data indicative of starting points of respective tone durations {Ri}. While several evaluation functions may be adopted, consider here the following function for the sake of discussion:

$$V = \frac{1}{N} \sum_{i=0}^{15} (Ri \times Ti)$$

where {Ti} is a pulse scale having three or more different weights, Ti is the weight of the i-th pulse point and N is the number of motif notes.

Also suppose that the pulse scale {Ti} is a numeric representation of a particular polyphonic rhythm. What music does the user who has input the motif expect to follow ? This is a puzzle and will be discussed later.

The evaluation value of motif V can be computed using a pulse scale {Ti}. The evaluation value depends on the sequence of motif tone durations and may be high on one occasion or low on another occasion.

In the assumption that the pulse scale {Ti} is a numeric representation of polyphonic rhythm, the fact that a high evaluation value V has been obtained indicates that most of the tones in the given motif rhythm patterns are likely to start at those points assigned heavier weights in the pulse scale applied. Thus, the rhythm pattern can be said to have the character or flavor of polyphonic rhythm elements (rock, eight beats for example). When a lower evaluation value V has been obtained, this indicates that the weakest character of the polyphonic rhythm elements is made cospicuous by most notes in the given rhythm pattern.

It is time to describe several logics or rules adopted alternatively by the note disjoining and joining means to form a rhythm pattern of melody, a sequence of tone durations.

The first approach is to adopt "positive" logic for both of disjoining and joining. That is, those points that cause the evaluation function, when a minimum number of disjoining has been performed, to increase by a maximum amount are selected as note boundaries and those points that cause the evaluation function, when a minimum number of joining has been performed, to decrease by a minimum amount are selected as note junctions. This approach serves to maintain the character of the polyphonic rhythm elements in the pulse scale.

In the second approach (negative logic approach), those points that cause the evaluation function V to increase by a minimum amount, when disjoining, are selected as note boundaries and when joining those points that cause the evaluation function to decrease by a maximum amount are selected as note junctions. This approach tends to create new features independent from the pulse scale.

In the third approach, for both of disjoining and joining, those points that cause the evaluation value to vary least are selected.

The fourth approach adopts the positive logic when the evaluation value is large, and adopts the negative logic when the evaluation value is small.

The first approach is useful for a user who aims at developing melody rhythm from the motif in accordance with the character of the polyphonic rhythm immanent in the pulse sale.

The second approach is suitable for a user who is conscious of the polyphonic rhythm, however aims at representing a different character in melody rhythm, apart from the polyphonic rhythm.

The third approach is suitable for a user who is not conscious of the polyphonic rhythm. This is because, if the character of the polyphonic rhythm not intended by the user were made conspicuous due to note disjoining or joining, this would be surely against the user's expectation.

The above approaches are useful for respective users.

However, the user's intention is not predictable from the user's motif only. To dissolve this, it is necessary for the automatic composer to interact with the user. While interaction may be implemented in several ways (for example, there is provided an input device by which the user may input his request such as the one for rock if rock patterns are desired), this is not the subject matter of the present invention and further description is omitted.

Nevertheless, there exists a pulse scale which best matches the rhythm of motif. It is believed that using such a best-fit pulse scale for the generation of the rhythm of melody is of great significance.

EVALUATION OF DEGREE OF SYNCOPATION

The subject to be discussed here is measurement of syncopation as an example of evaluation of the rhythm of motif. In general, syncopation is a shift of accent in a passage from its normal position. To measure the degree of syncopation, use a pulse scale of quadruple rhythm in which the first beat (T0) has the heaviest weight, the third beat (T8) has the next heaviest weight and each of the second and fourth beats (T4, T12) has the third heaviest weight. Further dividing each beat into equal four parts, the first part or pulse has the heaviest weight among the four parts, the third pulse has the next heaviest weight and each of the second and fourth pulses has the lightest weight: the weight pattern has a hierarchy structure. This kind of pulse scale is shown in the lower part in FIG. 92. To show again here:

| T0 | T1 | T2 | T3 | T4 | T5 | T6 | T7 | T8 | T9 | T10 | T11 | T12 | T13 | T14 | T15 |
|---|---|---|---|---|---|---|---|---|---|---|---|---|---|---|---|
| 5 | 1 | 2 | 1 | 3 | 1 | 2 | 1 | 4 | 1 | 2 | 1 | 3 | 1 | 2 | 1 |

Figure 92:
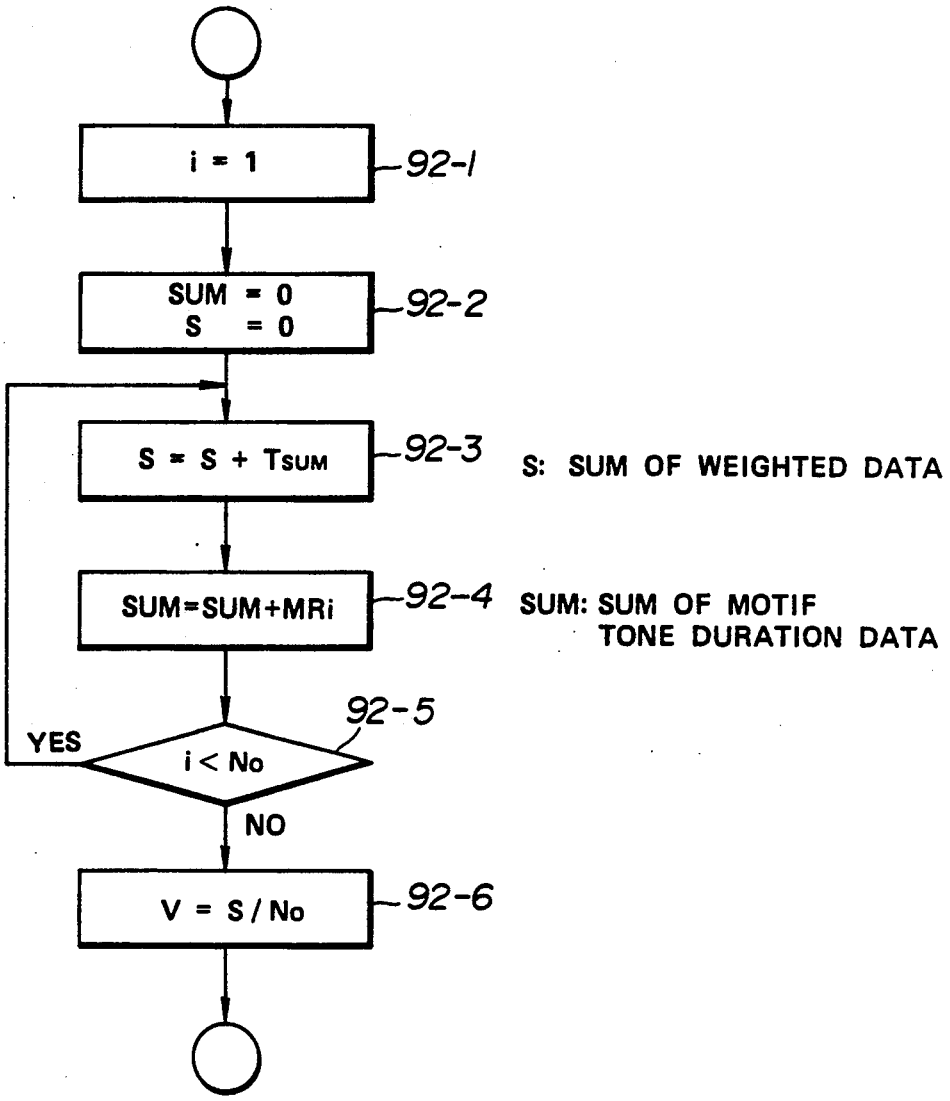
FIG. 92 is a flowchart of evaluation of a degree of syncopation using the positive logic pulse scale.

In the flow in FIG. 92, i is a note number and SUM indicates the starting position of the (i+1)-th note (accumulated tone durations of the first to the i-th tones in the measure) at the time of computation 92-4. When the process exits the loop at 92-5, S indicates accumulated weights with respect to the sequence of starting points of respective notes, or:

$$S=\Sigma TSUM$$

where SUM is in the range of SUM=0 to the last note's start point. Using Ri and Ti as stated, this yields:

$$S=\sum_{i=0}^{15}(Ri\times Ti)$$

Therefore, V computed at 92-6 is given by:

$$V=\frac{1}{N}\sum_{i=0}^{15}(Ri\times Ti)$$

where N is the number of notes. This is the same form with the above mentioned evaluation function. Here, V indicates the degree of syncopation for the rhythm of motif, the tone duration sequence {MRi}.

Figure 93:
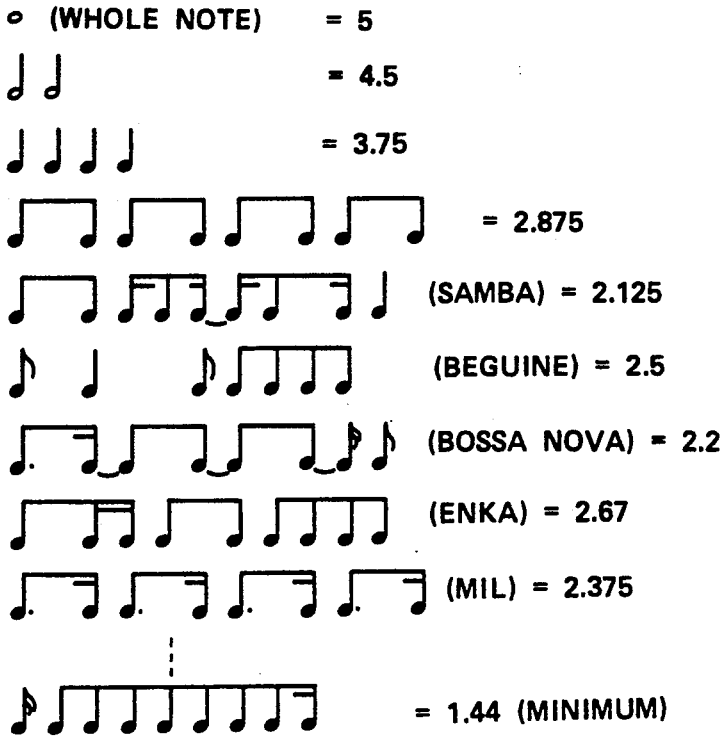
FIG. 93 illustrates evaluated degree of syncopations.

FIG. 93 shows syncopation values for various rhythm patterns, measured by the flow in FIG. 92 using the shown pulse scale.

GENERATION OF CONTROLLED TONE DURATION PATTERN

As stated, the rhythm of the given motif may be evaluated by using a pulse scale.

The subject discussed here is the technique to generate a controlled tone duration pattern (which may be used as a sequence of melody tone durations) based on the evaluated values of the rhythm of motif.

Evaluation function V varies in value with the sequence of tone durations to be examined. Hence, evaluation function V generally depends on the number of tones contained in the sequence of interest. Suppose that the value of the evaluation function V for the sequence of original (motif) tone durations having N tones is V(N). Consider the development from the original sequence for any number of tones n. Then, the evaluation function will form a curve passing a point of V(N). Such an evaluation curve may be obtained in several ways (for example, by computing, for all numbers of tones, the evaluation values of the sequences of tone durations developed by the note disjoining and joining means as stated).

Now generate a sequence of tone durations using random number generation means. Check whether the sequence of tone durations randomly generated well matches the evaluation curve. If passed the test, the sequence is selected as a sequence of melody tone durations or intermediate melody tone durations. In this manner, a sequence of tone durations controlled by the evaluation function is obtained.

Figure 94:
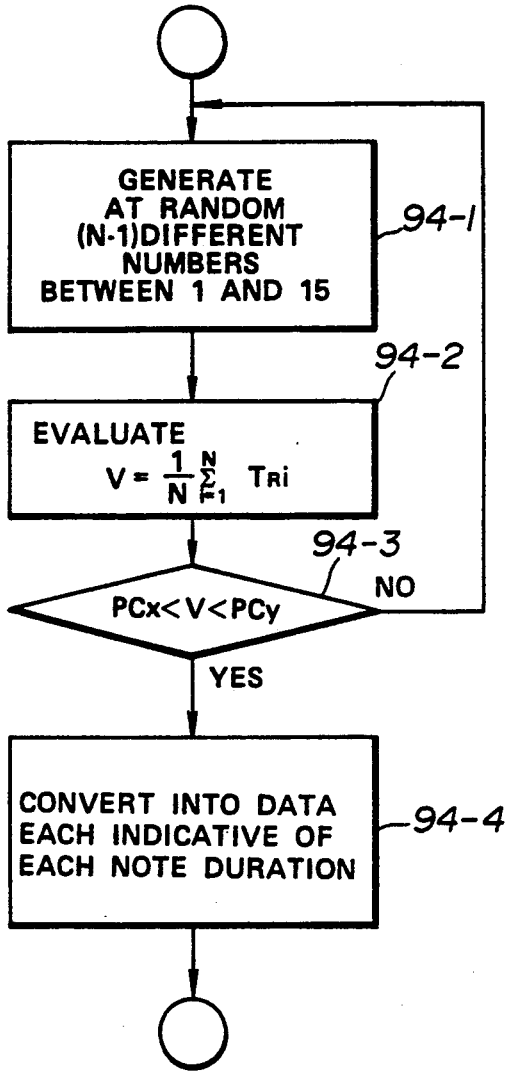
FIG. 94 is a flowchart of generation of a controlled pattern of tone durations.

FIG. 94 illustrates a flow of generating a controlled tone duration pattern. At 94-2, an evaluation function is computed:

$$V = \frac{1}{N} \sum_{i=0}^{15} TRi$$

where TRi is the Ri-th pulse point's weight. This is a mere example. Any matching function which measures the degree of similarity between a pulse scale {Ti} and a sequence of tone points {Ri} generated at random (and which function will be 1 in the best match case and will be 0 in the worst mismatch case) may be used. One such function is given by:

$$V = \frac{\left\{ \sum_{i=0}^{15} (Ri + Ti) \right\}^2}{\sum_{i=0}^{15} R1 \times \sum_{i=0}^{5} Ti}$$

Analyzing the pulse scale {Ti} into M number of constituent pulse scales {tij} each containing weights of 1s and 0s only and using these constituent pulse scales, another matching function is given by:

$$V = \frac{1}{M} \times \sum_{j=1}^{M} \frac{\left\{ \sum_{i=0}^{15} (tij \times Ri) \right\}^2}{\sum_{i=0}^{15} tij \times \sum_{i=0}^{15} Ri}$$

Figure 95:
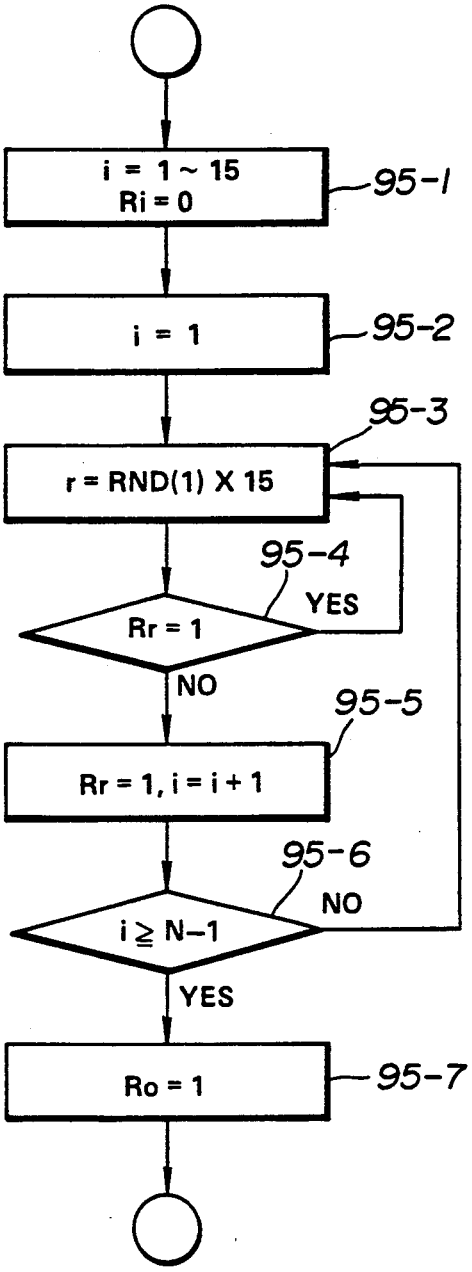
FIG. 95 is a flowchart illustrating the details of generation of random numbers in FIG. 94.
Figure 96:
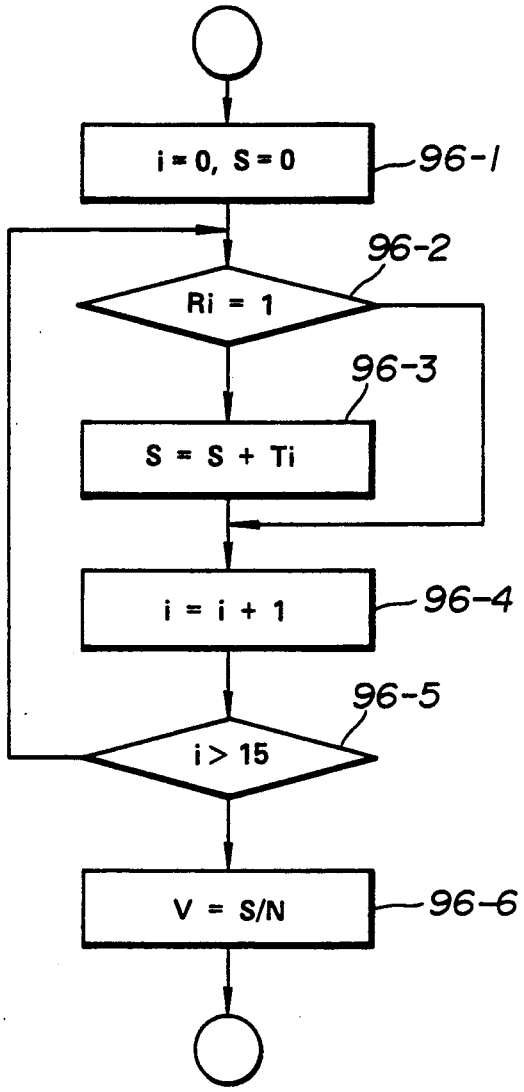
FIG. 96 is a flowchart illustrating the details of evaluation in FIG. 94.

The details of 94-1 in FIG. 94 are shown in FIG. 95. From FIG. 95, the operation is clear. In the operation, (N−1) different numbers in the range from 1 to 15 are generated at random as stated in FIG. 94. Each number indicates a tone emitting point. R0=1 at 95-7 indicates that there is a note starting at the beginning of measure: this is not a must, however. FIG. 96 shows the details of 94-2 in FIG. 94. No further description will be necessary. FIG. 97 shows the details of 94-4 in FIG. 94, the operation of which is evident from the illustration of the flow and the operation example (where MERi is the duration of the i-th note).

PCx and PCy at 94-3 in FIG. 94 are parameters which may be supplied from the melody control information generation means. PCx and PCy respectively indicates the upper limit and the lower limit of allowable evaluation values V. Those Ris that have passed the matching test 94-3 are converted into data of the sequence of melody tone durations at 94-4.

DERIVATION OF OPTIMAL PS MATCHING RHYTHM OF MOTIF

To derive or infer an optimal pulse scale which best fits the rhythm of motif is useful for the generation of melody following the motif.

Figure 99:
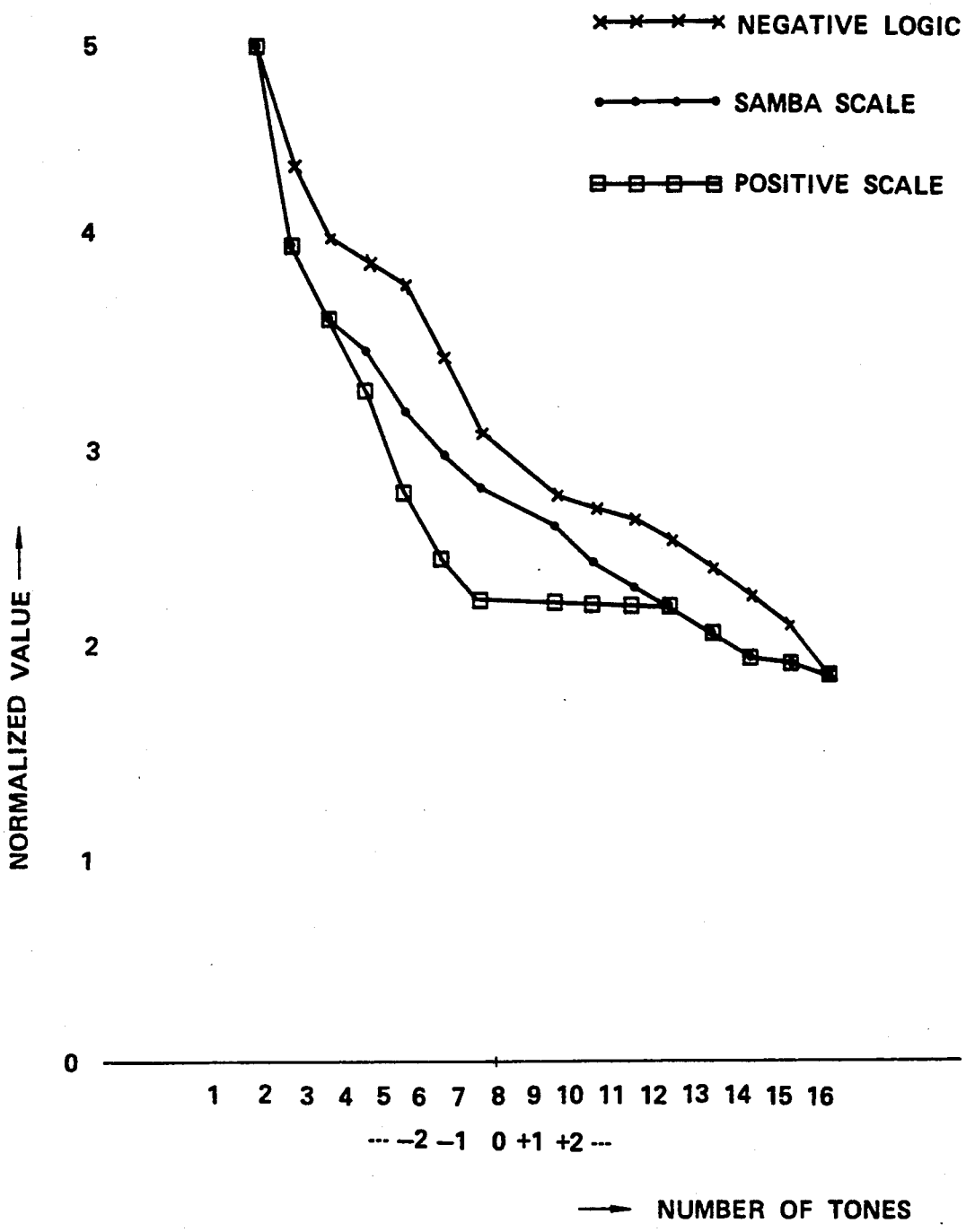
FIG. 99 is similar to FIG. 98 but illustrates normalized curves.

FIG. 98 shows examples of characteristics of evaluation curves of tone duration patterns developed from an initial, sambalike, pattern:

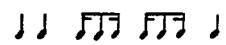

by disjoining and joining notes selectively using three different pulse scales i.e., a positive logic scale, a negative logic scale and a samba scale. In FIG. 99, these characteristic curves are normalized with their ends coinciding with one another. The applied evaluation function is given by:

$$V = \frac{1}{N} \sum_{i=0}^{15} Ri \times Ti$$

As is seen from FIG. 99, the curve using the samba scale is the smoothest: the computation of smoothness is omitted here. Thus, the conclusion is that the samba scale is the optimal pulse scale best matching the initial tone duration sequence:

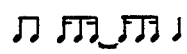

The next topic is the technique to find the pulse scale that gives the peak (maximum or minimum) evaluation value to the rhythm pattern of motif under examination for determination of optimal pulse scale.

As stated, in the assumption that a pulse scale is a numeric representation of a polyphonic rhythm, the pulse scale is formed by a linear combination of a plurality of simpler pulse scales (referred to as subpulse sales hereinafter). Then, each sub-pulse scale may be expressed by pattern data having values consisting of 1s and 0s without losing generalization (including all 1s' pattern but excluding all 0s' pattern).

Now suppose that there are provided a plurality of pulse scales, and apply a predetermined evaluation function (involving pulse scale data as its argument or variable) to the rhythm of a given motif or the sequence of tone durations. The calculated value of the evaluation function depends on the type of pulse scale and the rhythm pattern applied. For a particular rhythm pattern, the value of evaluation function using a particular pulse scale reaches its peak. For another particular rhythm pattern, the value of evaluation function using another particular pulse scale will reach its peak. There can be more than one pulse scale which provide the peak of evaluation function in some situations in which a great number of different pulse scales are tested or the character of the rhythm pattern similarly resides in more than one pulse scale. In such a case, each pulse scale that yields the peak is selected as the optimal pulse scale among the set of pulse scales tested.

To keep the discussion staright, take the peak as meaning the maximum only. And consider two different evaluation functions. The first one is given by:

$$V(\text{mean}) = \frac{1}{N} \times \sum_{j=1}^{N} \left[ \frac{\left\{ \sum_{i=0}^{15} (tij \times Ri) \right\}^2}{\sum_{j=0}^{15} tij \times \sum_{i=0}^{15} Ri} \right]$$

where {Ri} is a rhythm pattern (sequence of tone durations) represented by weights of 1s and 0s only and {tij} is the j-th sub-pulse scale. As stated, a pulse scale of polyphonic rhythm is represented by a linear combination of N number of sub-pulse scales. Thus, each element in the pulse scale {Ti} is given by:

$$Ti = \sum_{j=1}^{N} tij$$

The V (mean) is the average of evaluation values of the rhythm pattern Ri with respect to all constituent scales {tij} of the pulse scale Ti. The evaluation function V (mean) is in the range of 0 and 1. The values inside the square bracket [ ] also vary in the range between 0 and 1. "1" is obtained when the following is satisfied for all is:

$$tij = Ri$$

This is when the rhythm pattern {Ri} exactly matches the sub-pulse scale {tij} in respect of tone positions. In this sense, the function V (mean) defines a matching function.

The second evaluation function is given by:

$$V(\text{max}) = \underset{j=1 \text{ to } N}{\text{MAX}} \times \left[ \frac{\left\{ \sum_{i=0}^{15} (Tij \times Ri) \right\}^2}{\sum_{i=0}^{15} Tij \times \sum_{i=0}^{15} Ri} \right]$$

the V (max) is the maximum among values inside the square bracket [ ]. A particular sub-pulse scale among N sub-pulse scales determines the value of V (max).

In the following, the first evaluation function is also called "mean" whereas the second evaluation function is simply called "maximum."

FIG. 100 illustrates five different rhythm patterns (sequences of motif tone durations) to be evaluated. "SAMBA" is a pattern characterizing a samba music. "ENKA" is a pattern like enka (a kind of Japanese music). "NOW" is a pattern full of syncopations, recently popular. "4" is a pattern consisting of four quarter notes. "2" is a pattern consisting of two half notes.

FIG. 100 further illustrates four different pulse scales each of the form of linear combination of subpulse scales. The first pulse scale is a positive logic (normal) one comprised of five sub-pulse scales. The second is a negative logic pulse scale which is opposite to the first and is formed with five sub-pulse scales as shown. The third is a samba scale formed with four subpulse scales. The fourth is a 16 beat pulse scale synthesized from five sub-pulse scales as shown.

FIG. 101 shows results of evaluation. The five different sequences of motif tone durations in FIG. 100 have been evaluated as shown by the first evaluation function V (mean) (see the column of MEAN) and the second evaluation function V (max) (see the column of MAXIMUM), for each of the four pulse scales shown in FIG. 100.

These results indicate the following: First, each evaluation function gives similar evaluation. For example, for "SAMBA" motif, both of "mean" and "maximum" give the highest point to the samba scale. For "enka", another pulse scale has been given the highest point but that is the positive logic scale in both case of "mean" and "maximum." Second, the first evaluation function "mean" provides a higher selectivity. In other words, the second evaluation function gives rougher evaluation or wider association: this is affected by the composite characters of respective pulse scales. Most of existing polyphonic rhythms are formed by several rhythm patterns which are closely associated with one another.

Determining the pulse scale which is given the highest point, regarding it as an optimal pulse scale and based on the optimal pulse scale, and forming a rhythm pattern of melody (sequence of tone durations) are useful: this should not be interpreted in absolute sense, however. The most important thing is what pattern the user wishes as long as the goal is to satisfy the user's expectation. Thus, another approach is to allow the user to freely select a desired pulse scale. Still another approach is to compose music based on respective pulse scales and to allow the user to judge the composed pieces. Here again, the question of interaction between the automatic composer and the user comes out but it is out of place to discuss the details.

ASSOCIATION OF PS CONSIDERING SEQUENCE OF TONE PITCHES AS WELL

The rhythm of melody is not completely defined by its sequence of tone durations. Other elements such as the sequence tone pitches can affect the rhythm of music. In the described embodiments, for simplicity, melody or motif is represented by two components only. One is the data of the sequence of tone durations and the other is the data of the sequence of tone pitches. No further components are considered.

The subject here is an example of association of pulse scale considering the sequence of tone pitches as well as the sequence of tone durations.

First look at this pitch pattern

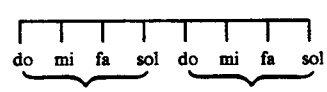

In this pattern, the positions of "dos" act to raise the weights of the corresponding points in a pulse scale. In a little more general, the regularity of the pitch pattern constrains a pitch pattern to come more or less. This is what a human often experiences. The contribution of the regularity in the present pitch pattern to the future pattern may be represented by raising the weight data in the pulse scale. That is, those points the weights of which are raised play a central role in note disjoining and joining such that the regularity of the present pattern is incorporated in the future pattern more or less. To put it another way, when a person hears a phrase, he is often able to predict the next phrase to some extent.

The following example is a technique to associate or devise a pulse scale by measuring periodical elements such as autocorrelation factors in tone duration pattern.

To devise a pulse scale:

(i) convert data of sequence of tone durations to that of the sequence of tone start points, then assign a weight of say 1 to the tone start points and assign zero weight to the other points to cleate a pulse scale, (ii) perform DFT (Discrete Fourier Transformation) of time sequence of tone pitches to obtain spectral series and add the $2^x$ harmonic components to the pulse scale.

Figure 102:
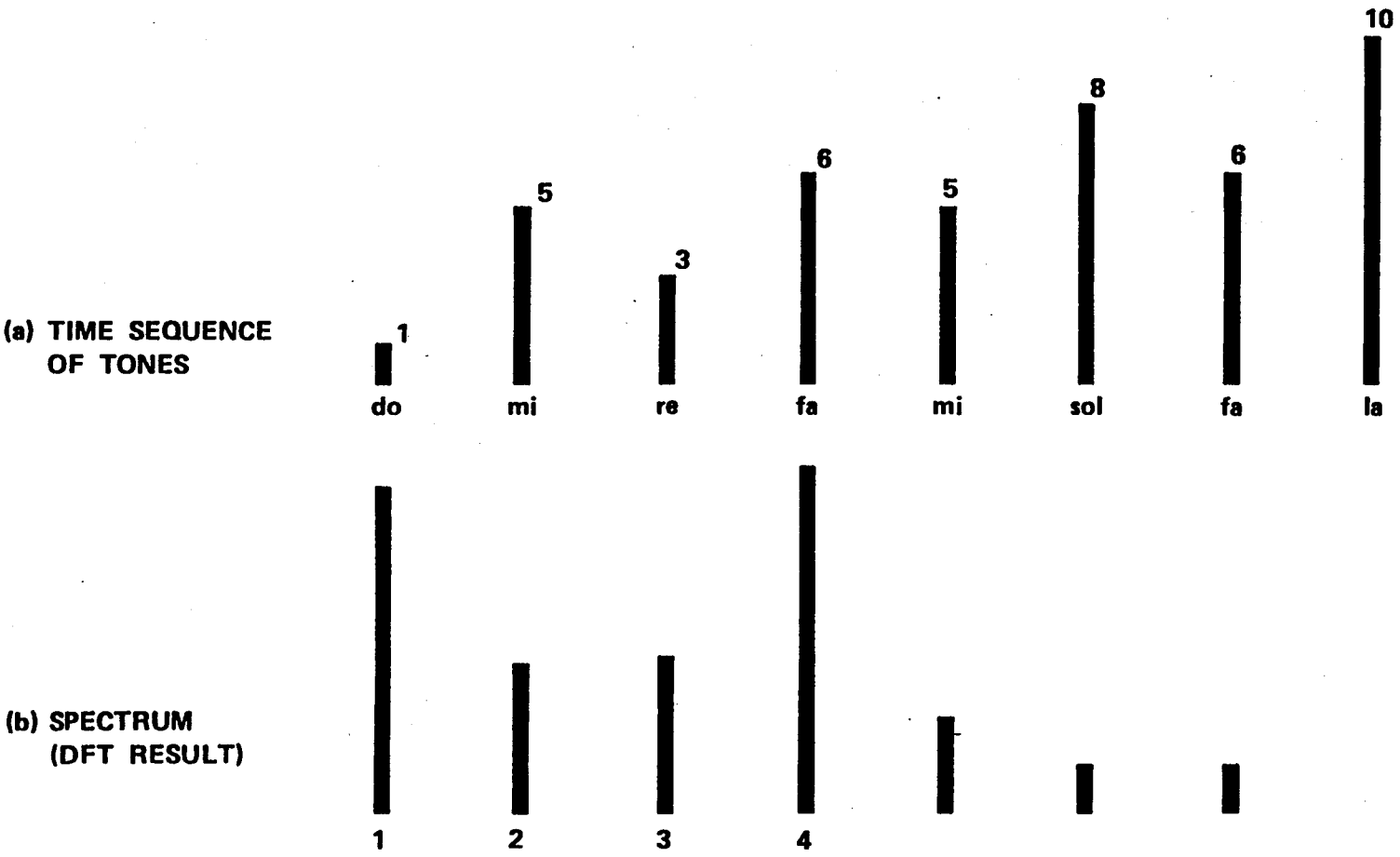
FIG. 102 illustrates a time sequence of tones and its spectrum.

Part (a) in FIG. 102 illustrates data of time sequence of tones for evaluation. This is a pitch pattern of do, mi, re, fa, mi, sol, fa, and la tones at eighth note intervals: the successive eight tones form one measure. DFT result of this pattern is shown in part (b) in FIG. 102. "1" in part (b) indicates the amplitude (by the height of the line) of fundamental frequency component with a cycle of one measure, "2" is the amplitude of second harmonic component with a cycle of half measure and "4" is the amplitude of fourth harmonic component. The ratio of amplitudes of the fundamental to the second and to the fourth harmonic is approximately 1:0.5:1. The position of the do concides with all the positions of the fundamental, the second and the third harmonics. The position of the re and the second occurrence of the fa concides with the position of the fourth harmonics. The position of the second occurrence of the mi is in phase with both of the second harmonic position and the fourth harmonic position.

In accordance with one scheme of raising weights, the weight of the position of the do, is measured by addition of 1 from the rhythm data, 1 contributed by the fundamental, 0.5 by the second harmonic and 1 by the fourth harmonic, totaling 3.5. Similarly, the weight of the pulse point of the re is given 2, the weight of the point of the latter mi is assigned 2.5 and the weight of the point of the latter fa is given 2. Thus, the final pulse scale {Ti} is formed by:

| T0 | T1 | T2 | T3 | T4 | T5 | T6 | T7 | T8 | T9 | T10 | T11 | T12 | T13 | T14 | T15 |
|---|---|---|---|---|---|---|---|---|---|---|---|---|---|---|---|
| 3.5 | | 1 | | 2 | | 2 | | 2.5 | | 1 | | 2 | | 1 | |
| | 0 | | 0 | | 0 | | 0 | | 0 | | 0 | | 0 | | 0 |

The weights measured from the rhythm data of arpeggio tones may be further added to the pulse scale, if desired.

From the foregoing, the pulse scale may be also viewed as a pattern having weights raised by the regularity in the time sequence of tones. That is, the likelifood of tones reccuring at the corresponding points in successive measures is represented by raised weights in pulse scale.

AUTOMATIC COMPOSER OF CHORD INPUT TYPE

In the environment in which chord(s) for the motif is provided by the user, the means for distinguishing nonharmonic tones contained in the motif from harmonic tones and for classifying the nonharmonic tones into respective types can be made in simpler form than that previously described.

An embodiment of such means will now be described.

Extraction of Nonharmonic Tones

Figure 103:
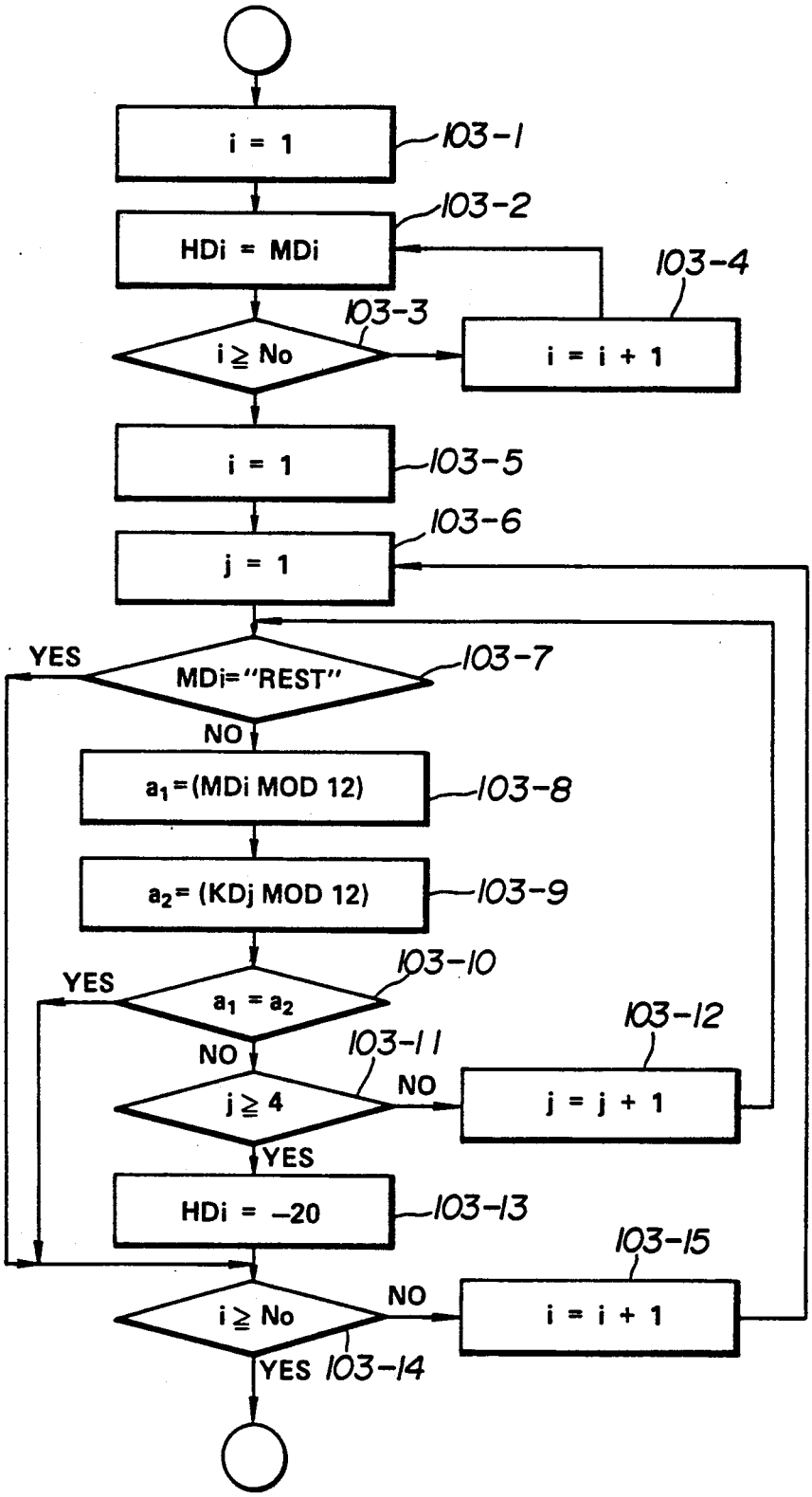
FIG. 103 is a flowchart of extraction of nonharmonic tones in accordance with a still further embodiment of the present invention.

FIG. 103 illustrates a flowchart of extracting nonharmonic tones in the motif. The basic logic says that any note in the motif which is not any of the chord members is a nonharmonic tone: any note in the motif which agrees with a chord member is a harmonic tone.

More specifically, at 103-1 to 103-4, the sequence of pitches of motif data stored in the motif memory 106 (FIG. 37) is transferred to the {HDi} in the work memory 110. In the present example, each note in the motif is represented by a pair of pitch data and duration data. For a rest, the pitch data is assigned an unique value because rests do not involve the concept of pitch.

At 103-5 to 103-15, determination is made as to whether the i-th note in the array {HDi} is a harmonic or a nonharmonic tone. The result of the determination that the tone is a nonharmonic is recorded by writing a unique value (−20 in the Figure) into the corresponding HDi. J is a chord member number. For the purpose of description, the present embodiment considers those chords only which are formed of either four independent voices or three independent voices plus one which is an octave up or down from the one of the three independent voices. Correspondingly, the chord member memory 103 stores four data items of chord members. In the present flow, the pitch data of a chord member is indicated by KDj: the suffix j designates the jth lowest chord member.

As shown in 103-7, if the motif note of interest is a rest, the flow skips to the check of the next motif note because the rest is not a nonharmonic tone. The pitch name of the motif note and the pitch name of the chord member is computed at 103-8 and at 103-9, respectively for elimination of octave number. At 103-10, it is checked to see whether the pitch name of the motif note of interest matches the pitch name of the current chord member. If they match, the motif note is a harmonic tone and the flow goes to the check of the next motif note. If they mismatch, j is incremented at 103-12 and the process starting from 103-7 is repeated to compare the motif note with the next chord member. The occurrence of $j \geqq 4$ at 103-11 indicates that no chord members match the motif note of interest, thus meaning that motif note is a nonharmonic tone. Hence, the pitch data of the motif note HDi is replaced by an identification value of nonharmonic tone. No at 103-14 is the total number of motif notes. Hence when $i \geqq No$ is satisfied at 103-14, every motif note has been determined as to whether it is a nonharmonic tone, thus finishing the process of extracting nonharmonic tones.

CLASSIFICATION OF NONHARMONIC TONES

Using the extraction result of nonharmonic tones, nonharmonic tones are classified by pattern analysis of the sequence of motif tones.

Figure 104:
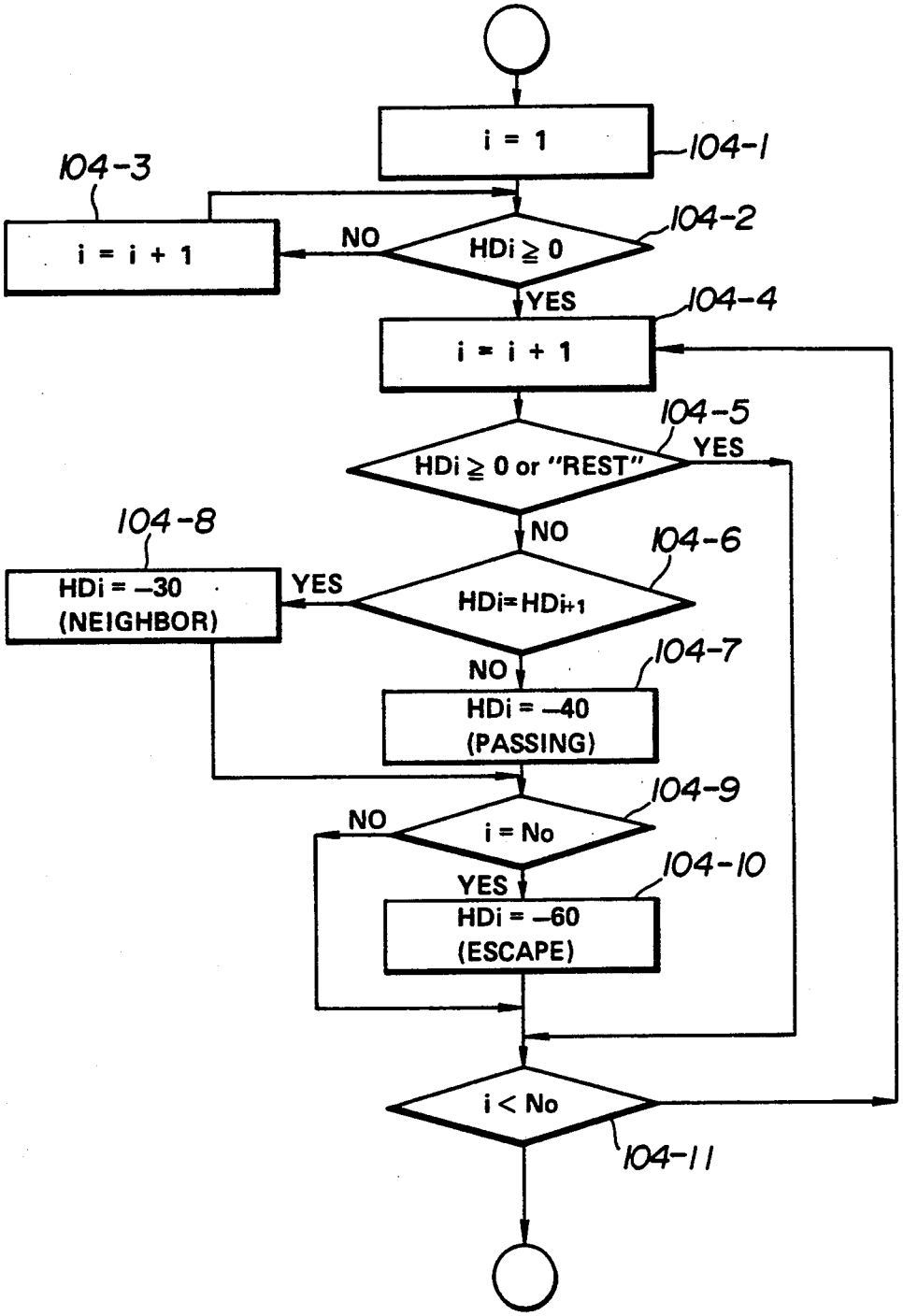
FIG. 104 is a flowchart of classification of nonharmonic tones.
Figure 105A:
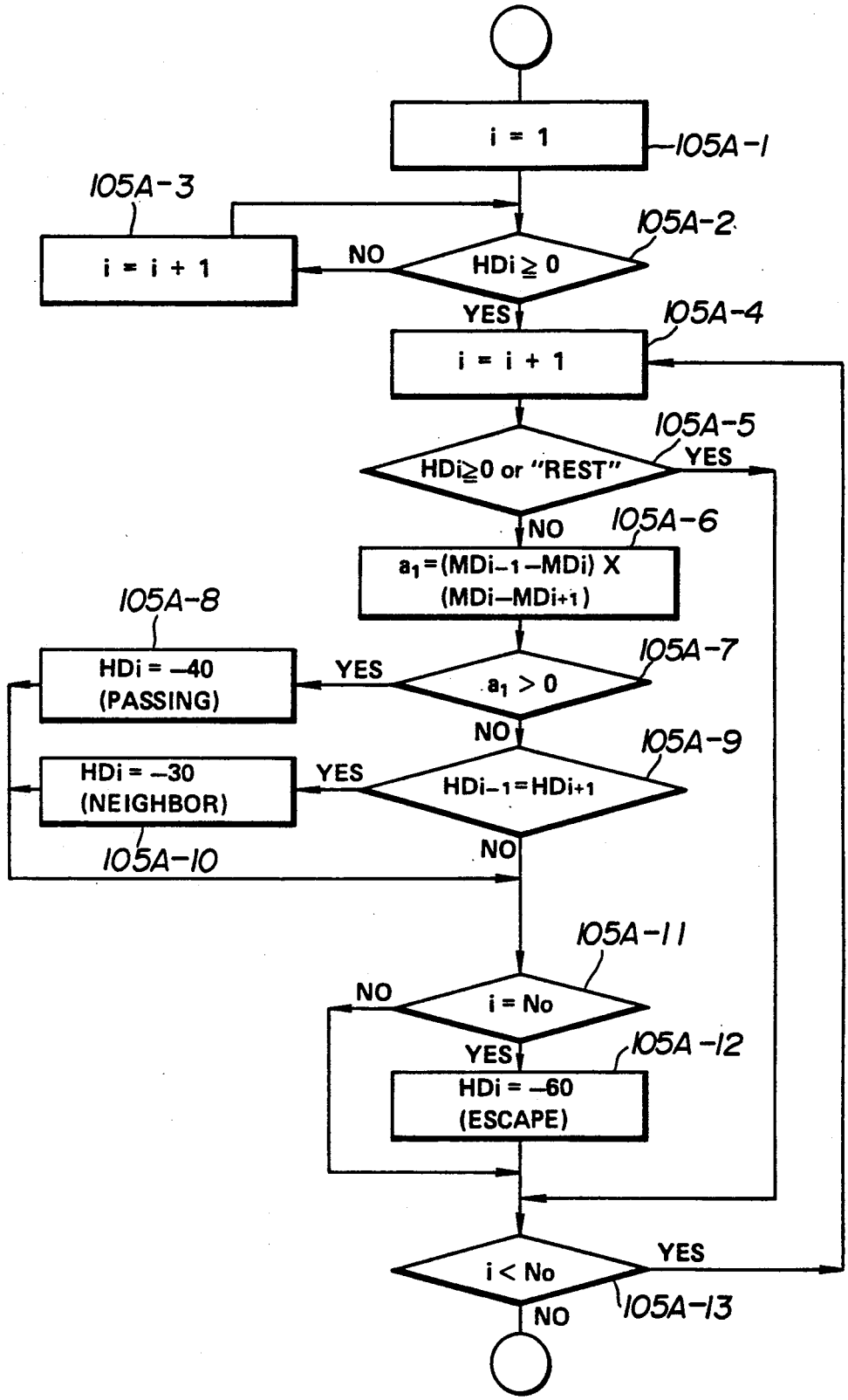
FIG. 105A is a flowchart of classification of nonharmonic tones.
Figure 105B:
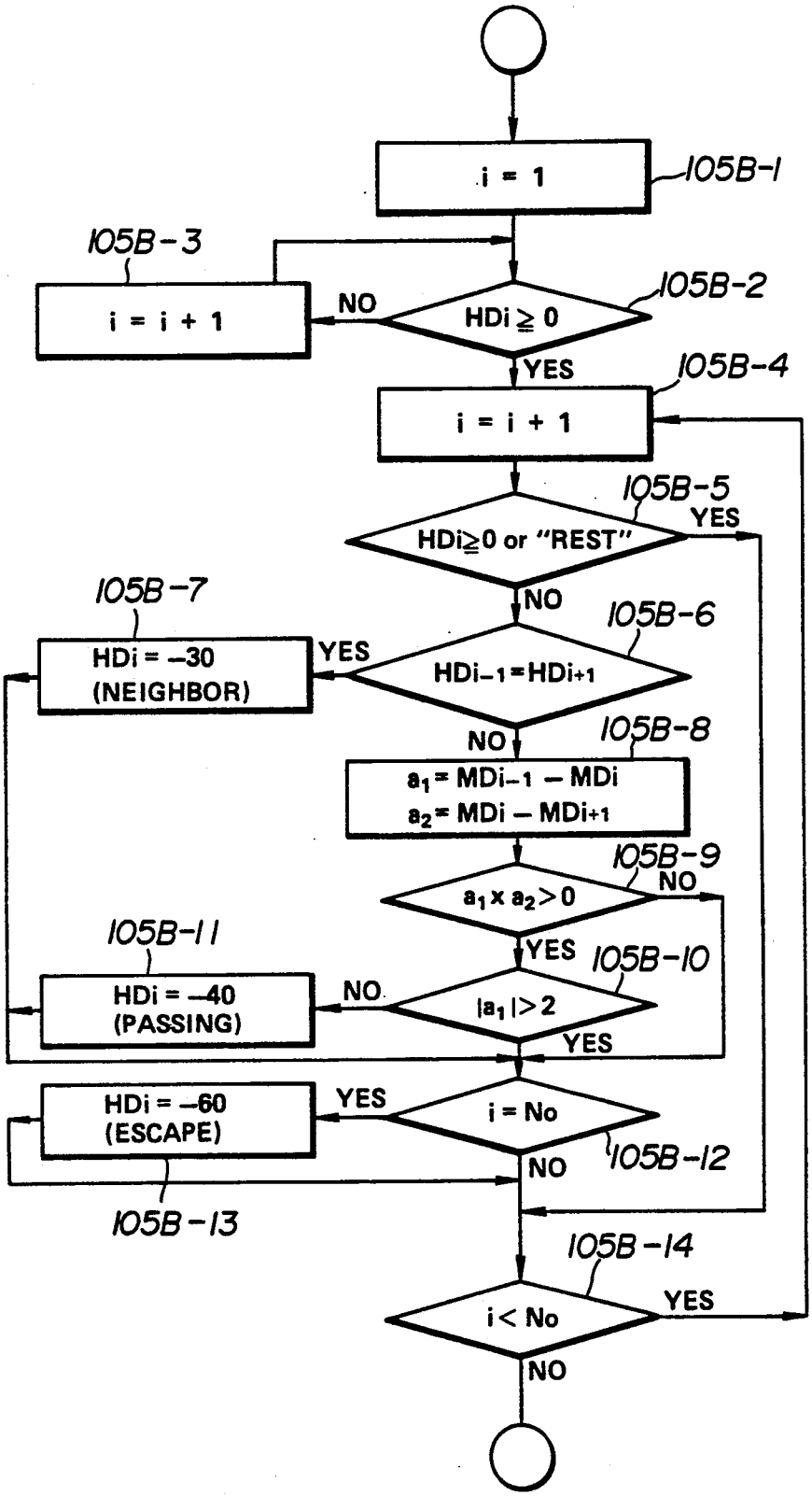
FIG. 105B is a flowchart of classification of nonharmonic tones.

There are several ways of classifying nonharmonic tones. FIG. 104 illustrates a flowchart in accordance with first logic of classification. FIGS. 105A and 105B are flowcharts in accordance with second and third logic of classification, respectively.

Referring first to FIG. 104, a motif note number i is initialized at 1 (104-1) and i is incremented until HDi≧0 is satisfied (104-2, 104-3). HDi≧0 indicates that the i-th note is a harmonic tone. As is foreseen from the operation of incrementing i at 104-4, the nonharmonic tone encountered in going from the first motif tone to the first harmonic tone is distinguished from the other nonharmonic tone. HDi of this nonharmonic tone exits the illustrated flow without changing the value of −20 (appoggiatura: HDi=−20).

At 105-4, check is made to see whether the note of interest is a harmonic tone or a rest. If this is the case, it is not necessary to change its HDi and the process goes to the examination of the next note. If this is not the case, the note of interest is a nonharmonic tone. At 104-6, check is made as to whether the note in front of the note of interent and the note in back of the note have the same pitch. If this is the case, the operation of HDi=−30 (neighbor) is executed (104-8), concluding that the note of interest is a neighbor tone. If this is not the case, the operation of HDi=−40 (passing) is executed (104-7), concluding that the note of interest is a passing tone.

If the note of interest is a nonharmonic tone and is the last tone as well, i=NO is satisfied at the check 104-9. This nonharmonic tone is viewed as an except tone so that the operation of HDi=−60 is executed at 104-10. If i<N0 is satisfied at 104-11, there still remains notes to be classified and the process returns to $i=i+1$ (104-4) for the analysis of the next note.

The terms of the four different nonharmonic identification values of HDi, "appoggiatura", "passing", "neighbor" and "passing" are merely for the sake of description. This is also applied to FIGS. 105A and 105B.

The classification of nonharmonic tones shown in FIG. 105A is identical with that shown in FIG. 104 except the addition of the process shown at 105A-6 and 105A-7. The following operation is executed at 105A-6:

$$al=(MDi-1-MDi)\times(MDi-MDi+1)$$

This is a product of the intervals formed among three successive tones.

Hence, if al is positive, the three tones change (increase or decrease) in pitch monotonously. This check is done at 105A-7, and if affirmative, HDi is set as −40, thus concluding that the note is a passing tone.

FIG. 105B is a flowchart of classifying nonharmonic tones in accordance with the third logic. As is seen from the comparison of FIG. 105B with FIG. 104, additional knowledge (check item) about passing is provided and condition to lead to the conclusion of appossiatura is slightly modified.

Specifically, if three successive tones (MDi−1, MDi and MDi+1) with a nonharmonic tone (HDi) in the middle change in pitch monotonously (see 105B-6, 105B-8 and 105B-9) and if the interval between the nonharmonic tone and its preceding tone is equal to a whole step or a half step (105B-10), then it is concluded that the nonharmonic tone (HDi) is a passing tone (HDi=−40). If this condition of passing is not satisfied, it is decided that the nonharmonic tone is an appoggiatura tone. To be strict, if the nonharmonic tone fails to satisfy the condition of neighbor, shown at 105B-6, the condition of passing shown at 105B-8 to 105B-11, or the condition of escape at 105B-12, it is concluded that the nonharmonic tone is an appoggiatura tone, with HDi remaining −20.

The above mentioned technique of extracting and classifying nonharmonic tones may be readily applied to a melody analyzer for automatically providing a harmony evaluation of melodic lines without requiring any substantial modification. Through the use of such a melody analyzer, the user may develop ability of pattern recognition of a variety of melodic lines in an effective manner. Further, it is expected that the user's skill to fit chords to melodies is acquired in a relatively short time.

AUTOMATIC MOTIF GENERATION TYPE

In the first and second embodiments, it is assumed that motif is provided by the user.

In accordance with the present invention, there is further provided an automatic composer which automatically generates motif as well as melody. An embodiment will now be described.

Figure 106:
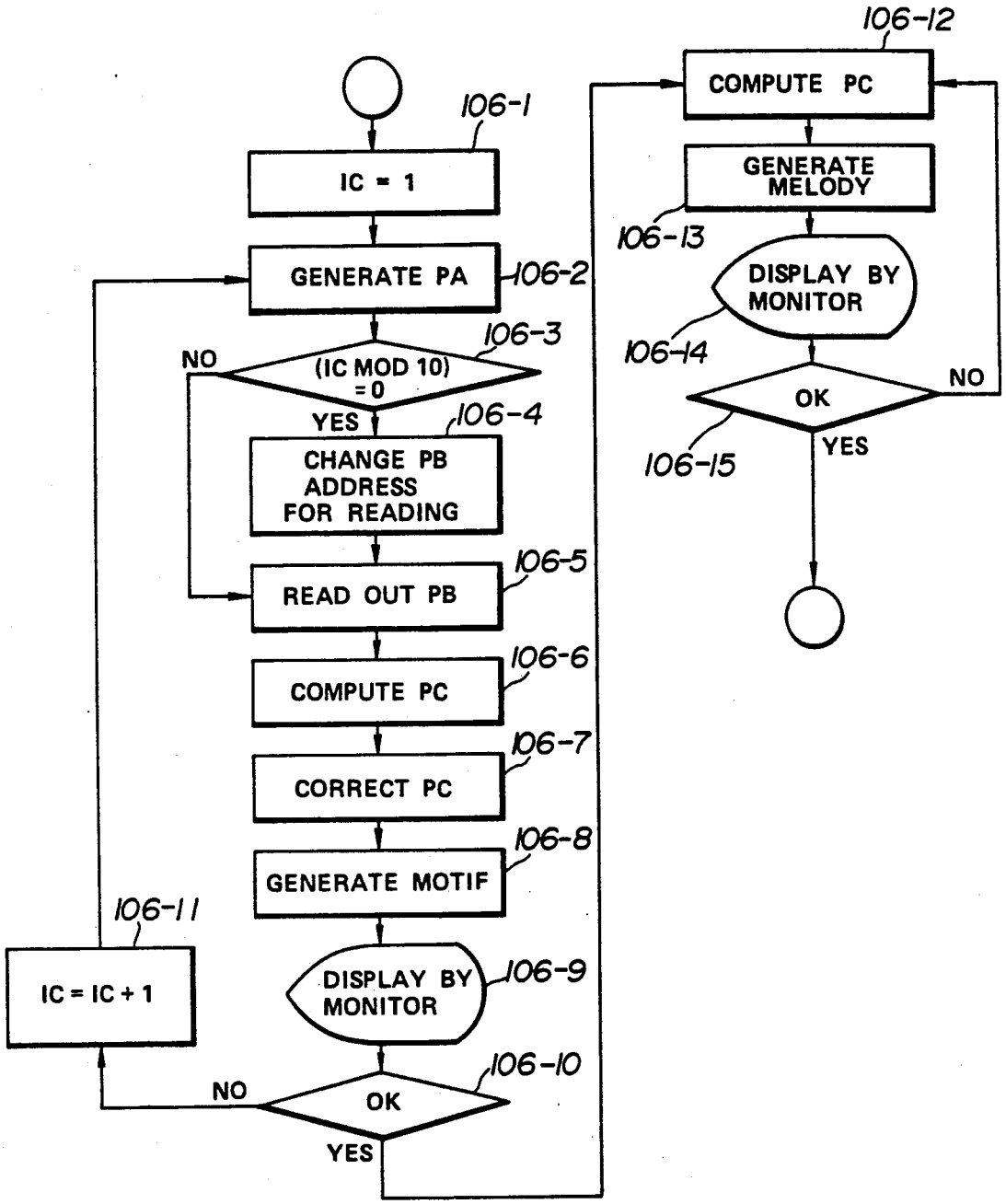
FIG. 106 is a general flowchart of music composition in a further modified automatic composer.

FIG. 106 illustrates a general flow of music composition by an automatic composer of automatic motif generation type. In the flow, it is assumed that the motif forms the opening part of a music piece and has a length of one measure. Also assumed is that before entering the illustrated flow, musical form data to be read from the musical form data memory 108 (FIG. 37) have been selected, parameters B to be read from the parameter B memory 107 have been specified and chord progression to be read from the chord progression memory 103 has been determined. It is also supposed that in the flow, parameters B can be changed but musical form data is not changed: the change of musical form data occurs in a different process.

In the first column of the flow at 106-1 to 106-11, a motif is generated and concluded by means of interaction or conversation with the user. In the second column of the flow at 106-12 to 106-15, melodies following the motif are successively generated and concluded by means of interaction with the user. IC in FIG. 106 denotes a counter which counts the number of the user's negative answers to the generation result. At 106-2, parameters A (PA) are generated at random under a predetermined restrictive condition. As is seen from 106-10, 106-11, 106-3, 106-4, when the user's negative answers repeat too many times (as many as ten times in FIG. 106), PB data controlling the structures of music are completely replaced. In the other cases, the scope of the variation in composition in response to the user's negative answer is basically determined by the range of PA generated at random (106-2). At 106-6, parameters PC are computed from the variables at PA, PB (the data read from the memory 107 in FIG. 37), SB (the data read from the memory 108 and decoded) and the measure number. At 106-8, the parameters PC are converted into a sequence of tone pitches and a sequence of tone durations, thus forming actual motif data. At 106-9, the generated motif data are output by the monitor 114 to allow the user to judge the result. This is done by emitting physical tones by means of the tone forming circuit 114 and the sound system 118 or by visually displaying the score by means of CRT 115. At 106-10, the user's answer input by the input device 101 is checked. When the user says O.K., the motif is concluded and the process of generating melodies following the motif as shown in the right column will start.

In the flow, the PC computation at 106-6 is essentially identical with the PC computation at 106-12. Similarly, the process of generating a motif at 106-8 is essentially identical with the process of generating a melody at 106-13. The overall process of generating melodies shown in the right column is a mere example, however. For example, instead of outputting the melody data (106-14) each time one measure melody is generated, the monitor may provide the output after one phrase melody has been completed. During the melody generation processing, PB may be replaced by completely new ones where necessary, as in the motif generation.

The process of correcting PC in the first column at 106-7 is based on the assumption as stated that the motif is the first measure melody of music. Among parameters PC, there are parameters which commands the melody generation execution means such that the features of the current measure have a specific relationship in melody to those of the preceding measure: such parameters are corrected to inhibiting values because the first measure of a music piece obviously does not have any preceding measure. It is also preferred that PC values are regulated to avoid the occurrence of a meaningless motif.

The generation of parameters A will now be described in detail.

GENERATION OF PARAMETERS A

Figure 107:
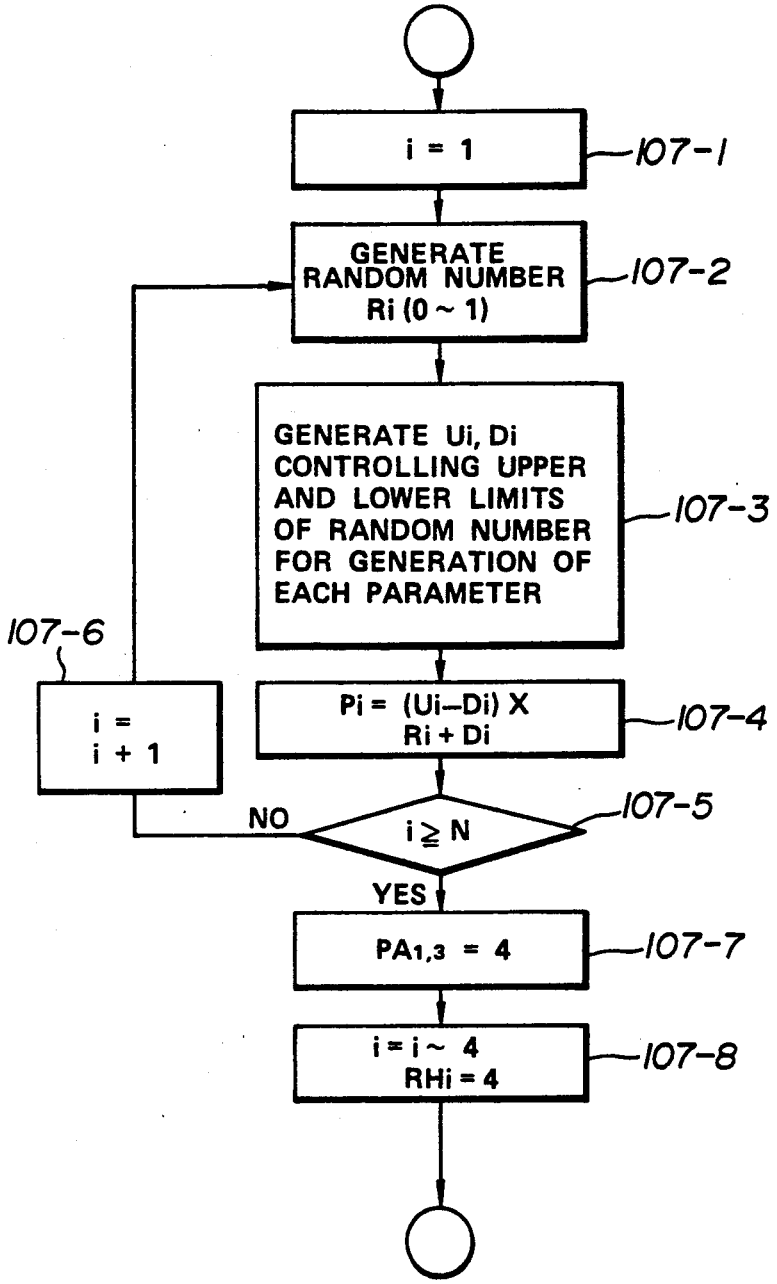
FIG. 107 is a flowchart illustrating the details of generation of PA in FIG. 106.

The generation of parameters A at 106-2 in FIG. 106 is an at-random one. The details thereof are illustrated in FIG. 107.

Parameters A (PA) are parameters inherent in a motif in the sense that they would be obtained by evaluating the motif. In the following PC computation, parameters PA are typically used as static components of PC. In this case, parameters PA serve to define static characteristics of a music piece independent from the progression of music.

The following is an example of a set of parameters:

PA1,2; Smoothness parameter. This is a degree of smoothness in going from one harmonic tone to another in arpeggio pattern.

PA1,6; This is a same pitch motion parameter indicative of a degree of a succession of harmonic tones having the same pitch.

PA2,2; Parameter of the weight of appoggiatura. This indicates the likelihood of appoggiatura appearing in motif.

PA3,2; This is a parameter of the weight of passing.

PA3,3; This is a parameter to control the shortest tone duration.

PA4,4; This parameter indicates the likelihood of neighbor appearing in motif.

PA6,1; This parameter indicates a characteristic rhythm.

PA1,3; This parameter indicates a number of harmonic tones.

RHi; This is an initial pattern of motif (arpeggio) tone durations.

At 107-1 to 107-5 in the flow in FIG. 107, the above-mentioned seven parameters PA1,2 to PA6,1 are generated at random. To avoid the creation of an awful motif, the random numbers are restricted. According to the flow, for each parameter A, there are provided an upper limit Ui and a lower limit Di to control the value of each parameter Pi between the limits. For example, parameters A are selected at random from the following limitations:

PA1,2=1 to 4, PA1,6=1 to 4, PA2,2=0 to 4, PA3,2=0 to 4, PA3,3=2 or 1, PA4,4=0 to 4, and PA6,1=0 to 4.

At 107-7, the number of arpeggio tones PA1,3 is determined. At 107-8, the pattern of arpeggio tone durations {RHi} is determined.

The flow in FIG. 107 is a merely exemplified flow of generating parameters PA. For example, the technique of developing a controlled tone duration pattern using a pulse scale as stated may be used here to generate the pattern of the arpeggio tone duration.

The present embodiment has an advantage that it does not need the motif analyzer means (such as the elements F1 and F2 in FIG. 1 and the elements F10 in FIG. 38), thus simplifying the construction of automatic composer. Further, the present automatic composer does not need any motif provided outside of the automatic composer and instead generates internally a motif in a similar manner to the generation of melody. Therefore, no technical knowledge about music is required on the part of the user.

OTHER MODIFICATIONS AND APPLICATIONS

While several embodiments of the present invention have been described, various modifications, improvements and applications can be easily made by a person having an ordinary skill in the art without departing from the scope of the present invention. Regarding rhythm, for example, the mini-pattern means (comprising means for extracting a mini-pattern characterizing the rhythm of motif and means for incorporating the mini-pattern into the sequence of melody tone durations based on the result of the extraction), the pulse scale means (such as means for disjoining and joining notes using a pulse scale, means for evaluating the rhythm of motif using a pulse scale and means operable based on the result of the evaluation of developing a controlled sequence of tone durations) may be employed either in combination or separately.

Regarding the generation of melody tone pitches, the above-mentioned embodiments employs an approach in which arpeggio tones constitute fundamentals of melody. This is not necessarily requisite however. It is possible to generate a melody based on a note scale and such techniques are partly known in the art. For example, to generate a sequence of melody tone pitches, a note scale is selected and tone pitches are successively determined based on 1/F noise using the selected note scale. In the alternative, specifying a note scale and using a frequency table representing a Markov model in which a tone pitch is greatly influenced by its immediately preceding tone pitch, a sequence of tone pitches may be generated.

Regarding the melody control information generation means, the present invention might employ means which generates control information (melody planning information), taking account of the interactions among the respective elements of melody.

The pulse scale means may be applied to a rhythm machine which generates a rhythm only. Such a rhythm machine may form a variation of the given motif rhythm. The pulse scale means may also be applied to an apparatus which provides an automatic analysis of the rhythmic characteristics of melody. Further, the pulse scale means may be applied to an apparatus which modifies the rhythmic characterizes of a completed music piece.

Therefore, it is intended that the scope of the present invention be limited only by the appended claims.

What is claimed is:

1. A rhythm machine for automatically forming a rhythm pattern, comprising:

reference rhythm source means for providing a reference rhythm pattern representing a sequence of a plurality of tone durations;

pulse scale source means for providing a pulse scale of pulse points having weights for joining or disjoining tone durations depending on their positions; and means for modifying said reference rhythm pattern by executing one of joining or disjoining tone durations in accordance with said pulse scale.

2. An automatic composer comprising:

input means for inputting a portion of a musical piece for composing an entire musical piece;

parameter extraction means for extracting, from said inputted portion of a musical piece, featuring parameters characterizing said inputted portion; and music composing means for forming the entire musical piece in accordance with at least said featuring parameters extracted by said parameter execution means.

3. An automatic composer as claimed in claim 2, further comprising progression-providing means for providing a progression of music, and wherein said music composing means includes means for receiving said progression of music from said progression-providing means and for composing the entire musical piece in accordance with said featuring parameters and said progression of music.

4. An automatic composer as claimed in claim 2, wherein said parameter extraction means includes means for extracting said featuring parameters in accordance with at least one of a sequence of tone pitches and a sequence of tone durations, said sequences defining said inputted portion of a musical piece.

5. An automatic composer comprising:

parameter generating means for generating featuring parameters characterizing a portion of a musical piece for composing an entire musical piece, in accordance with a user's command;

progression-providing means for providing a progression of music; and music forming means for forming the entire musical piece in accordance with said featuring parameters provided by said parameter generating means and said progression of music provided by said progression-providing means.

6. An automatic composer as claimed in claim 5, wherein said progression-providing means includes means for providing a chord progression as said progression of music.

7. An automatic composer as claimed in claim 6, wherein said music forming means includes arpeggio generating means for generating arpeggios in accordance with said chord progression; and nonharmonic tone imparting means for imparting at least one nonharmonic tone before, after an arpeggio and/or between arpeggios, whereby a generated melody is formed by said arpeggios and said nonharmonic tones.

* * * * *